US011613869B2

(12) United States Patent
Robson

(10) Patent No.: US 11,613,869 B2
(45) **Date of Patent: *Mar. 28, 2023**

(54) RECIPROCATING IMPACT HAMMER

(71) Applicant: Terminator IP Limited, Matamata (NZ)

(72) Inventor: Angus Robson, Matamata (NZ)

(73) Assignee: Terminator IP Limited, Matamata (NZ)

( * ) Notice: Subject to any disclaimer, the term of this patent is extended or adjusted under 35 U.S.C. 154(b) by 9 days.

This patent is subject to a terminal disclaimer.

(21) Appl. No.: 17/321,795

(22) Filed: May 17, 2021

(65) Prior Publication Data

US 2021/0340722 A1 Nov. 4, 2021

Related U.S. Application Data

(63) Continuation-in-part of application No. 15/765,975, filed as application No. PCT/NZ2016/050164 on Oct. 5, 2016, now Pat. No. 11,008,730.

(30) Foreign Application Priority Data

Oct. 5, 2015 (NZ) ..... 712986

(51) Int. Cl.
*E02F 9/22* (2006.01)
*E02F 3/96* (2006.01)
*E02F 5/30* (2006.01)

(52) U.S. Cl.
CPC ..... *E02F 3/966* (2013.01); *E02F 5/305* (2013.01); *E02F 9/22* (2013.01)

(58) Field of Classification Search
CPC ..... E02F 3/966; E02F 5/305; E02F 9/22; B28D 1/26; B25D 2250/035; B25D 11/125; B23Q 5/027
See application file for complete search history.

(56) References Cited

U.S. PATENT DOCUMENTS 4,383,363 A 5/1983 Hayakawa et al.
4,741,404 A * 5/1988 Oyama ..... B25D 17/245 173/17
4,828,046 A * 5/1989 Pyatov ..... B23Q 5/033 60/542
4,932,479 A * 6/1990 Pyatov ..... B25D 11/125 60/542
5,363,835 A 11/1994 Robson
(Continued)

*Primary Examiner* — Thomas M Wittenschlaeger
(74) *Attorney, Agent, or Firm* — Gardner Linn

(57) ABSTRACT

An impact hammer for breaking a working surface, the hammer including a drive mechanism and a housing with an inner containment surface and a reciprocating hammer weight. A reciprocation cycle of the hammer weight includes an upstroke and a down-stroke, the hammer weight respectively moving upwards and downwards. On the down-stroke the hammer weight impacts a striker pin with a driven end and a working surface impact end. A vacuum chamber in the housing is formed by the containment surface, upper vacuum sealing coupled to the hammer weight and lower vacuum sealing. The hammer weight is driven toward the striker pin by the pressure differential between atmosphere and the vacuum chamber formed on the upstroke. A down-stroke vent permits fluid egress from the vacuum chamber on the down-stroke.

20 Claims, 54 Drawing Sheets

(56) References Cited

U.S. PATENT DOCUMENTS

| | | | | |
|---|---|---|---|---|
| 6,523,622 | B1 * | 2/2003 | Berger | B25D 11/005 173/132 |
| 7,331,405 | B2 | 2/2008 | Robson | |
| 7,407,017 | B2 | 8/2008 | Robson | |
| 7,980,240 | B2 | 7/2011 | Robson | |
| 8,037,946 | B2 | 10/2011 | Robson | |
| 8,181,716 | B2 * | 5/2012 | Robson | B25D 17/08 173/90 |
| 8,733,610 | B2 * | 5/2014 | Pedicini | B25C 1/06 227/8 |
| 8,939,341 | B2 * | 1/2015 | Pedicini | B25C 1/06 227/8 |
| 9,044,847 | B2 * | 6/2015 | Kohlschmied | B25D 11/005 |
| 9,278,433 | B2 | 3/2016 | Robson | |
| 9,278,443 | B2 * | 3/2016 | Robson | B25D 17/24 |
| 9,636,812 | B2 * | 5/2017 | Pedicini | B25C 1/041 |
| 9,656,377 | B2 * | 5/2017 | Moore | B25D 9/18 |
| 9,790,962 | B2 * | 10/2017 | Robson | E02F 3/966 |
| 9,821,447 | B2 * | 11/2017 | Robson | B32B 15/18 |
| 11,008,730 | B2 * | 5/2021 | Robson | E02F 3/966 |
| 2021/0340722 | A1 * | 11/2021 | Robson | E02F 3/966 |

* cited by examiner

Fig. 33a
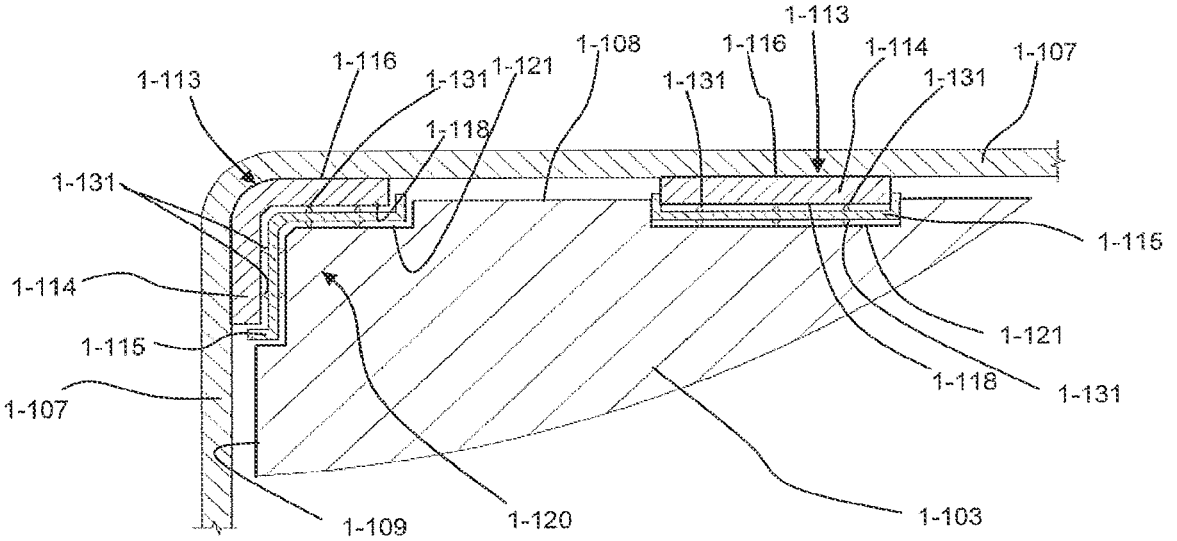
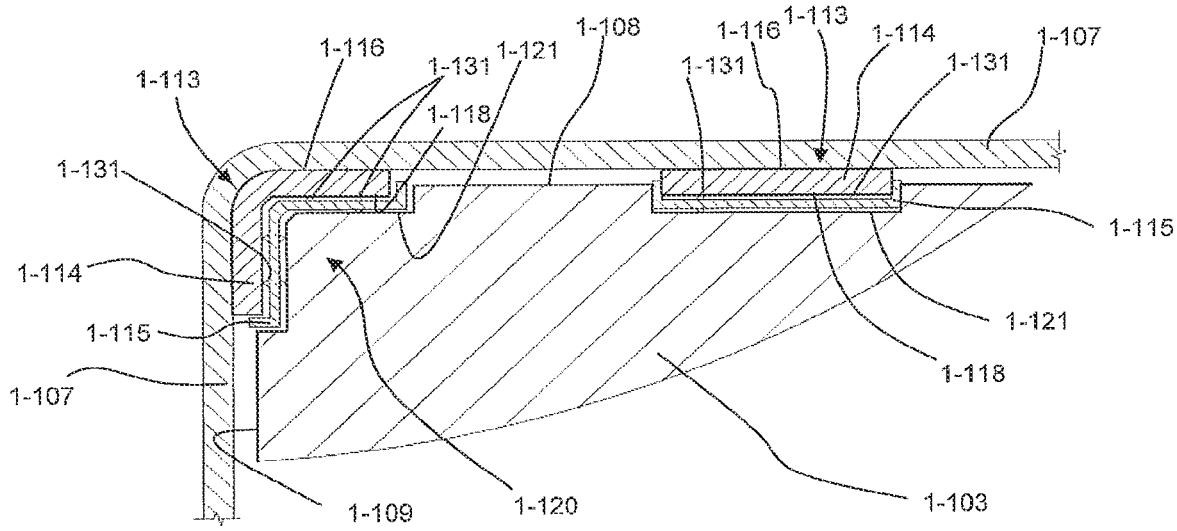
Fig. 33b

Fig. 34a
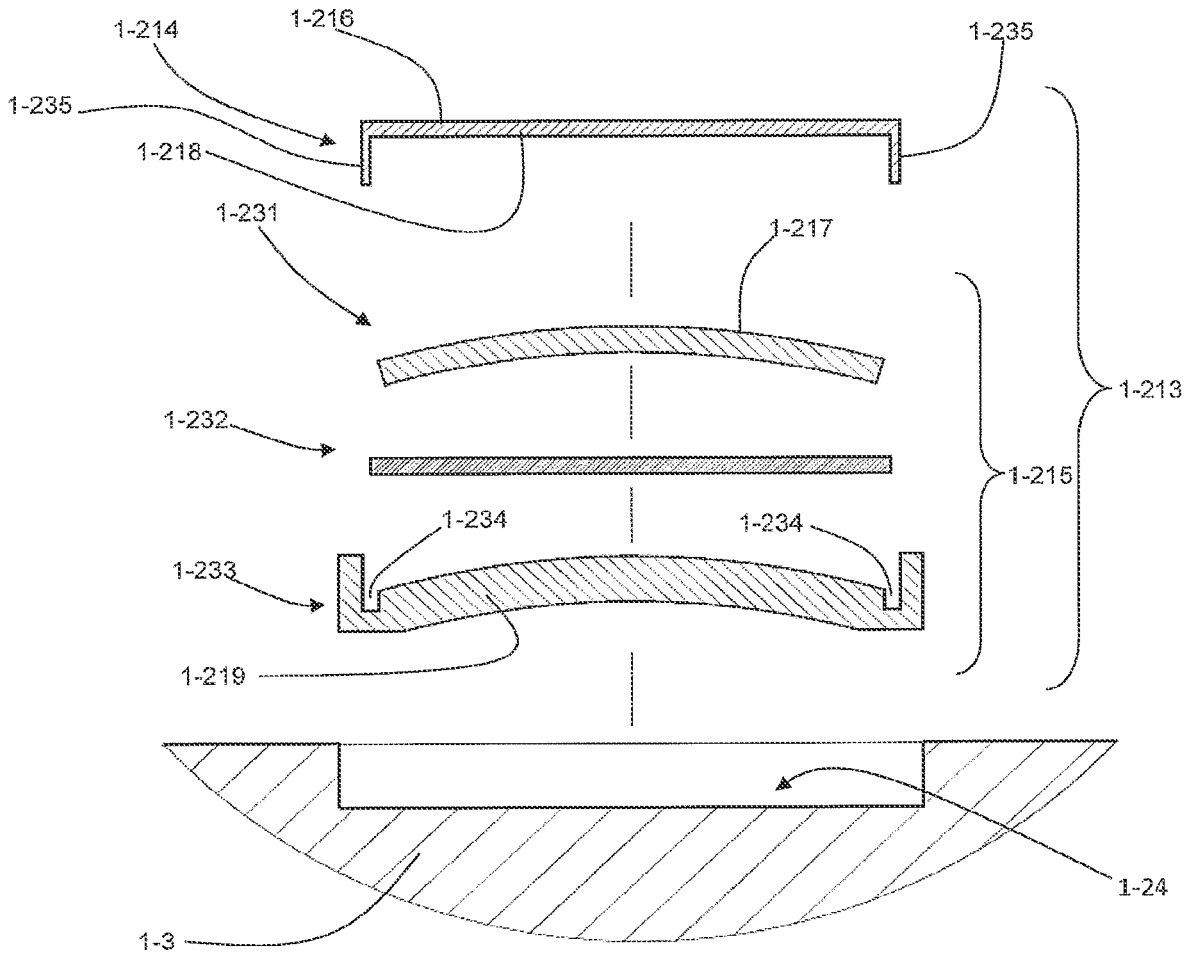
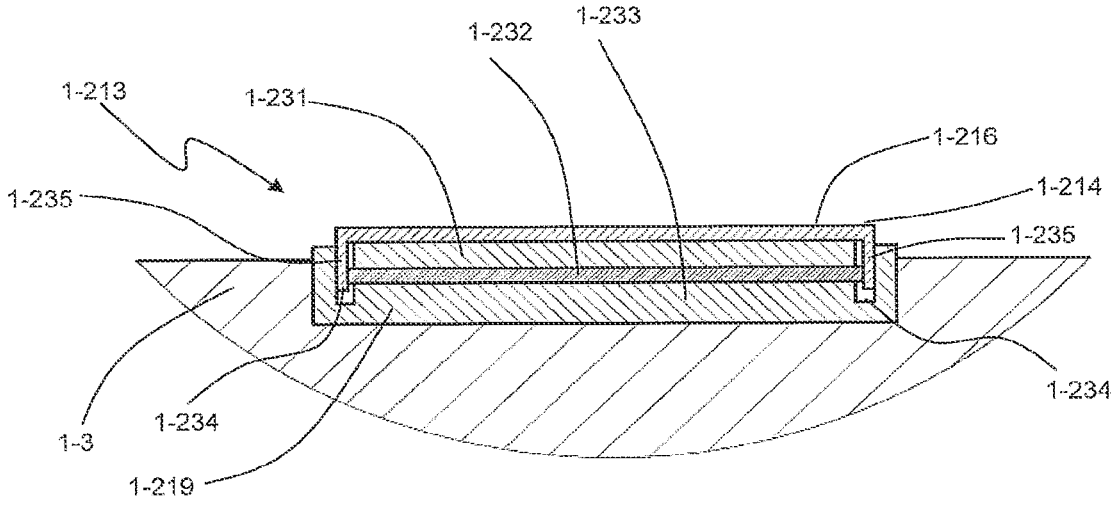
Fig. 34b

RECIPROCATING IMPACT HAMMER

TECHNICAL FIELD

The present invention relates to a means for driving apparatus including impact hammers, drop hammers and other breaking apparatus in which impact power is derived from reciprocating a mass. More particularly, the present invention relates to a vacuum-assisted reciprocating impact hammer.

BACKGROUND ART

Gravity impact hammers are primarily designed for surface breaking of exposed rock, concrete or other material and generally consist of a mass capable of being raised to a height within a housing or guide before release. The mass falls under gravity to strike a surface to be broken, either directly (thus protruding through an aperture in the hammer housing) or indirectly via a striker pin.

The present invention is discussed herein with respect to rock breaking devices invented by the present inventor including the devices described in U.S. Pat. Nos. 5,363,835, 8,037,946, 7,980,240, 8,181,716 and PCT publication number WO2014/013466. These publications describe a rock-breaking hammer with a mass capable of being raised to a height within a housing before release to drop and impact one end of a 'striker pin' or other tool which transmits the force to the rock or item to be broken.

U.S. Pat. Nos. 7,407,017, 7,331,405 and 4,383,363, also by the present inventor, respectively feature an impact hammer lock, drive mechanism and rock breaking apparatus for a driven hammer which comprises a unitary weight within a housing that is raised and dropped to impact a surface with additional impetus added by a drive-down mechanism.

The term gravity drop hammer or impact hammer is thus used herein to encompass powered impact hammers in addition to those powered solely by gravity. The aforementioned references are incorporated herein by reference.

The present inventor was able to improve the performance of the above-referenced impact hammers through use of the 'cushioning slides' described in PCT publication number WO2014/013466. The cushioning slides were fitted in the hammer between the mass and housing and include a low-friction outer layer contacting the housing inner walls and cushioning inner layer against the mass.

The aforementioned cushioning slides have been found to reduce frictional losses, enable the hammer drive mechanism to lift a heavier mass and, in the case of a drive down hammer, drive the weight downwards with reduced friction, with a commensurate improvement in impact energy.

Moreover, the reduction in shock load applied to the apparatus because of the shock absorbing inner layer enables either an extension in the working life of the apparatus or the ability to manufacture a housing with a lighter, cheaper construction. The use of the aforementioned cushioning slide also enables apparatus to be manufactured to wider tolerances, thereby reducing costs further. It may thus be desirable to incorporate the advantages of the cushioning slides in a vacuum driven impact hammer.

Impact hammers such as gravity drop hammers (as described in the applicant's own prior U.S. Pat. Nos. 5,363,835, 8,037,946 and 7,980,240) are primarily utilised for breaking exposed surface rock. These hammers generally consist of a striker pin which extends outside a nose cone positioned at the end of a housing which contains a heavy hammer weight. In use, the lower end of the striker pin is placed on a rock and the hammer weight subsequently allowed to fall under gravity from a raised position to impact onto the upper end of the striker pin, which in turn transfers the impact forces to the rock.

The term 'striker pin' refers to any elements acting as a conduit to transfer the kinetic energy of the moving mass to the rock or working surface. Preferably, the striker pin comprises an elongate element with two opposed ends, one end (generally located internally in the housing) being the driving end which is driven by impulse provided by collisions from the hammer weight, the other end being an impact end (external to the housing) which is placed on the working surface to be impacted. The striker pin may be configured to be any suitable shape or size.

Elevated stress levels are generated throughout the entire hammer apparatus and associated supporting machinery (e.g. an excavator, known as a carrier) by the high impact forces associated with such breaking actions. U.S. Pat. No. 5,363,835 discloses an apparatus for mitigating the impact forces from such operations by using a unitary shock absorbing means in conjunction with a retainer supporting a striker pin within the nose cone. It is thus desirable to incorporate the advantages of such shock absorbers in a vacuum-assisted impact hammer.

Accumulators are well known apparatus used in a variety of engineering fields as a means by which energy can be stored and are sometimes used to convert a small continuous power source into a short surge of energy or vice versa. Accumulators may be electrical, fluidic or mechanical and may take the form of a rechargeable battery or a hydraulic accumulator, capacitor, compulsator, steam accumulator, wave energy machine, pumped-storage hydroelectric plant or the like.

Hydraulic accumulators are produced in numerous forms including piston accumulators, bladder accumulators, diaphragm accumulators, weighted and spring-loaded accumulators. One of the primary tasks of hydraulic accumulators is to hold specific volumes of pressurized fluids of a hydraulic system and to return them to the system on demand. However, hydraulic accumulators may also be configured to perform a plurality of tasks including, energy storage, impact, vibration and pulsation damping, energy recovery, volumetric flow compensation, and the like.

Most accumulators are primarily directed at improving consistency of power output by taking some of the peak power of a cyclic operation and re-introducing it into portions of the cycle with a lower-power availability. However, this does not assist in cyclic operations with the converse requirements, i.e. cyclic operations with non-constant power requirements. In particular, most accumulators do not assist in cyclic operations such as impact hammers where there may be unutilised available power during portions of the cycle, whilst additional power is highly desirable at other portions of the cycle. PCT publication no WO/2013/054262 by the present inventor describes an accumulator designed to store excess available energy on one part of the impact hammer's cycle and release on the down-stroke of the impact hammer, greatly increasing the force applied.

It would be desirable to utilise the performance benefits of a vacuum assistance system in an impact hammer and in conjunction with one or more of the features in the aforementioned referenced publications.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DESCRIPTION OF THE PREFERRED EMBODIMENTS

The present invention provides an apparatus including a reciprocating component movable along a reciprocation path, said reciprocating component configured and orientated to come into at least partial sealing contact with a containment surface of said apparatus during said reciprocating movement of the component.

Such an apparatus including a reciprocating component may take many forms and the present invention is not limited to any individual configuration. Examples of such apparatus include mechanical impact hammers, gravity drop hammers, powered drop hammers, jack hammers, pile-drivers, rock-breakers, and the like.

As used herein, the term 'reciprocating' includes, any operating cycle of the apparatus whereby during operation of the apparatus, the reciprocating component repeatedly moves along the same path, including linear, non-linear, interrupted, orbital and irregular paths and any combination of same.

As used herein, the term 'partial contact' includes intermittent, continuous, interrupted, instantaneous, partial, infrequent, periodic, and irregular contact with the containment surface with respect to time and/or distance and any combination of same.

As used herein, the term 'containment surface' includes any structure, surface, object or the like that is positioned so as to come into at least partial contact with the reciprocating component, parts thereof or attachments thereto, during operation of the apparatus.

As used herein, the term 'working surface' includes any surface, material or object subject to impacting, contact, manipulation or movement by the apparatus. In many embodiments disclosed herein the working surface will typically comprise rock, steel, concrete or other material to be broken.

As used herein, the term 'atmosphere' and 'atmospheric' denotes, or pertains to, the gaseous mass or envelope surrounding the apparatus, wherein said gaseous mass includes fluids.

As used herein, the term 'vacuum' includes any sub-atmospheric pressure, i.e. having a fluid pressure less than the atmosphere. Thus, reference to 'vacuum' should not be interpreted to require an absolute vacuum.

As used herein the term 'vent' includes any feature, mechanism or system for permitting passage of fluid therethrough, whether passively or actively.

As used herein the term 'valve' includes any vent that can be configured to selectively prevent passage of fluid therethrough.

As used herein, the term 'vacuum sealing' refers to a sealing between at least two surfaces capable of mutual relative movement and includes any flexible, variable and/or slideable seals capable of maintaining an at least partial seal between said surfaces during said relative movement.

As used herein, the term 'drive mechanism' includes any mechanism used to move the reciprocating component away from the working surface, including elevating the reciprocating component against the effects of gravity, and also includes any drive-down mechanism used to drive the reciprocating component towards the working surface including descending the reciprocating component in combination with the effects of gravity, either as a separate drive or as an integral part of the elevating drive mechanism. The drive mechanism may take any convenient form such as a hydraulic ram or a rotating chain drive or the like. A chain drive drive-down mechanism is herein considered in more detail for exemplary purposes though it will be understood that this is in no way limiting.

The present invention is particularly suited for use with a mechanical impact hammer and for the sake of clarity and to further reduce prolixity the present invention will herein be described with respect to use with same. It will be understood however that this is exemplary only and the present invention is not necessarily limited to same.

Typically, gravity impact hammers cyclically lift and drop a reciprocating component provided in the form of a large weight to crush rocks concrete, stones, metal, asphalt and the like, where the weight is lifted by a powered drive mechanism of some form (e.g. hydraulic) and falls freely under gravity. In a development of such gravity impact hammers, the present inventor devised a powered impact hammer (as described in U.S. Pat. No. 7,331,405 and incorporated herein by reference) where the weight is actively driven downwards to impact the surface.

Reference herein to weight, hammer weight, impact mass or similar should be understood to also refer to a 'reciprocating component'.

In some embodiments, the term 'hammer weight' may also include any component, item or intermediary element attached, coupled, connected or otherwise engaged with the hammer weight to move with the hammer weight during the reciprocation cycle.

Although hammers may be formed in any shape, including irregular rectangular, square or circular in lateral cross section, they are typically vertically elongate and are raised and lowered about a linear impact axis.

The weight itself may be formed directly as a hammer whereby one or more distal ends of the weight are formed with tool ends shaped to strike the working surface. Alternatively, the weight may simply be formed as a block of any convenient shape which falls onto a striker pin on the down-stroke which in-turn strikes the working surface (as described in the inventor's prior publications U.S. Pat. Nos. 5,363,835, 7,980,240, 8,037,946 and 8,181,716 incorporated herein by reference).

The weight is at least partially located in, and operates in, a housing which protects vulnerable portions of the apparatus and reduces debris ingress from the impacting operations from fouling the apparatus. The housing also acts as a guide to ensure the path of the weight during the lift or descent stroke remains laterally constrained to prevent damaging the apparatus and/or causing instability. Ideally, the weight would travel upwards and downwards without touching the interior sides of the housing, thereby avoiding any detrimental friction.

In practice, the impacting operations are undertaken at a wide variety of inclinations and are seldom perfectly vertical. Moreover, the nature of the working surface may result in multiple impacts before fracture occurs, and thus the hammer or striker pin may recoil away from the unbroken working surface. The direction of the recoiling hammer/striker pin will predominantly include a lateral component, thereby bringing it into contact with the inner side walls of the housing. In one embodiment of the present invention, cushioning slides are utilised to mitigate the undesirable effects of contact between the reciprocating parts of the hammer and the containment surfaces of the housing. The configuration and implementation of cushioning slides is considered in greater detail later.

To facilitate clarity, the orientation of the present invention and its constituents is referred to with respect to use of the apparatus operating with said reciprocating component moving along said reciprocation path about a substantially vertical reciprocation axis, and thereby denoting the descriptors 'lower' and 'upper' as comparatively referring to positions respectively closer and further from the 'working surface'. It will be appreciated however this orientation nomenclature is solely for explanatory purposes and does not in any way limit the apparatus to use in the vertical axis. Indeed, preferred embodiments of the present invention are able to operate in a wide range of orientations as discussed further subsequently.

In one embodiment, said apparatus is an impact hammer, wherein said reciprocating component is a hammer weight.

According to one aspect, the reciprocation path of the reciprocating component includes a linear impact axis. Preferably, said hammer weight has a stroke length equal to the magnitude of said reciprocation path in a constant direction along the impact axis.

In one embodiment, said apparatus includes a housing, wherein said containment surface includes an impact hammer's housing inner side walls.

According to one aspect, the present invention provides a variable volume vacuum chamber formed between the hammer weight and at least a portion of the containment surface, the vacuum chamber having a sub-atmospheric pressure in at least a portion of said reciprocating movement.

Preferably, said vacuum chamber includes at least one vent in fluid communication with said vacuum chamber.

Preferably, said vacuum chamber includes:

at least one movable vacuum piston face, and at least one vacuum chamber vacuum sealing (herein referred to as the upper vacuum sealing) between the hammer weight and at least a portion of the containment surface.

Preferably, said vacuum piston face is formed by a portion of the hammer weight.

According to alternative embodiments, said vacuum piston face may be integrally formed as part of the hammer weight, or comprise an attachment thereto. Preferably, said vacuum piston face is movable along a path parallel to, or co-axial to, said reciprocation path.

Preferably, said vacuum chamber includes:

an upper vacuum sealing between the hammer weight and the containment surface, and a lower vacuum sealing.

The position and configuration for said lower vacuum sealing is dependent on whether the impact hammer weight is configured as a weight transferring its impact energy to the working surface via a striker pin or alternatively formed with a tool end for directly striking the working surface. In the former case, the lower vacuum sealing may be formed either about a lower portion of the weight or about the striker pin assembly.

In the latter case, the lower vacuum sealing may be located between the hammer weight and the containment surface at a position below the upper vacuum sealing.

In both weight configurations, the movement between the weight and the containment surface implicitly requires that the sealing is capable of accommodating relative, sliding movement therebetween. The sealing may be fixed to the weight, striker pin assembly, containment surface or a combination of same and these variations are considered in greater detail later.

In addition, despite the differences in the above-described weight configurations possible, the same vacuum chamber configuration criteria as described above may be employed. In operation, a full reciprocation cycle of the apparatus comprises four basic stages (described more fully subsequently) consisting of: the up-stroke, upper stroke transition, down-stroke and lower stroke transition.

During these four stages, the corresponding effects in the vacuum chamber are:

up-stroke: the volume of the vacuum chamber increases, as the weight is then driven away from the working surface (i.e., for a vertically orientated impact axis, the weight is elevated) by the drive mechanism. As the vacuum chamber is sealed from air ingress by the containment surface, the surface of the weight and the upper and lower vacuum sealing, the chamber's volume expansion causes a corresponding pressure differential between the vacuum chamber and the pressure outside the vacuum chamber which is typically an atmospheric pressure of 1 bar depending on leakage through the upper and lower vacuum sealing. Notwithstanding the effects of sealing losses, the vacuum chamber pressure differential is maintained as the hammer weight travels up to the up-stroke travel limit of its reciprocation path;

upper stroke transition: at its position of maximum potential energy (i.e. the up-stroke travel limit, which would correspond to its maximum elevation for a vertical reciprocation axis), the weight is released (and notwithstanding the effects of any drive-down mechanism employed), it is impelled to travel towards the working surface under both the force of gravity and the pressure differential acting on the weight;

down-stroke: as the weight travels to the working surface/striker pin, the volume of the vacuum chamber is reduced until the weight reaches the end of the down-stroke;

lower stroke transition: the volume of the vacuum chamber is at its minimum at the instant of energy transference from the weight to the working surface with the weight at the bottom of its reciprocation cycle. The cycle is then repeated.

As indicated, the above description ignores the influence of any sealing losses which would diminish the pressure differential generated during the up-stroke by the vacuum chamber volume increase.

Thus, according to one aspect of the present invention is provided an impact hammer including:

a housing, having inner side walls;

a hammer weight movable reciprocally along a linear impact axis, said hammer weight configured and orientated to come into at least partial sealing contact with a containment surface of said impact hammer during reciprocating movement of the hammer weight, said containment surface including said housing inner side walls, and a variable volume vacuum chamber formed between the hammer weight and at least a portion of the containment surface.

Preferably, a full reciprocation cycle of the hammer weight along said linear impact axis, when orientated vertically, includes four steps consisting of:

an up-stroke, wherein said hammer weight is moved along the impact axis for a distance equal to a hammer weight up-stroke length from a lower initial position with a minimum hammer weight potential energy to an upper position at a distal end of said housing with a maximum hammer weight potential energy;

an upper stroke transition, wherein the hammer weight movement is stationary before reversing direction along the impact axis;

a down-stroke, wherein said hammer weight is moved back along the impact axis for a distance equal to a hammer weight down-stroke length from said upper position at a distal end of said housing to said lower position, and a lower stroke transition, wherein the hammer weight movement is stationary before a subsequent up-stroke.

Preferably, said hammer weight potential energy includes:

gravitational potential energy equal to the hammer weight's vertical displacement from the up-stroke start position multiplied by the force due to gravity, and vacuum chamber generated potential energy equal to a product of said vacuum piston face area and a pressure differential between the vacuum chamber and atmosphere multiplied by said hammer weight stroke length.

According to the configuration of the impact hammer, the hammer weight up-stroke length and the hammer weight down-stroke length may be equal, or differ slightly. In the latter case for example, where a striker pin is incorporated with a slideable coupling, the precise position of the hammer weight at the start of the up-stroke will depend on whether or not the operator partially forces the striker pin inside the housing.

According to one aspect, said containment surface is substantially elongate surrounding the impact axis with an upper distal end and an opposing lower distal end.

Preferably, said lower containment surface end is proximal to an attachment position for attachment of the impact hammer to a carrier.

Preferably, during said reciprocating operating cycle, at said containment surface upper and lower distal ends, the hammer weight has a maximum and a minimum potential energy respectively.

According to one aspect, said housing is substantially elongate surrounding the impact axis with an upper distal end and an opposing lower distal end.

Preferably, said lower containment surface end is proximal to an attachment position for attachment of the impact hammer to a carrier.

To fully appreciate the significance of the present invention in the field of impact hammers, it is helpful to consider the range of applicable impact hammer configurations and the consequences of their salient features.

There are two main alternative weight configurations, which are both sub-dividable into two configuration types applicable to either weight configuration category i.e., a weight configuration in which:

Case 1. the impact hammer weight itself directly forms a hammer with distal tool ends, or Case 2. the impact hammer weight is a mass which impacts onto a striker pin which in-turn impacts the working surface, In either case 1 or case 2, the down-stroke of the reciprocation cycle may be configured to:

allow the elevated weight to fall solely under gravity to transfer its kinetic energy to the working surface, or actively drive the weight towards the working surface to increase the kinetic energy transferred to the impact surface relative to that resulting solely from gravity.

Moreover, the effectiveness and efficiency of the apparatus, for each of the above-referenced hammer weight and drive mechanism configurations, is affected by the following core performance parameters, namely:

the total mass (and size) of the apparatus; —and the commensurate effects on the size and power of the carrier necessary to operate and manoeuvre the apparatus;

the impact energy required; —and the hammer mass and elevation necessary for the hammer weight to produce the required impact energy levels;

the frequency of impact energy required; —and the ability of the impact hammer to reciprocate the weight in the corresponding time frame without adverse effects on the drive mechanism and/or housing.

According to one aspect of the present invention there is provided an impact hammer for breaking a working surface, the impact hammer including:

a housing with at least one inner side wall forming at least part of a containment surface;

a drive mechanism;

a reciprocating hammer weight at least partially located in the housing, the hammer weight reciprocating along a reciprocation axis, wherein a reciprocation cycle of the hammer weight, when the reciprocation axis is orientated vertically, includes:

an up-stroke, wherein the hammer weight is moved upwards along the reciprocation axis by the drive mechanism, a down-stroke, wherein the hammer weight moves downwards along the reciprocation axis, and a striker pin having a driven end and a working surface impact end, the striker pin located in the housing such that the impact end protrudes from the housing, a shock-absorber coupled to the striker pin, a variable volume vacuum chamber including:

at least a portion of the containment surface;

at least one upper vacuum sealing coupled to the hammer weight;

at least one lower vacuum sealing;

at least one down-stroke vent, operable to permit fluid egress from the vacuum chamber during at least part of the down-stroke, the vacuum chamber having a sub-atmospheric pressure during at least part of the up-stroke, the hammer weight driven toward the striker pin by the pressure differential between atmosphere and the vacuum chamber.

In the case of a conventional gravity impact hammer, the options for improving any one of the above parameters without an adverse impact on the others is very limited. The energy yield is normally a product of the gravitational acceleration of the hammer weight and the vertical drop distance, minus any losses caused by friction, angle from vertical or drag from the lift mechanism. The impact energy delivery to the working surface is entirely provided by the kinetic energy of the weight, proportional to the product of the hammer weight's mass and the square of the velocity. Thus, the interdependency of the above parameters for existing impact hammers severely hinders any significant improvement in the total mass, impact energy or impact frequency without an adverse impact on one or both of the other two parameters.

The limitations of the parameter interdependencies for a conventional gravity impact hammer are illustrated more fully with respect to the three major performance improvements sought, i.e.:

reducing hammer weight while maintaining impact energy. To achieve a given kinetic energy using a lighter hammer weight offers the potential benefit of a correspondingly lighter impact hammer and commensurately, a potentially lighter carrier. However, this would require an increase in the stroke length (to increase the drop height) to achieve the necessary increase in the impact velocity required. There are however practical constraints on the maximum feasible weight height without adversely impacting the reciprocation period and/or the usability/maneuverability of the apparatus.

The additional drop height inevitably requires additional apparatus structure which thus adds mass to be borne by the carrier. Moreover, using a more powerful drive mechanism to maintain the same lift duration despite the increased distance inexorably increases the apparatus weight and expense. In the alternative, using a drive mechanism with the same power would cause an increase in the cycle time. Furthermore, given the hammer weight must come to a stop at the upper stroke transition before returning back on the reciprocal path, there is an unavoidable limit on the viable lift speed of the hammer weight without requiring impractically robust and increasingly massive shock absorbing buffers to decelerate the weight to a halt. Without such buffers, the height of the assembly housing must be yet further increased to allow the hammer weight to decelerate solely via the effects of gravity and the drive mechanism friction.

As already discussed, this in turn counteracts the benefit of a more powerful drive mechanism and further reduces the achievable impact frequency due to the weight's additional required travel distance. Thus, any benefit from the reduced hammer weight is counteracted by the reduced impact frequency, decreased usability/maneuverability and the other weight increases described above.

increasing impact energy without increasing hammer weight: —Without increasing the drop height (with the same attendant drawbacks outlined above), the ability to increase the impact energy of a conventional impact hammer without increasing the hammer weight is negligible.

increasing impact frequency without reducing hammer weight: —To increase the impact frequency, without reducing the hammer weight, either the drop height must be reduced or the drive mechanism lift speed increased. However, in the former case, the impact energy would correspondingly decrease. In the latter case, there would still be the difficulty of needing the hammer weight's increased speed to be halted before the down-stroke. As described above, this would require an increased drop height and/or buffers, both of which would increase the total weight.

These factors incentivise alternative methods of increasing a gravity impact hammer's weight's impact velocity. One such method utilises the drive mechanism to also apply a downward force on the down-stroke, i.e. a drive-down mechanism. A second method supplements the first method by storing any surplus unutilised power from the drive mechanism available during the up-stroke weight lifting for use on the impact down-stroke. These methods both provide the ability to advantageously alter one or more of the impact hammer parameters including: reducing hammer weight, reducing elevation height, increasing impact energy, or reducing reciprocation period.

These methods were both addressed in the inventor's earlier inventions described in U.S. Pat. No. 7,331,405 and PCT Publication No. WO/2013/054262 respectively, and are incorporated herein by reference. Whilst both these methods provide the aforesaid advantage, the drive-down mechanism and the energy storage components and the means of coupling to the weight during the down stroke inherently adds complexity and weight to the apparatus.

The apparatus described herein not only provides similar advantages to the both the inventor's referenced methods but these are achieved without adding to the apparatus' weight or complexity. Advantageously, the apparatus described herein may optionally also be used in addition to one or both of said aforementioned methods to provide an enhanced apparatus.

The creation of a vacuum within the vacuum chamber during elevation of the weight on the up-stroke of the reciprocation path generates a corresponding opposing force due to the pressure differential between the vacuum chamber and the atmosphere. As the weight is constrained to the reciprocating path, the force of atmospheric pressure applied to the weight is resolved downwards along the reciprocation path, thereby compounding with the force of gravity acting on the hammer weight.

However, the atmospheric pressure applied to the vacuum piston face of the vacuum chamber (via the weight) does not require any additional energy from the carrier or drive mechanism to operate on the down-stroke. Neither does the vacuum chamber assembly require the additional weight and complexity of any additional external storage apparatus. Notably, aside from the negligible weight of the sealing, the vacuum chamber itself need not add to the mass of the apparatus. The hammer weight and associated housing of an impact hammer have an appreciable cross section allowing the generation of a highly significant vacuum under the hammer weight.

Thus, it is possible to make a comparative assessment of the impact hammer described herein against prior art gravity-only impact hammers by individually identifying any improvements in parameters such as impact energy, tonnage production rate per hour, or impact hammer weight, whilst keeping the remaining impact hammer performance variables substantially constant. As a primary example, to compare any benefits in impact hammer weight saving (and thus, the commensurate cost saving in using a lighter excavator), it is necessary for the compared impact hammers to display, for example, the same impact energy or other germane performance metric. The significance of an impact hammer weight saving on the overall cost of its associated carrier/excavator is expanded on as follows.

The excavator market is well established and for commercial, legacy and convention reasons, excavators are manufactured with specifications falling into designated bands or classes. In particular, excavators are primarily configured with an overall weight that falls within the following classes:

20-25 tonnes,
30-36 tonnes,
40-55 tonnes,
65-80 tonnes,
100-120 tonnes

Although each class includes a significant weight range, the cost of an excavator is directly governed by its specific weight. Excavator purchasers are thus highly incentivized to select the lightest excavator within a given class capable of performing the task required. An operator/purchaser with an attachment requiring a 56 tonne excavator for example may incur a cost of approximately US$10/Kg and thus the cost of a theoretical 56 tonne excavator should be US$570,000. However, the operator will actually need to use a 65 tonne excavator at a cost of US$650,000; a 14% cost increase over an excavator from the lighter class. The commercial practical reality is further compounded by the availability of excavators precisely at the limits of the classes' weight boundary, forcing an operator to use an even heavier excavator. Moreover, the cost per kilogram of a carrier is not uniform between the different weight classes, and instead increases disproportionately for the heavier carrier classes (particularly above 40 tonnes) due to their limited availability. It can be thus seen that saving costs by using the lightest excavator necessary is paramount. The interrelationship between the weight of a carrier and its weight-bearing capacity for any attachments is well known in the art, whereby in a pro-rata relationship, the carrier (typically an excavator) must weigh at least six to seven times the weight of the attachment. Thus, a reduction in the weight of an attachment such as an impact hammer can potentially produce a corresponding six to seven-fold reduction in the weight of the excavator required to operate the attachment. Shown below is a comparison of excavator weight classes and the weight saving required to transition from a higher weight class.

It can be seen from table 1 that an impact hammer total weight saving of between approximately 11-20% in any class would be potentially sufficient to change the required excavator to a lighter class. These potential weight savings are based on the minimum weight saving required to transition between the adjacent limits of excavator classes. Thus, the above tables essentially outline the minimum range of attachment weight savings which would lead to the extremely beneficial cost saving of using a lighter class excavator.

Even higher weight savings would permit an operator to select from a significantly wider choice of heavier excavators within the class. In practice, the choice of available excavators at any given time/location may easily preclude the use of the optimum weight excavator forcing the use of a heavier machine. Moreover, the excavator classes are far more heavily populated by machines with weights in the centre of the weight bands rather than the peripheries. Thus, impact hammer weight savings that allow the use of an excavator from well within the next class boundaries provide a disproportional benefit than weight saving that only just span excavator weight classes. The potential of the present invention for such weight savings, in addition to numerous other performance parameters, are illustrated below in comparison to the prior art.

Naturally, weight reduction in itself may be achieved by a variety of means simply by compromising other performance parameters of the impact hammer, as discussed above. Thus, a meaningful assessment is only possible by fixing certain key parameters during a comparison with the prior art of a single parameter e.g. impact hammer weight.

Thus, tables 2-3 (see appendix) illustrate a comparison of three different impact hammer weights of one embodiment of a vacuum-assisted impact hammer with the best-performing comparable prior art gravity-only impact hammers. The prior art hammers listed are the top-performing impact hammers available which require an excavator in the above weight classes. The DX900 and DX1800 are different size/weight impact hammers which are configured with a gravity-only hammer weight falling on a striker-pin, which in turn impacts the working surface. The inventor is the creator of both the DX machines. Although both the DX impact hammers represent the closest performing competitors to the present invention, additional prior-art in the form of the SS80 and SS150 are included to provide appropriate industry context. The SS80 and SS150 are devices manufactured by Surestrike International, Inc also configured similarly, with a gravity-only hammer weight falling on a striker-pin.

Tables 2 and 3 (see appendix) above detail the key physical and performance parameters of actual prior art gravity-only impact hammers and vacuum-assisted impact hammers according to the present invention. The prior art impact hammers were selected for comparison due to their comparable hammer weight mass and stroke length. Understandably, the embodiments disclosed herein as labelled XT1000, 2000 and 4000 are not specifically configured to facilitate comparison with prior art impact hammers and thus differ in several respects, such as impact energy and productivity. One of the advantages of the vacuum-assistance of the present invention is that the performance improvements are essentially scalable to differently sized impact hammers. Thus, the following tables 4 and 5 are formulated for vacuum-assisted impact hammers (denoted 1-8) configured precisely to match specified parameters of the prior-art gravity-only impact hammers.

Table 4 (see appendix) compares vacuum impact hammers 1-4 with the same overall impact hammer weight, (and thus carrier weight) and stroke length with the prior art DX900, SS80, DX188 and SS150, resulting in impact energy improvements of 105%, 260%, 183% and 206% respectively. The commensurate improvements in production rates at a vertical impact axis are even more disparate at 325%, 695%, 337% and 505% respectively. At a 45° impact axis inclination, the improvements in production rates increase yet further to 712%, 1,394%, 727% and 1,045% respectively.

Table 5 (see appendix) focuses on the difference in weight between the above prior art impact hammers and the present invention vacuum impact hammers (5-8) when the impact energy is equalized. The resulting weight reductions between the present invention impact hammers (5-8) and the DX900, SS80, DX188 and SS150 are respectively, 42%, 60%, 48% and 58%. The present invention impact hammers 5-8 provide an improvement in the carrier-cost per-tonne-per-hour of production (in a vertical impact axis orientation) of a 65%, 81%, 69% and 76% reduction over the costs for the DX900, SS80, DX188 and SS150 respectively as a result of being able to use a lighter carrier together with the reduced cycle time (considered more thoroughly elsewhere).

Table 6 (see appendix) represents a further four configurations of the present invention impact hammers (No. 9-12) in which the productivity has been correspondingly equalised with the same prior art impact hammers referenced in the earlier examples. As already seen, the present invention is significantly lighter than the comparable prior art impact hammers.

Thus, even when the present invention is configured to be notionally equal in productivity with the prior art, its reduced weight provides significant savings in the cost of the carrier needs plus manufacturing cost savings due to the correspondingly lighter housing and hammer weight required. These savings translate into carrier-cost per tonne per hour of production improvements by the vacuum impact hammers Nos 9-12 of 151%, 345%, 181% and 274% over the DX900, SS80, DX188 and SS150 respectively for a vertically orientated impact axis. The improvement is even more pronounced for inclined impact axis orientations as demonstrated by the figures for the carrier-cost per tonne per hour of production at 45°.

The embodiments described herein provide the means to achieve highly significant performance improvements over the prior art. The vacuum assistance of the impact hammer allows the use of a lighter hammer weight which not only reduces the cost of materials and manufacturing of the impact hammer itself, but also the operational cost associated with using a lighter excavator.

The gulf between the present invention and the prior art is such that even more conservative improvements (detailed below) represent a clear manifestation of the inventive advantages provided by embodiments of the present invention.

Preferably, said impact hammer is configured with one or more of:

- an impact energy of at least 70 Kilojoules for a total apparatus weight of up to 3.6 tonnes;
- a total apparatus weight of up to 3.6 tonnes with an impact energy output equal or greater than a gravity-only impact hammer weighing between 4.5-6.5 tonnes;
- a total apparatus weight of up to 3.6 tonnes with an impact energy output equal or greater than a gravity-only impact hammer requiring a 30 to 36 tonne carrier;
- an impact energy of at least 150 Kilojoules for a total apparatus weight of up to 6.0 tonnes;
- a total apparatus weight of up to 6.0 tonnes with an impact energy output equal to or greater than a gravity-only impact hammer weighing between 8-11 tonnes;
- a total apparatus weight of up to 6.0 tonnes with an impact energy output equal or greater than a gravity-only impact hammer requiring a 65-80 tonnes carrier;
- an impact energy of at least 270 Kilojoules for a total apparatus weight of up to 11 tonnes;
- a total apparatus weight of up to 11 tonnes with an impact energy output equal to or greater than a gravity-only impact hammer weighing between 15-20 tonnes;
- a total apparatus weight of up to 11 tonnes with an impact energy output equivalent to at least 50% more than the impact energy output from a gravity impact hammer requiring a 65-80 tonnes carrier.

As the typical capital cost of an excavator is approximately USD $10 or €6.25 per Kilo, it can be immediately appreciated that any of the above configurations provide significant cost saving, particularly given the above-referenced disproportionate cost increases for heavier class excavators.

As is also axiomatically demonstrated above, it is highly desirable to utilise the lightest impact hammer weight possible to achieve the required impact energy to the working surface. As the hammer weight itself is the predominant factor in the total impact hammer apparatus weight, a lighter hammer weight directly contributes to a lighter total apparatus weight, together with numerous consequential weight savings (e.g. the need for a lighter containment surface/housing) as discussed subsequently.

Therefore, embodiments of the present invention enable a super-gravitational (greater than gravity) force to be applied to the weight on the down-stroke without additional weight incurred by use of a drive-down mechanism.

A yet further advantage of embodiments of the present invention over conventional gravity-only impact hammers is a vastly improved performance capacity for operating at non-vertical impact axis orientations. Typically, as a gravity-only impact hammer is inclined, the effective drop height decreases while the resistance from friction increases as the hammer weight increasingly bears on the housing during the cyclic operation. Impact axis inclination angles of over 60° from vertical typically result in the reciprocating hammer weight in gravity-only hammers ceasing to move.

The potential energy provided by the vacuum-assistance of the impact hammer is however not diminished by the orientation change and in contrast remains unaltered by any impact axis orientation, including upwards. Furthermore, as the vacuum effect does not add to the mass of the impact hammer, there is no increase in friction with the containment surfaces due to the vacuum as the impact hammer is inclined. The total frictional losses of an inclined vacuum assisted impact hammer are thus proportionally far lower than a conventional gravity-only impact hammer capable of the same impact energy, as the vacuum-generated proportion of the impact energy places no additional friction on the inclined impact hammer but provides a greater impact energy.

To illustrate the performance advantages with a numerical example, table 8 (see appendix) compares a gravity-only impact hammer with an embodiment of the present invention in the form of a vacuum-assisted impact hammer at both 0° and 45° impact axis inclination:

As may be seen for the above comparison, even with a vertical impact axis and theoretically equal impact energy (30,000 J), the gravity-only impact hammer incurs a greater energy loss, i.e. 4,500 J compared to 1,600 J for the vacuum-assisted impact hammer. This greater loss is a direct consequence of the greater friction generated by the larger hammer weight, and the larger air displacement losses. The disparity increases markedly with increasing impact axis inclination. It can be seen that at a 45° impact axis inclination, the energy losses through friction and air displacement gravity-only impact hammer and vacuum-assisted impact hammer are now respectively 6,360 J and 2,350 J. Thus, the vacuum-assisted impact hammer is able to perform 115% of the work done by the gravity-only impact hammer at 0° impact axis inclination, increasing to 194% at a 45° impact axis inclination. The difference becomes even more marked as the inclination increases, to the point (around 65-70°) where the gravity-only impact hammer ceases functioning altogether.

Preferably, said impact hammer is configured to be operable with an impact axis angle of inclination from vertical from 0° to at least 60°.

In one embodiment, said operable impact axis angle of inclination from vertical is 0-90°.

In a further embodiment, said operable impact axis angle of inclination from vertical is 0-180°.

In one embodiment said maximum gravitational potential energy is less than said maximum vacuum chamber generated potential energy.

Preferably, said hammer weight impacts on said driven end of the striker pin along the impact axis, substantially co-axial with the striker pin longitudinal axis.

Preferably, said striker pin is locatable in the housing in a nose block such that said impact end protrudes from the housing, said shock-absorber being coupled to the striker pin inside said nose block. According to another aspect of the present invention there is provided a mobile impact hammer, including an impact hammer substantially as hereinbefore described, supported by a mobile carrier, said impact hammer operable in use with an impact axis angle of inclination from vertical from 0° to at least 45°, and preferably at least 60°.

Preferably said mobile impact hammer is configured to impart an impact energy of at least 5000 Joules per reciprocation cycle of the hammer weight.

The capacity to operate at such inclination angles enables work in applications unfeasible for gravity-only impact hammers such as operations in confined areas, close to steep rock-faces, tunnelling, trenching and the like.

According to another aspect of the present invention, said mobile impact hammer, is configured whereby said impact hammer is substantially equal to or greater than the mass of said supporting mobile carrier.

According to a further embodiment, said impact hammer is configured as a remotely operated and/or robotic tunnelling impact hammer.

The present invention makes it feasible for purpose-built robotic tunnelling impact hammers to operate at shallow impact angles without fear of falling debris placing an operator at risk. Self-evidently, operating at near horizontal impact axis angles requires the predominant majority (>80%) of the impact energy to be generated by the vacuum effect, thus requiring a large vacuum surface area to weight ratio.

As will be appreciated, when the impact hammer is intended for operations at any upward inclination, the hammer weight may incorporate a tether, restraint, lease or the like. Such a restraint to the hammer weight would prevent the weight sliding out of the housing in the event of a vacuum chamber sealing failure, potentially damaging drive mechanism components and presenting a hazard. It will also be appreciated that the present invention impact hammer capable of tunnelling operations and/or other work impacting operations at greater than 60° need not necessarily be robotic and/or remotely controlled, depending on the particular circumstances of the operation. Suitably protected human-operated excavators with the vacuum-assisted impact hammers of the present invention may also be usable in such circumstances.

Preferably, the drive mechanism is an up-stroke drive mechanism, operable to elevate the hammer weight along the reciprocation axis.

Preferably, the drive mechanism includes a drive connected to the hammer weight by a flexible connector. The flexible connector may include a belt, cable, strop, chain, rope, wire, line, or other sufficiently strong flexible connection.

Preferably, the drive is positioned below the upper distal end of the housing.

Preferably, the drive is positioned below the end of the hammer weight up-stroke with a centre of gravity between an upper distal end of the housing and the striker pin driven end.

Preferably, the drive is positioned below the end of the hammer weight up-stroke with a centre of gravity between the distal ends of the containment surface.

Preferably, the flexible connector passes about at least one pulley located at an upper distal end of the housing, the drive configured to pull the hammer weight upwards via the flexible connector about the pulley.

An impact hammer as claimed in claim 1, wherein the drive is a linear reciprocating drive.

According to one aspect, the drive mechanism is preferably positioned below the end of the hammer weight up-stroke with a centre of gravity between said distal ends of the containment surface.

Preferably said drive mechanism is positioned below the end of the hammer weight up-stroke with a centre of gravity between said distal end of the housing and the striker pin driven end.

According to one embodiment, said drive mechanism includes:

a drive;

at least one strop;

at least one sheave.

Preferably, said drive mechanism further includes a pulley and/or winch. Preferably, the drive includes a hydraulic or pneumatic ram or the like, configured to pull the hammer weight via the strop (either directly or through a pulley or winch) and turning about a sheave at the upper distal of the housing.

Thus, the impact hammer is able to provide effective impact energy levels and low cycle times during operations at an inclined impact axis without detrimentally adding to the mass of buffers, or a drive mechanism ram drive, pressure chambers or the like to the upper distal end of the housing/containment surface. This enables the impact hammer to remain mobile and manoeuvrable by conventional carriers/excavators without adding excessive additional torque loads to the carrier attachment point.

The incorporation of vacuum assistance also provides yet further consequential weight savings in addition to the reduction in hammer weight to achieve a given impact energy.

As discussed elsewhere, during the operating cycle, at the end of the down-stroke, the hammer weight impact with the driven end of the striker pin transfers kinetic energy via the striker pin to the working surface.

In practice, not all the kinetic energy of the hammer weight is transferred to the working surface, as in the event of:

- a 'mis-hit' when the operator drops the hammer weight on the striker pin driven end without the impact end being in contact with the working surface, the impact of the hammer weight forces an appreciable shock load through, and also absorbed by, the impact hammer.
- 'over-hitting' whereby even though the working surface does fracture successfully after a strike, the impact may only absorb a portion of the kinetic energy of the striker pin and hammer weight. In such instances, the resultant effect on the impact hammer is directly comparable to a 'mis-hit'.
- the nature of the working surface requires multiple impacts before fracture occurs and thus the striker pin or hammer weight may recoil away from the unbroken working surface. The direction of the recoiling hammer weight will predominantly include a component lateral to the impact axis, thereby bringing it into contact with the containment surface.

In practice, the impacting operations are undertaken at a wide variety of inclinations, and are seldom performed with a perfectly vertical impact axis.

The primary contact region location between the hammer weight and the containment surface from such lateral impacts is immediately adjacent the hammer weight when contacting the striker pin. The lateral contact region (herein referred to as the strengthened housing portion) of the containment surface and adjacent hammer housing surrounding the hammer weight at the point of impact with the striker pin is thus additionally strengthened compared to the remainder of the housing. Thus, embodiments of the present invention are able to make a further weight saving in comparison to a gravity only impact hammer producing the same impact energy, by virtue of a shortened strengthened housing portion due to the reduced size of the hammer weight parallel to the impact axis.

According to a further aspect, the vacuum assisted impact hammer may provide a housing weight saving reduction comparative to a gravity-only impact hammer generating an equivalent impact energy and having the same cross-sectional area, said housing weight saving reduction being proportional to the difference in dimension of the weight along the impact axis.

The said housing weight saving reduction is proportional to the reduction in hammer weight volumetric size due to several additive components, including:

- the smaller volumetric size hammer weight of the vacuum assisted impact hammer requires a shorter housing and containment surface to enclose an equal hammer weight travel distance along the impact axis;
- the reduced mass of the smaller volumetric size hammer weight of the vacuum assisted impact hammer generates proportionally lower lateral impact forces on the strengthened housing portion, requiring proportionally less strengthening;
- the shorter length parallel to the impact axis (for hammer weights of comparable lateral cross-sectional area) of the hammer weight of the vacuum assisted impact hammer generates a smaller couple from lateral movements of the hammer weight, generating corresponding smaller point-load lateral impacts with the containment surface, requiring proportionally less strengthening.

The additional weight required by a gravity-only impact hammer for any/all of the above reasons further compounds the relative performance disadvantage compared to embodiments of the present invention as the total increased weight consequently adds 6-7 times that value to the weight of the required excavator.

Thus, preferably the housing weight saving reduction proportional to the difference in dimension of the weight along the impact axis includes at least one of:

- a housing weight saving due to the difference in housing length corresponding to the difference in said hammer weight up-stroke length;
- a housing weight saving proportional to the difference in dimension of a strengthened housing portion extending parallel to the impact axis for a length at least substantially equal to the dimension of the weight along the impact axis from said start position of said up-stroke, and/or
- a housing weight saving due to the difference in dimension of a strengthened housing portion extending laterally to the impact axis the weight along for a length at least substantially equal to the dimension of the weight along the impact axis from said start position of said up-stroke.

A yet further advantage of embodiments of the present invention relate to improvements in the operating cycle time. As previously described, in operation, a full reciprocation cycle of the apparatus comprises four basic stages consisting of: the up-stroke, upper stroke transition, down-stroke and lower stroke transition. The predominant time components of the reciprocation cycle are the up-stroke and down-stroke, given the upper stroke transition is typically instantaneous. Although the lower stroke transition timing is influenced by the time required to ensure the hammer weight has ceased any bouncing after the initial impact, the magnitude of any bouncing is also dampened by the effect of the corresponding vacuum generated in the vacuum chamber.

An obstacle however to simply increasing the lift speed is the issue of halting the hammer weight at the end of the up-stroke. After the drive mechanism has ceased actively lifting the hammer weight on the up-stroke, momentum will act to continue the motion of the hammer weight, opposed by the forces of gravity and friction from the drive mechanism and containment surface contact. Thus, if the hammer weight lift speed is increased, the increased momentum of the hammer weight at the end of being actively lifted by the drive mechanism will require an extended containment surface to house and guide the weight until it decelerates to a halt.

The alternative of adding a buffer or some form of cushioning to decelerate the hammer weight over a shorter distance is also highly unattractive. The high mass of the hammer weight would require the buffer to be substantial to provide any meaningful effect and be sufficiently robust. The additional weight added to the upper extremity of the housing by either alternative presents a significant performance impact. The additional torque exerted on the impact hammer attachment to the carrier by the additional weight requires corresponding strengthening, in addition to the direct weight penalty of the additional housing length.

More significantly, the impact of the hammer weight into a physical buffer would unavoidably disturb the operator's positioning of the striker pin on the desired position on the work surface (e.g. the centre of a rock, or crack and so forth) requiring time consuming re-positioning and/or causing undesirable 'mis-hits'.

The duration of the down-stroke, is simply a function of the effective drop height and the opposing frictional forces between the hammer weight and the housing containment surface and the inertia of the drive mechanism. As also discussed above, it will be appreciated that the hammer weight effective drop height decreases and the opposing frictional force increases with inclination of the impact hammer away from a vertical impact axis. The minimum possible duration for the down-stroke therefore cannot be reduced below that of the free drop time of an unrestricted weight falling under gravity. In practice therefore, the duration of the down-stroke is always greater than this due to the aforesaid frictional restraints.

In contrast to both the above limitations, the addition of vacuum assistance provides a distinct reduction in the overall cycle time, without any of the above described drawbacks. The atmospheric force on the vacuum chamber acts to drive the weight to compress the vacuum chamber irrespective of the orientation. Thus, on the up-stroke, after the drive mechanism has stopped raising the hammer weight, the force opposing the expansion of the vacuum chamber (i.e. the continued movement of the hammer weight up the impact axis) still operates to decelerate and stop the hammer weight, in addition to the effects gravity. Equally, on the down-stroke, the atmospheric restorative force acting on the vacuum chamber increase the force on the hammer weight in addition to the force of gravity. To illustrate this clear and significant benefit, table 9 makes a comparison between comparable impact hammers having the same drop height of 5 m, the same hammer weight and the same drive mechanism, differing only in the vacuum assistance provided to the present invention impact hammer. The gravity-only impact hammer and the vacuum-assisted impact hammers figures are both derived from a vertically orientated impact axis with typical drag factors. In the example in table 9, the vacuum-to-weight ratio of 2:1. It will be appreciated higher vacuum ratios are possible producing correspondingly shorter cycle times.

In practice, the stopping distances chosen for the hammer weights may vary from 200 mm up to 500 mm depending on the importance of other impact hammer performance criteria. To ensure a meaningful comparison however, the convergence between stopping distances for the gravity-only impact hammer and the vacuum assisted impact hammer is 420 mm, achieved with respective hammer weight velocities of 3 m/s and 5 m/s.

It can be thus seen that the practical minimum cycle time for the gravity-only impact hammer is approximately 3.27 s and 1.91 s for the vacuum assisted impact hammer. This reduction in cycle time gives the vacuum-assisted impact hammer a 171% improvement over the gravity-only impact hammer. As the productivity of an impact hammer relates directly to the frequency of impact blows to the working surface, this cycle time reduction translates directly to an improvement in productivity.

The effects of the vacuum in retarding or braking the motion of the hammer weight during the up-stroke after the drive mechanism ceases acting on the hammer weight, essentially provide a buffering action. The magnitude of the vacuum-generated potential energy is at its peak at the end of the up-stroke. However, notwithstanding any sealing losses, the force of the atmospheric pressure acting against the vacuum chamber (via the hammer weight) is constant throughout the up-stroke and thus continues to apply the braking effect on the hammer weight's motion even after then drive mechanism ceases actively propelling the hammer weight. Thus, the atmospheric pressure differential acts to compound the decelerative effects of gravity to significantly reduce the cycle time from this portion of the cycle.

To replicate such a profound braking effect with a physical buffer system would be highly problematic. Firstly, the location of the added mass positioned at the upper distal extremity of the housing would exacerbate the torque load generated by the impact hammer on the excavator attachment during movement. Secondly, the magnitude of the additional weight would add a six to seven-fold increase to the excavator weight, as described above. Thirdly, the effects of increasing impact axis inclination further reducing the decelerative effects of gravity would require an even stronger and thus heavier buffer. In contrast, the vacuum generated braking force is unaffected by angular orientation.

According to one embodiment, the present invention is an impact hammer including:

a housing, having inner side walls a hammer weight movable reciprocally along a linear impact axis, said hammer weight configured and orientated to come into at least partial sealing contact with a containment surface of said impact hammer during reciprocating movement of the hammer weight, said containment surface including said housing inner side walls, drive mechanism such that in operation, a full reciprocation cycle of the hammer weight along said linear impact axis, when orientated vertically, comprises four stages consisting of:

an up-stroke, wherein said hammer weight is moved along the impact axis for a distance equal to a hammer weight up-stroke length comprised of an initial driven-portion and an un-driven-portion, said hammer weight being moved by the drive mechanism from a lower initial position along said driven-portion before moving along said un-driven-portion to a final upper position at a distal end of said housing;

an upper stroke transition, wherein the hammer weight movement is stationary before traversing the reciprocal direction to the up-stroke along the impact axis;

a down-stroke, wherein said hammer weight is moved back along the impact axis for a distance equal to a hammer weight down-stroke length from said upper position at a distal end of said housing to said lower position, and a lower stroke transition, wherein the hammer weight movement is halted before a subsequent up-stroke, said impact hammer further including an atmospheric up-stroke brake including:

a variable volume vacuum chamber formed between the hammer weight and at least a portion of the containment surface, wherein said movement of the hammer weight along the impact axis on the up-stroke generates a pressure differential between said vacuum chamber and the impact hammer atmosphere, said up-stroke atmospheric brake applying said pressure differential to the movement of the hammer weight over an un-driven-portion to decelerate the hammer weight up-stroke movement.

Preferably, at least a portion of an upper face of said hammer weight is open to said atmosphere.

According to a further aspect, the present invention provides a mobile carrier and vacuum-assisted impact hammer substantially as hereinbefore described, including said up-stroke atmospheric brake, said impact hammer operable with an impact axis angle of inclination from vertical from 0° to at least 45°, and preferably at least 60°.

As may be noted from the plethora of configurations of the present invention referenced herein, sheer versatility is in itself a notable characteristic of the vacuum-assisted hammer. The ability of vacuum assistance to add impact energy, reduce weight, increase apparatus compaction, reduce operating and manufacturing costs, increase productivity, reduce cycle time and so forth demonstrates the wide spectrum of variable parameters available to a designer to optimally configure an impact hammer to suit different operator priorities. The following comparative tables illustrate several widely differing scenarios where operators with differing performance priorities are accommodated by the present invention. The present invention vacuum-assisted impact hammer in each scenario is compared to the closest performing prior art gravity only impact hammers. It will be noted that none of the prior art impact hammers are remotely competitive in meeting the respective performance criteria.

It will be discernible from the illustrations, that the variety of possible expressions of the present invention and the flexibility in implementation of its advantages over the prior art presents a unique advantage in itself.

As discussed above, table 1 shows (for a fixed impact energy) the minimum impact hammer weight saving necessary to enable an impact hammer operated by the lightest excavator in a given weight class to be operated by the heaviest excavator in the adjacent lighter class. While this provides tremendous economic operational savings, to give an operator maximum theoretical versatility, the ideal weight saving would enable a transition between the lower weight limit of one class to the upper weight limit of the next class.

As an example, table 11 illustrates a scenario of an operator, requesting an impact hammer which may be carried on the lightest possible excavator while still matching the production tonnage per hour of either of the two heaviest, most powerful gravity-only impact hammers, i.e. the SS150 and the DX1800. The production tonnage per hour is the primary indicator of productivity in impacting operations, whilst the cost of the carrier is the single largest operating cost.

Thus, by maintaining parity of the former, while reducing the latter, the vacuum-assisted impact hammer of one embodiment of the present invention (labelled the XT 1200) is significantly more cost effective. Moreover, it can be seen that the XT1200, weighing 3.9 tonnes, may be carried by a 25 tonne carrier from the 20-25 tonne class while the SS150 and the DX 1800 prior art hammers both require carriers from the 65-80 tonne class. The XT1200 thus requires a carrier that is two whole classes lighter compared to the 65 tonne and 80 Tonne DX 1800 and SS150, with a carrier cost saving of $330,000 and $480,000 respectively. The superiority of the XT1200 is actually even more pronounced when considering the production tonnage at inclined impact axis. As the table illustrates, at a 45° inclination, the XT1200 produces approximately double the output of the SS150 and DX1800.

Table 12 illustrates an example scenario where an operator requires an impact hammer to operate in an environment with a maximum height restriction of 5 m such as encountered in tunnelling or under other overhead restrictions. All the impact hammers in table 12 are equipped with a striker pin configuration, which together with other necessary portions of the impact hammer take up 2 m of the 5 m height clearance allowing a maximum of a 3 m up-stroke length. However, the additional size of the gravity-only impact hammer weight takes up a further 1 m. Thus, the gravity-only impact hammer has a maximum vertical up-stroke length of 2 m, compared to 3 m for the vacuum-assisted impact hammer. As explored earlier, a gravity-only impact hammer produces its maximum impact energy and cycle time when operating with a vertical impact axis. Table 12 shows the gravity-only hammer produces a maximum impact energy of 33,354 J with a vertical orientation and a cycle rate of 15.

However, it is futile to use a larger gravity impact hammer inclined at a non-vertical impact axis as the losses still result in a lower impact energy and a lower cycle rate. As an example, a 2.82 m up-stroke length impact hammer inclined at 45° has the same vertical drop as the 2 m up-stroke length hammer however it only produces impact energy of 32,212 J at a cycle rate of 12, i.e. 3.4% less than the upright 3 m gravity-only impact hammer. The resultant productivity also falls from 22 respectively. In contrast, a vacuum assisted 4.24 m up-stroke length impact hammer (with an equivalent vertical hammer weight drop to the 3 m vertically orientated gravity-assisted impact hammer) inclined at 45° produces 30% greater impact energy and (despite the slower cycle rate) an increase of 14% greater productivity than the upright 3 m vacuum-assisted impact hammer. The 45° inclined vacuum-assisted impact hammer productivity is also 568% greater than the gravity-only impact hammer in outright terms. The operator is thus provided with the option to simply use a larger, existing vacuum-assisted impact hammer instead of ordering a custom-produced shortened impact hammer.

Table 13 illustrates a scenario where an operator's priorities are speed of production tonnage for a given carrier weight. Such scenarios may exist where noise and/or traffic restrictions limit impacting operations to limited windows of opportunity thereby prioritising speed of production, without resorting to acquiring significantly heavier impact hammers and their correspondingly heavier, costlier and less widely available carriers. Here it can be seen that despite the vacuum-assisted impact hammer (XT2000) being slightly lighter than the closest prior art gravity-only impact hammer (DX900), requiring a 36 tonne instead of a 40 tonne carrier, its productivity is 315 tonnes/hour compared to 63 tonnes/hour, i.e. 5× faster. Thus, even taking account of the increased production rate disparity at inclined operating angles (296 v 31 tonnes/hour, i.e. 9.5× faster), the vacuum-assisted hammer would complete a notional 5-day task in a single day.

According to a further aspect of, the present invention, there is provided a method of configuring an impact hammer substantially as hereinbefore described by selection of at least one of the following improvements in impact hammer performance metrics over corresponding gravity-only impact hammers wherein at least two of the group including: reciprocation period, impact energy, reciprocation path length and carrier weight are equivalent to said gravity-only impact hammer, said improvements including:

- a higher impact energy to be applied to the working surface for a given reciprocation period, impact energy, hammer weight, reciprocation path length and carrier weight:
- a lighter hammer weight for a given reciprocation period, impact energy, carrier weight and reciprocation path length;
- a shorter reciprocation path for a given hammer weight, reciprocation period, carrier weight, and impact energy;
- a reduced reciprocation period for a given reciprocation path length, hammer weight, carrier weight and impact energy; and/or
- a reduced carrier weight for a given reciprocation impact energy, path length, hammer weight, and impact energy.

It will be clearly apparent that the above list is not exhaustive and that one or more combinations of the parameters may be also varied to various extents, depending on the desired performance outcome.

According to a further aspect, the present invention may provide a method of improving a gravity-only impact hammer with performance metrics including: reciprocation period, impact energy, reciprocation path length, hammer weight, housing weight, impact hammer weight and carrier weight, said method including the selection from the group of improvements including:

- reduced reciprocation period;
- increased impact energy;
- reduced reciprocation path length;
- reduced carrier weight;
- reduced hammer weight;
- reduced housing weight;
- reduced impact hammer weight;
- increased operating impact angle from vertical, by incorporation of a vacuum chamber substantially as hereinbefore described, whilst maintaining at least two of said gravity-only performance metrics substantially unchanged.

As discussed, the energy yield of the gravity hammer is normally a product of the gravitational acceleration of the hammer weight and the fall distance, less any losses caused by friction, angular deviation from vertical, drag from the drive mechanism and compression of any air in the lower part of the guide column under the hammer weight. In the case of the vacuum assisted impact hammer embodiment of the present invention, the same forces and losses still apply. The presence of any residual or leakage air in the vacuum chamber acts to reduce the effectiveness of the vacuum generated by the up-stroke, whilst compressing the air on the down stroke generates a retarding force on the momentum of the hammer weight. These clearly deleterious effects of air remaining in the vacuum chamber are ideally mitigated.

Prior to considering the effects of sealing losses and/or the effects of residual air in the vacuum chamber, it is helpful to consider the sealing options available to form the vacuum chamber and their performance implications.

The position and configuration for said lower vacuum sealing is dependent on whether the impact hammer weight is configured as a separate weight transferring its impact energy to the working surface via a striker pin or formed with a tool end for directly striking the working surface. In the former case, the lower vacuum sealing may be formed either about a lower portion of the housing or about the striker pin assembly. In the latter case, the lower vacuum sealing may be located between the hammer weight and the containment surface at a position below the upper vacuum sealing. It is thus possible to duplicate the same sealing configuration for both the upper and lower vacuum sealing when used in conjunction with a non-striker pin impact hammer configuration.

In both weight configurations, the movement between the weight and the containment surface implicitly requires that the sealing is capable of accommodating relative, sliding movement therebetween. The sealing may be fixed to the weight, nose block/striker pin assembly containment surface or a combination of same and these variations are considered in greater detail later.

Considering said upper vacuum sealing, the position, construction and configuration may be varied according to the constraints of the containment surface and hammer weight and required performance characteristics required. There are several advantages in forming the upper vacuum sealing from one or more seals located on (or attached to) the hammer weight, e.g.:

- The distance travelled by the hammer weight along the impact axis is greater than the length of the weight itself. Thus, seals placed on the containment surface would need to extend over the distance of weight travel, while sealing on the weight need only be located at a single position about the impact axis;
- Sealing located on the containment surface along the hammer weight's travel path is vulnerable to damage by lateral movements of the weight without incorporation of shock absorption and abrasion resistance capabilities. In contrast, sealing on the hammer may be configured to accommodate lateral weight movement without also being required to provide lateral shock absorbing or centring capacity.
- Replacement of worn seals is easier as the weight can be removed from the housing.
- Seals are inherently flexible and normally made from different materials to the housing. There is typically a large range of ambient and operating temperatures where an impact hammer may work. The thermal expansion coefficients of the sealing material and the housing are typically very different, which makes them change shape at various temperatures. This shape change is hard to manage physically and the seal quality is compromised whenever the seal is not a good fit to either the housing or the hammer weight.

The performance characteristics of sealing included with the hammer weight may also depend on the weight's mass, size, velocity along the impact axis, degree of lateral movement from the impact axis, orientation of the impact axis, uniformity, accuracy and surface finish of the containment surface, life expectancy and the like.

According to one aspect, said hammer weight includes a lower impact face, an upper face and at least one side face. It should be appreciated that a cylindrical hammer includes a single said 'side' face.

It will be appreciated that for an impact hammer embodiment incorporating a striker pin, the lower impact face impacts the striker pin in use, while in a non-striker pin impact hammer embodiment, the lower impact face impacts the working surface in use.

It will also be appreciated that the hammer weight may take any convenient shape, including a cube, cuboid, an elongate substantially rectangular/cuboid plate or blade configuration, prism, cylinder, parallelepiped, polyhedron and so forth.

According to one aspect, said upper vacuum sealing includes one or more seals located peripherally about a said hammer weight side face.

Preferably, said seals form at least one substantially uninterrupted sealing laterally encompassing said hammer weight. Preferably, said sealing may be formed from abutting, overlapping, coterminous, interlocking, mating, and/or proximal adjacent seals. It will be understood that in embodiments utilising a plurality of said seals, one or more seals may be configured or dimensioned differently, and/or provided separate functionality or capabilities in addition to providing sealing.

According to one aspect, said seals are coupled to said hammer weight by:

- a cushioning slide;
- mounting on, or retention or attachment to, an intermediary element;
- retention in a recess, void, space, aperture, groove or the like in the hammer weight, cushioning slide and/or intermediary element;
- direct mounting on said side face; and/or
- any combination or permutation of the above.

According to one aspect, said seal is formed from a flexible elastomer.

According to a further aspect, said seal is formed from a rigid or resilient material, biased into contact with said containment surface by a preload. It will be appreciated said preload may take several forms, including, but not limited to a compressible medium, a spring, elastomer, buffers, or the like.

In one embodiment, said seals coupled to the hammer weight by retention, may be biased into intimate contact with the containment surface. Said biasing may be provided by a spring or equivalent, compressible medium, an elastomer, buffers, or the like and may act on said seals laterally outwards from the impact axis and/or circumferentially.

In an embodiment utilising a cylindrical hammer weight, said circumferential biasing is applied via one or more intersections between adjacent seals. Preferably, supplementary fillets provide hermetic continuity between said seal intersections thereby maintain a substantially continuous sealing between the containment surface and the hammer weight.

In an embodiment utilising a hammer weight with a plurality of side faces joined at two or more vertices, said circumferential biasing may be applied via intersections between said vertices.

In use, when the impact hammer is operated at non-vertical orientations, the sealing coupled to the hammer weight by retention may still be biased into intimate contact with the containment surface even if the hammer weight is laterally displaced relative to the impact axis.

According to one aspect, at least part of a said seal is configured to provide a unidirectional vent. In a further embodiment, the majority or entirety of the seal is configured to provide a unidirectional vent. In one embodiment, said seal includes at least one uni-directional vent.

Preferably said cushioning slide is a composite cushioning slide

According to one aspect, said hammer weight is fitted with at least one composite cushioning slide on an exterior surface of the hammer weight, said cushioning slide including:

an exterior first layer, formed with an exterior surface configured and orientated to come into at least partial sliding contact with a containment surface of said apparatus during said reciprocating movement of the component, said first layer being formed from a material of predetermined friction and/or abrasion resistance properties, and an interior second layer located between said first layer and said reciprocating component, said second layer at least partially formed from a shock-absorbing material having predetermined shock absorbing properties.

Preferably, the second layer has at least one surface connected to the first layer and an interior surface connected to the hammer weight.

The first layer exterior surface is preferably a lower-friction surface than said second layer.

As used herein, the term 'connected' with reference to the first and second layers refers to any possible mechanism or method for connection and includes, but is not limited to, adherence, releasable connection, mating profiles or features, nesting, clips, screws, threads, couplings or the like.

According to a yet further aspect, the upper vacuum sealing is at least partially or wholly provided directly by said cushioning slides.

According to one aspect, one or more intermediary elements is/are coupled to the hammer weight below said impact face and/or above said upper face; said intermediary element including one or more seals located about the periphery of said intermediary element in intimate contact with the containment surface, such that in use, the intermediary element forms at least part of said upper vacuum sealing. The intermediary element may be configured in a variety of forms, including plates, discs, annular rings and the like. It will be easily understood that an intermediary element coupled to the hammer weight below said impact face, is configured with a central aperture to allow unhindered contact between the hammer weight and the striker pin.

Coupling of the intermediary element to the hammer weight may be flexible (including straps, lines, linkages, couplings etc.) and/or slideable laterally to the impact axis, while substantially rigid parallel to the impact axis. Such coupling configurations allow the intermediary element to maintain an effective sealing with the containment surface without being affected by lateral movements of the hammer weight, e.g. couplings in the form of flexible linkages are pulled or pushed along the reciprocation path by movement of the hammer weight according to the direction of travel, and relative position of the intermediary element relative to the hammer weight.

Preferably, said vacuum piston face is formed by a portion of the hammer weight. In one embodiment, said vacuum piston face includes a hammer weight impact surface. It will be appreciated that moveable seals attached to the hammer weight, including said cushioning slides may also form part of the vacuum piston face.

According to alternative embodiments, said vacuum piston face may be integrally formed as part of the hammer weight, or comprise an attachment thereto. Preferably, said vacuum piston face is movable along said reciprocation path or a path parallel, or co-axial thereto.

In use, as the vacuum chamber expands during the up-stroke, atmospheric air ingress to the vacuum chamber may occur through sealing leakage due to imperfect, worn or damaged seals or containment surfaces, interference from airborne residual debris, material or design characteristics or limitations and so forth. The presence of a limited degree of leakage may in fact be deliberately incorporated to provide a balanced trade-off between required performance and manufacturing and/or operating practicalities. The sealing leakage need not present significant influence on the magnitude of the vacuum generated during the up-stroke, particularly given the highly transient vacuum duration (e.g. 2-4 seconds) typically involved. Even if sealing leakage reduced the level of the vacuum by a significant level, e.g. 60%, the remaining 40% vacuum assistance to the impact hammer would still provide meaningful performance advantages.

Residual air may also be present in the vacuum chamber before the start of the up-stroke, for a variety of reasons including the presence of any void un-traversed by the movement of the hammer weight. Moreover, it is extremely difficult to achieve a completely impassable seal the vacuum chamber in such a high speed, high energy reciprocation and thus during the up-stroke the upper and/or lower vacuum sealing may allow some air pass into the vacuum chamber, thereby increasing the pressure therein. The volume of such air leakage is dependent on a number of parameters, including the effectiveness of the sealing, area of sealing, pressure differential between vacuum chamber and atmosphere and the exposure time the pressure differential is applied across the sealing.

Leakage can be minimised by using more seals and more flexible seals, however, this inherently increases friction and in such a high speed reciprocation, such seals can quickly become damaged or retard the hammer weight movement. Thus a balance is required between sealing effectiveness and friction. In preferred embodiments, the hammer weight moves with such speed and force that highly effective seals such as rubber or other 'soft' seals are quickly damaged and become non-functional. Thus, it is preferable to use a less effective 'hard' seal that can withstand the high-friction loads, even though this may lead to more air leakage into the vacuum chamber.

However, the presence of any air inside the vacuum chamber on the down-stroke is detrimental to the impact force achievable by the impact hammer. The air in the vacuum chamber reduces the pressure differential and becomes increasingly compressed during the down-stroke applying a retarding force to the movement of the hammer weight, together with a significant detrimental heating effect due to the air compression.

The present invention addresses this serious issue by the incorporation of at least one down-stroke vent in the vacuum chamber. The down-stroke vent permits air egress during at least part of the down-stroke and preferably prevents, or at least restricts, air ingress during at least part to the up-stroke and more preferably, the majority or entirety of the up-stroke.

The vent is preferably configured as a unidirectional valve operable to permit air egress from the vacuum chamber on the down-stroke.

Preferably, the valve is a flap valve or similar with a flap or equivalent mechanism biased closed, the valve openable when the pressure of the air in the vacuum chamber reaches a super-atmospheric pressure such that a pressure differential is formed with atmosphere sufficient to apply a force exceeding the bias, thus forcing the flap or equivalent mechanism open. It will be appreciated that other valve types, whether automated or passive may be utilised as long as they restrict or prevent air ingress on the up-stroke and permit air egress on at least part of the down-stroke.

The down-stroke vent need not be located in or on the housing as long as it is in fluid communication with the vacuum chamber. Thus, in one embodiment the down-stroke vent may be formed by a port connected to a conduit connected to the vacuum chamber.

Preferably, at least one down-stroke vent is formed or located in, on or through:

the containment surface;
the upper vacuum sealing;
the lower vacuum sealing;
a nose block, and/or
the hammer weight.

The vent may be incorporated into the shape of the seal itself, e.g. a V-shaped outer cross-section, outwardly tapered, lip-shaped flexible outer periphery which allows the passage of higher pressure air from one side to lift the seal edge from the containment surface. Conversely, higher pressure air on the opposing side increasingly forces the outer edge against the containment surface.

A said vent may be formed as a port through the housing or hammer weight with a unidirectional, self-sealing valve or seal. The valve may be a resiliently or spring biased flap or a flexible poppet (or mushroom) valve, a rigid poppet valve, and a side opening flap valve or any other convenient unidirectional valve type.

When closed, (e.g. during the up-stroke and for at least portions of the down stroke) the vent prevents or restricts fluid ingress into the vacuum chamber. When the down-stroke vent is open (e.g. on the down-stroke when the compression of any fluid in the vacuum chamber raises the pressure above atmospheric level), the compressed fluid may be vented directly to atmosphere immediately adjacent the vent or via a conduit to a more distant location. The conduit may be rigid, flexible or a combination of same and routed internally or externally to the housing.

In one embodiment, the conduit may be routed to provide a fluid passageway from the vacuum chamber through to the containment surface at a position above the hammer weight. In a further embodiment, the movement of the hammer weight along the reciprocation path may be used to occlude or open the vent on the up-stroke and down-stroke respectively, thus providing the role of a unidirectional valve.

In a further embodiment, a vacuum pump may be connected to said vent or port to remove any residual air and/or maintain a vacuum in the vacuum chamber throughout the reciprocating operating cycle.

It will be appreciated that the down-stroke vent may be configured to open according to a variety of different parameters including:

the pressure differential magnitude between the vacuum chamber and the atmosphere;
the pressure differential magnitude between the vacuum chamber and a conduit in fluid communication with the down-stroke vent;
the position of the hammer weight on the down-stroke;
the temperature of the vacuum chamber on the down-stroke;
the elapsed time of the hammer weight movement on the down-stroke;
any combination or permutation of same.

Thus, in one embodiment, during the down-stroke the hammer weight descends under the force of gravity and the effect of a pressure differential between the atmospheric pressure acting on the upper hammer weight surface and the pressure in the vacuum chamber. As the hammer weight travels towards the working surface, any residual air in the vacuum chamber from the previous reciprocation, and/or vacuum sealing leakage is compressed. The pressure in the vacuum chamber thus rises until reaching equalization with the atmospheric pressure. Further down-stroke travel of the hammer weight would thus create a super-atmospheric pressure in the vacuum chamber unless venting occurs.

The down-stroke vent may be configured to open at any stage during the down stroke, as referenced above. Preferably, in one embodiment, the down-stroke vent is configured to open substantially simultaneously with any super-atmospheric pressure generation in the vacuum chamber.

As hereinbefore described, according to one aspect of the present invention there is provided an impact hammer as hereinbefore described, including a housing and a reciprocating hammer weight movable along said impact axis, said impact hammer further including:

a striker pin having a driven end and an impact end and a longitudinal axis extending between the driven and impact ends, said striker pin locatable in the housing such that said impact end protrudes from the housing, and
a shock-absorber coupled to the striker pin, said hammer weight impacting on said driven end of the striker pin along the impact axis, substantially co-axial with the striker pin longitudinal axis.

Preferably, said shock-absorber is coupled to the striker pin by a retainer, said retainer being interposed between first and second shock-absorbing assemblies (also referred to as upper and lower shock-absorbing assemblies) located internally within said housing along, or parallel to, the striker pin longitudinal axis, said first shock-absorbing assembly positioned between said retainer and said hammer weight.

Preferably, said first shock-absorbing assembly is formed from a plurality of un-bonded layers including at least two elastic layers interleaved by an inelastic layer.

According to one embodiment, said second shock-absorbing assembly is formed from a plurality of un-bonded layers including at least two elastic layers interleaved by an inelastic layer. Alternatively, either or both of said first and second shock-absorbing assemblies may be formed from a unitary shock-absorbing layer or buffer such as a single elastic layer.

Preferably, the striker pin is coupled to the retainer by a slideable coupling. Preferably, the slideable coupling allows relative movement between the striker pin and retainer co-axial or parallel with the longitudinal axis of the striker pin.

The region of the impact hammer close to the working surface is naturally in greater proximity to dust; rock, concrete, steel fragments, dirt, debris, and other by-products of breaking operations. Consequently, it is desirable to ensure the lower vacuum sealing configuration mitigates the ingress of any foreign matter via the region about the striker pin. In contrast to the upper vacuum sealing, the lower vacuum sealing is not subjected to large relative movement between adjacent sealing surfaces. The upper vacuum sealing is required to accommodate the movement of the hammer weight along the full extent of its travel along the reciprocation axis. In contrast, the lower vacuum sealing of a striker pin configuration is only subjected to the relatively smaller movement of the striker pin relative to said shock-absorber.

In a preferred embodiment, said relative movement between the striker pin and retainer results from movement of said slideable coupling within a retaining location. Preferably, said retaining location is demarcated, with respect to the striker pin driven end, by a proximal travel stop and a distal travel stop.

In one embodiment, the retainer (also known as a 'recoil plate') is formed as a rigid plate, at least partially surrounding the striker pin, with planar, parallel lower and upper surfaces positioned in adjacent contact with an elastic layer of the first and/or second shock absorbing assemblies respectively. According to one embodiment, the shock-absorber includes said retainer positioned between said shock absorbing assemblies.

The term 'slideable coupling' as used herein includes any moveable, or slideable coupling or engagement or configurations allowing at least some striker pin longitudinal axial travel relative to the housing and/or retainer. Preferably, engagement of the slideable coupling against either the proximal or distal travel stops during operational use transmits force to the shock-absorber. Preferably, engagement of the slideable coupling against the distal and proximal travel stops during operational use respectively transmits force to the first and second shock absorbing assemblies.

In a preferred embodiment, said slideable coupling includes one or more retaining pins at least partially passing through one of either the retainer or the striker pin and at least partially protruding into a longitudinal recess on the other one of either the retainer or striker pin. Preferably said longitudinal recess is said retaining location. To aid simplicity and clarify the description, the retaining location longitudinal recess is herein described as being located on the striker pin though this should not be seen to be limiting.

The maximum and minimum extent to which the striker pin protrudes from the housing is defined by the length of the striker pin, the position and length of the recess and the position of the releasable retaining pin(s). In addition to transmitting the impact shock to the first shock absorbing assembly, the proximal travel stop prevents the striker pin from falling out of the housing during use. The distal travel stop prevents the striker pin from being pushed completely inside the housing when an operator positions the striker pin in the primed position, in addition to transmitting recoil shock to the second shock absorbing assembly.

The first and second shock absorbing assemblies (with the retainer or 'recoil plate' interposed therebetween) is preferably contained within a portion of said housing (herein referred to as the 'nose block') as a collection of elements closely held together by inner walls of the nose block and partially by the outer walls of the striker pin. In one embodiment, all the elements of the shock absorbing assemblies in the nose block, including the retainer are mutually unbonded.

As used herein, the term 'unbonded' includes any contact between two surfaces which are not adhered, integrally formed, joined, attached or in any way connected other than being placed in physical contact.

The nose block provides a lower and an upper substantially planar boundary perforated by an aperture for the striker pin, each said planar boundary being orientated orthogonal to the longitudinal axis of the striker pin for the first and second shock absorbing assemblies respectively. The upper and lower nose block boundaries may take any convenient form providing the requisite robustness and capacity for maintenance access.

In one embodiment, the upper nose block boundary is provided by a rigid cap plate, preferably with a planar underside and an aperture for the striker pin.

The lower nose block boundary is provided in one embodiment by a rigid nose plate (also referred to as a 'nose cone'), preferably with a planar upper side and an aperture for the striker pin. The retainer and the first and second shock absorbing assemblies are located together in a stack between the cap plate and nose plate, surrounded by sidewalls of the nose block. The nose block and/or nose plate/cone may be formed with any convenient lateral cross-section, including circular, square, rectangular, polygon and so forth, bounded by correspondingly shaped sidewall(s).

According to one aspect of the present invention, the cap plate and nose plate secure the first and second shock absorbing assemblies together inside the nose block sidewalls by elongate nose block bolts parallel to the striker pin longitudinal axis. Preferably, the nose block is square or circular in plan-view section with the striker pin passing centrally through the shock absorbing assemblies and retainer.

In an alternative embodiment, the nose block and nose cone may be at least partially formed from a single continuous rigid structure.

It can thus be seen that the planar surfaces of the upper and lower nose block boundaries and the retainer planar surfaces provide four rigid, inelastic surfaces adjacent to the elastic layers of the shock absorbing assemblies. Thus, depending on the number of elastic and inelastic layers employed in an embodiment, an individual elastic layer may be interposed by the rigid, inelastic planar surfaces of either:

the upper nose block boundary and an inelastic layer;
the lower nose block boundary and an inelastic layer;
two inelastic layers, or
an inelastic layer and the retainer.

In each of the above configurations, the elastic layer is sandwiched between the parallel planar surfaces of the adjacent rigid inelastic surfaces orthogonal to the striker pin longitudinal axis.

It can be thus seen that an impact hammer according to the present invention incorporating a striker pin, is configured with nose block elements including:

a cap plate;
a first (or upper) shock absorbing assembly;
a retainer;
a second (or lower) shock absorbing assembly;
a nose cone;

positioned substantially about the striker pin between said striker pin driven end and the impact end in the preceding sequence with respect to the impact axis.

The lower vacuum sealing may include seals positioned at several alternative or cumulative positions in the above sequence of nose block elements.

According to one aspect, said lower vacuum sealing includes one or more seals located:

between the cap plate and the striker pin;

between the first (or upper) shock absorbing assembly and the striker pin;

between the retainer and the striker pin;

between the retainer and a nose block inner side wall;

between the second (or lower) shock absorbing assembly and the striker pin, and/or between the nose cone and the striker pin.

According to another aspect, said lower vacuum sealing is also, or alternatively, provided by one or more seals formed as individual independent layers laterally encompassing the striker pin and located:

between the nose cone and the lower shock absorbing assembly;

between the first (or upper) shock absorbing assembly and the cap plate, and/or between the cap plate and the lower travel extremity of the lower impact face of the hammer weight.

According to one embodiment, said individual independent layers include a flexible diaphragm. Preferably, a portion of said flexible diaphragm sealing against the striker pin is free to move with striker pin movements along the impact axis.

According to a further aspect, said individual independent layers further include at least one static seal between the diaphragm and the inner nose block walls.

The lower vacuum sealing seals may take a variety of forms including those described herein with respect to the upper vacuum sealing.

Thus, said lower vacuum sealing seals may include:

a flexible elastomer;

an elastic or inelastic material, biased into contact with the striker pin and/or the nose block inner side walls by a preload or intimate fit;

at least one unidirectional vent; and/or any combination or permutation of same.

A said seal located in at least one shock absorbing assembly may be formed:

as an integral part of an elastic layer;

as a distinct elastic seal positioned adjacent a shock absorbing assembly elastic layer;

an elastic or inelastic seal formed in a shock absorbing assembly inelastic layer;

as an elastic or inelastic seal positioned in, or adjacent a shock absorbing assembly inelastic layer;

from an intimate fit between a shock absorbing assembly inelastic layer and the striker pin, and/or any combination or permutation of same.

In one embodiment, the elastic layer is formed from a substantially incompressible material, such as an elastomer. In such embodiments, when the shock absorber is subjected to a compressive force during use, the only permissible deflection direction for the incompressible elastic layer is laterally, orthogonal to the striker pin longitudinal axis. This change in shape will hereinafter be referred to as lateral 'deflection' and includes equivalent expansion, deformation, distortions, spreading and the like. It is therefore essential there is sufficient lateral volume between the elastic layer periphery and the nose block walls and/or the striker pin to accommodate this lateral deflection of the elastic layer.

As previously described, the impact hammer is configured such that during use, the elastic layers are laterally moveable relative to said inelastic layers with respect to said striker pin longitudinal axis. It should be understood that as used herein, the term 'movable' includes any movement, displacement, deflection, translation, expansion, spreading, bulging, swelling, contraction, tracking, or the like.

It will be further appreciated that when the elastic layer is under compression between two inelastic surfaces, the elastic material deflects or 'spreads' laterally. As the adjacent elastic and inelastic surfaces are not bonded together, the elastic material is able to slide laterally across the inelastic surface. In embodiments with the elastic layer configured to laterally surround the striker pin, the elastic material moves both outwards and inwards from a null position when under compression. Prior art shock absorbers with elastic layers bonded to inelastic layers are unable to move laterally as described above.

Moreover, significant levels of friction occur between the elastic and inelastic layers as the elastic layer deflects. The friction opposes the elastic layer deflection and thus dramatically improves the shock-absorption capacity relative to a bonded multi-layer or unitary shock absorber.

Preferably, the first and/or second shock absorbing assembly is configured with a lateral 'clearance' to compensate for wear of the nose plate and/or cap plate. In one embodiment, the inelastic layers of first and/or second shock absorbing assemblies are laterally unconstrained within the nose block aside from centring engagement with the striker pin, wherein said lateral clearance is formed between the lateral peripheries of the inelastic layers and the nose block inner walls. According to a further aspect, the elastic layers of the first and/or second shock absorbing assemblies are centred by the nose block inner walls with the lateral clearance provided between the lateral periphery of the shock absorbing assemblies and the striker pin.

According to one embodiment, at least one said elastic and/or inelastic layer is substantially annular and/or concentric about the striker pin longitudinal axis. As used herein, the elastic layer may be formed from any material with a Young's modulus of less than 30 GigaPascals (GPa), while said inelastic layer is defined as including any material with a Young's modulus of greater than 30 GPa (and preferably greater than 50 GPa). It will be appreciated that such a definition provides a quantifiable boundary to classify materials as elastic or inelastic, though it is not meant to indicate that the optimum Young's modulus necessarily lies close to these values. Preferably, the Young's modulus of the inelastic and elastic layer is >180×109 Nm−2 and <3×109 Nm−2 respectively.

Preferably, an inelastic layer is formed from steel plate (typically with a Young's modulus of approximately 200 GPa) or similar material capable of withstanding the high stresses and compressive loads and preferably exhibiting a relatively low degree of friction. The elastic material may be selected from a variety of such materials exhibiting a degree of resilience, though polyurethane (with a Young's modulus of greater than 0.02×109 Nm−2) has been found to provide ideal properties for this application.

During compressive loads, rubber materials and the like may reduce in volume and/or display poor heat, resilience, load and/or recovery characteristics. However, an elastomer polymer such as polyurethane is essentially an incompressible fluid and thus tries to alter shape, not volume, during compressive loads, whilst also displaying desirable heat, resilience, load and recovery characteristics. Thus, in a preferred embodiment, said elastic layer is formed as an elastomer layer sandwiched on opposing substantially parallel planar sides between rigid surfaces whereby a compressive force applied substantially orthogonal to the plane of the elastomer layer thus causes the unbonded elastomer to deflect laterally. The degree of lateral deflection depends on the empirically derived 'shape factor' given by the ratio of the area of one loaded surface to the total area of unloaded surfaces free to expand.

As substantially planar elastomer layers placed between parallel inelastic rigid planar surfaces causes the elastomer to deflect or 'spread' laterally under compression, the net effect is an increase in the effective load bearing area. It has been determined that a shock-absorbing assembly with a steel plate providing the inelastic layer interleaved between elastic layers formed of polyurethane provides a configuration whilst providing far greater compressive strength than could be achieved with a single unitary piece of elastic material. This is primarily due to the 'shape factor' of the elastic layer—i.e., as the ratio of diameter to thickness increases, the load bearing capacity increases exponentially and consequently multiple thinner layers have significantly greater load capacity than a single thicker layer used in the same space.

As discussed below in greater detail, it is highly advantageous to maximise the volumetric efficiency of the nose block internal components such as the shock absorber layers. Using multiple thin layers instead of a single thicker layer with the same overall volume provides a high load capacity while only subjecting the individual elastic layers to a manageable degree of deflection. As an example, two separate layers of polyurethane of 30 mm, each deflecting 30%, i.e. 18 mm, possess twice the load bearing capacity of a single 60 mm layer deflecting 18 mm. This provides significant advantages over the prior art. In tests, the present invention has been found to withstand twice the load of a comparable shock absorber with a single unitary elastic layer, allowing twice the shock load to be arrested by the shock-absorber in the same volume of the hammer nose block.

The degree of deflection is directly proportional to the change in thickness of the elastic layer, which in turn affects the deceleration rate of the hammer weight; the smaller the change in overall thickness, the more violent the deceleration. Thus, using several thinner layers of elastic material also enables the deceleration rate of the hammer weight to be tailored effectively for the specific parameters of the hammer, which would be impractical with a single unitary elastic component.

Variations in the load surface conditions cause significant consequential variations in the stiffness of the elastic layer, e.g. a lubricated surface offers virtually no resistance to lateral movement, while a clean, dry loading surface provides a greater degree of friction resistance. However, bonding the elastic material and the inelastic material together, as employed in prior art solutions, would detrimentally prevent any lateral movement at the interface between the elastic and inelastic layers. It can be thus seen that providing an unbonded interface between the elastic layer and the adjacent rigid, inelastic surface on either side provides significant benefits over a bonded interface.

The volume of space inside the housing nose block is limited and consequently any space savings allow either a weight reduction and/or stronger, more capable components to be fitted with a consequential improvement in performance. The present invention for example may allow a sufficient weight saving (typically 10-15%) in the hammer nose block to allow a lighter carrier to be used for transport/operation. As an example, the reduction from a 36 tonne carrier (used for typical prior art gravity-only impact hammers) to a 30 tonne carrier offers a purchase saving of approximately €37500 euros (at approximately €6.25/kg) in addition to increased efficiencies in reduced operational and maintenance costs. Transporting a 36 tonne carrier is also an expensive and difficult burden for operators compared to a 30 tonne carrier which is far more practical.

As discussed previously, an elastic layer such as an elastomer, under load between two rigid, parallel, inelastic surfaces will deflect outwardly. If the elastic layer is configured in a substantially annular configuration laterally surrounding the striker pin, the elastic material will also deflect inward toward the centre of the aperture. This simultaneous movement in opposing lateral directions requires careful management for the rigid elements of the shock-absorbing assembly (i.e. the inelastic layers and/or the retainer) to stay centred around the striker pin while the elastic layers remain free to deflect around its entire inner and outer perimeters. It is important the whole shock-absorbing assembly of elastic and non-elastic plates and the retainer is free to move parallel or co-axially with the longitudinal axis of the striker pin, and laterally with minimal or zero direct contact by the elastic layers impinging against the walls of the housing and/or striker pin.

During shock absorbing use, the shock absorbing assemblies move parallel to the longitudinal axis of the striker pin. Thus, any appreciable impingement of the elastic layer directly on the walls of the nose block and/or the striker pin can cause the elastic layer to be deformed or damaged at the contact point. However, the shock absorber also needs to remain centred within the nose block during the movement and consequently some form of alignment or centring of the elastic layers is desirable.

In one embodiment, one or more void reduction objects are positioned between the hammer weight lower impact face and the nose block. According to one aspect, said void reduction objects include at least one of: spheres, interlocking shapes, expandable foam, and so forth.

It will be appreciated that undesirable contact may occur between the hammer weight and the containment surfaces during three separate phases of the impacting operation cyclical process, where the hammer weight:

- drags against the housing containment surface during the up-stroke;
- glances or bounces obliquely into contact with the containment surfaces on the down-stroke,
- makes lateral contact with the containment surfaces during the down-stroke, particularly when the apparatus is inclined from vertical as the hammer weight slides along the housing;
- makes lateral contact with the containment surfaces due to force applied by a driving mechanism and/or
- rebounds into the housing inner side walls after impacting the working surface.

The contact between the hammer weight and the containment surfaces described above may vary in duration, impact angle and magnitude according to the design of the apparatus, inclination of the apparatus during impacting operations and the specifics of the working surface. The velocity of the hammer weight in the applicant's own breaking machines can reach 8 $ms^{-1}$ in a driven hammer and up to 10 $ms^{-1}$ in a gravity-only impact hammer. The gravity-only impact hammer experiences the peak PV (pressure×velocity) when inclined at approximately 30° from vertical as the hammer weight bears on the housing side walls.

Regarding the apparatus design, pertinent parameters include the size and shape of the hammer weight and the degree of lateral clearance between the hammer weight's lateral periphery and the containment surfaces.

As referred to above, the containment surfaces act as barriers to the ingress of material and also constrain or guide the movement of the hammer weight within the lateral confines of the containment surfaces. In prior art apparatus, the clearance between the hammer weight and the containment surfaces is a compromise between competing factors, namely:

- a narrow clearance minimizes the space for the hammer weight to be accelerated laterally, thereby decreasing the impact force on the containment surfaces, at the expense of a high precision requirement during manufacturing;
- a large clearance reduces the precision required during manufacturing, at the expense of allowing the hammer weight to be accelerated under the effects of any lateral force component for a longer duration resulting in a greater impact force on the containment surfaces.

To maximise the operating efficiency of an impact hammer, it is desirable to minimise any impediment, hindrance or drag caused by the housing during lifting of the hammer weight which would increase wear and slow the cycle time of the apparatus. Equally, any such impediment to the passage of the hammer weight on the down-stroke would dissipate energy that could otherwise be imparted to the working surface. The hammer weight is thus typically raised by the drive mechanism in a manner designed to avoid any undue contact pressure on the housing, e.g. via a strop attached to the upper centre of the hammer weight.

It will be appreciated that while the containment surfaces do constrain the path of the hammer weight, they do not always guide the hammer weight in the sense of providing a continual, active or direct directional control over the weight's path. However, the housing inner side walls adjacent the path of the hammer weight do still laterally constrain the path of the hammer weight, within defined boundaries, effectively acting as a guide.

Consequently, and to aid clarity, the containment surfaces adjacent the path of the hammer weight may also be referred to herein as the housing inner side walls.

Mechanical breaking apparatus such as impact hammers operate by applying high impact forces to the working surface, achieved by the abrupt deceleration of the large hammer weight at the instant of impact. It is thus an unavoidable consequence of the high energy kinetic forces generated by the downward acceleration of the hammer weight that any impact with the housing inner side walls causes appreciable shock forces and noise. Moreover, if the working surface fails to fracture, or deforms in a manner insufficient to fully dissipate all of the impact energy, any lateral component of the re-bounding hammer weight's movement will result in an impact between the hammer weight and the housing inner side walls, also generating high levels of shock and noise.

Embodiments of the present invention address these difficulties by providing cushioning slides on the reciprocating hammer weight. Although it is conceivable to place cushioning slides on the static surface of the housing inner side walls, this is less practical and economic for several reasons.

Firstly, the entire length of the reciprocation path of the hammer weight would require cushioning slides protection. In comparison, only a relatively small fraction of the hammer weight requires covering by the cushioning slides with an attendant materials cost saving.

Secondly, as the housing (including the containment surfaces) needs to be highly robust, it is typically formed as a forged steel elongated passageway and therefore it is highly problematic to add, maintain or replace cushioning slides attached to the containment surface.

Thirdly, the effect of repeated impact/contacts by the hammer weight on an elongated cushioning slide is to generate ripples in the first and second layers which distort into the path of the falling hammer weight, ultimately leading to failure.

Finally, it offers no intrinsic advantage over locating the cushioning slides on the hammer weight to offset the aforesaid drawbacks. Naturally, the properties of the materials used in the cushioning slides are critical to their successful functioning.

The types of contact between the hammer weight and the containment surfaces described above are characterised by high speeds and very high impact forces. Unfortunately, materials possessing a low coefficient of friction are typically not highly shock absorbent. Conversely, highly shock-absorbing materials typically have high coefficients of friction. It is thus not feasible to create an effective cushioned slide from a single material.

Further difficulties include the practical challenges of attaching or forming a cushioning slide on the surface of an impact hammer weight. Due to the high impact forces involved and the near instantaneous deceleration of the reciprocating hammer weight when impacting the working surface (either directly or via a striker pin), extremely high loads (e.g. 2000G) are placed on any attachment system used to secure the slides to the hammer weight. It is thus desirable for the cushioning slides to be as light as feasible to minimize such loads.

The first layer exterior surface is preferably formed from a material of predetermined low friction properties and of a suitable material able to minimize friction and maximize abrasion resistance during the repeated high velocity contacts (e.g. up to 10 $ms^{-1}$) with the housing inner side walls. According to one aspect, said first layer is formed from the group of engineering plastics including:

- Ultra High Molecular Weight Polyethylene (UHMWPE), Spectra®, Dyneema®
- Polyether Ether ketone (PEEK)
- PolyAmide-Imide (PAI)
- PolyBenzimldazole (PBI)
- PolyEthylene Terephthalate (PET P)
- PolyPhenylene Sulphide (PPS)
- Nylon including lubricant and/or reinforced filled nylon such as Nylatron™ NSM or Nylatron™ GSM.
- Composites such as Orkot
- any combination or permutation of the above.

The above list is not restrictive and should also be interpreted to include modifications to the above materials by modifying fillers, reinforcing materials and post-forming treatments such as irradiation for cross-linking polymer chains. Desirable characteristics for said first layer material include lightness, high wear resistance under moderate to high speed and pressure, shock resistance, a low friction coefficient and lower hardness to minimise noise levels on impact.

It is also possible to use metals for the first layer where a more robust material is required and in one embodiment the first layer is formed from:

- Cast iron, and/or
- Steel, including any alloy and/or heat treatment of the steel.

The weight of metal plates may be too great for most applications and so when used in the first layer, preferably utilises weight-reducing measures such as hollowing out to reduce mass-per-unit area.

New materials such as graphene, whilst not being presently commercially viable, may soon be a useful substitute for the above plastic or metal materials and provided they meet or exceed the physical requirements of the first layer they may be suitable for use in the present invention.

Preferably, said predetermined low friction properties of the first layer are an unlubricated coefficient of friction of less than 0.35 on dry steel of surface roughness Ra 0.8 to 1.1 μm.

Preferably, said predetermined abrasion resistance properties of the first layer are a wear rate of less than $10\times10^{-5}$ $m^2/N$ using metric conversion from ASTM D4060

Preferably, said first layer also possesses:

tensile strength of more than 20 MPa and compressive strength at 10% deflection of more than 30 MPa.

a hardness of more than 55 Shore D.

a high PV (pressure×velocity) value e.g. above 3000.

It will be appreciated by one skilled in the art, that a material with a low co-efficient of friction does not necessarily have a high abrasion resistance and vice versa. The use of UHMWPE offers particular performance benefits for both low friction and abrasion resistance at lower speeds and pressures. UHMWPE has high toughness and is economical to use, and allows the second layer to be formed as a thinner and/or less complex layer. For higher speeds and pressures, other more expensive plastics with high PV but reduced toughness such as Nylatron™ NSM may be used for the first layer with the second layer formed to be capable of more shock absorption per unit area.

Usage of dense materials such as steel requires appropriately designed mounting to ensure it doesn't dislodge from the hammer weight during impacting operations.

In one embodiment, the first layer exterior surface may have an application of a dry lubricant such as spray-on graphite, Teflon or molybdenum disulphide and/or the first layer may be embedded with a dry lubricant such as molybdenum disulphide.

The choice of material chosen for the first layer exterior surface is important for the effectiveness of the cushioning slide and will be chosen depending on the size of the reciprocating component, the forces involved and the operating environment. In low-friction materials there is often a trade-off made between wear and impact resistance with very low friction materials, (e.g. PTFE) not having enough impact resistance for the impact force remaining after the impact absorption performed by the second layer. In one preferred embodiment, the first layer material is chosen to have as low co-efficient of friction as possible while being able to withstand an instantaneous sliding speed of more than 5 $ms^{-1}$ and up to 10 $ms^{-1}$ at a sliding pressure of more than 0.05 MPa and up to 4 MPa with a wear rate of no more than 0.01 $cm^3$ per metre of travel, when used on housing inner side walls of steel with surface roughness of approximately Ra=0.8 to 3 μm. The first layer material is preferably capable of withstanding a shock pressure of more than 0.3 MPa and up to 20 MPa without permanent deformation.

The second layer is preferably formed from a material of predetermined shock absorbency properties and needs to be able to be attachable to a metal weight and the first layer, as well as being flexible and shock absorbing.

The second layer's shock-absorbing properties can be improved by choosing a material capable of absorbing higher shock forces or simply making a thicker layer of the same material. However, a thicker layer takes longer to return to its original shape form ready for the next impact, doesn't maintain its shape as well and can overheat. In one embodiment, the second layer is formed from multiple sub-layers. The provision of multiple sub-layers in the second layer can improve the shock-absorbing characteristics without the disadvantages of a singular layer of the same thickness. Reference herein to a second layer should thus be interpreted as potentially including multiple sub-layers and not limited to a singular unitary layer.

According to one embodiment, said second layer includes an elastomer layer, preferably polyurethane.

Preferably said elastomer has a Shore A scale value of 40 to 95.

Combining the properties of the first and second layers in the cushioning slide prevents high impact shock loads damaging or breaking the first layer and prevents the easily abraded second layer from being damaged or worn away from repeated sliding contact with the housing inner side walls.

Successfully combining the disparate materials of the first and second layer together requires a robust structure capable of withstanding the loads imposed during impacting operations. Preferably, the first and second layers are releasably attached together. Said releasable attachment may take the form of clips, screws, cooperative coupling parts, reverse countersinks or nesting. In one embodiment the releasable attachment may be a nesting arrangement such that the housing inner side walls hold the layers in place in a socket in the reciprocating component. In an alternative embodiment, the first and second layers are integrally formed, or bonded, or in some other way non-releasable. It will be appreciated however that by configuring the first layer to be detachable from the second layer, permits a layer's replacement after a period of wear without necessitating replacement of the whole cushioning slide.

When a compressive load is applied to the elastomer forming the second layer, the elastomer absorbs the shock by displacement of volume of the elastomer away from the point of impact. If the elastomer is surrounded by any rigid boundaries, this forces the direction of the elastomer volume displacement to occur at any unrestrained boundaries. Thus, if the elastomer is bounded by rigid surfaces on an upper and lower surface, the elastomer is displaced laterally between the rigid layers when under compression. However, if the elastomer is not able to be freely displaced, the elastomer acts like a confined incompressible liquid and consequently applies high, potentially destructive pressure on its surroundings. If the surrounding structures are sufficiently robust, the elastomer itself will fail.

To function effectively as a shock-absorber, the elastomer requires a void into which the displaced volume may enter under the effects of compression.

Thus, according to a further aspect of the present invention, said cushioning slide and/or a portion of said reciprocating component adjacent the cushioning slide is provided with at least one displacement void, configured to receive a portion of said second layer displaced during compression.

In one embodiment, said displacement void may be formed in:

said first layer;

said second layer;

said reciprocating component, or a combination of the above.

Although displacement voids may be formed in the first layer, these would typically require being machined into the structure of the first layer material (e.g. UHMWPE, Nylon, or Steel). Furthermore, although compression voids may be machined, or otherwise formed directly into the hammer weight, care is required to avoid generating stress fractures from discontinuities in the hammer weight's surface.

Therefore, forming at least one said displacement void in the second layer offers several advantages in ease of manufacturing and fitment. Thus, according to a further aspect of the present invention, said cushioning slide is formed with at least one displacement void. Preferably, said void is formed as:

an aperture extending through the second layer;

a repeating corrugated, ridged, beaded, saw-tooth and/or castellated pattern applied to at least one second layer side contacting the first layer and/or reciprocating component;

a scalloped or otherwise recessed lateral peripheral portion, any combination or permutation of same.

Preferably, said first and second layers are substantially parallel. Preferably, said second layer is substantially parallel to an outer surface of said reciprocating component. Thus, the impact force will generally act normally to the majority of the second layer.

In one embodiment, the first and second layers are unbonded to each other, preferably being held in mutual contact by clips, screws, threads, couplings, or the like. In contrast, attaching the elastomer to the first layer by adhesives or the like would prevent the elastomer from displacing laterally under compression except at the outer periphery. Consequently, not only would this reduce the shock absorbing capacity of the elastomer, it increases the likelihood of damage under high loads as the two layers act to tear apart the mutual bonding.

It has been found in practice that the high forces generated by the violent decelerations accompanying impacting operations can create up to a thousand-fold increase over the force of gravity (1000 G) applied by the static hammer weight and any component attached thereto. Thus, a cushioning slide weighing just 0.75 kg generates a shock load of 750 kg when subjected to 2000 G.

In one embodiment the present invention addresses the issue of withstanding such high G forces on the cushioning slides by locating the cushioning slides in a socket in the hammer weight or reciprocating component.

According to one aspect, the cushioning slides are located on the reciprocating component in at least one socket, said reciprocating component having a lower impact face and at least one side face, said socket being formed with at least one ridge, shoulder, projection, recess, lip, protrusion or other formation presenting a rigid retention face between said lower impact face and at least a portion of the cushioning slide located in the socket on a side wall of the reciprocating component.

Alternatively, where said reciprocating component has a lower impact face and at least one side face, the cushioning slides are located on the reciprocating component on an outer surface of said side face, said side face being formed with at least one ridge, shoulder, projection, recess, lip, protrusion or other formation presenting a rigid retention face between said lower impact face and at least a portion of the cushioning slide located on said side wall of the reciprocating component.

In one embodiment, said retention face is positioned at a cushioning slide perimeter located about:

a lateral periphery of;

an inner aperture through, and/or a recess in, the cushioning slide.

The retention face provides the support to prevent the cushioning slide being detached from the reciprocating component under impact of the reciprocating component with the working surface/striker pin and/or the housing inner side walls. A retention face may be formed as outwardly or inwardly extending walls forming projections or recesses respectively, substantially orthogonal to the side walls of the reciprocating component surface.

A retention face may also be formed with a variety of retention features to also secure the cushioning slide to the reciprocating component side wall from the component of forces substantially orthogonal to the reciprocating component side walls. Such retention features include, but are not limited to, a reverse taper, upper lip, O-ring groove, threads, nesting or other interlocking feature to retain the cushioning slide attached to the reciprocating component.

In one embodiment, said retention face may be formed as walls forming at least one location projection passing through an aperture in at least the second layer, and optionally also the first layer.

In one embodiment, a locating portion of the first layer of the cushioning slide extends through said second layer into a recess in the reciprocating component side wall, said recess thereby presenting a retention face to said location portion.

It will be appreciated that employment of a location portion and/or a locating projection enables a cushioning slide to be positioned at a distal edge of the reciprocating component side wall, without a retention face surrounding the entire outer periphery of the cushioning slide.

The first layer may also be releasably secured to the second layer by a variety of securing features, including a reverse taper, upper lip, O-ring groove, threads, clips, nesting or other inter-locking or mutually coupling configurations.

In one embodiment, the second layer is an elastomer layer bonded directly to the surface of the reciprocating component side wall. As will be familiar to one skilled in the art, the surface of an elastomer such as polyurethane is highly adhesive and may be bonded to the steel hammer weight reciprocating component through being formed in direct contact.

The size, location and shape of the cushioning slides are axiomatically dependant on the shape of the reciprocating component. In the case of a reciprocating component formed as rectangular/square cross-section block-shaped hammer weight, used to impact a striker pin, it will be appreciated that any of the four side faces and corners may potentially come into contact with the housing inner side walls.

As the reciprocating component travels downwards, any deviation from a perfectly vertical orientation for the path of the reciprocating component and/or the orientation of the housing inner side walls can lead to mutual contact. The initial point of impact of such a contact is predominantly near one of the reciprocating component's 'apices', e.g. the corners between lateral faces. This impact applies a moment to the reciprocating component which causes the reciprocating component to rotate until impacting on the diametrically opposite apex. The cushioning slides are therefore preferably located towards the distal ends of the reciprocating component. As referred to herein the reciprocating component's 'apices' refer to the lateral points or edges of the reciprocating component such as the corners of a square or rectangular cross-section or the junctions between two faces of the reciprocating component.

Therefore, according to one aspect, said first layer is formed to project beyond the outer periphery of the reciprocating component side walls adjacent the cushioning slide.

According to one aspect, said reciprocating component is square or rectangular in lateral cross-section, with substantially planar side walls connected by four apices, wherein a cushioning slide is located on at least two sides, two apices, and/or one side and one apex. Preferably, said cushioning slides are located on at least two pairs of opposing side walls and/or apices.

In addition to the lateral placement of the cushioning slides described above, the longitudinal location of the cushioning slides (with respect to the longitudinal axis of the elongate reciprocating component) is influenced by the operational characteristics of the apparatus. The appropriate longitudinal positioning of the cushioning slides can be subdivided into the following categories:

- uni-direction, e.g. unitary hammer weights and weights used to impact striker pins;
- bi-direction, e.g. unitary hammer weights, with impact tool ends at both ends of a reversible hammer and/or uni-direction hammers also used for levering and raking.

Impact hammers as described in WO/2004/035939 are also used for raking and levering rocks and the like with the hammer tip extending from the hammer housing. Such manipulation of the working surface is highly abrasive and contact by the working surface with any portion of the hammer weight with a cushioning slide will damage the cushioning slide and must be avoided. Consequently, when utilized in conjunction with a reversible hammer with two opposing tool ends, the cushioning slides need to be equidistantly placed sufficiently far away from the exposed hammer tool ends to avoid damage with the hammer in either orientation.

Embodiments of cushioning slides for use with a reversible hammer are preferably shaped as an elongate substantially rectangular/cuboid plate or blade configuration, with a pair of wide parallel longitudinal faces, joined by a pair of parallel narrow side faces. Such a configuration enables cushioned slides located on the short sides to readily extend sufficiently to provide cushioning for both the wide sides, in-effect wrapping around the sides of the hammer weight. Such a configuration enables just two cushioning slides to be used to protect from impact on all four sides.

Thus, according to one aspect, the present invention includes at least two cushioning slides located on opposing sides of a rectangular cross-sectioned reciprocating component, said cushioning slides being configured and dimensioned to extend about a pair of adjacent apices.

A typical rock-breaking machine reciprocating cycle involves a lifting of a hammer weight followed by the impact stroke. The hammer weight drops in a housing along one or two housing side walls and strikes the rock surface or a striker pin and bounces back, potentially striking another side wall. It is this subsequent side-wall impact that generates a large amount of noise. As discussed above, the potential impact force and noise generated from an impact of the hammer weight and the housing inner side walls increases with increasing separation between the hammer weight and the housing inner side walls as the hammer weight has greater distance to build up relative speed. However, decreasing the 'clearance' to the walls requires the housing and hammer weight to be manufactured more precisely.

According to a further embodiment, said cushioning slides include at least one pre-tensioning feature or 'pre-load' for biasing the first layer toward the housing side walls.

In one preferred embodiment the pre-tensioning feature may be a pre-tensioning surface feature formed in or on at least one of:

- the first layer lower surface;
- the second layer upper surface;
- the second layer lower surface,
- a surface of a second layer sub-layer, and/or
- the reciprocating component side wall surface adjacent the underside of the second layer, said pre-tensioning feature biasing apart the surface provided with at least one pre-tensioning feature and an adjacent surface contacting said pre-tensioning feature.

The pre-tensioning feature is preferably a surface feature shaped and sized such that it compresses more easily than said second layer.

In one embodiment, the pre-tensioning feature is formed from a material having a lower elastic modulus than said second layer material.

In another embodiment, the pre-tensioning feature is formed by shaping the second layer, or sub-layer thereof, to provide said bias, preferably being tensioned when the cushioning slide is assembled on the reciprocating component.

The pre-tensioning feature may thus bias the first layer toward the housing side walls and axiomatically space the reciprocating component from the housing side walls. The pre-tensioning features may thus eliminate or at least reduce the clearance between the cushioning slides and the housing side walls, thereby reducing potential lateral impact noise. The pre-tensioning feature also compensates for reduction in the thickness of the first layer due to wear. The pre-tensioning feature may also assist in centralizing the reciprocating component when it is not plumb or is travelling through a housing which has a variable side clearance.

Preferably, said reciprocating component with cushioning slides incorporating at least one pre-tensioning feature is configured and dimensioned such that at least one said cushioning slide is in continuous contact with the housing inner side walls during reciprocation of the reciprocating component. Preferably, said pre-tensioning feature is elastic.

In one embodiment a pre-tensioning feature may be pre-tensioned when the reciprocating component is laterally equidistantly positioned within the housing inner side walls.

Thus, the outer surface of the first layer of the cushioning slide is biased into light contact with the housing inner side walls when the housing is substantially vertical. In use when the reciprocating component reciprocates, any lateral component of a force experienced by the reciprocating component acts to compress the pre-tensioning feature. The pre-tensioning feature is thus compressed to a point where any additional compressive force causes the elastomer of the second layer to deflect as discussed above in the earlier embodiments. By appropriate choice of the shape and bias of the pre-tensioning feature and the second layer elastomer, the first layer may be maintained in contact with the housing inner side walls with sufficient bias to prevent becoming detached during reciprocation, but without hindering the shock-absorbing capacity of the second layer.

In one embodiment, said pre-tensioning feature includes spikes, fins, buttons, or the like formed into the second layer.

According to a yet further aspect, said cushioning slides include a wear buffer. If for example, an impact hammer was used for a prolonged period at an appreciable inclination, a force results on the lowermost housing inner side wall and the cushioning slides facing the lower sidewall. Such prolonged use may cause the elastomer in the affected cushioning slides to become overstressed and potentially fail. The elastomer is able to recover its resilient capabilities if the intensity and/or duration of the overstressing do not exceed certain limits. Consequently, the wear buffer provides a means of preventing compression of the second layer elastomer beyond a predetermined threshold. In one embodiment, the wear buffer is provided by said retention face configured as walls forming at least one location projection passing through apertures in the second layer and first layer. As discussed above, a location projection is a means of securing the cushioning slide to the reciprocating component side walls under impact forces. However, it also provides the capacity for being configured as a wear buffer, whereby after deflection of the second layer elastomer has reduced the thickness of the elastomer beyond a predetermined point, the location projection extends through the aperture in the first layer sufficiently to contact an inner housing side wall. The steel housing side wall thus bears on the location projection preventing any further compression of, of damage to, the elastomer second layer. Although this will result in some increased noise generation it will be substantially less than if there was no buffer at all.

In another embodiment, the cushioning slide is configured with dimensions such that when the second layer is compressed past its normal operating limits (typically 30% for a typical elastomer) the surface of the reciprocating component surrounding the recess containing the cushioning slide bears on the housing inner side walls.

According to a further aspect, the present invention provides a cushioning slide for attachment to a reciprocating component in an apparatus;

said reciprocating component being movable along a reciprocation path in at least partial contact with at least one containment surface of said apparatus, said cushioning slide formed with an exterior first layer and an interior second layer, wherein;

said first layer is formed with an exterior surface configured and orientated to come into at least partial contact with said containment surface during said reciprocating movement of the component, said first layer being formed from a material of predetermined low friction properties, and said second layer is formed with at least one surface connected to said first layer and at least one interior surface connectable to said reciprocating component, said second layer being formed from a material of predetermined shock absorbency properties.

According to a further aspect, there is provided a method of assembling a reciprocating component, said method including the step of attaching an aforementioned cushioning slide to the reciprocating component.

As stated previously, the present invention is not limited to impact hammers or other rock-breaking apparatus and may be applied to any apparatus with a reciprocating component involving multiple mutual collisions between parts of the apparatus.

The present invention thus offers significant advantages over the prior art in terms of improvement in impacting performance, and a reduction in manufacturing cost, noise and maintenance costs.

It has been found the present invention achieves a noise reduction of 15 dBA on the applicant's gravity impact hammer. This gives a highly significant operational improvement. The earlier impact hammer generated 90 dBA at 30 m in use, while the present invention generates only 75 dBA at 30 m. Moreover, the widespread legislative noise limit for operating such machinery in the proximity of urban areas of 55 dBA which was previously reached at 1700 m is now only reached at 300 m—a more than 5-fold improvement.

The typical frictional power losses of an impact hammer weight are approximately 12-15%. The co-efficient of friction of steel on steel is 0.35, whereas UHMWPE or Nylon on steel is less than 0.20. Thus, the present invention utilising UHMWPE as the cushioning slide first layer has been found to reduce these losses by approximately 40% to 7-9%. The hammer drive mechanism is thus able to lift a 3-5% heavier hammer weight and, in the case of a drive down hammer, drive the hammer weight downwards with 3-5% less losses, with a commensurate improvement in demolition effect.

The reduction in shock load applied to the apparatus because of the shock absorbing second layer enables either an extension in the working life of the apparatus or the ability to manufacture a housing with a lighter, cheaper construction.

The use of the aforementioned cushioning slide also enables apparatus to be manufactured to wider tolerances, thereby reducing costs further. This is achievable due to the change from steel on steel contact between the hammer weight and the housing hammer weight guide (housing inner guide walls) to a low-friction first layer (e.g. UHMWPE) contact with the steel housing hammer weight guide. The steel/steel contact required a high level of machining accuracy and low tolerances to minimise the shock and noise levels as far as possible. Furthermore, the housing casings are typically un-machined weldments which are difficult to manufacture to exact tolerances, and if incorrect necessitate machining of the hammer weight which is difficult and time consuming and results in requirements for non-standard parts.

In contrast, the use of the aforementioned cushioning slide allows the hammer weight to be manufactured to rough tolerances, or even rough cast or forged before accurately machining a relatively small part of the hammer weight sides for placement of the cushioning slides. Any discrepancy in the necessary width of the hammer weight can be accommodated simply be adjusting the thickness of the cushioning slide, typically via adjustment of the first layer.

The details of the striker pin configuration in conjunction with the present invention are considered in further depth below.

In use, the striker pin is placed in a primed position by the operator positioning the striker pin impact end against or as close to the working surface as possible. If placed against the working surface the striker pin is forced into the housing until being restrained by the retaining pin(s) engaging with the distal travel stop. The impact hammer is thus primed to receive and transmit the impact from the hammer weight to the working surface.

When the hammer weight is dropped onto the striker pin, unless the working surface fails to fracture, the striker pin is forced into the working surface until it is prevented from any further movement by the retaining pin contacting the proximal travel stop at the end of the sliding coupling recess closest to the hammer weight. In the event of an ineffective strike, whereby the working surface fails to fracture, or otherwise distort sufficiently for the striker pin to penetrate after impact, the striker pin recoils reciprocally along the axis of the striker pin forcing the distal travel stop against the retaining pin.

A 'mis-hit' occurs when the operator drops the hammer weight on the driven end of the striker pin without the impact end being in contact with the working surface. In the event of a mis-hit, the impact of the hammer weight forces the proximal travel stop against the slideably coupled retaining pin.

Even if the working surface does fracture successfully after a strike, the impact may only absorb a portion of the kinetic energy of the striker pin and mass. In such instances, known as 'over-hitting', the resultant effect on the impact hammer is directly comparable to a 'mis-hit'.

Thus, during impact operations when the retaining pin(s) are forced into engagement with either the distal or proximal travel stop, any remaining striker pin momentum is transferred to the retainer, which in turn acts on the shock-absorbing system.

According to a further embodiment, at least one shock-absorbing assembly is slideably retained within the housing about the striker pin, wherein said impact hammer is provided with guide elements located within said nose block configured to provide a centring effect on the elastic layers of the shock absorbing assemblies during impacting operations.

The present invention enables the use of numerous different configurations of guide elements in addition to the elongate slides described above. Despite the difference in physical form and implementation, all the guide element embodiments share the common purpose of maintaining the relative position of the elastic layers and the housing and/or striker pin. It will be appreciated that the shock absorber may function without guide elements, although it is advantageous to do so to maximise the usable volume available to incorporate the largest bearing surface for each elastic layer without interference with the housing and/or striker pin walls.

As used herein, the terms 'centering' or 'centred' include any configuration or arrangement at least partially applying a restorative or corrective effect to lateral displacement of the shock absorbing assemblies away from the longitudinal impact axis during impacting operations. It will be appreciated that while the impact axis and the striker pin longitudinal axis are normally substantially co-axial, any wear by the striker pin on the nose block may cause the striker pin longitudinal axis to deviate. Any such deviation may cause the shock absorbing assemblies to adversely interfere with the side wall of the nose block and thus requires a restorative centering action to keep the alignment of the shock absorber within acceptable limits.

Moreover, as discussed in more detail elsewhere, the shock absorbing assemblies' elastic layers are configured to freely deflect laterally during compression without being bonded or attached to the inelastic layers, the adjacent nose block lower and upper planar boundary and/or the retainer. Consequently, the lateral alignment of the elastic layers within the nose block must be maintained within acceptable levels, i.e. centred, to prevent any destructive interference with the surface of the striker pin, nose block side walls and/or nose block bolts.

According to a further aspect, the alignment of the shock absorbing assemblies' elastic layers is provided by said lower vacuum sealing formed as part of said elastic layers, while said alignment may also be provided directly by the inelastic layers, wherein said lower vacuum sealing if formed by, in, or adjacent said inelastic layer.

According to one aspect, the guide elements are provided in the form of elongate slides arranged on inner walls of the housing and orientated parallel to the longitudinal axis of the striker pin, said elongate slides configured to slideably engage with a cooperatively shaped portion of the elastic layer periphery. In one embodiment, the elongate slide guide elements are formed with a longitudinal recess and said shaped portion of the elastic layer is formed as a complimentary projection. In an alternative embodiment, the elongate slides are formed with a longitudinal projection and said shaped portion of the elastic layer is formed as a recess complimentary to the cross section of said projection. In an alternative embodiment, guide elements may be provided in the form of elongate slides arranged on the exterior of the striker pin. It will also be appreciated that the slidable engagement between the elastic layer periphery and the striker pin may be formed by a recess on the elongate slide guide element and a protrusion on the elastic layer periphery or vice versa Preferably, a said projection is a substantially rounded, or curved-tip triangular configuration, sliding within a complementary shaped recess or groove. The above described embodiments thus provide locating, or 'centering' of the elastic layers during longitudinal movement caused by shock-absorbing impact, preventing the laterally displaced/deflected portions of the elastic layer from impinging on the housing and/or striker pin walls.

During the compressive cycle the edges of the elastic layer are subject to large changes in size and shape. Any excessively abrupt geometric discontinuities at the edges are subject to significantly higher stresses than gradual discontinuities. Thus the elastic layer is preferably shaped as a substantially smooth annulus without sharp radii, small holes, thin projections and the like as these would all generate high stress concentrations and consequential fractures. Unsupported stabilising features being formed directly on the elastomer layer are thus difficult to successfully implement and would be subject to being worn rapidly, or even being torn off if the elongate slide guide elements were formed from a rigid material. Consequently, according to a further aspect, said elongate slide guide elements are formed from a semi-rigid or at least partly flexible material.

If large and/or unsupported stabilising features were formed, there is a risk they would fracture along the point of exiting the lateral periphery of the corresponding shock-absorbing assembly.

At any point where an elastic layer such as polyurethane is locally constrained by a rigid surface (i.e. is prevented from expanding in a particular direction), it becomes incompressible at that location and would be rapidly destroyed by the intense self-generated heat caused by the applied compressive forces. Thus, the elastic layer must always be capable of free or relatively free expansion in at least one direction throughout the compressive cycle. This could be accomplished simply by limiting elastic layer lateral dimensions overly conservatively. However, such an approach does not make efficient use of the available cross-sectional area in the nose block to absorb shock. Thus, it is advantageous to maximise usage of the lateral area available without jeopardising the integrity of the elastic layers. The incorporation of guide elements provides a means of attaining such efficiency.

It will be appreciated that although the elastic layer also expands inwardly towards the striker pin, contact with the striker pin is not as problematic due to the loaded shock-absorbing assembly (i.e. the shock absorbing assembly being compressed during shock absorbing) and the striker pin moving longitudinally substantially in concert. According to one aspect of the invention, the guide elements in the form of elongate slides are formed from a material of greater resilience (i.e. softer) than the elastic layer. Consequently, as the elastic layer expands laterally in use under compression and projection(s) move into increasing contact with the guide elements, two different types of interaction mechanism occur. Initially, the projections slide parallel to the longitudinal striker pin axis, until the contact pressure reaches a point where the guide element starts to move in conjunction with the elastic element parallel to the striker pin longitudinal axis. The elongate slide guide element thus offers minimal abrasive, or movement resistance to the elastic layer projections. Moreover, in addition to preventing the projection becoming locally incompressible, the increased softness of the guide element compared to the elastic layer projections causes the effects of any wear to be predominately borne by the guide element. This reduces maintenance overheads as the guides may be readily replaced without the need to remove and dismantle the shock-absorbing assemblies.

According to a further aspect, at least one projection includes a substantially concave recess at the projection apex. Preferably, said recess is configured as a part-cylindrical section orientated with a geometric axis of revolution in the plane of the elastic layer. Under compressive load, the centre of the elastic layer is displaced outwards by the greatest extent. The recess or 'scoop' of removed material from the projection apex enables the elastic layer to expand outwards without causing the centre of the projection to bulge laterally beyond the elastic layer periphery. The volume and shape of the recess is substantially equivalent to the reciprocal, or invert shape and volume of the elastic layer that would otherwise protrude outwards beyond the adjacent inelastic layer if the elastic layer periphery were perpendicular to the planar surfaces of the elastic and inelastic layers.

Removal of the volume of material to form the recess causes a reduction (relative to an elastic layer without such a recess) in the pressure subjected by the elastic layer periphery contacting the guide element and/or nose block side walls during shock absorbing induced compression of the elastic layer. As the peripheral edge of the compressed elastic layer contacts the guide element and/or nose block side walls with a substantially flush surface, the surface area is larger (and thus the pressure is smaller) in comparison to the smaller surface area of the contact point of the bulge produced by an elastic layer without a recess.

Alternative methods for generating a reduced contact pressure between the elastic layer periphery and the guide element and/or nose block side walls may be achieved by variations in the elastic layer and inelastic layer peripheral edge profile. According to one embodiment, the elastic layer thickness adjacent the peripheral edge is reduced to form a tapered portion. According to an alternative embodiment, the inelastic layer thickness adjacent the peripheral edge is reduced to form a tapered portion. Effectively, both embodiments provide a means to reduce the pressure exerted on the elastic layer periphery under compression by for reducing the volume of the either the elastic layer peripheral edge or the inelastic layer peripheral edge with a negligible impact on the volume or thickness of the whole layer.

The reduction in pressure applied by the elastic layer to the guide element in the above described embodiments has the additional benefit of preventing any adverse impingement on the functioning or integrity of the guide element during compressing of the shock absorber assembly.

In an alternative embodiment, the guide elements are formed as locating pins, located between an inner and an outer lateral periphery of the elastic layers, orientated to pass through, and laterally locate, each elastic layer in an individual shock absorbing assembly substantially parallel with the striker pin longitudinal axis. Preferably said pins are attached to said inelastic layer, extending orthogonally from a said planar surface of the inelastic layer to pass through an elastic layer. In one embodiment, locating pins on opposing planar sides of the inelastic layer are aligned co-axially, optionally being formed as a single continuous element, passing through at least two elastic and one inelastic layer. In an alternative embodiment, said pins are located in pairs mounted co-axially on opposing sides of the inelastic layer. It will be appreciated however, that the locating pins on either side of the inelastic layer do not necessarily need to be aligned, or the same in number.

Although the elastic layer deflects outwards towards the nose block walls and inwards towards the striker pin under compression, it will be readily appreciated that here is a null-point position between the inner and outer lateral periphery that is stationary. As this null-point position is laterally stationary during shock absorbing, there is no relative movement between the elastic layer and locating pin guide element passing through the elastic layer, and consequently, no tension nor compression generated therebetween. Thus, in another alternative embodiment said locating pin is located on the inelastic layer at a location corresponding to a null position in the corresponding elastic layers. It will be understood the null position for a generally annular elastic layer, will be a generally annular path located between the inner and outer periphery of the elastic layer.

Preferably four locating pins are employed on each side of a said inelastic layer, radially disposed equidistantly about the striker pin. It will be appreciated however that two or more pins may be employed to ensure the centring of the elastic layers.

In a yet further embodiment, another alternative configuration of guide elements is provided in the form of a tension band circumscribing an elastic layer and one or more anchor points. In one embodiment, said anchor points are provided by four nose block bolts located centrally and equidistantly about the sides of the nose block walls. Preferably a separate tension band is provided for each elastic layer. It will be appreciated however that the tension band may be configured to pass around a differing number of anchor points, including nose block bolts and/or other portions of, or attachments to the nose block side walls.

The tension band may also be formed of an elastic material such as an elastomer. According to one aspect, the portion of the tension band passing around the nose block bolts passes through a shallow indent in the adjacent nose block side wall, thereby securing the band from sliding up or down the nose block bolts during use. The tension band need not necessarily pass around the nose bolts, and may instead pass around or through other anchor points such as a portion of the side walls and/or some other fitting. The centering force applied by the tension bands onto the elastic layer is proportional to the degree the band is displaced from a direct liner path between two anchor points by the outer periphery of the elastic layer. It will be understood therefore that the potential restorative centering force applied by the tension band may be varied by selection of different tension band material, separation and location of the anchor points and the shape and dimensions of the elastic layer and the degree of deflection it produces on the band portions between successive anchor points.

As described previously, unsupported stabilising features formed directly on the elastic layer periphery are difficult to successfully implement and could be subject to rapid wear or even failure during use unless used in conjunction with guide elements in the form of non-rigid elongate slides. However, in another embodiment, a further alternative configuration of guide elements is provided in the form of supported stabilizing features projecting directly from the elastic layer outer periphery to contact the nose block side walls. Preferably, said supported stabilizing features on said elastic layer are supported on at least one planar surface by a correspondingly shaped adjacent inelastic layer. In one embodiment, the inelastic layer is formed with substantially square or rectangular planar surfaces with at least one tab portion located at the outer periphery, shaped to substantially correspond to the shape and/or location of a corresponding stabilizing feature on the adjacent elastic layer. Preferably, said tab portions are located at each apex of the inelastic layer and are shaped to pass between adjacent nose bolts to within close proximity of the nose block side wall.

An unavoidable consequence of use is that the impact hammer is naturally subject to wear and tear. In addition to erosive wear of the striker pin, the sides of the striker pin wear the sides of the apertures through the nose plate and cap plate. This wear causes the striker pin longitudinal axis to become misaligned from the impact axis and consequently brings the shock absorbing assemblies surrounding the striker pin into closer proximity with the nose block walls. Incorporating a degree of lateral clearance between either the striker pin and the inner inelastic layer periphery or the nose block side walls and the outer inelastic layer periphery enables a commensurate degree of said wear to be successfully accommodated. In order to maintain a consistent clearance separation, the opposing lateral periphery of the inelastic layer also requires some form of centering, in addition to the above-described centring of the elastic layer. While the inelastic layers naturally do not expand or deflect laterally under compression, any variation in lateral alignment during impacting use may cause an interference with the nose block walls and/or any other structures inside the nose block such as said nose block bolts.

In one embodiment, the inelastic layer is configured with its inner periphery positioned immediately adjacent the striker pin, with a clearance between the outer inelastic layer periphery and the nose block walls.

In an alternative embodiment the inelastic layer is configured with its outer periphery positioned immediately adjacent at least a portion of the nose block walls and/or nose bolts, with a clearance between the inner inelastic layer periphery and the striker pin. In the former embodiment, although the inelastic layer remains centred via the its proximity to the striker pin, there remains the possibility of a non-circular inelastic layer rotating about the striker pin and thus detrimentally interfering with the nose block side walls and/or nose block bolts.

The present invention is thus provided with a pair of restraining elements, placed about the inner nose block walls, positioned and dimensioned to obstruct rotation of the inelastic layer, whilst permitting movement parallel to the longitudinal impact axis. In one embodiment, said restraining elements comprise a pair of substantially elongated cuboids positioned adjacent the nose block inner walls, and extending laterally inwards toward the striker pin beyond a pair of nose bolts at the nose block side walls.

In one embodiment, the term housing is used to include any portion of the impact hammer used to locate and secure the hammer weight and, if part of the apparatus, the striker pin, including any external casing or protective cover, nose-block (through which the striker pin protrudes), and/or any other fittings and mechanisms located internally or externally to said protective cover for operating and/or guiding said hammer weight to contact the striker pin, and the like. The nose block may be formed as a discrete item (attached to the remainder of the housing) or be a part of an integrally formed housing; both these nose block construction variants being included as part of the housing as defined herein.

Various embodiments of the present invention thus provide a host of advantages and benefits over the prior art as described herein including, but not limited to:

- easily configuring the percentage of the total impact energy provided by the vacuum, depending on the ratio of hammer weight cross-section to weight;
- weight savings sufficient to enable a vacuum-assisted impact hammer to be produced with an impact energy to weight ratio of double that of a comparable sized gravity-only impact hammer;
- a vacuum-assisted impact hammer configured with a total hammer weight reduction that is not only enough to move to a lower excavator weight class for the same impact energy but such that the capital cost reduction for the excavator exceeds the entire cost of a prior art gravity hammer.

It should be appreciated that the disclosure herein encompasses embodiments where any one or more of the features, components, methods or aspects, either individually, partially or collectively of any one embodiment or aspect may be combined in any way with any other feature of any other embodiment or aspect and the disclosure herein does not exclude any possible combination unless explicitly stated otherwise.

BRIEF DESCRIPTION OF DRAWINGS

Further aspects and advantages of the present invention will become apparent from the following description which is given by way of example only and with reference to the accompanying drawings in which:

FIG. 33*a* shows an enlarged plan section view of the weight and cushioning slides in FIG. 32 located inside the housing inner side walls, the cushioning slide having pre-tensioning features fitted;

FIG. 33*b* shows an enlarged plan section view of weight and cushioning slides in FIG. 33*a*, with a compressive force applied to the pre-tensioning features;

FIG. 34*a* shows an exploded diagram of a cushioning slide according to another embodiment of the present invention;

FIG. 34*b* shows an assembled diagram of the cushioning slide of FIG. 34*a;*

DETAILED DESCRIPTION OF THE PREFERRED EMBODIMENTS

Figure 1:
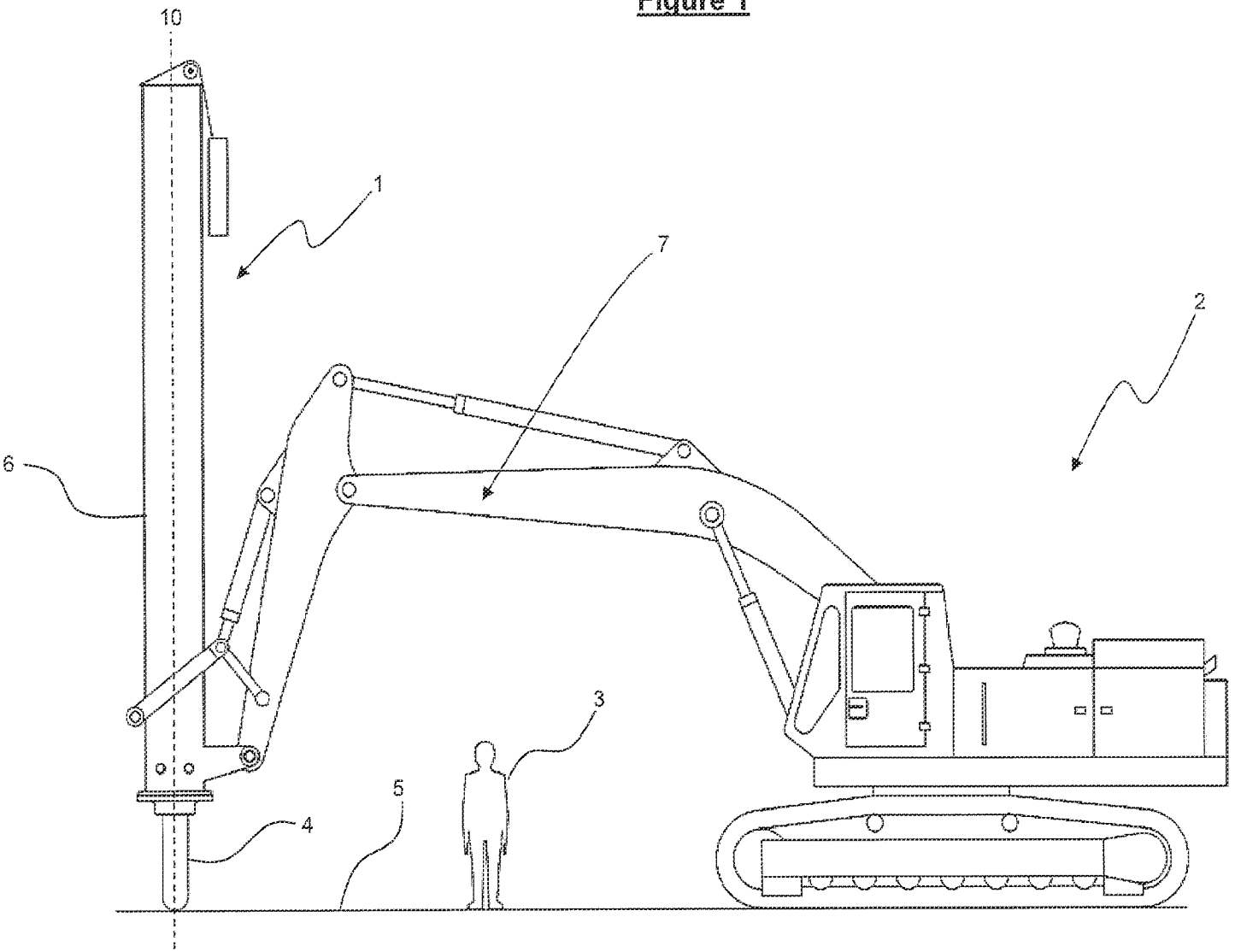
FIG. 1 shows a preferred embodiment of the present invention of an apparatus in the form of an impact hammer attached to an excavator.

Reference numerals for the figures (1)—Impact hammer
(2)—excavator
(3)—human operator
(4)—striker pin
(5)—working surface -continued (6)—housing
(7)—excavator arm
(8)—containment surface
(9)—hammer weight
(10)—impact axis
(11)—drive mechanism
(12)—strop
(13)—upper face (hammer weight)
(14)—sheave
(15)—lower impact face (hammer weight)
(16)—side face (hammer weight)
(17)—driven end (striker pin)
(18)—impact end (striker pin)
(19)—shock absorber
(20)—nose block
(21)—cap plate
(22)—vacuum chamber
(23)—vacuum piston face
(24)—upper vacuum sealing
(25)—lower vacuum sealing
(26)—recoil plate
(27)—retaining pin
(28)—nose cone
(29)—attachment coupling
(30)—cushioning slides seals
(31)—in-weight seal
(32)—V-shape protrusions
(33)—retention recess
(34)—biasing means
(35)—fillets
(36)—pre-load
(37)—vertex
(38)—intermediary element
(39)—strap
(40)—flexible seal
(41)—annular membrane
(42)—void
(43)—down-stroke vent
(44)—valve
(45)—vacuum pump
(46)—vacuum tank
(47)—recess (striker pin)
(48)—distal travel stop
(49)—proximal travel stop
(50)—first (upper) shock absorbing assembly
(51)—second (lower) shock absorbing assembly
(52)—elastic layer
(53)—inelastic layer
(54)—inner side wall (nose block)
(55)—independent sealing layers
(56)—nose cone ring seals
(57)—annular recesses (nose cone)
(58)—integral elastic layer seal
(59)—distinct elastic layer seal
(60)—inelastic layer seal
(61)—intimate fit seal
(62)—recoil plate ring seals
(63)—annular recesses (recoil plate)
(64)—flexible diaphragm
(65)—outer rim
(66)—static seal
(67)—maximum impact height (prior art)
(68)—inclined drop height (prior art)
(69)—maximum drop height
(70)—inclined drop height
(71)—tracked carrier
(72)—azimuth cradle
(73)—void-reduction foam
(74)—intermediary layer peripheral rim portion
(75)—distinct elastic or inelastic layer seal
(100)—prior art impact hammer
(200)—robotic tunnelling impact hammer
(1-1)—impact hammer
(1-2)—small excavator
(1-3)—hammer weight
(1-4)—tool end
(1-5)—working surface
(1-6)—housing
(1-7)—housing inner side walls -continued (1-8)—wide side walls
(1-9)—narrow side walls
(1-10)—upper distal face
(1-11)—lower distal face
(1-12)—impact axis
(1-13)—cushioning slides
(1-14)—first layer
(1-15)—second layer
(1-15a-d)—second layer
(1-16)—exterior surface—first layer
(1-17)—outer surface—second layer
(1-17a-d)—outer surface—second layer
(1-18)—underside—first layer
(1-19)—interior surface—second layer
(1-19a-d)—interior surface—second layer
(1-20)—longitudinal apices
(1-21)—weight surface under second layer
(1-22)—displacement void
(1-22a-d)—displacement void
(1-23a-23e)—securing feature
(1-23f-23k)—securing feature
(1-23m)—securing feature
(1-24)—socket
(1-25)—retention face
(1-26)—location projections
(1-27)—locating recesses
(1-28)—aperture—second layer
(1-29)—aperture—first layer
(1-30)—locating portion
(1-101)—large impact hammer
(1-102)—large excavator
(1-103)—weight
(1-104)—striker pin
(1-105)—working surface
(1-106)—housing
(1-107)—housing inner side walls
(1-108)—wide side walls
(1-109)—narrow side walls
(1-110)—upper distal face
(1-111)—lower distal face
(1-112)—linear impact axis
(1-113)—cushioning slides
(1-114)—first layer
(1-115)—second layer
(1-116)—exterior surface—first layer
(1-117)—outer surface—second layer
(1-118)—underside—first layer
(1-119)—interior surface—second layer
(1-120)—longitudinal apices
(1-121)—weight surface under second layer
(1-122)—displacement void
(1-123)—securing feature
(1-124)—socket
(1-125)—retention face
(1-126)—location projection
(1-127)—locating recess
(1-128)—aperture—second layer
(1-129)—aperture—first layer
(1-130)—locating portion
(1-131)—tensioning features
(1-213)—cushioning slide
(1-214)—first layer
(1-215)—second layer
(1-216)—first layer exterior surface
(1-217)—second layer outer surface
(1-218)—first layer interior surface
(1-219)—second layer interior surface
(1-231)—upper sub-layer
(1-232)—intermediate sub-layer
(1-233)—lower sub-layer
(1-234)—lower sub-layer recess
(1-235)—lower layer side walls
(2-1)—rock-breaking hammer
(2-2)—hammer weight
(2-3)—housing
(2-4)—striker pin
(2-5)—nose block
(2-6)—attachment coupling (
(2-7a)—first shock absorbing assembly -continued (2-7b)—second shock absorbing assembly
(2-8)—retainer in the form of recoil plate
(2-9)—upper cap plate
(2-10)—nose block bolts
(2-11)—nose cone
(2-12)—elastic layers/polyurethane
(2-13)—inelastic layer—steel plate
(2-14)—retaining pins
(2-15)—recess
(2-16)—elongate slides guide elements
(2-116)—elongate slides
(2-17)—longitudinal projections
(2-117)—longitudinal projection
(2-18)—rock
(2-19)—concave recess
(2-20)—distal travel stops
(2-21)—proximal travel stops
(2-22)—locating pins guide elements
(2-23)—outer periphery—elastic layer
(2-24)—inner periphery—elastic layer
(2-25)—null-point path/position
(2-26)—tension band guide elements
(2-27)—nose block side walls
(2-28)—indent - nose block walls
(2-29)—anchor points
(2-30)—stabilizing features guide elements
(2-31)—tab portions
(2-32)—lateral clearance
(2-33)—restraining elements
(2-34)—outer periphery—inelastic layer
(2-35)—inner periphery—inelastic layer
(2-36)—outer periphery taper—inelastic layer
(2-37)—outer periphery taper—elastic layer
(2-100)—impact axis FIGS. 1-15 show separate embodiments of the impact hammer provided as apparatus in the form of vacuum-assisted impact hammers (1). FIG. 1 shows an impact hammer (1) attached to a carrier in the form of an excavator (2), adjacent to a 1.8 m tall human operator (3) for scale purposes. The impact hammer (1) embodiment shown in FIG. 1 is configured with a striker pin (4) as the contact point with a working surface (5) for impacting and manipulation operations. The working surface (5) includes any surface, material or object subject to impacting, contact, manipulation and/or movement by the impact hammer (1), e.g. the working surface may be rock in a quarry. The striker pin (4) protrudes from a housing (6) which provides protection for vulnerable portions of the impact hammer (1), reduces debris ingress and provides attachment to the excavator (2) via the excavator's arm (7).

Figure 2A:
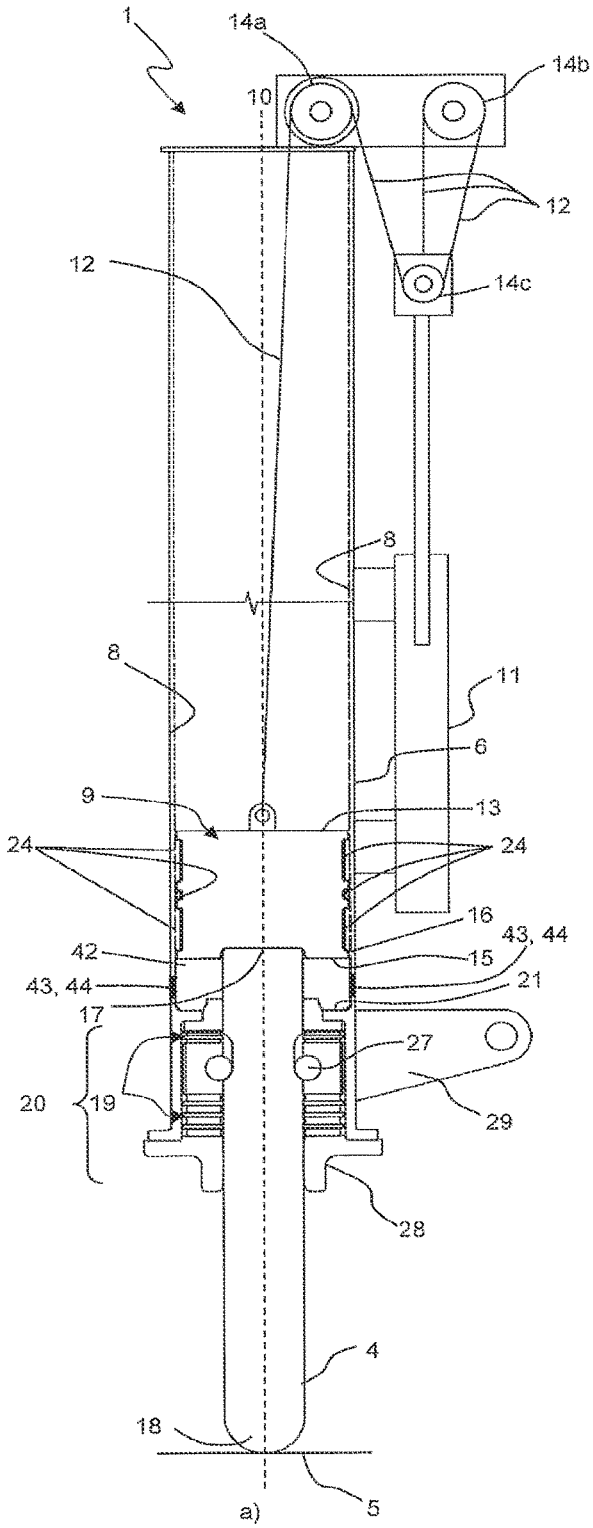
FIG. 2*a* shows an enlarged view of a side elevation section of the impact hammer shown in FIG. 1 with the hammer weight at the bottom of the down-stroke.
Figure 2B:
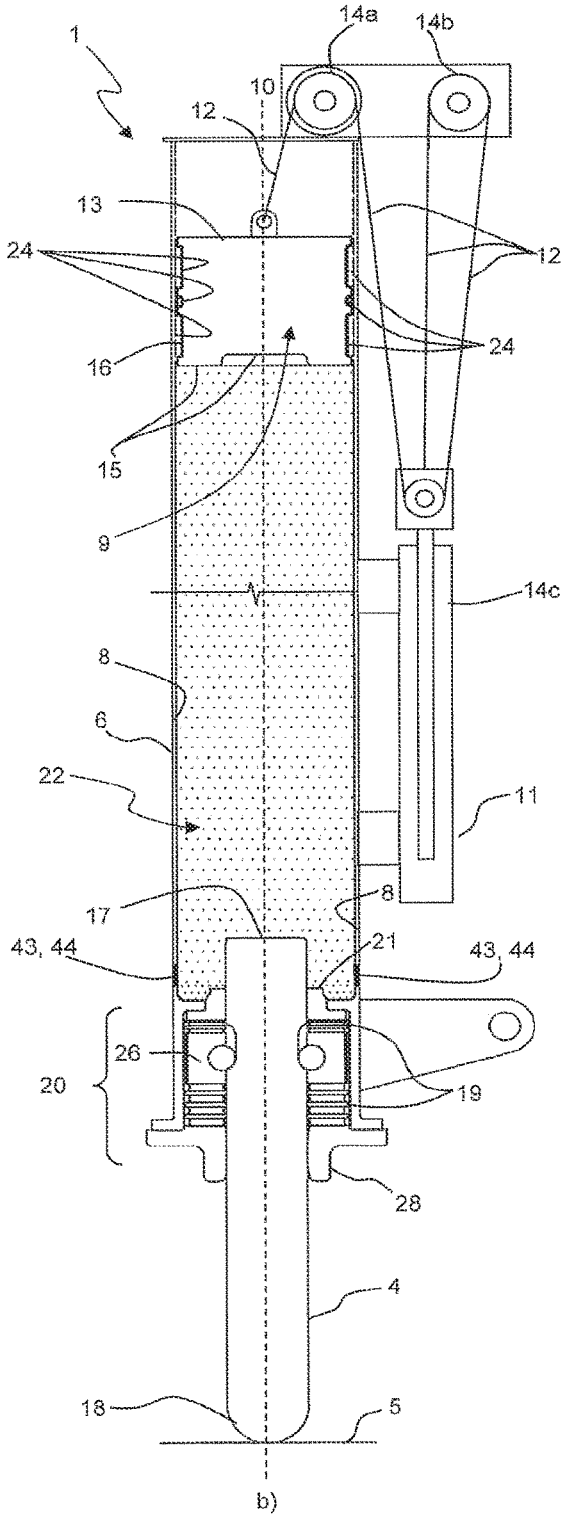
FIG. 2*b* shows a side elevation section of the impact hammer shown in FIG. 2*a* with the hammer weight at the top of the up-stroke.

FIGS. 2*a* and 2*b* show an enlarged vertical section through the impact hammer (1) in FIG. 1. The housing (6) is configured as a substantially hollow elongate cylindrical column with an inner side wall in the form of a containment surface (8), enclosing a reciprocating component in the form of a hammer weight (9) movable along a reciprocation path, in the form of impact or reciprocation axis (10). A lifting and/or reciprocating mechanism in the form of drive mechanism (11, 12, 14) raises the hammer weight (9) along the impact axis (10) from a position of contact with the striker pin (4) (as shown in FIG. 2*a*) to the opposing maximum extent of the reciprocation path as shown in FIG. 2*b*. The drive mechanism is shown schematically and includes a linear drive provided in the form of a hydraulic ram (11) located to one side of the column (6). The ram (11) is connected to the hammer weight (9) via a flexible connector (12) that passes about a series of pulleys (14). The flexible connector (12) is a strop, belt or band attached to an upper face (13) of the hammer weight (9) after passing over a rotatable sheave (14*a*) located at the upper periphery (or adjacent the upper end) of the housing (6).

The pulley (14*a*) is formed as a sheave to limit lateral movement of the connector (12) along the rotation axis of the sheave (14*a*).

It will be appreciated that when the impact hammer (1) is orientated as shown in FIGS. 1 and 2 with its impact axis (10) vertically, the maximum extent of travel of the hammer weight (9) along the impact axis (10) (as shown in FIG. 2*b*) is also the maximum vertical height the weight (9) can reach.

To aid readability and clarity, the orientation of the impact hammer (1) and its constituents is referred to with respect to use of the impact hammer (1) operating with said hammer weight (9) moving along said impact axis (10) about a substantially vertical axis, and thereby denoting the descriptors 'lower' and 'upper' as comparatively referring to positions respectively closer and further vertically from the working surface (5). It will be appreciated however this orientation nomenclature is solely for explanatory purposes and does not in any way limit the apparatus to use in the vertical axis. The impact hammer (1) is able to operate in a wide range of orientations as discussed further subsequently.

In operation the drive mechanism (11) lifts the hammer weight (9) via the flexible strop (12). The hammer weight (9) is formed substantially cylindrically with a lower impact face (15) on the opposing side to said upper face (13), and a hammer weight side face (16).

The impact hammer (1) embodiment shown in FIGS. 1 and 2, is configured with the striker pin (4) having a driven end (17) and an impact end (18) with a longitudinal axis extending between the driven and impact ends (17, 18). The striker pin (4) is locatable in the housing (6) such that said impact end (18) protrudes from the housing (6).

The hammer weight (9) impacts on the driven end (17) of the striker pin (4) along the impact axis (10), substantially co-axial with the striker pin's (4) longitudinal axis.

A shock-absorber (19) is coupled to the striker pin (4) and both are retained in a lower portion of the housing (6), referred to herein as the "nose block" (20)

A variable volume vacuum chamber (22) is formed by:

- an upper vacuum sealing (24) located between the hammer weight (9) and the containment surface (8), the upper vacuum sealing encompassing/encircling the hammer weight (9);
- the lower impact face (15) of the hammer weight (9);
- the upper boundary (referred to herein as the "cap plate" (21)) of the nose block (20);
- the driven end (17) of the striker pin (4) protruding through the cap plate (21), and
- at least a portion of the containment surface (8), and
- a lower vacuum sealing (25) more clearly discernible in FIGS. 8-13.

The vacuum chamber (22) includes an upper vacuum sealing (24) between the hammer weight and the containment surface and a lower vacuum sealing (25) (more clearly discernible in FIGS. 8-13.

FIG. 2*a* shows the vacuum chamber (22) at near its minimum volume, while FIG. 2*b* shows the maximum vacuum chamber (22) volume.

The vacuum chamber (22) is configured with at least one movable vacuum piston face (23) which in the embodiment of FIG. 2 is provided by the lower impact face (15) of the hammer weight (9). In alternative embodiments (not shown), the vacuum piston face (23) may be formed from an attachment to the hammer weight (9) rather than being integrally formed, e.g. like the lower impact face (15). Irrespective of its configuration, the vacuum piston face (23) is movable along a path parallel to, or co-axial to, the impact axis (10).

In addition to the shock absorber (19) and the striker pin (4), the nose block (20) also includes a retainer in the form of recoil plate (26), a retaining pin (27), a lower boundary in the form of a rigid nose plate (herein referred to as a nose cone (28)) and an attachment coupling (29) for attachment of the impact hammer (1) to the excavator (2). The interaction of the nose block (20) components is described in further detail elsewhere.

The operation of the impact hammer (1) and the movement of both the hammer weight (9) and the striker pin (4) in use require that the vacuum sealing (24, 25) is capable of accommodating relative and/or sliding movement therebetween. The vacuum sealing (24, 25) may be fixed to the hammer weight (9), within the nose block (20), containment surface (8) or a combination of same and these variations are subsequently considered in greater detail later.

In operation, a full reciprocation cycle of the impact hammer (1) comprises four basic stages (described more fully subsequently) consisting of; the up-stroke, upper stroke transition, down-stroke and lower stroke transition.

During these four stages (with reference to an impact hammer (1) orientated with a vertical impact axis (10)), the corresponding effects in the vacuum chamber (22) are:

- up-stroke: from the start position shown in FIG. 2*a*, the volume of the vacuum chamber (22) increases, as the hammer weight (9) is pulled upwards by the drive (11) via flexible connector (12), away from the cap plate (8) and striker pin (4). The vacuum chamber's (22) volume expansion causes a commensurate pressure drop in the vacuum chamber (22) relative to the air pressure outside the vacuum chamber (22), i.e. atmosphere, notwithstanding any sealing losses. The hammer weight (9) is raised with a commensurate pressure decrease in the vacuum chamber (22) until the hammer weight (9) reaches the up-stroke travel limit of its reciprocation path (shown in FIG. 2*b*);
- upper stroke transition: FIG. 2*b* shows the hammer weight (9) at its position of maximum potential energy before being released, and being driven towards the cap plate (8) and striker pin (4) under both the force of gravity and the atmospheric pressure acting on the vacuum chamber (22) via the hammer weight (9) volume;
- down-stroke: as the hammer weight (9) travels towards the driven end (17) of the striker pin (4), the volume of the vacuum chamber (22) is compressed and its internal pressure increases until it reaches the end of the down-stroke (shown in FIG. 2*a*);
- lower stroke transition: the volume of the vacuum chamber (22) is at its minimum) after energy transference from the hammer weight (9) to the working surface (5) via striker pin (4). At this point the hammer weight (9) is at the bottom of its reciprocation cycle.

The cycle is then repeated to break the working surface (5) by reciprocating the hammer (1).

In use, the striker pin (4) drops further than is shown in FIG. 2*a* as it is driven into the working surface (5) and thus the lowermost point possible of the striker pin (4) and hammer weight (9) is lower, as more clearly seen in FIGS. 38A-40B. The vacuum chamber (22) will thus also have a smaller volume than is shown in FIG. 2*a*. For the purposes of this description reference to a minimum volume or lowermost point will however refer to that shown in FIG. 2*a* as this is the point at the start of the reciprocation cycle.

During the above-described reciprocation cycle, the upper vacuum sealing (24) forms the dynamic sealing between the static containment surfaces (8) and the moving hammer weight (9). In the embodiment shown in FIGS. 2-4 and 8-13, the hammer weight (9) is provided with cushioning slides (1-13) about its side face (16). The cushioning slides (1-13) are formed with a:

first layer (1-14) formed from a material of predetermined low friction properties (e.g. UHMWPE, Nylon, PEEK or steel), and second layer (1-15) formed from a material of predetermined shock absorbing properties such as an elastomer, e.g. polyurethane.

The functioning and roles of the cushioning slides (1-13) are more comprehensively expanded on below with reference to FIGS. 16-34*b*. The embodiment shown in FIGS. 1-3 incorporates two types of upper vacuum sealing (24), in the form of a pair of cushioning slides seals (30) and an in-weight seal (31). The cushioning slides (1-13) may be used for the coupling, mounting or retention of additional seals such as the configuration of the in-weight seal (31) to form the cushioning slide seals (30). It will be appreciated that the cushioning slides (1-13) may also directly form part or all of said upper (and/or lower) vacuum sealing (24, 25) and may thus also be designated as cushioning slide seals (30).

Figure 4B:
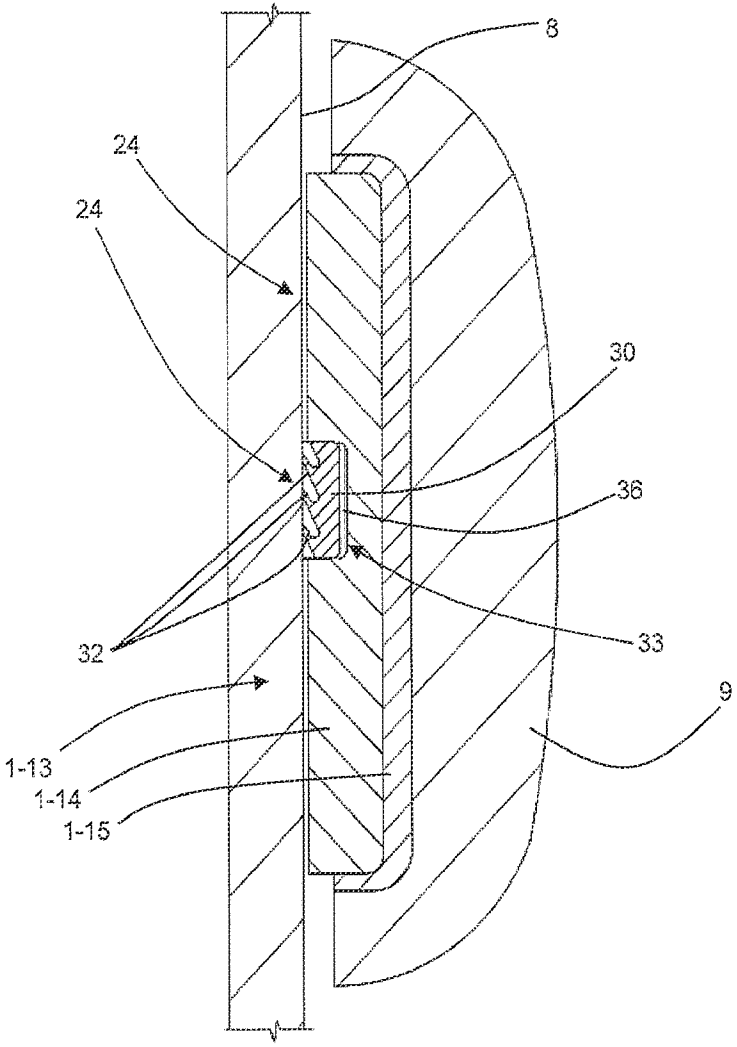
FIG. 4*b* shows an enlarged view of a side elevation section of a combined seal and cushioning slide according to a preferred embodiment.
Figure 4A:
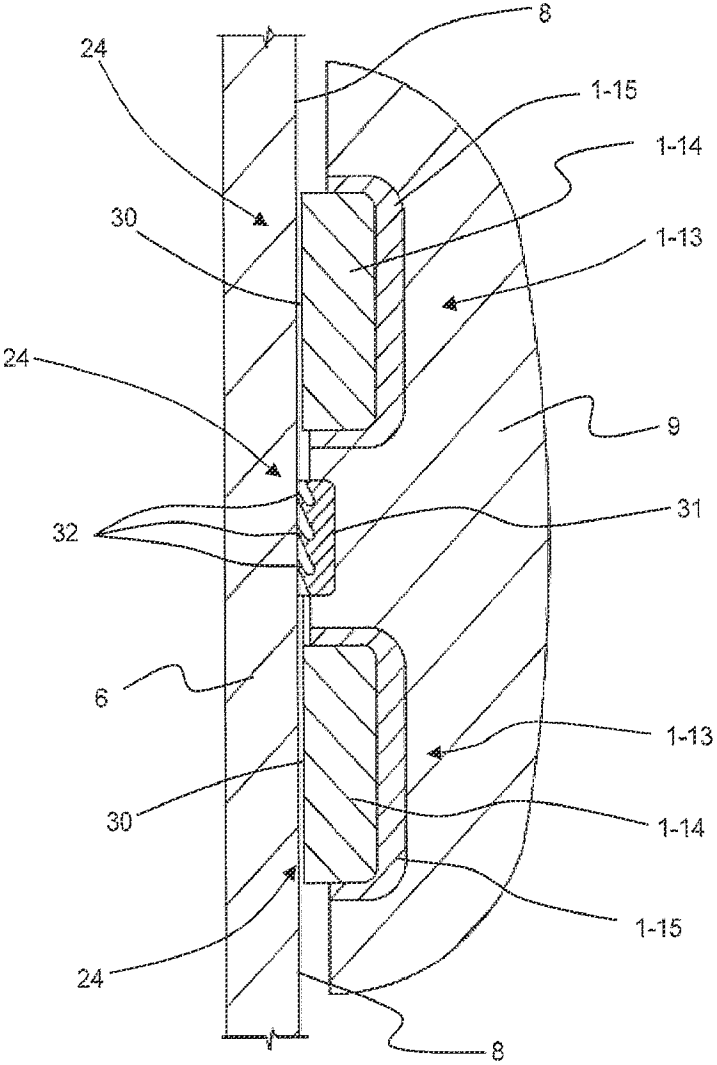
FIG. 4*a* shows an enlarged view of a side elevation section of a seal and cushioning slides according to a preferred embodiment.

FIG. 4*a* shows both cushioning slides seals (30) and an in-weight seal (31) in greater detail.

FIGS. 4*b*-4*k* show further embodiments of upper vacuum sealing (24).

It will be appreciated that in alternative embodiments (not shown) the upper vacuum sealing (24) may alternatively be fixed to the containment surfaces (8) of the housing (6). However, there are several advantages in locating the upper vacuum sealing (24) on the hammer weight (9). Firstly, the distance travelled by the hammer weight (9) along the impact axis (10) greatly exceeds the length of the hammer weight (9) side face (16). Upper vacuum sealing (24) located on the containment surface (8) would need to extend over the full extent of the hammer weight (9) travel along the impact axis (10), while upper vacuum sealing (24) located on the hammer weight (9) is only essential at a single position about the impact axis (10). Secondly, upper vacuum sealing (24) located on the containment surface (8) adjacent the hammer weight's (9) path along the impact axis (10) is vulnerable to damage by any lateral movements of the hammer weight (9). Although this can be addressed by the incorporation of shock absorption and abrasion resistance capabilities, these must extend along the full extent of the containment surface (8) adjacent the hammer weight's (9) passage. In contrast, upper vacuum sealing (24) positioned on the hammer weight (9) may be configured to accommodate lateral weight movement without also being required to provide lateral shock absorbing or centering capacity.

It will also be appreciated that the hammer weight (9) may be formed in a variety of solid volumes, including a cube, cuboid, an elongate substantially rectangular/cuboid plate or blade configuration, prism, cylinder, parallelepiped, polyhedron and so forth. The embodiment shown in FIGS. 1-4 incorporate a cylindrical hammer weight (9), though this is illustrative only. An advantage of a cylindrical hammer weight (9) is the ability to utilize ring seals encircling the lateral periphery or side face (16) of the hammer weight (9), instead of separate seals for each side face (16) of a multi-sided hammer weight (9).

FIG. 4*a* shows an enlarged view of a down-stroke vent formed in the in-weight seal (31). The seal (31) is formed from a hard-wearing flexible material or other material providing abrasion resistance, flexibility, and heat resistance. The outer profile of the in-weight seal (31) is configured with a plurality of V-shaped protrusions (32) orientated with their apices angled upwards away from the vacuum chamber (22). These protrusions (32) form the down-stroke vent and permit air egress to the vacuum chamber (22) on the down-stroke while preventing or at least restricting air ingress on the up-stroke. Thus, during the up-stroke as the hammer weight (9) is raised, the vacuum chamber (22) pressure drops to a sub-atmospheric level, thereby generating an increasing pressure differential between the vacuum chamber (22) and the surrounding atmosphere. The v-shaped protrusions (32) are thus forced against the containment surface (8) occluding the vacuum chamber (22) from air ingress. At the bottom of the down-stroke, any air in the vacuum chamber, whether residual or having leaked past vacuum sealing (24, 25) is compressed to a super-atmospheric level (i.e. greater than atmosphere) and thus the pressure differential is reversed and the protrusions (32) are pushed open, thereby venting the air to atmosphere.

FIG. 4*a* shows an embodiment where the outermost surface of the first layer (1-14) of the cushioning slides (1-13) is able to act as a cushioning slide seal (30) in intimate sliding contact with the containment surface (8). It will be appreciated that whether a cushioning slide (1-13) also acts as a cushioning slide seal (30) or only as a cushioning slide (1-13) depends on the extent of its continuity about the hammer weight side face (16) to form a sealing barrier.

FIG. 4*b* shows another embodiment of a cushioning slide seal (30) formed as a circumferential seal in an insert in the first layer (1-14) of a cushioning slide (1-13). In a corresponding manner to the in-weight seal (31) of FIG. 4*a*, the outer profile of the cushioning slide seal (30) is also configured with a plurality of V-shape protrusions (32) orientated with their apices angled upwards away from the vacuum chamber (22). The cushioning slide (1-13) in FIG. 4*b* does show an additional feature in the form of a retention recess (33) which contains a 'pre-load' (36) formed from an elastomer ring that biases the cushioning slide seal (30) radially outward toward the containment surface (8). Such a preload (36) may also be used in other vacuum sealing (24, 25) embodiments. The cushioning slide seal (30) is able to be forced into the retention recess (33), compressing the pre-load (36) layer until the cushioning slide seal (30) is flush with the adjacent surface of the cushioning slide first layer (1-14) when the hammer weight (9) experiences any lateral movement during its reciprocation cycle due to for example, a non-vertical impact axis, hammer recoil bounce after impact with the striker pin (4), containment surface (8) imperfections or the like. This avoids the potentially significant lateral force of the hammer weight (9) being born solely by the small surface area of the relatively fragile cushioning slide seal (30).

The upper vacuum sealing (24) forms a substantially uninterrupted sealing laterally encompassing the hammer weight (9). The upper vacuum sealing (24) may be formed from a single continuous, uninterrupted seal or by multiple abutting, overlapping, conterminous, interlocking, mating, and/or proximal adjacent seal sections.

Figure 4C:
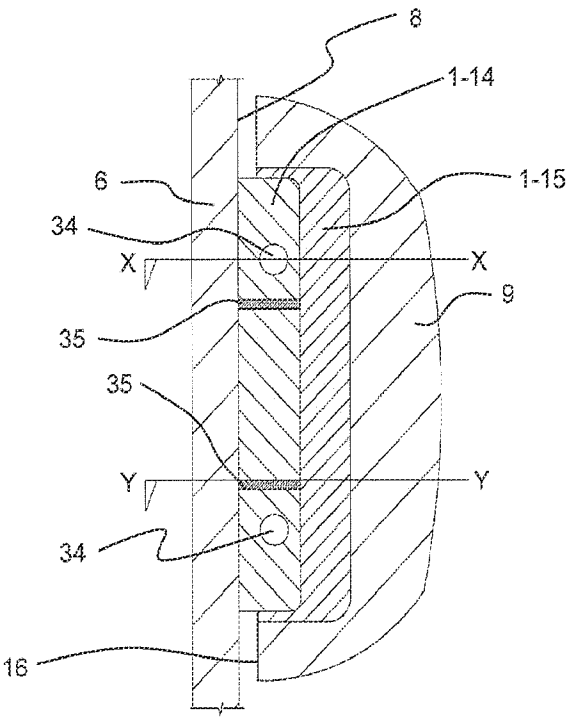
FIG. 4*c* shows a side elevation section view of a weight, cushioning slides and seal.

In the embodiment shown in FIG. 4*c*, the cushioning slide seal (30) is located in a retention recess (33) in the hammer weight side face (6). The cushioning slide seal (30) is formed directly by the outer surface of the cushioning slide first layer (1-14) and maintained in sealing contact with the containment surface (8) by virtue of a biasing means (spring (34)) located at a separation segment in the circular or part-circular cushioning slide first layer (1-14). The biasing means (34) is a further form of pre-load (36) and may take the form of a resilient material or a compression spring or the like, acting circumferentially to bias the cushioning slide seal (30) of first layer (1-14) radially outward into intimate contact with the containment surface (8). When the hammer weight (9) is deflected into contact with the containment surface (8) during operation, the cushioning slide seal (30) is able to retract into the retention recess (33) by compression of the cushioning slide second layer (1-15) thus avoiding any potentially damaging loads.

Figure 4E:
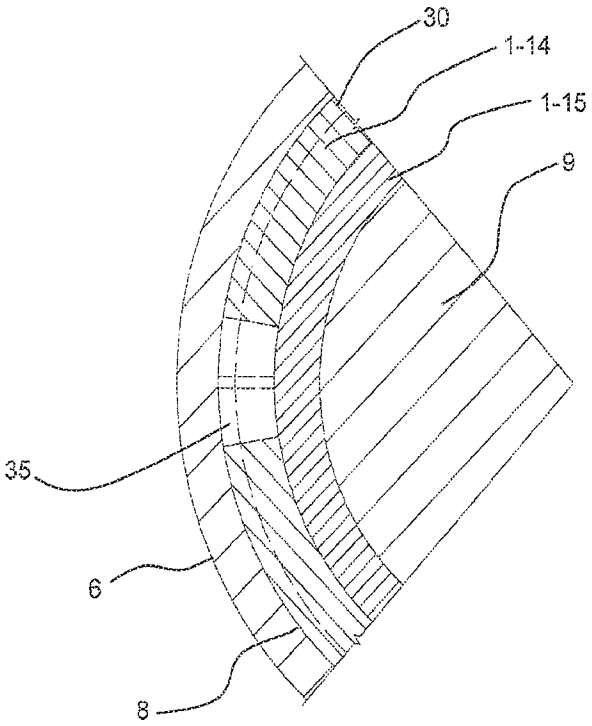
FIG. 4*e* shows a plan view of section YY of the weight, cushioning slides and seal in FIG. 4*c;*
Figure 4D:
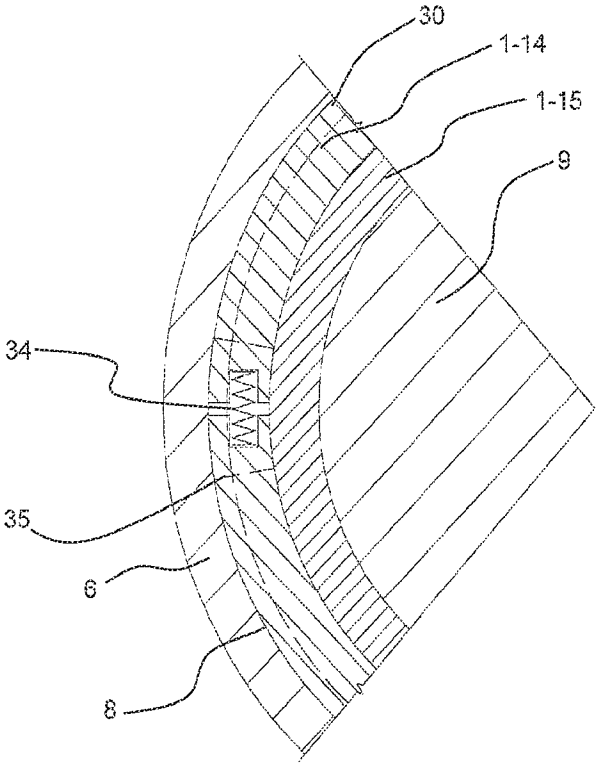
FIG. 4*d* shows a plan view of section XX of the weight, cushioning slides and seal in FIG. 4*c;*

FIGS. 4*c*-4*e* show fillets (35) positioned between upper and lower biasing means (34) to prevent any circumvention of air about the biasing means (34) which could cause seal leakage. FIG. 4*d* is a plan view of section XX through the biasing means (34) in FIG. 4*c*, while FIG. 4*e* shows the plan view of section YY immediately above a fillet (35). Only one interruption is required in a circumferential seal (such as shown in FIGS. 4*c*-4*e* used with cylindrical hammer weights (9). In contrast, cubic, cuboid or other, multi-faceted hammer weights (9) may require the incorporation of multiple individual seals to maintain sealing about each vertex (37) of the hammer weight (9).

Figure 4G:
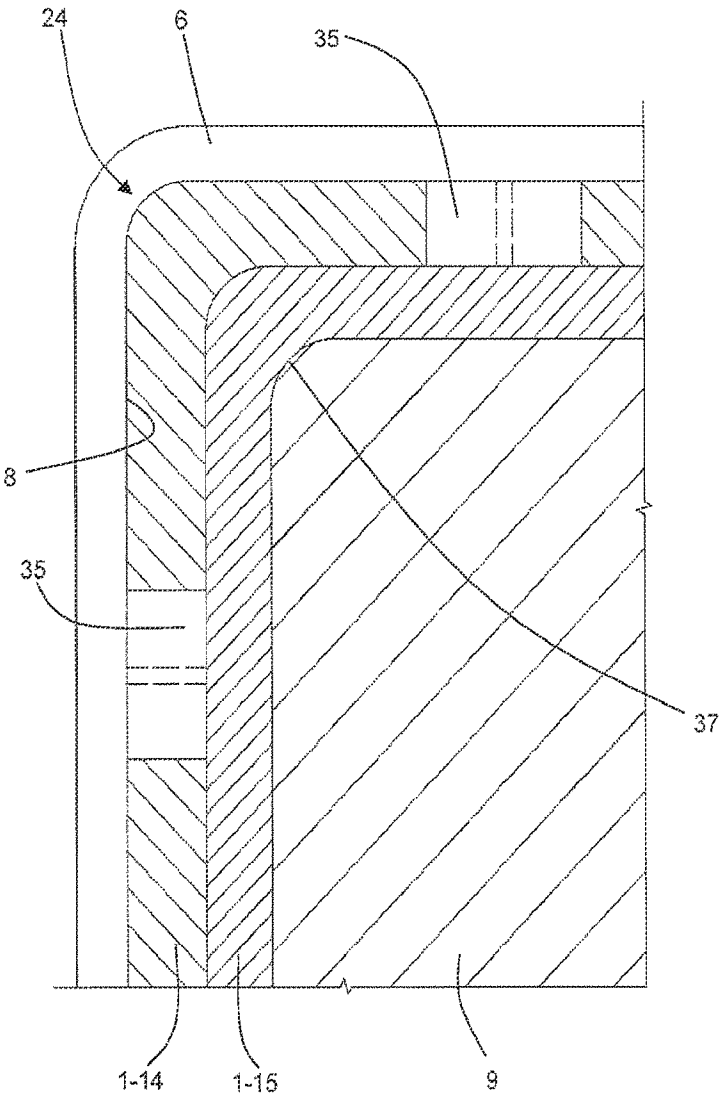
FIG. 4*f* shows a plan section view of an alternative weight, cushioning slides and seal.
FIG. 4*q* shows a lower plan section view of the weight, cushioning slides and seal shown in FIG. 4*f;*
FIG. 4*h* shows a side elevation view of the striker pin and nose block with an intermediary element.
FIG. 4*i* shows an enlarged side elevation of the intermediary element shown in FIG. 4*f;*
FIG. 4*j* shows a side view of a further embodiment including a further intermediary element.
FIG. 4*k* shows an enlarged side elevation of the intermediary element shown in FIG. 4*h;*
FIG. 4L shows a side elevation section view of a weight and cushioning slides according to another embodiment.
Figure 4F:
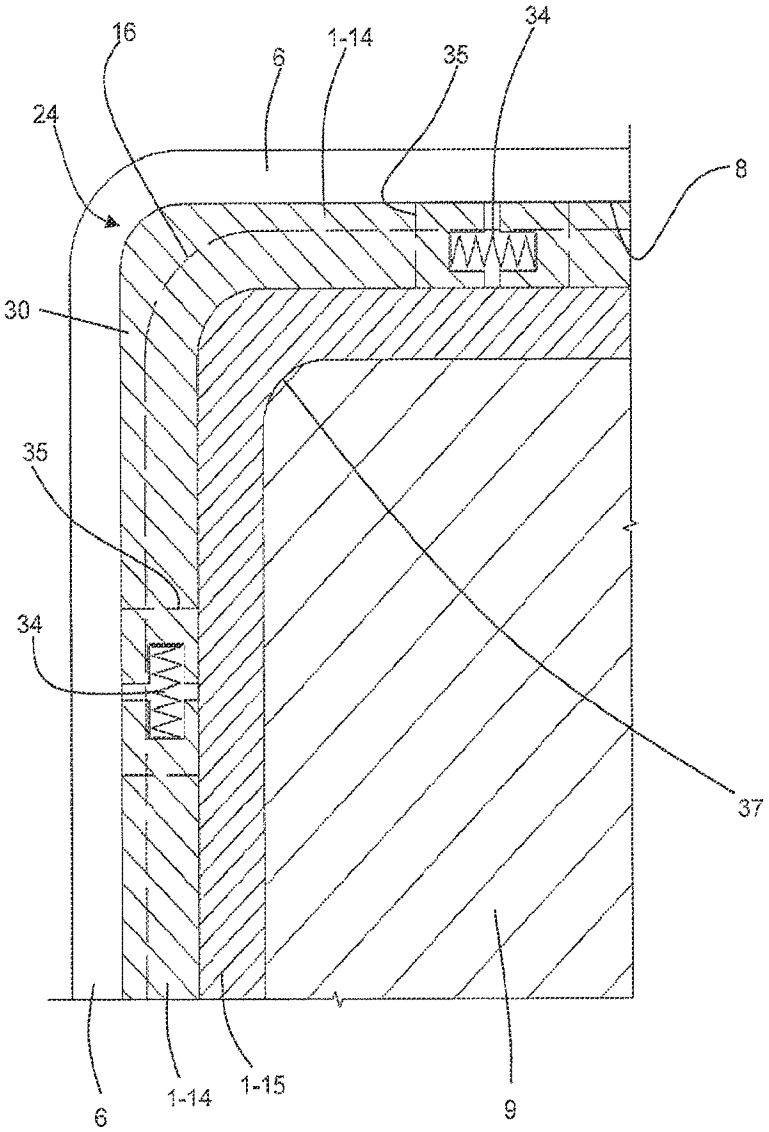

FIGS. 4*f* and 4*g* show an upper vacuum sealing (24) used in a square cross-section shaped weight (9). The sealing (24) is provided in the form of multiple cushioning slide seals (30) surrounding a vertex (37) of a cuboid hammer weight (6). The cushioning slide seals (30) in this embodiment are formed by the outer surface of the first layer (1-14) of cushioning slides (1-13). Biasing springs (34) ensure that the cushioning slide seals (30) are biased toward the containment surface (8) in a manner analogous to that shown in FIGS. 4*c*-4*e*. Fillets (35) are positioned between upper and lower biasing means (34) to prevent any circumvention of air about the biasing means (34) which could cause seal leakage.

In these embodiments, the vacuum sealing (24, 25) may include a seal with a radially acting pre-load (36) and a circumferentially acting biasing means (34). The preload may take several forms, including, but not limited to a compressible medium, a spring, an elastomer, buffers, or the like.

FIGS. 4*h*-4*k* show embodiments with intermediary elements (38) coupled to the hammer weight (9) below the impact face (10) and/or above the upper face (13) to provide a means of linking the upper vacuum sealing (24) to the movement of the hammer weight (9) along the impact axis (10), whilst allowing decoupled movement laterally to the impact axis (10). The intermediary elements (38) shown in FIGS. 4*h*-4*k* are configured to form the upper vacuum sealing (24) of the vacuum chamber (22), though it will be appreciated that the intermediary elements (38) may also be used in conjunction with other seal types described herein such as the cushioning slide seals (30), in-weight seals (31) and the like.

Figure 4I:
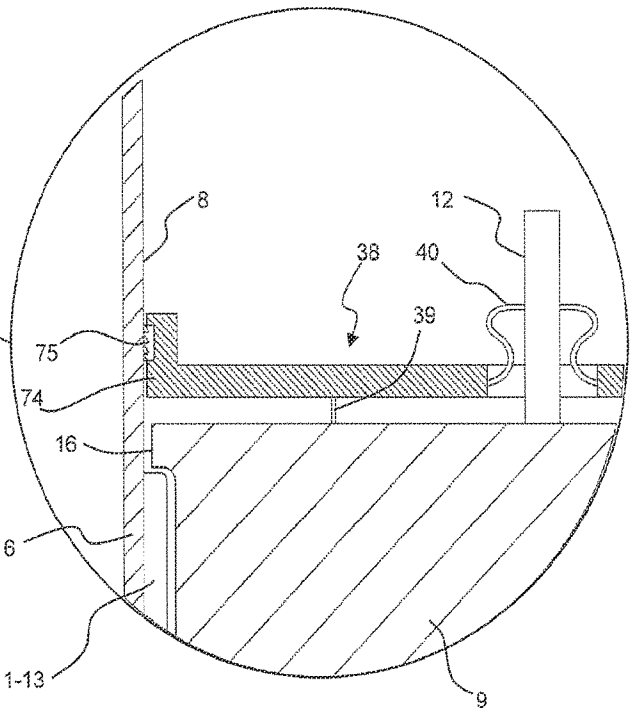
Figure 4H:
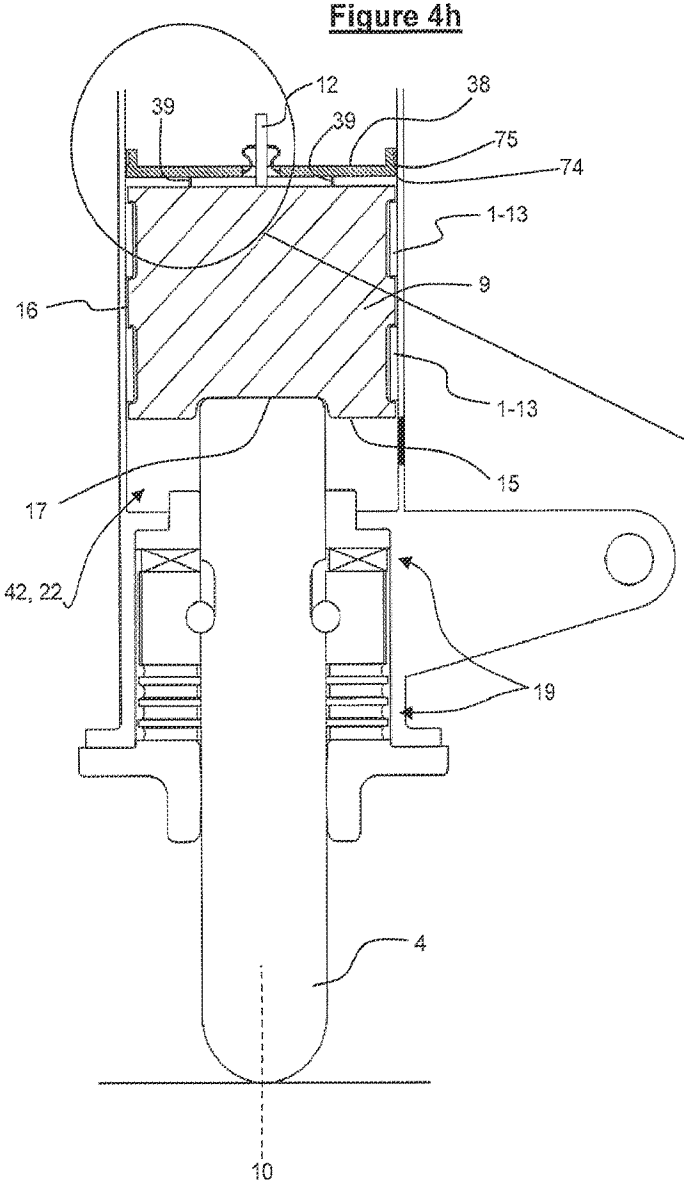

The intermediary elements (38) may be configured in a variety of forms, including plates, discs, annular rings and the like. FIGS. 4*h* and 4*i* show an intermediary element (38) coupled to the upper face (13) of the hammer weight (9) via flexible linkages in the form of straps (39).

Alternative embodiments for coupling the intermediary element (38) to the hammer weight (9) include non-flexible couplings which are laterally slideable with respect to the impact axis, while being substantially rigid parallel to the impact axis, as well as alternative flexible linkages, such as lines, wires, braids, chains, universal joints and so forth. Such coupling configurations allow the intermediate element (38) to maintain an effective sealing with the containment surface (8) without being affected by lateral movements of the hammer weight (9).

In the embodiment of FIG. 4*h* a single intermediary element (38) is formed as a substantially planar disc with a central aperture allowing the passage of the strop (12) for attachment to the hammer weight (9). A flexible seal (40) between the strop (12) and the intermediary element (38) prevents potential air ingress to the vacuum chamber (22). The substantially planar disc shaped intermediary element (38) includes an outer peripheral rim portion (74) which may form the upper vacuum sealing (24). Alternatively, or in addition, the upper vacuum sealing (24) may include a separate seal (75) coupled to the intermediary element (38) (as shown in FIGS. 4*h*-4*k*).

Figure 4K:
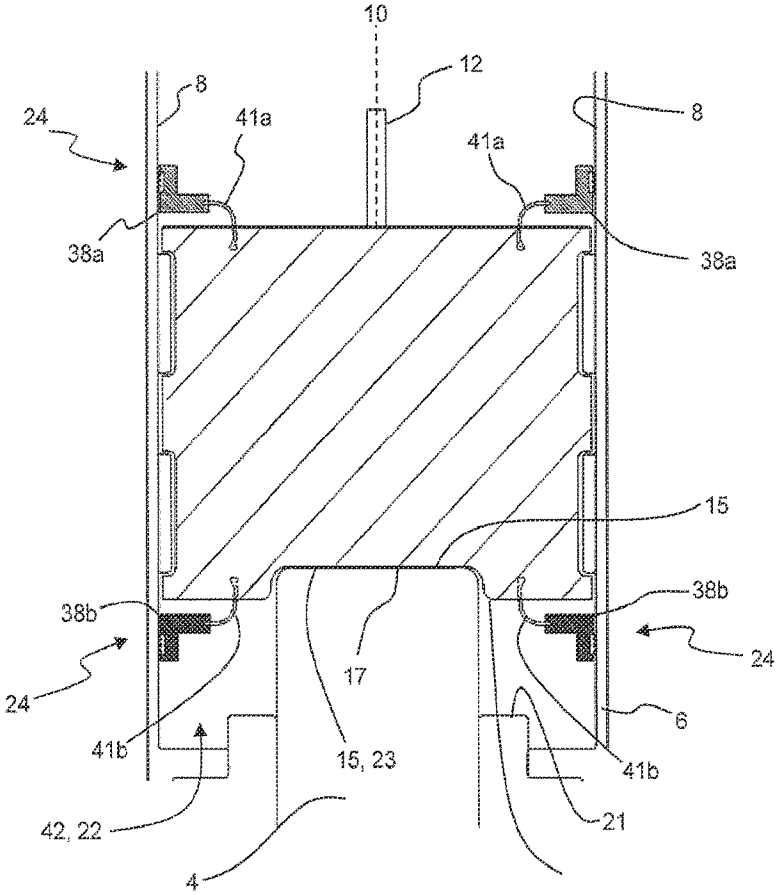
Figure 4J:
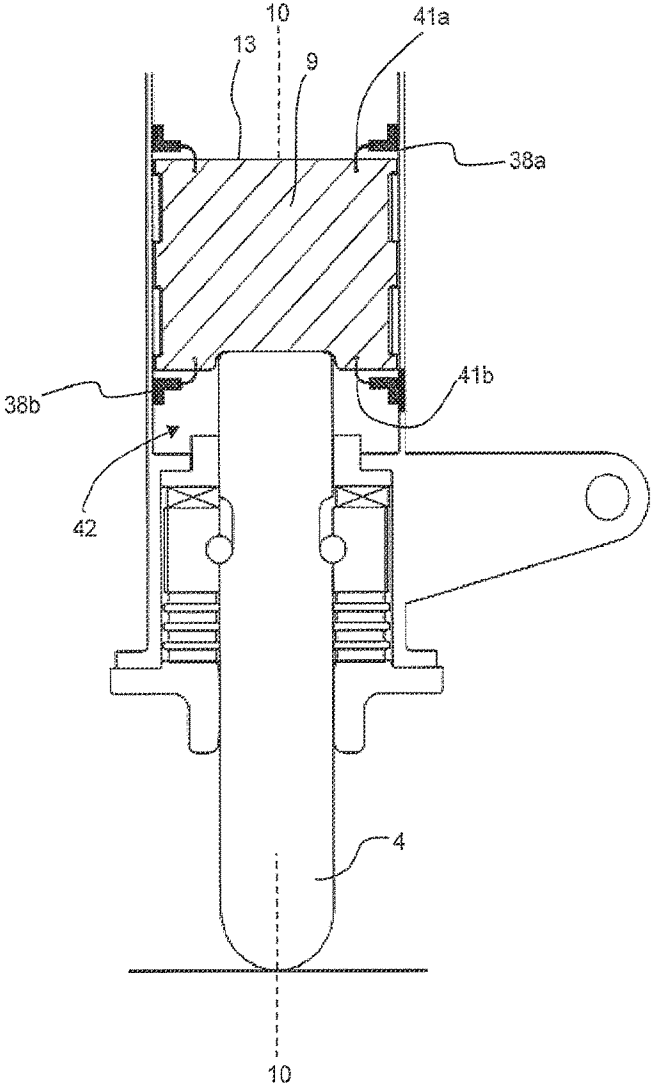

FIGS. 4*j*-4*k* show a further embodiment with a pair of intermediary elements (38*a* and 38*b*) positioned on either side of the hammer weight (9), coupled via flexible annular membranes (41*a* and 41*b*) to the upper face (13) and the lower impact face (15) respectively. However, in contrast to the preceding embodiment, the intermediary elements (38) in FIGS. 4*j* and 4*k* are configured as substantially annular rings, whereby the central aperture allows unhindered contact between the lower impact face (15) of the hammer weight (9) and the driven end (17) of the striker pin (4). The annular membranes (41) also provide part of the movable upper vacuum sealing (24).

During reciprocating operation of the impact hammer (1), the intermediary elements (38) (including straps (39) and annular membranes (41*a*, 41*b*)) are pulled or pushed along the reciprocation path by movement of the hammer weight (9) according to the direction of travel, and relative position of the intermediary element (38) relative to the hammer weight (9).

Figure 4L:
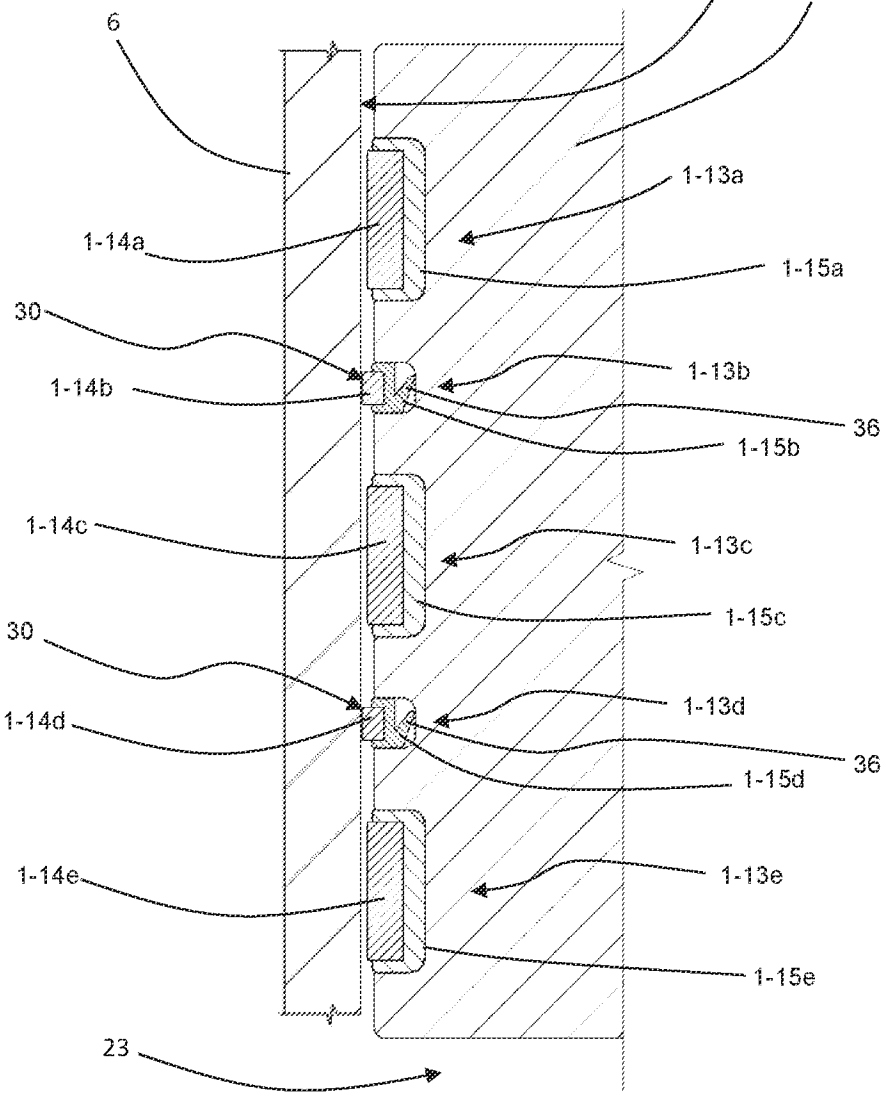

FIG. 4L shows another embodiment with five cushioning slides (1-13*a* to 1-13*e*) laterally encircling the hammer weight (9). The two intermediate cushioning slides (1-13*b* and 1-13*d*) have inner second layers (1-15*b*, 1-15*d*) that form biasing means (34) acting as preloads. The biasing means (34) may take the form of a resilient material, acting circumferentially to bias the cushioning slide seal (30) of first layer (1-14) radially outward into intimate contact with the containment surface (8). As is previously described, a pressure differential is formed between atmosphere and the vacuum chamber when the hammer weight (9) is raised on the up-stroke. The biasing means (34) in the embodiment of FIG. 4L are shaped such that air will be forced against the upper side of the biasing means (34) when a pressure differential is present, thereby further forcing the seal (30) against the containment surface (8) and improving its sealing effectiveness.

The other cushioning slides (1-13*a*, 1-13*c*, 1-13*e*) may also act as partial seals but primarily act as shock absorbing elements that also help to align the hammer (9) in the housing (6) as it reciprocates.

It can thus be seen that the seals forming the upper vacuum sealing (24) may be coupled to the hammer weight (9) by:

- a cushioning slide (1-13);
- mounting on, or retention or attachment to, an intermediary element (38);
- retention in a recess (33), void, space, aperture, groove or the like in the hammer weight (9), cushioning slide (1-13) and/or intermediary element (38);
- direct mounting on said side face (16); and/or
- any combination or permutation of the above.

As described previously, during impacting operation during which the vacuum chamber (22) expands during the up-stroke, air leakage into the vacuum chamber (22) may occur through any misaligned, ill-fitting, worn, inadequate or damaged seals or containment surfaces, interference from airborne residual debris, material or design characteristics or limitations and so forth. In all the embodiments shown in FIGS. 1-4, residual air may also be present in the vacuum chamber (22) before the start of the up-stroke in the void (42) formed between the lower impact face (15), the containment surfaces (8), the cap plate (21) and the striker pin driven end (17) protruding through the cap plate (21).

It is extremely difficult to achieve a completely impassable vacuum sealing (24, 25) in such a high speed, high energy reciprocation and thus during the up-stroke the upper (24) and/or lower (25) vacuum sealing may allow some air pass into the vacuum chamber (22), thereby increasing the pressure therein. The volume of such air leakage is dependent on a number of parameters, including the effectiveness of the sealing, area of sealing, pressure differential between vacuum chamber (22) and atmosphere and the exposure time the pressure differential is applied across the sealing.

The time the pressure differential is applied is relatively small as the cycle time of each reciprocation is 2-4 seconds. Reciprocating a heavy weight (9) (in the order of 1000's of Kilograms) over a 3-6 metre stroke length with a 2-4 cycle time is such a rapid rate that the heat that would be generated by the friction on a 'soft', e.g. rubber sealing (24, 25) would likely melt it after a few strokes.

Leakage can be minimised by using more seals and/or more flexible seals, however, this inherently increases friction and in such a high speed reciprocation, such seals can quickly become damaged or retard the hammer weight movement. Thus a balance is required between sealing effectiveness and friction. In preferred embodiments, the hammer weight (9) moves with such speed and force that highly effective seals such as rubber or other 'soft' seals are quickly damaged and become non-functional. Thus, it is preferable to use a less effective 'hard' seal that can withstand the high-friction loads, even though this may lead to more air leakage into the vacuum chamber.

Any residual air in the void (42) plus any leakage via the vacuum sealing (24, 25) and/or the housing (6) contributes to reduce the magnitude of the vacuum generated in the vacuum chamber (22). Moreover, on the down-stroke, any air inside the vacuum chamber (22) becomes increasingly compressed during the down-stroke applying a retarding force to the movement of the hammer weight (22).

Figure 3:
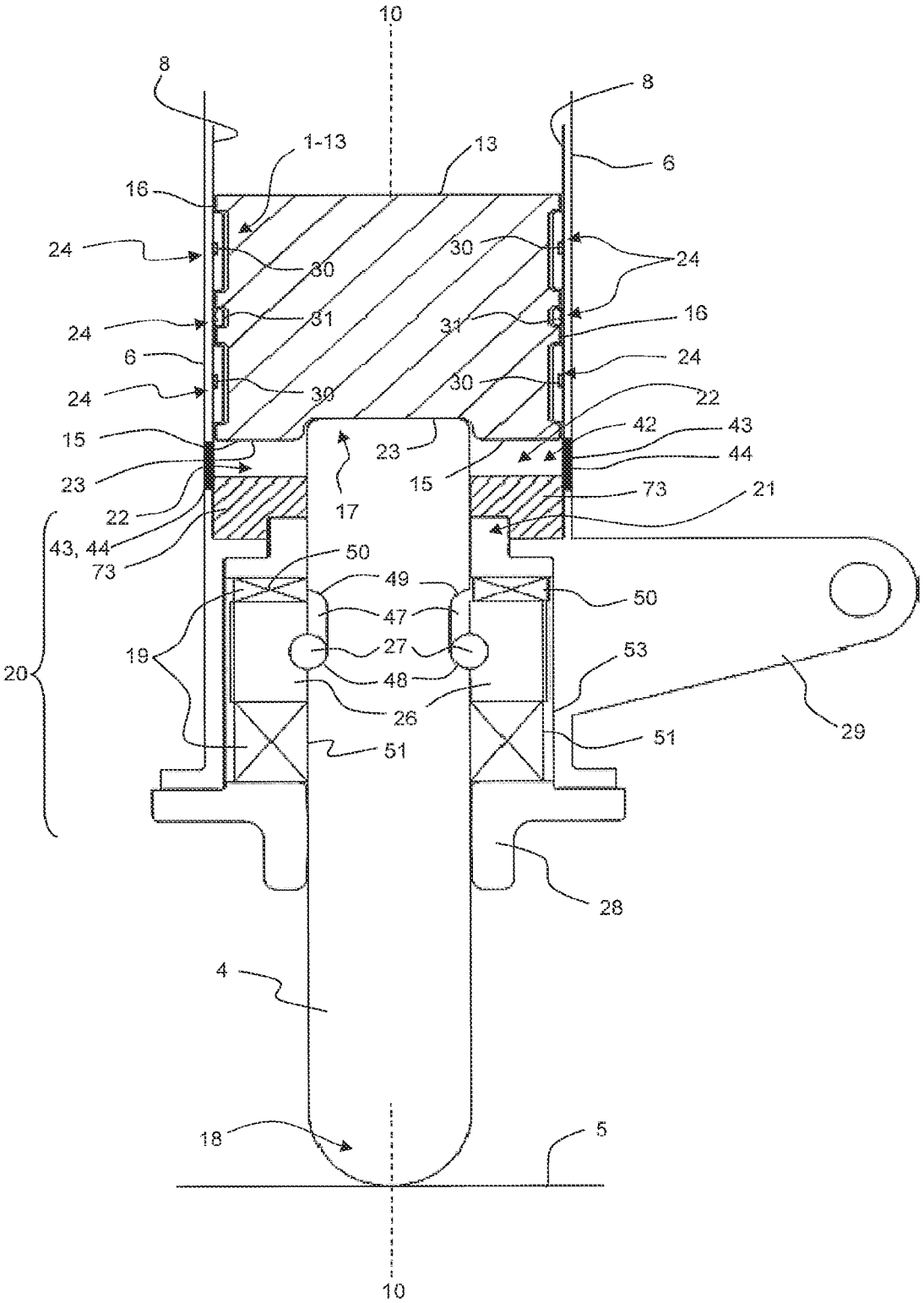
FIG. 3 shows an enlarged side elevation view of a cross-section of the lower end of the impact hammer shown in FIG. 2.

As shown in FIGS. 2 and 3, the impact hammer addresses this serious issue by the incorporation of unidirectional down-stroke vents (43) formed in the side of the housing (6) in fluid communication with the vacuum chamber (22 to ensure air is vented during the down-stoke.

It will be appreciated however, that one or more vents (43) may alternatively, or additionally formed in the upper vacuum sealing (24) (as shown in FIGS. 2 and 4*a-i*).

Down-stroke vents may alternatively, or in addition be formed in the lower vacuum sealing (25), the nose block (20) and/or through the hammer weight (9) (not shown).

Figure 5C:
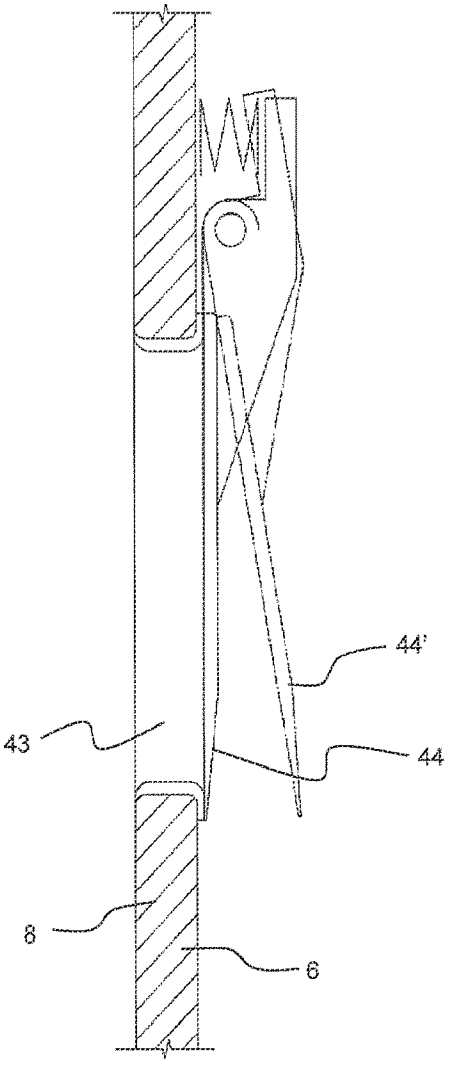
FIG. 5*c* shows a side elevation section view of a vent and unidirectional side opening flap valve.
Figure 5B:
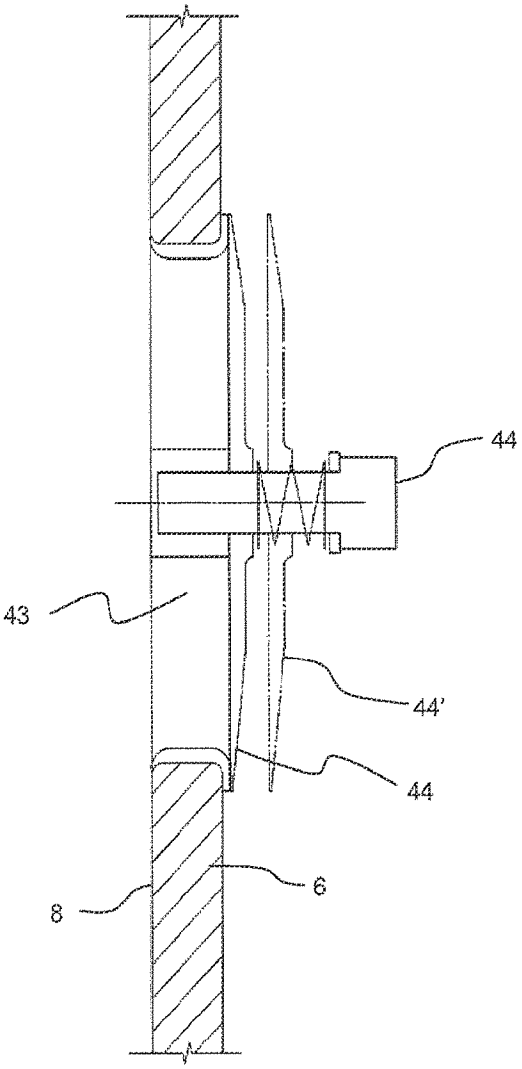
FIG. 5*b* shows a side elevation section view of a vent and unidirectional rigid poppet valve.
Figure 5A:
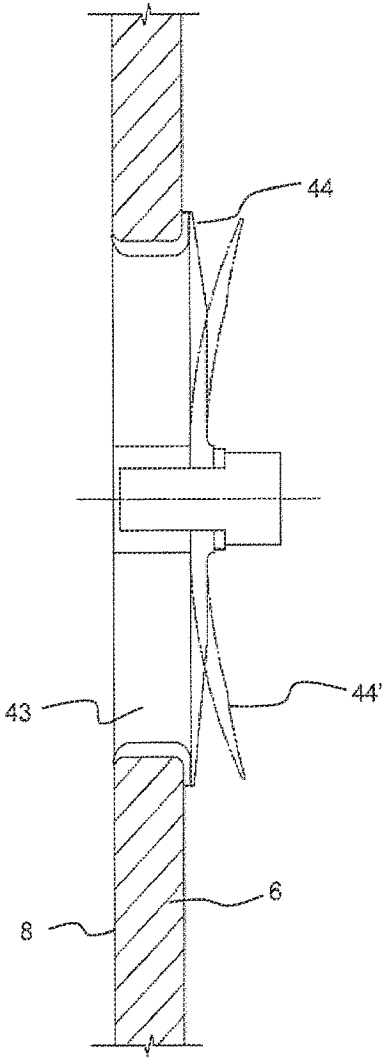
FIG. 5*a* shows a side elevation section view of a vent and unidirectional flexible poppet valve.

The vents (43) shown in FIGS. 2 and 3 are located in the containment surface (8) and pass through the housing (6) to atmosphere and includes a unidirectional valve (44). FIGS. 5*a-c* show three variants of a unidirectional, self-sealing valve (44), in the form of a flexible poppet (or mushroom) valve (FIG. 5*a*), a rigid poppet valve (FIG. 5*b*), and a side opening flap valve (FIG. 5*c*) respectively. The open vent position of the respective sealing valves (44) is denoted by reference numeral (44) in each of FIGS. 5*a-c*.

Figure 6:
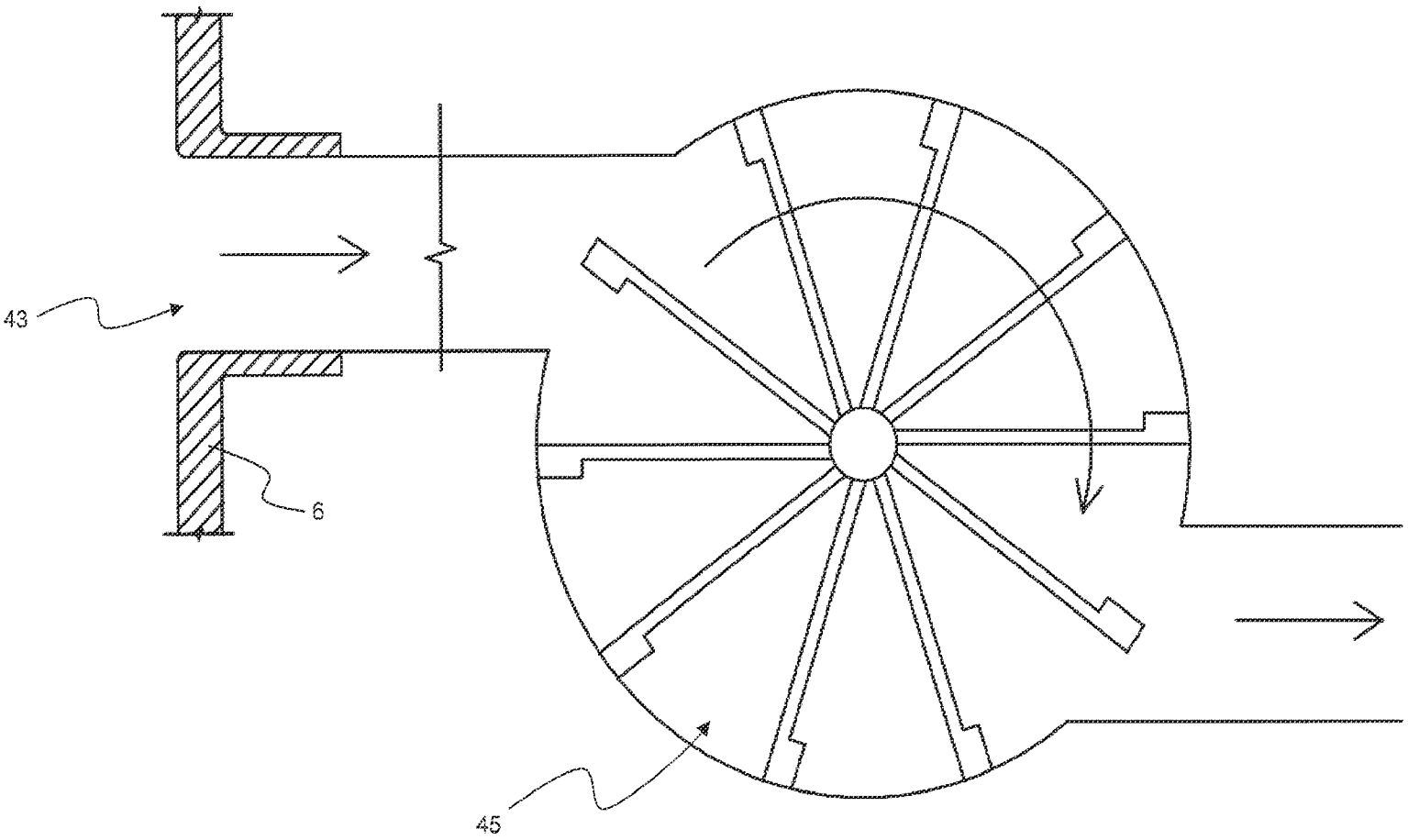
FIG. 6 shows a side elevation section view of a vent and vacuum pump.

An additional or alternative mechanism of removing residual air in the vacuum chamber (22) is shown in FIG. 6 and provided by a down-stroke vent in the form of an external vacuum pump (45) connected to the vent (43).

Figure 7:
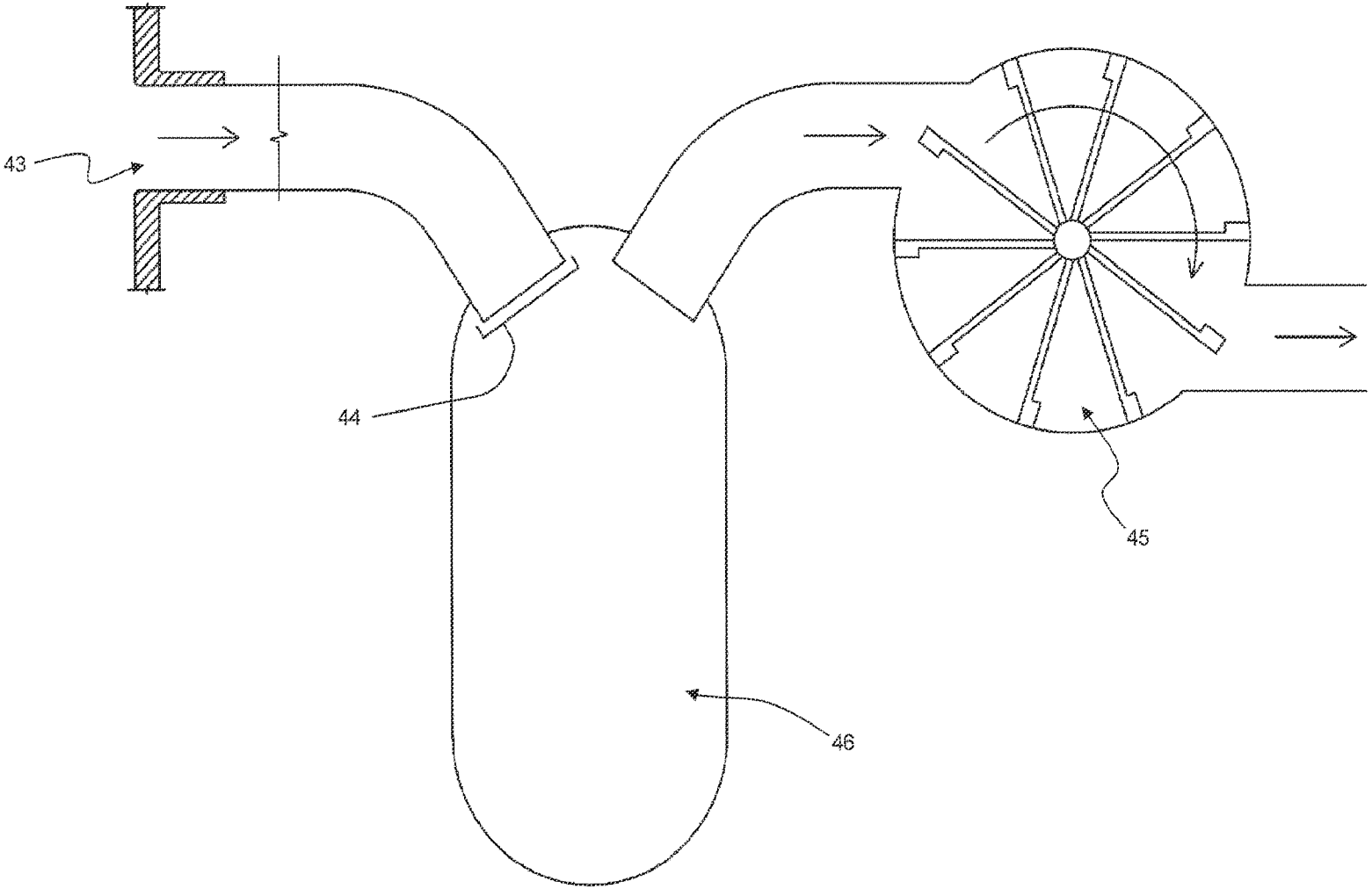
FIG. 7 shows a side elevation section view of a vent, vacuum chamber and vacuum pump.

FIG. 7 also shows an external vacuum pump (45), mounted to vent (43) via valve (44) to an intermediate vacuum tank (46). The vacuum pump (45) may be configured to operate continuously during the operating cycle, triggered according to threshold vacuum levels, or according to other sensing or input criteria. The vacuum tank (46) provides a degree of vacuum pressure at the vent (43) without the vacuum pump (45) necessarily operating.

In each embodiment, the down-stroke vents (43) are designed to open on the hammer down-stroke to permit air egress from the vacuum chamber (22) and closed on the up-stroke to prevent or at least restrict air ingress to the vacuum chamber (22). The down-stroke vents are biased closed with a bias sufficient to prevent undesired opening due to hammer vibration or impacts while opening when the pressure in the vacuum chamber reaches a threshold super-atmospheric level, e.g. 0.1 Bar.

Thus, compression of any air inside the vacuum chamber and the resultant heat is minimised as the air and heat is vented. A means for optionally reducing the potential for residual air in the void (42) is shown in FIG. 3 where the portion of the vacuum chamber (22) about the driven end (17) of the striker pin (4) is at least partially filled by one or more void-reduction objects. FIG. 3 shows a void reduction object in the form of foam (73) positioned in the void (42) to remain clear from contact from the hammer weight (9) during impact between lower impact face (15) and the striker pin driven end (17). Alternative void reduction objects include spheres, interlocking shapes, gels and the like.

A variety of alternative sealing configurations from said upper vacuum sealing (24) may be employed to form said lower vacuum sealing (25).

In contrast to the upper vacuum sealing (24), the lower vacuum sealing (25) is not subjected to the same magnitude of relative movement between adjacent sealing surfaces. While the upper vacuum sealing (24) is required to seal the movement of the hammer weight (9) along its travel along the reciprocation axis (at least several meters), the lower vacuum sealing (25) need only seal the movement of the striker pin (4) relative to the elements of the nose block (20).

FIGS. 8-13 show different embodiments of lower vacuum sealing (25) located in the impact hammer (1) nose block (20). A fuller description of the striker pin (4), shock absorber (19) and its housing in the nose block (20) is described below with reference to FIGS. 35-48*c*. In part however, and with respect to FIGS. 1-4, and 8-13, it can be seen that:

- the striker pin (4) is attached to the impact hammer (1) by a slideable coupling in the form of two retaining pins (27) passing laterally through the recoil plate (26) such that a portion of each pin (27) partially projects inwardly into a recess (47) formed in the striker pin (4).
- the recoil plate (26) connects the striker pin (4) via the slideable coupling at a retaining location defined by the length of the recess (47) between (with respect to the driven end of the striker pin (4)) a distal and proximal travel stops (48, 49).
- the shock absorber (19), in the form of first and second shock absorbing assemblies (50, 51) (also referred to as the upper and lower shock absorbing assemblies (50, 51)) laterally surround the striker pin (4) within the nose block (20) and are interposed by the recoil plate (26).

in the embodiments shown specifically in FIGS. 2, 4*f*, 4*h* and 9, the second shock-absorbing assembly (51) is formed from a plurality of un-bonded layers including multiple elastic layers (52) interleaved by inelastic layers (53, 26, 28). This is best shown in FIG. 9*b*.

the first shock-absorbing assembly (50) in FIGS. 8-13 and the second shock-absorbing assembly (51) in FIGS. 8 and 10-13 is shown as a buffer symbol and denotes either a unitary shock-absorbing layer or buffer such as a single elastic layer (52) or plurality of un-bonded layers including at least two elastic layers (52) interleaved by an inelastic layer (53).

The planar surfaces of the nose block (20) inner boundaries are formed at the upper end by the cap plate (21) and at the lower end by the nose cone (28).

It can thus be seen that these inner boundaries and the upper and lower planar surfaces of the recoil plate (26) provide four rigid, inelastic surfaces adjacent to the shock absorbing assemblies (50, 51). Thus, depending on the number of elastic (52) and inelastic layers (53) employed in an embodiment, an individual elastic layer (52) may be interposed by the rigid planar surfaces of either:

the cap plate (21) and an inelastic layer (53);

the nose cone (28) and an inelastic layer (53);

two inelastic layers (53), or an inelastic layer (53) and the recoil plate (26).

In each of the above configurations, the elastic layer (52) is sandwiched between the parallel planar surfaces of the adjacent rigid surfaces orthogonal to the striker pin longitudinal axis, co-axial with the impact axis (10).

It can be thus seen that positioned about the striker pin (4) between the driven end (17) and the impact end (18) is the following sequence of nose block elements (20):

cap plate (21);

first (or upper) shock absorbing assembly (50);

recoil plate (26);

second (or lower) shock absorbing assembly (51), and nose cone (28).

The lower vacuum sealing (25) is required to prevent or at least restrict air ingress via the above-listed nose-block elements into the vacuum chamber (22) and may be formed from seals positioned at several alternative, or cumulative positions in the above sequence of nose block elements.

Figure 9A:
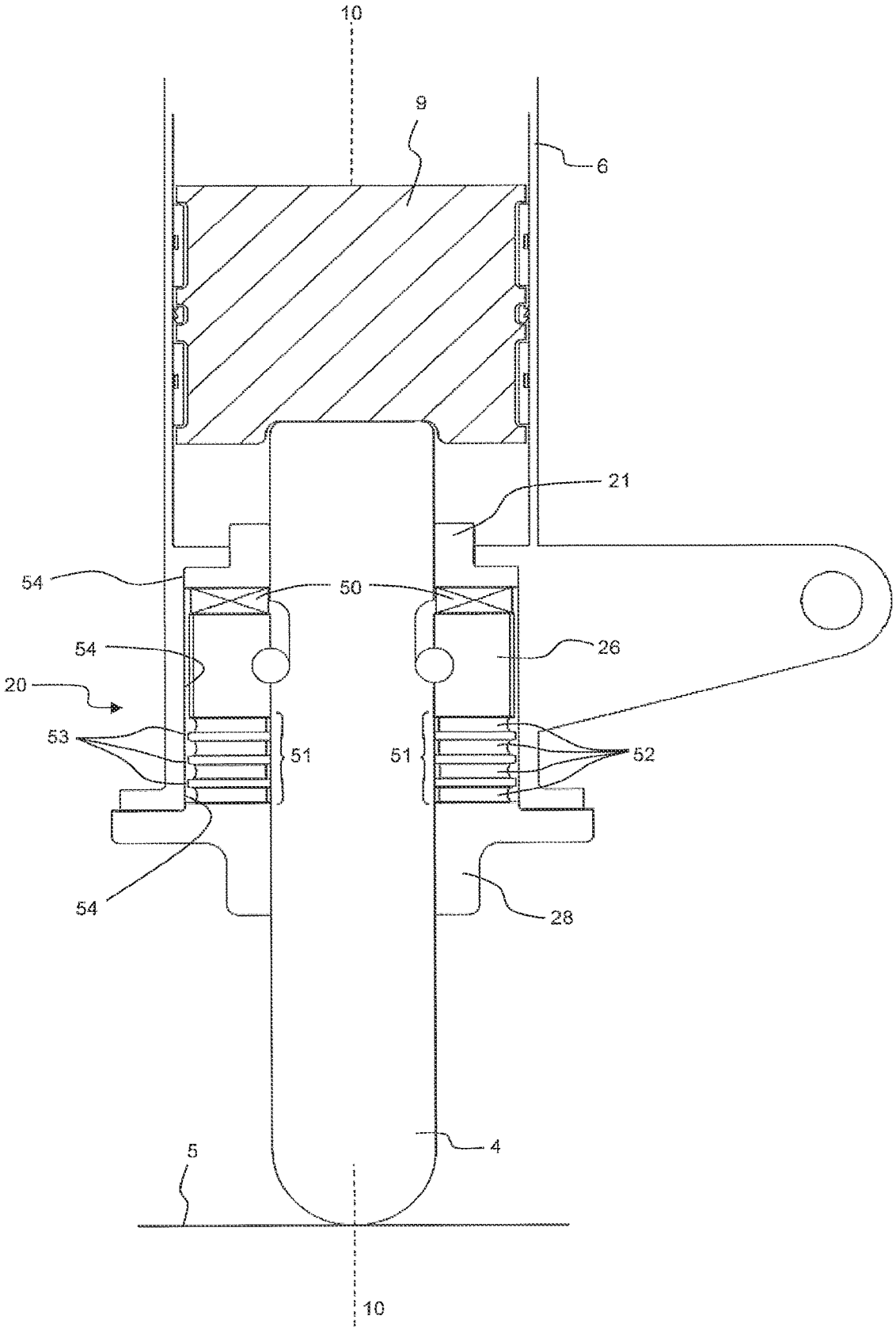
FIG. 9*a* shows a side elevation view of the striker pin and nose block with a further lower vacuum sealing embodiment.
Figure 9B:
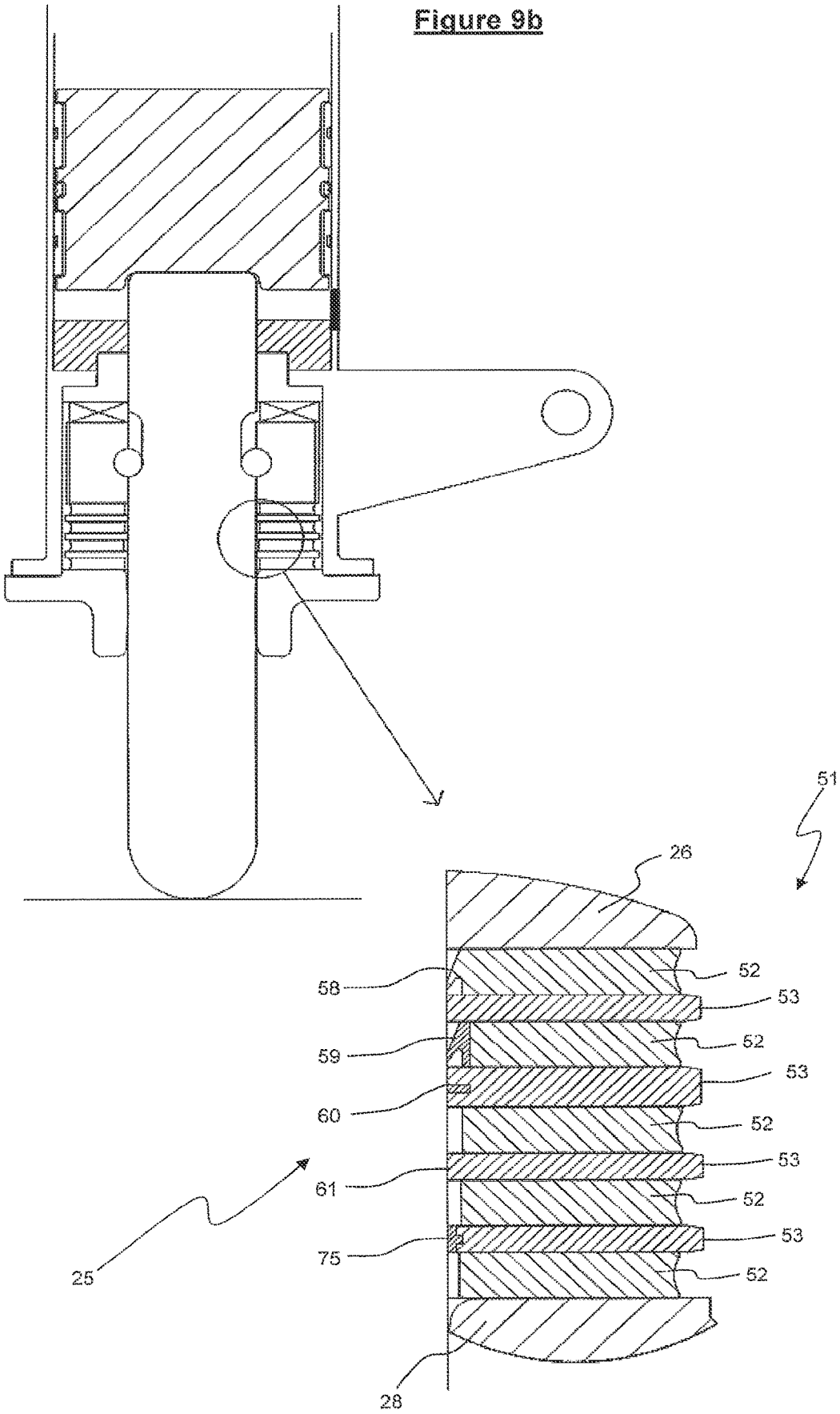
FIG. 9*b* shows an enlarged side elevation view of lower vacuum sealing embodiment in FIG. 9*a;*
Figure 10:
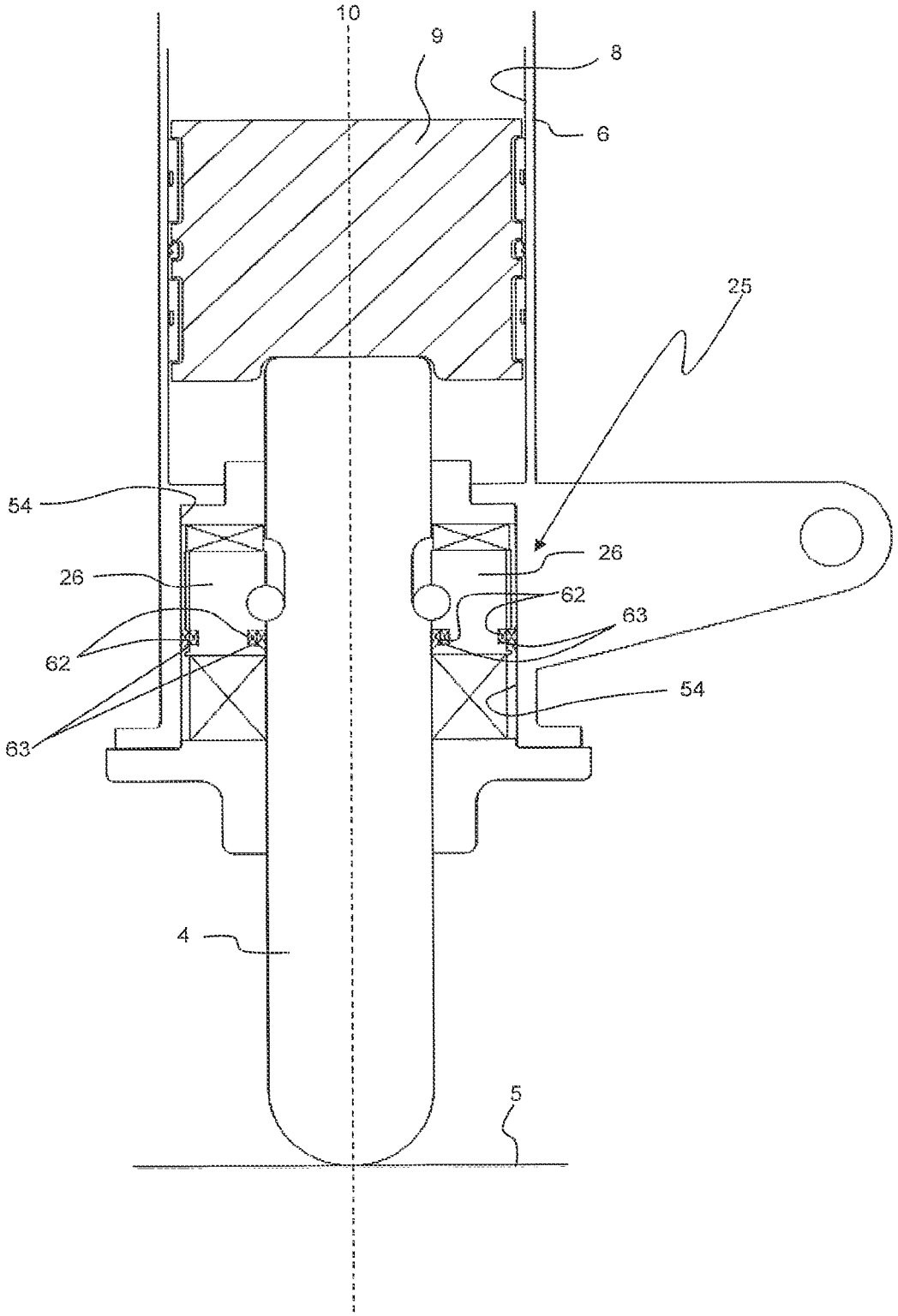
FIG. 10 shows an enlarged side elevation view of the striker pin and nose block with a further lower vacuum sealing embodiment.

The lower vacuum sealing (25) may thus be provided by one or more seals positioned at one of more of the interfaces between adjacent elements of the nose block (20). The different potential positions of the seals are:

between the nose cone (28) and the striker pin (4) (shown in FIG. 8):

between the lower shock absorbing assembly (51) and the striker pin (4) (shown in FIGS. 9*a* and 9*b*);

between the recoil plate (26) and the striker pin (4) (shown in FIG. 10) and/or between a nose block inner side wall (54) (shown in FIG. 10);

between the upper shock absorbing assembly (50) and the striker pin (4) (not shown), and/or between the cap plate (21) and the striker pin (4) (not shown).

Figure 11:
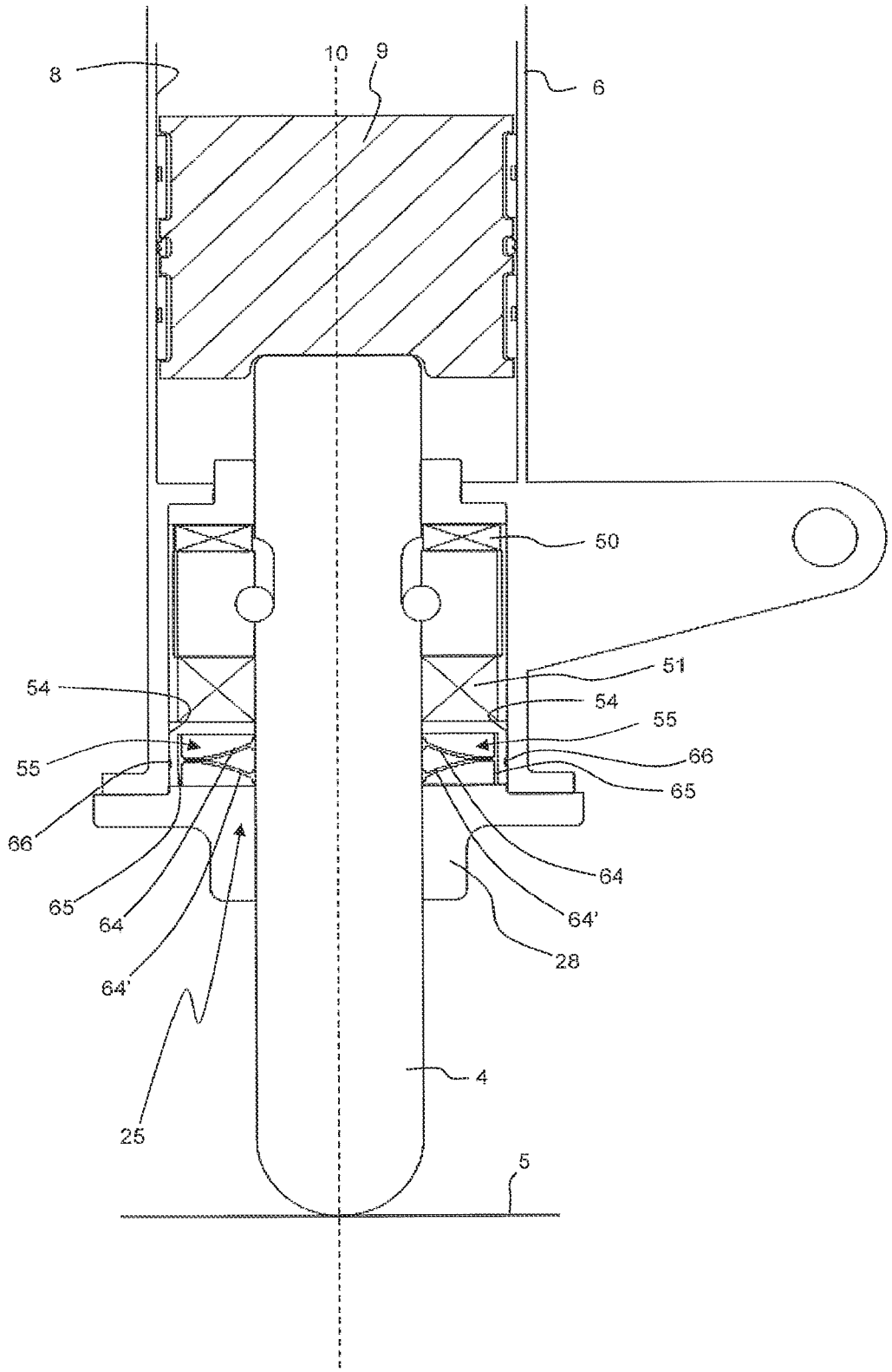
FIG. 11 shows an enlarged side elevation view of the striker pin and nose block with a further lower vacuum sealing embodiment.
Figure 12:
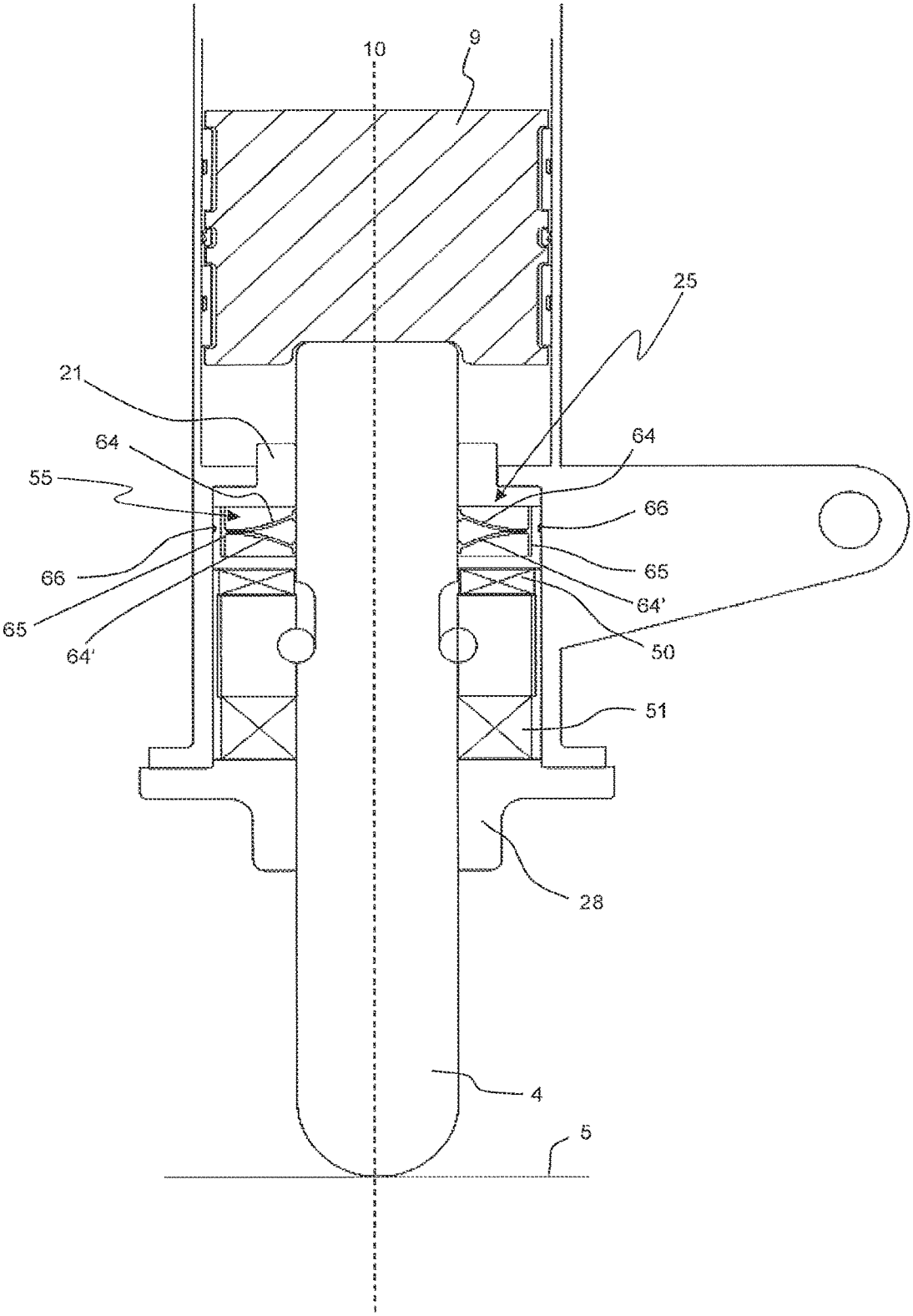
FIG. 12 shows an enlarged side elevation view of the striker pin and nose block with a further lower vacuum sealing embodiment.
Figure 13:
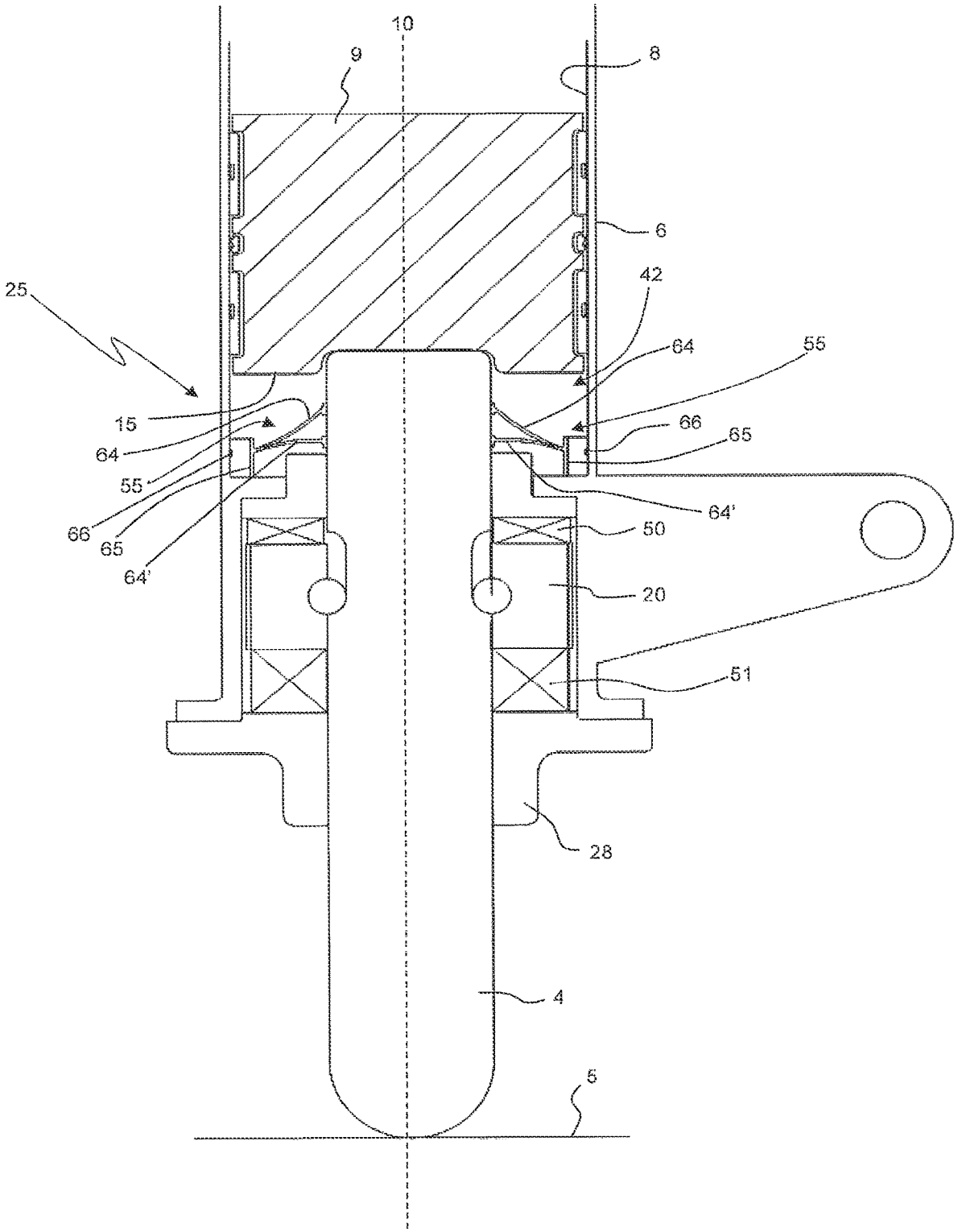
FIG. 13 shows an enlarged side elevation view of the striker pin and nose block with a further lower vacuum sealing embodiment.

According to a further embodiment, the lower vacuum sealing (25) is provided by one or more seals formed as individual independent sealing layers (55) laterally encompassing the striker pin and located:

between the nose cone (28) and the lower shock absorbing assembly (51) (shown in FIG. 11);

between the upper shock absorbing assembly (50) and the cap plate (21) (shown in FIG. 12), and/or between the cap plate (21) and the lower travel extremity of the lower impact face (15) of the hammer weight (9) (shown in FIG. 13).

Figure 8:
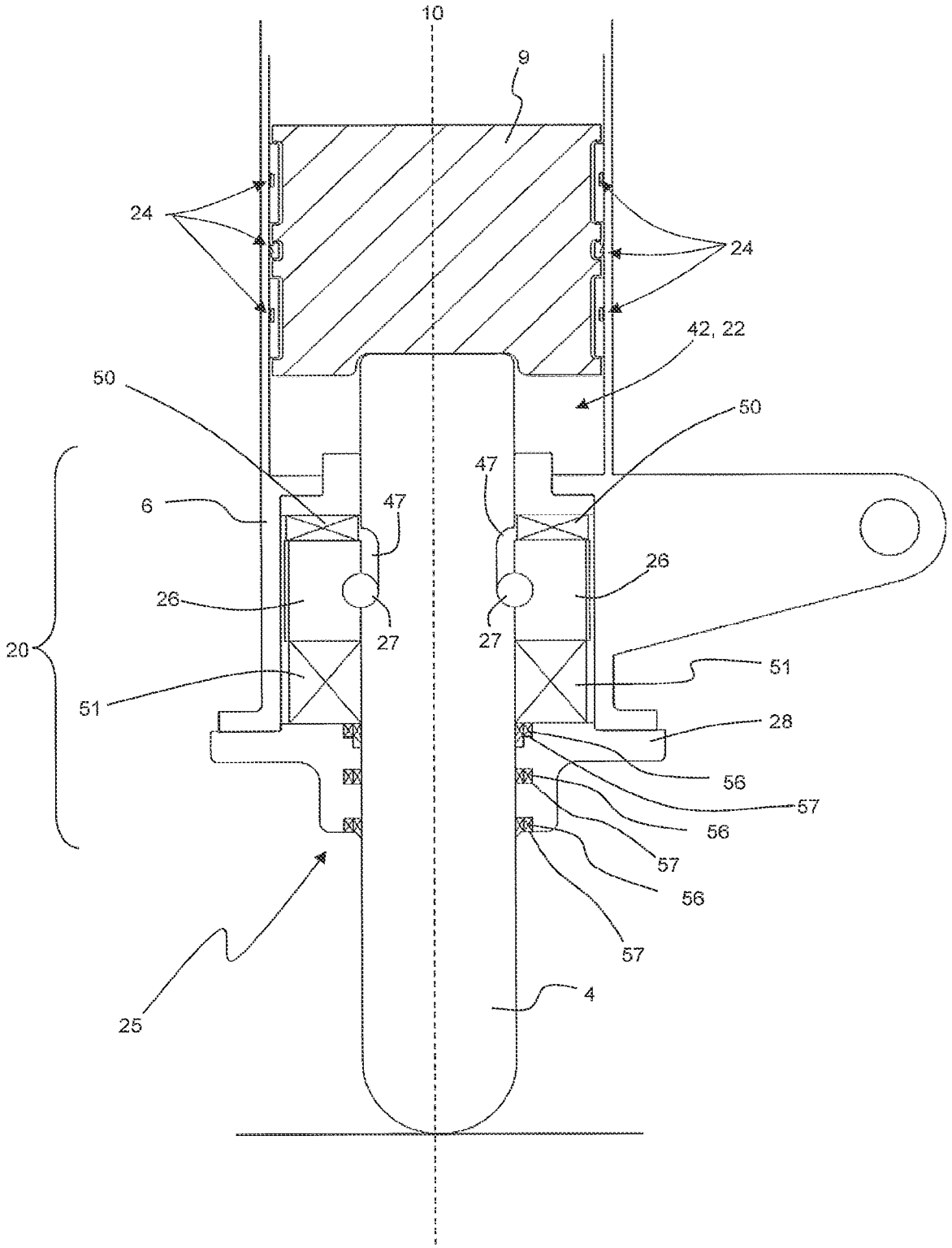
FIG. 8 shows an enlarged side elevation view of the striker pin and nose block with a lower vacuum sealing embodiment.

Considering the above referenced configurations individually in more detail, FIG. 8 shows a lower vacuum sealing (25) formed from a plurality of nose cone ring seals (56) located in corresponding annular recesses (57) in the nose cone (28). The nose cone ring seals (56) are engaged against the surface of the striker pin (4) to inhibit ingress of air, dust and detritus into the nose block (20) interior and subsequently to the vacuum chamber (22). The nose cone ring seals (56) may be venting (i.e. acting as additional down-stroke vents) or non-venting and formed from elastic or inelastic materials biased against the striker pin (4). It will be appreciated that any of the lower vacuum sealing (25) embodiments shown in FIGS. 9-13 may be formed as venting or non-venting seals, depending on the specific requirements of the impact hammer (1). It may not be essential for venting to be performed through the lower vacuum sealing (25) as venting may be performed via vents (43) in the housing (6) and/or the upper vacuum sealing (24). Furthermore, forming the lower vacuum sealing (25) without venting enables more robust, higher performance seals to be used which in turn enable a greater resistance to atmospheric ingress. Given the nose-block (20) is positioned in direct exposure to the debris and airborne contamination from impacting operations, it is typically more desirable to maximise nose block (20) atmospheric ingress prevention rather than supplement the vacuum chamber (22) venting.

FIG. 9*a* shows the lower vacuum sealing (25) formed between the striker pin (4) and either, or both of, the lower shock absorbing assembly (51) and the upper shock absorbing assembly (50).

FIG. 9*b* shows an enlarged view of the lower shock absorbing assembly (51) formed from a plurality of elastic layers (52) interleaved by inelastic layers (53). Seals may be formed from or in either, or both of, the elastic layers (52) and inelastic layers (53) and FIG. 9*b* illustrates several alternative configurations. The lower vacuum sealing (25) arrangement depiction in FIG. 9*b* is illustrative and does not imply such a combination of seals is required or that the invention is restricted to same.

FIG. 9*b* shows a lower vacuum sealing (25) in lower shock absorbing assembly (51) in the form of:

an integral elastic layer seal (58) forming the inner peripheral edge (and optionally, the outer peripheral edge (not shown)) of the elastic layer (52) adjacent the striker pin (4). The seal (58) is shaped to let air pass if the pressure on the upper side is super-atmospheric, i.e. the seal (58) acts as a down-stroke vent as previously described;

a distinct elastic layer seal (59), abutting the inner peripheral edge (and optionally, the outer peripheral edge (not shown)) of the elastic layer (52) adjacent the striker pin (4). This seal (59) also acts as a down-stroke vent as per seal (58);

an inelastic layer seal (60) retained within or coupled to the inner peripheral edge (and optionally, the outer peripheral edge (not shown)) of the inelastic layer (53) and formed from elastic or inelastic material;

an intimate fit seal (61) between a shock absorbing assembly inelastic layer (53) and the striker pin (4), and/or between the inelastic layer (53) and the nose block inner side wall (54) (not shown), a distinct elastic or inelastic layer seal (75), abutting the inner peripheral edge (and optionally, the outer peripheral edge (not shown)) of the inelastic layer (53) adjacent the striker pin (4), and/or any combination or permutation of the above.

FIG. 10 shows a pair of recoil plate ring seals (62) located in annular recesses (63) about the inner and outer periphery of the recoil plate (26) adjacent the striker pin (4) and nose block inner side wall (54) respectively. It should be understood that the outer recoil plate ring seal (62) engaging against the nose block inner side wall (54) is present as an additional safeguard seal to the inner recoil plate ring seal (62). The combined stack of nose block (20) elements (i.e. the upper and lower shock absorbing assemblies (50, 51) and recoil plate (26)) themselves effectively provide a composite seal to the ingress of air. It will thus be appreciated that corresponding seals (not shown) between the nose block inner side wall (54) and the upper and lower shock absorbing assemblies (50, 51) are also possible as additional safeguard seals.

FIGS. 11-13 show the use of individual independent sealing layers (55) to provide the lower vacuum sealing (25). Although the independent sealing layers (55) may be configured in a variety of forms, in the embodiments of FIGS. 11-13, each independent sealing layer (55) is formed with an inner flexible diaphragm (64) portion and a cylindrical, substantially rigid, outer rim (65) portion. The periphery of the flexible diaphragm (64) contacting the striker pin (4) is free to flex with the movement of the striker pin (4) along the impact axis (10), i.e. moving with the striker pin (4) from an upper position (64) when the striker pin (4) is an uppermost position to a lower position (64') as the striker pin (4) moves down. The outer rim (65) also provides a sealing wall between adjacent nose block elements. An additional safeguard static seal (66) is located between the diaphragm rim portion (65) and the inner nose block walls (54).

FIG. 11 shows the independent sealing layer (55) positioned between the nose cone (28) and the lower shock absorbing assembly (51).

In FIG. 12, the independent sealing layer (55) is positioned between the upper shock absorbing assembly (50) and the cap plate (21).

In FIG. 13, the independent sealing layer (55) is positioned outside the nose block (2) in the void (42) between the cap plate (21) and the lower travel extremity of the lower impact face (15) of the hammer weight (9).

The lower vacuum sealing (25) may alternatively be formed from, or include; a flexible elastomer, an elastic or inelastic material, biased into contact with the striker pin and/or the nose block inner side walls by a preload or imitate fit, unidirectional vent and/or any combination or permutation of same.

Figure 14:
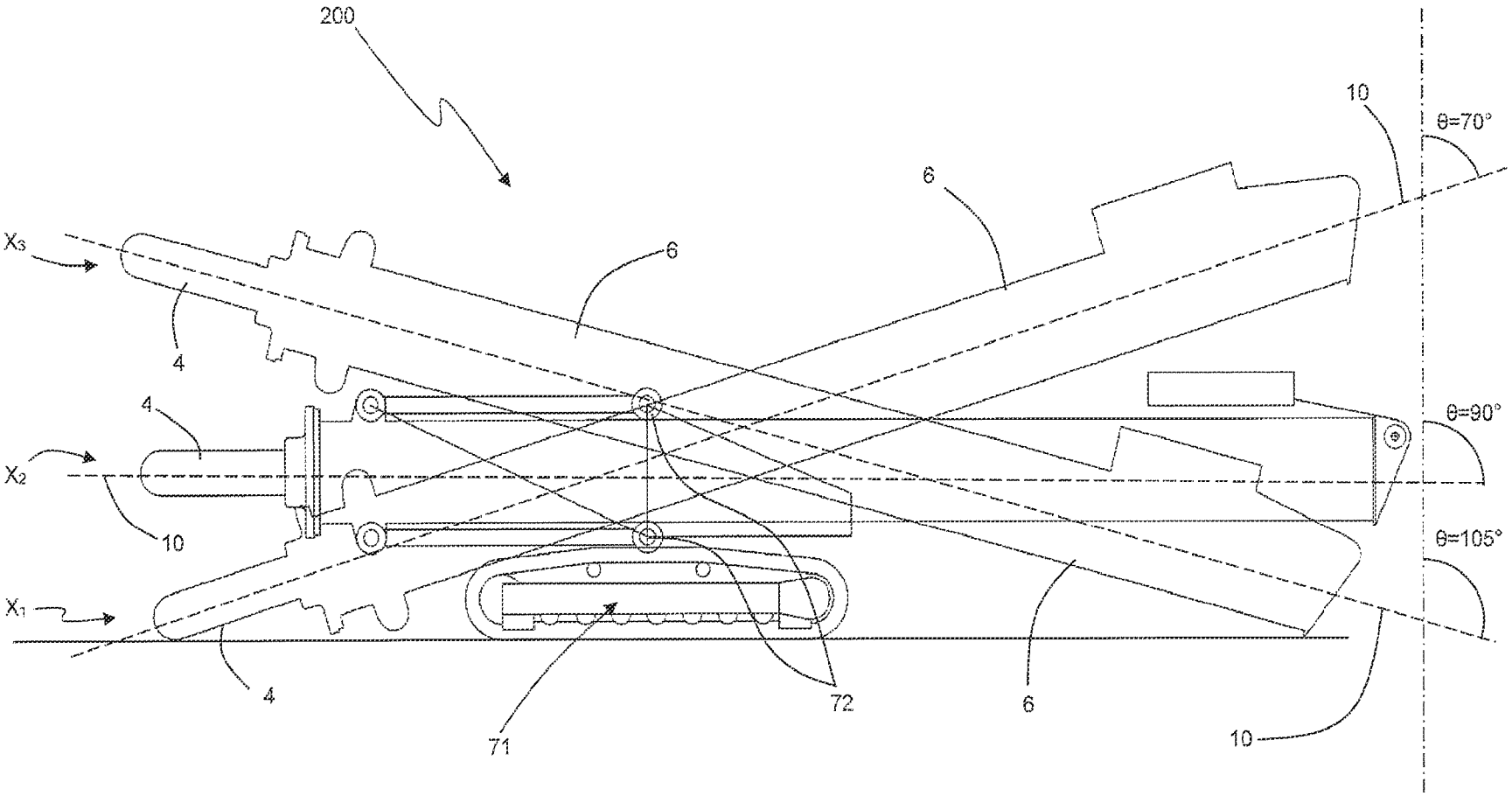
FIG. 14 shows a side elevation view of further embodiment of the present invention in the form of a robotic remote control impact hammer.

As discussed above, preferred embodiments are able to operate effectively at any inclination of the impact axis (10), including upwards. This provides great versatility for general impacting operations, quarrying, mining, extraction, demolition work and so forth. It also enables the impact hammer to be applied to specialised applications such as a further embodiment in the form of a robotic tunnelling impact hammer (200) shown in FIG. 14. The inherent operator danger from overhead rock-fall in tunnelling operations naturally favours the use of remote-control impact hammers. The restricted confines often associated with tunnelling further suit compact impact hammers with a high impact energy/volume ratio. The need to operate at steep impact axis (10) inclinations further restricts the suitability of prior art gravity-only impact hammers. The robotic tunnelling impact hammer (200) shown in FIG. 14 includes a striker pin (4) configuration located in a housing (6) comparable to that shown in the preceding embodiments. The housing (6) is mounted on a tracked carrier (71) via an azimuth cradle (72) which enables the impact hammer (200) to vary the inclination angle (θ) of the impact axis (10). In FIG. 14, the impact hammer (200) is illustrated at three orientations $X_1$, $X_2$, $X_3$ with a corresponding impact axis (10) inclination from vertical of θ=70°, 90° and 105° respectively. Clearly these orientations are exemplary and the invention is not limited to same. It will also be readily apparent that the robotic tunnelling impact hammer (200) is not necessarily restricted to tunnelling operations and may be used in other confined areas, close to steep rock-faces, trenching and the like.

Figure 15A:
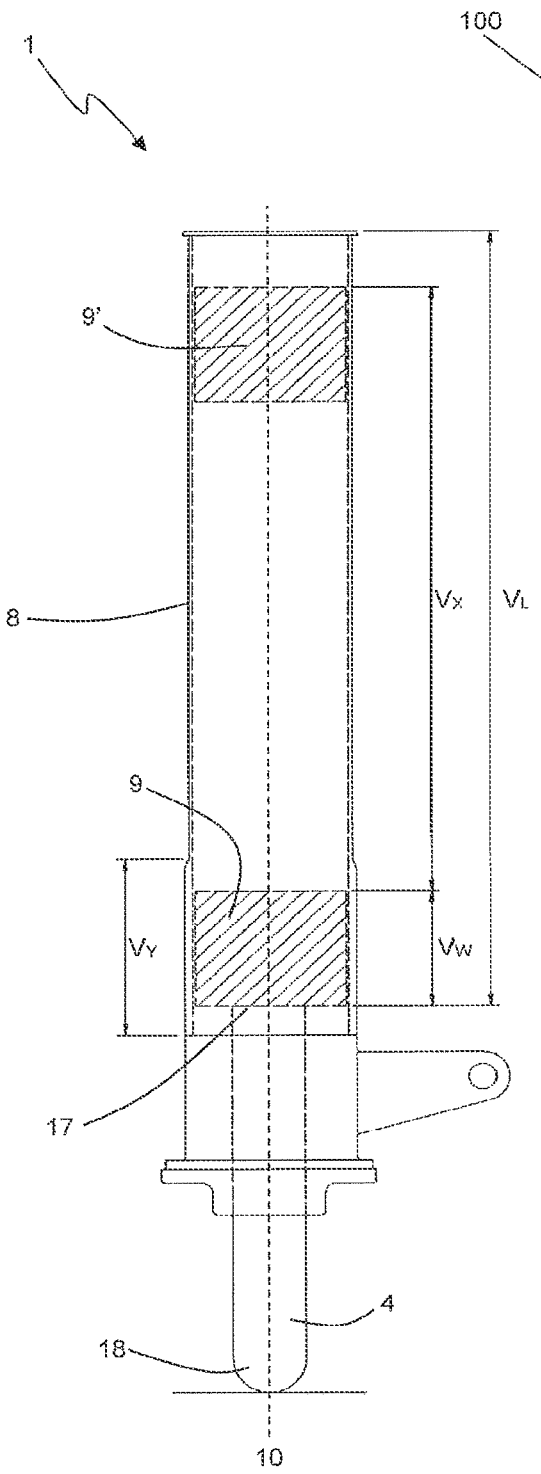
FIG. 15 shows a side elevation section view of the impact hammer of FIG. 1 and a side elevation section view of a prior art impact hammer.
Figure 15B:
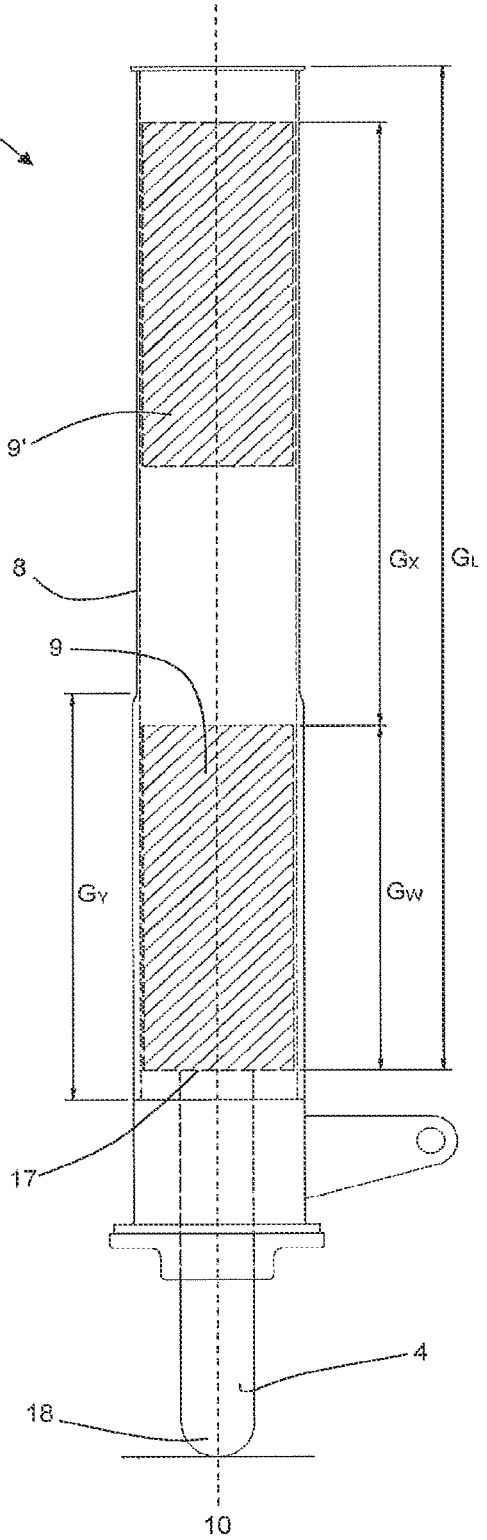

FIG. 15 shows a comparison between a prior art gravity-only impact hammer (100) shown and a vacuum-assisted impact hammer (1) according to one preferred embodiment. The above-documented capacity to use a lighter hammer weight (9) to achieve the same impact energy as a conventional prior art gravity-only impact hammer (100) (even with a shorter maximum drop height) provides yet further weight saving, manufacturing and associated economic benefits. During the operating cycle, at the end of the down-stroke, the hammer weight (9) impacts the driven end (17) of the striker pin (4) thereby transferring kinetic energy via the striker pin (4) to the working surface (5).

However, as explained in greater detail elsewhere, not all the kinetic energy of the hammer weight (4) is transferred to the working surface (5), as in the event of:

a 'mis-hit' when the operator drops the hammer weight (4) on the striker pin (4) driven end (17) without the impact end (18) being in contact with the working surface (5), the impact of the hammer weight (9) forces the proximal travel stop (49) against the slideably coupled retaining pin (27) (components shown most clearly in FIG. 3). Appreciable shock load is thus transferred through, and absorbed by, the impact hammer (1).

'Over-hitting' whereby even though the working surface (5) does fracture successfully after a strike, the impact may only absorb a portion of the kinetic energy of the striker pin (4) and hammer weight (9). In such instances, the resultant effect on the impact hammer (1) is directly comparable to a 'mis-hit'. In practice, the impacting operations are undertaken at a wide variety of inclinations, and are seldom performed with a perfectly vertical impact axis (10).

the nature of the working surface (5) requiring multiple impacts before fracture occurs, and thus the striker pin (4) or hammer weight (9) may recoil away from the unbroken working surface (5). The direction of the recoiling striker pin/hammer weight (4, 9) will predominately include a component lateral to the impact axis (10), thereby bringing it into contact with the housing (6) containment surface (8).

Due to the relatively massive mass of the hammer weight (9) in comparison to the rest of the impact hammer (1), the contact area between the hammer weight (9) and the containment surface (8) is particularly vulnerable to damage. Consequently, the portion of the containment surface (8) and adjacent hammer housing (6) surrounding the hammer weight (9) at the point of impact with the striker pin (4) requires additional strengthening compared to the remainder of the housing (6). FIG. 15 shows the relative difference between:

the vacuum-assisted impact hammer (1);

hammer weight height $V_W$ hammer stroke length $V_X$
overall housing column length $V_L$
strengthened housing portion $V_X$ and the gravity-only prior art impact hammer (100);
hammer weight height $G_W$
hammer stroke length $G_X$
overall housing column length $G_L$
strengthened housing (6) portion $G_X$ wherein the overall housing column length $V_L$, $G_L$ is the length of the containment surface (8) parallel with the impact axis (10) between the driven end (17) of the striker pin (4) and the upper distal end of the housing (6), and the hammer stroke length $V_X$, $G_X$ is the distance travelled by the hammer weight (9) along the impact axis (10) inside the containment surface (8).

As described previously, the impact hammer (1) can achieve the same impact energy as a prior art gravity-only impact hammer (100) using a significantly lighter hammer weight (4). Assuming an equal diameter (to facilitate comparison), it follows that the hammer weight height $V_W$ of the vacuum-assisted impact hammer (1) is less than the hammer weight height $G_W$ of the prior art impact hammer (100). The reduced hammer weight height $V_W$ compared to the hammer weight height $G_W$ produces numerous advantages for the impact hammer (1), namely:

despite the hammer stroke length $V_X$ being equal to the hammer stroke length $G_X$, the overall column length $V_L$ is less than overall column length $G_L$. The additional length of overall housing column length $G_L$ required by the prior art impact hammer (100) naturally increases the total weight of the impact hammer (100) and consequently adds six to seven times that value to the weight of the required excavator (2). As the extra weight on the prior art hammer (100) is located at the extremity of the housing (6), its polar moment of inertia also detrimentally increases the required strength (and thus weight) of the type of excavator (2) able to manoeuvre the impact hammer (100) effectively;

the strengthened housing portion $V_X$ of the impact hammer (1) is shorter than the corresponding portion $G_X$ in direct proportion to the difference in the hammer weight heights $G_W$–$V_W$. This results in further weight savings for the vacuum-assisted impact hammer (1).

As the hammer weight height $V_W$ of the vacuum-assisted impact hammer (1) is only a third of the hammer weight height $G_W$ of the prior art impact hammer (100), the behaviour of the respective hammer weights (9) during lateral impacts with the containment surface (8) differ. As the hammer weight (9) is deflected laterally towards the containment surface (8), it will seldom make simultaneous uniform contact with the containment surface (8) and the hammer weight side face (16) precisely parallel. Instead, the hammer weight (9) tends to rotate with respect to the containment surface (8) generating a couple. The resulting impact with the containment surface (8) is thus a point load rather than being dissipated uniformly along the length of the strengthened housing portion $V_X$, $G_X$. The vastly shortened hammer weight height $V_W$ of the vacuum-assisted impact hammer (1) significantly reduces the magnitude of such forces, thus further reducing the magnitude of the strengthening required over the strengthened housing portion $V_X$ relative to the prior art hammer (100).

Figure 16:
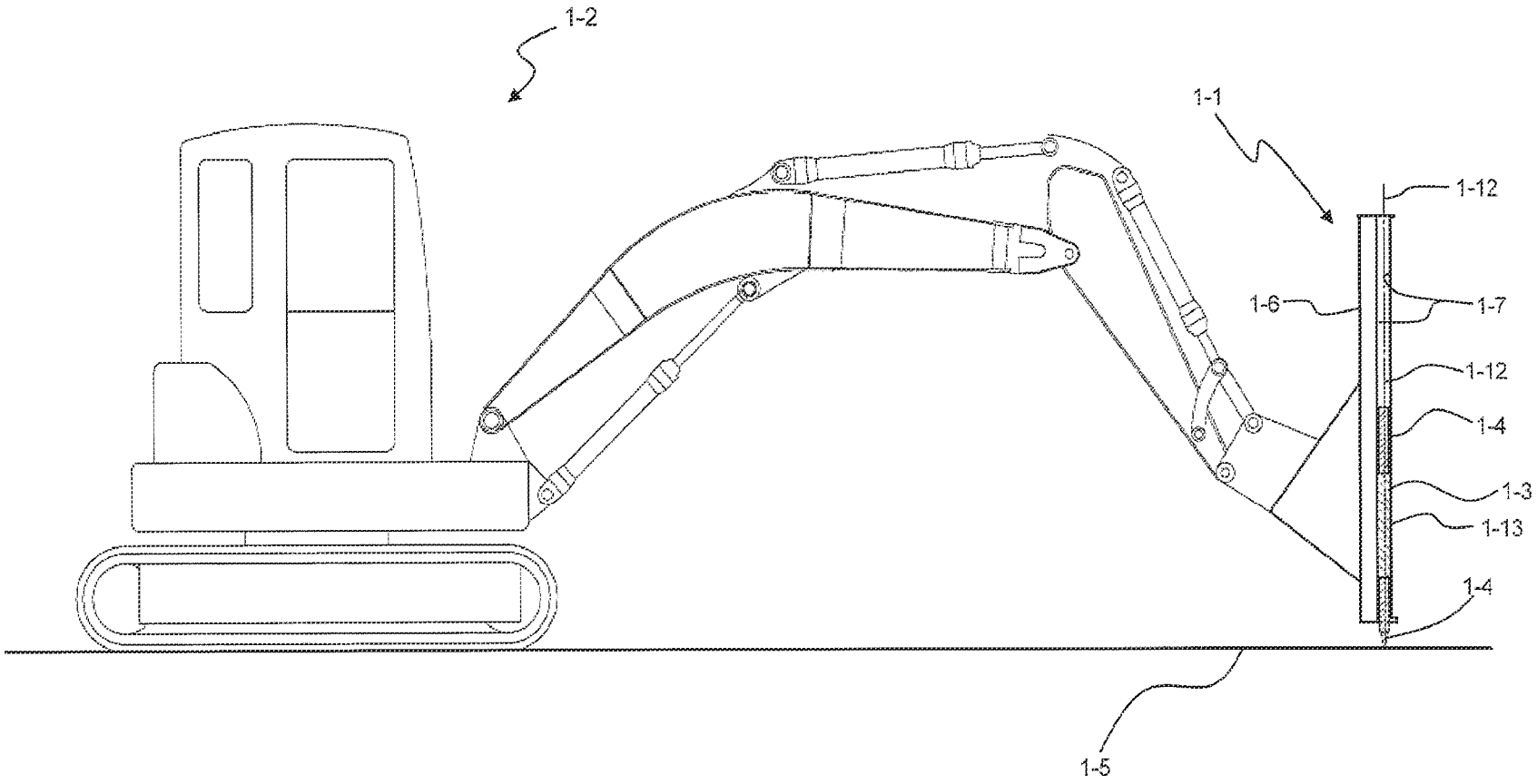
FIG. 16 shows a side elevation section of a preferred embodiment of the present invention of an apparatus in the form of a small impact hammer attached to a small excavator.
Figure 17:
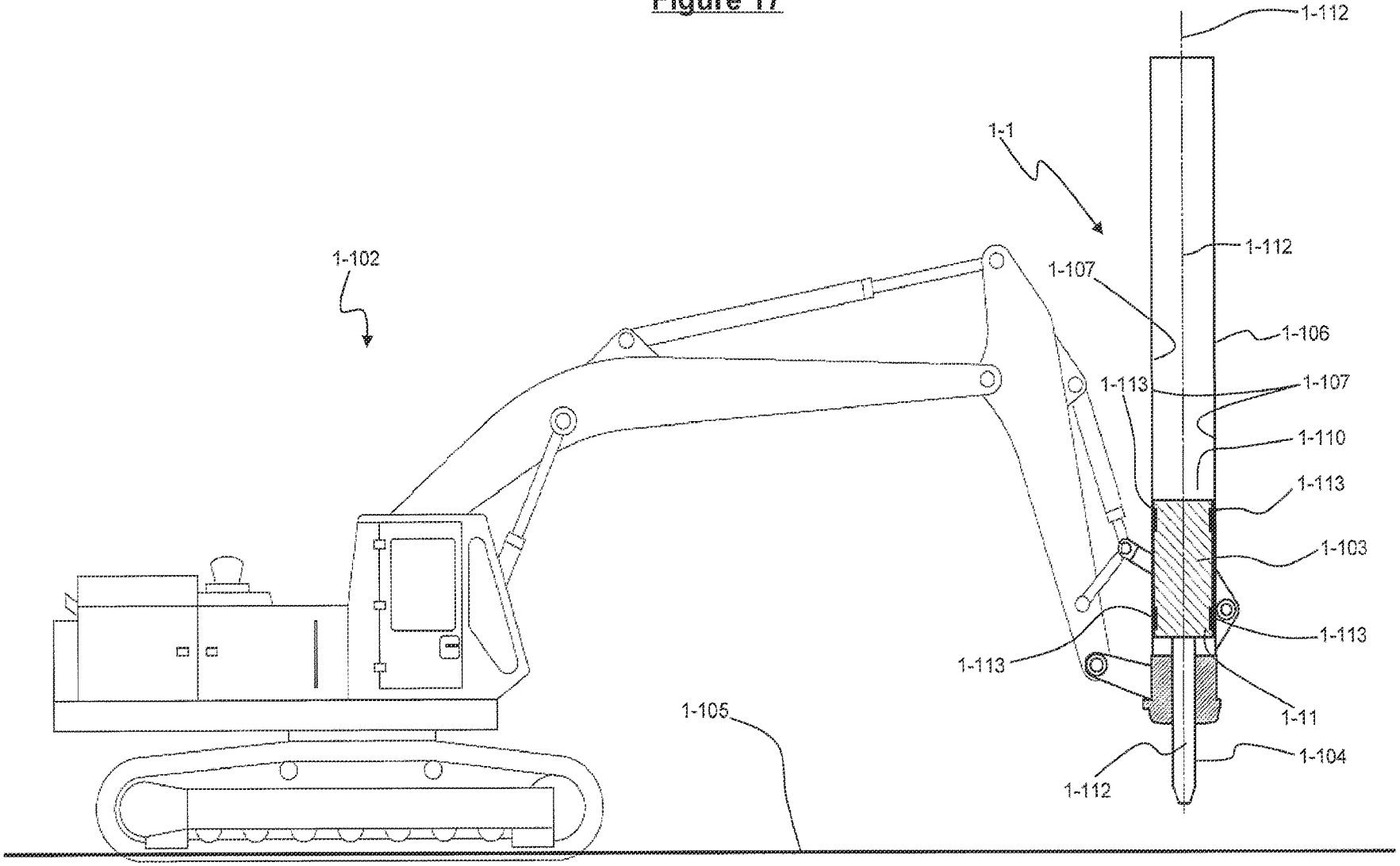
FIG. 17 shows a side elevation section of further embodiment of the present invention of an apparatus in the form of a large impact hammer attached to a large excavator.

FIGS. 16-17 show apparatus according to separate embodiments being in the form of impact hammers with weights fitted with cushioning slides.

FIG. 16 shows a further embodiment of an apparatus in the form of a small impact hammer (1-1) fitted to a small excavator (1-2).

The impact hammer (1-1) includes:

a lifting and/or reciprocating mechanism (not shown), a reciprocating component in the form of a weight configured as a unitary hammer weight (1-3) with an integral tool end (1-4) for striking a working surface (1-5) and a housing (1-6) attached to the excavator (1-2) and partially enclosing the hammer weight (1-3) with a containment surface in the form of housing inner side walls (1-7).

FIG. 17 shows an alternative apparatus embodiment in the form of a large impact hammer (1-100) fitted to a large excavator (1-102).

The impact hammer (1-100) includes:

a lifting mechanism (not shown)

a reciprocating component in the form of a weight (1-103)

a housing (1-106) attached to the excavator (1-102) and partially enclosing the hammer weight (1-103) with a 'containment surface' or 'housing weight guide' provided in the form of a housing inner side walls (1-107).

The lifting mechanism raises the weight (1-103) within the housing weight guide (1-107), before being dropped onto a striker pin (1-104), which in turn impacts the working surface (1-105).

Regarding the hammer (1-1) shown in FIGS. 16, 18*a-d*, and 22*a-b*, the hammer weight (1-3) is an elongate substantially rectangular/cuboid plate or blade configuration. The hammer weight (1-3) is of rectangular lateral cross section and composed of a pair of parallel longitudinal wide side walls (1-8), joined by a pair of parallel short side walls (1-9), with opposing upper and lower distal faces (1-10, 1-11) each provided with tool ends (1-4). The symmetrical shape of the hammer weight (1-3) enables the tool ends (1-4) to be exchanged when one is worn. The hammer weight (1-3) is removed from the housing (1-6) and re-inserted with the position of the tool ends (1-4) reversed. The hammer shown in FIG. 18*a-d* however only has one tool end (1-4).

In operation, the hammer weight (1-3) reciprocates about a linear impact axis (1-12) passing longitudinally through the geometric centre of the hammer weight (1-3). The hammer weight (1-3) is raised upwards along the impact axis (1-12) by the lifting mechanism to its maximum vertical height, prior to being released, or driven downwards back along the impact axis (1-12) until impacting with the working surface (1-5).

Figure 18A:
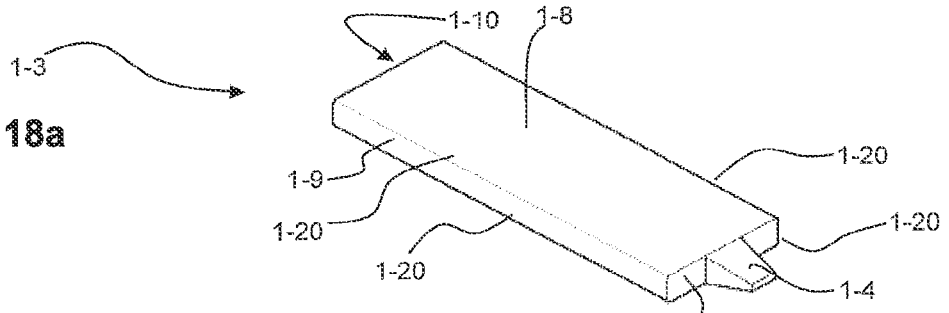
FIGS. 18*a-d* shows a perspective view of a hammer weight and cushioning slides according to the embodiment shown in FIG. 16.
Figure 18B:
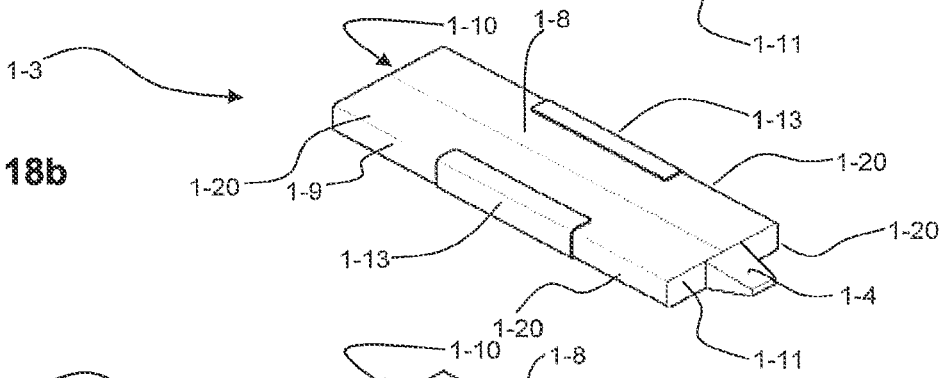
Figure 18C:
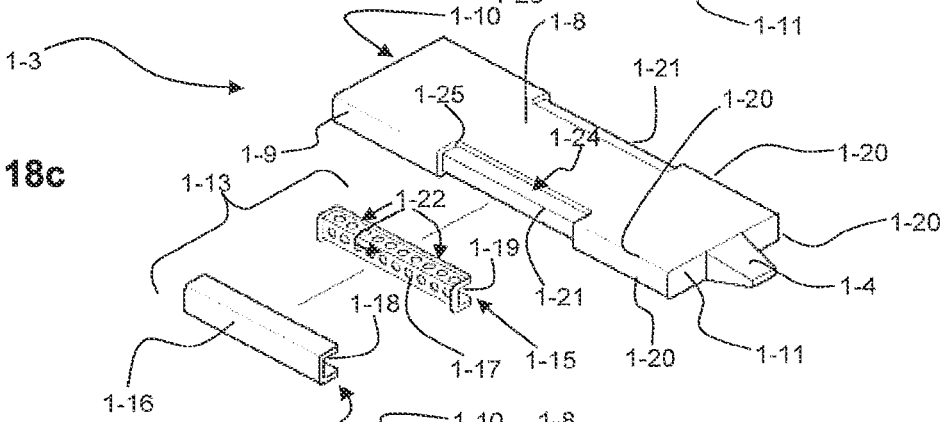

FIG. 18*b* shows the hammer weight (1-2) of FIG. 18*a* with the addition of a pair of centrally located cushioning slides (1-13). FIG. 18*c* is an exploded diagram showing the components of the cushioning slides (1-13), namely:

a first layer (1-14) formed from a material of predetermined low friction properties such as UHMWPE, Nylon, PEEK or steel, and a second layer (1-15) formed from a material of predetermined shock absorbing properties such as an elastomer, e.g. polyurethane.

The first layer (1-14) is formed with an exterior surface (1-16) configured and orientated to be the first contact point between the side walls (1-8, 1-9) and the housing inner side walls (1-7). The second layer (1-15) is located between the first layer (1-14) and the weight side wall (1-8, 1-9) and formed with an outer surface (1-17) connected to the underside (1-18) of the first layer (1-14) and an interior surface (1-19) connected to the weight side walls (1-8, 1-9).

The first and second layers (1-14, 1-15) are substantially parallel to each other and to the outer surface of the sidewalls (1-8, 1-9). Although the cushioning slides (1-13) may be located in a variety of positions on the side walls (1-8, 9), the narrow width of the short side walls (1-9) in the embodiment shown in FIG. 18*a-d* allows a single cushioning slide (1-13) to be used that spans the full width of the narrow side wall (1-9) between adjacent longitudinal apices (1-20) and extending to part of the opposing wide side walls (1-8).

Figure 18D:
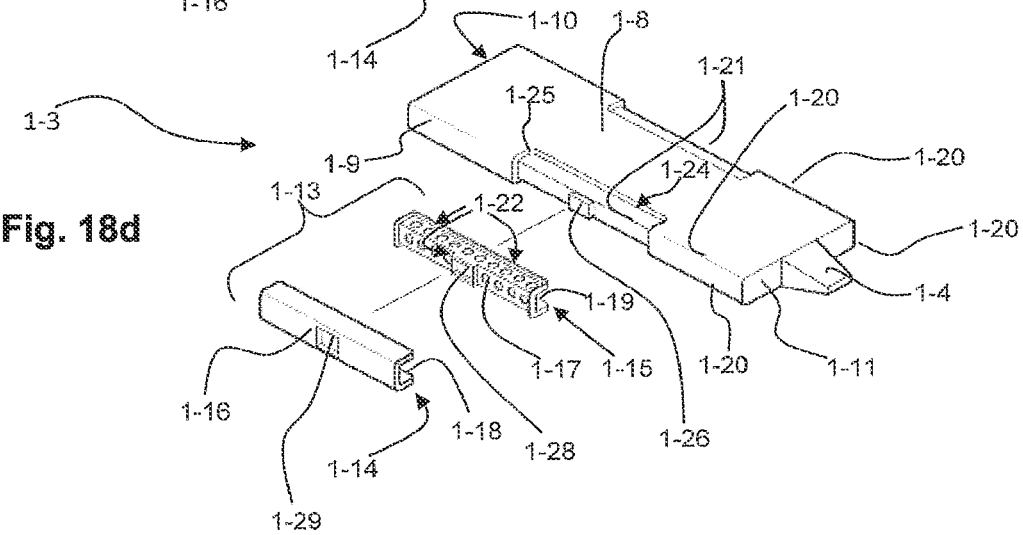
Figure 19:
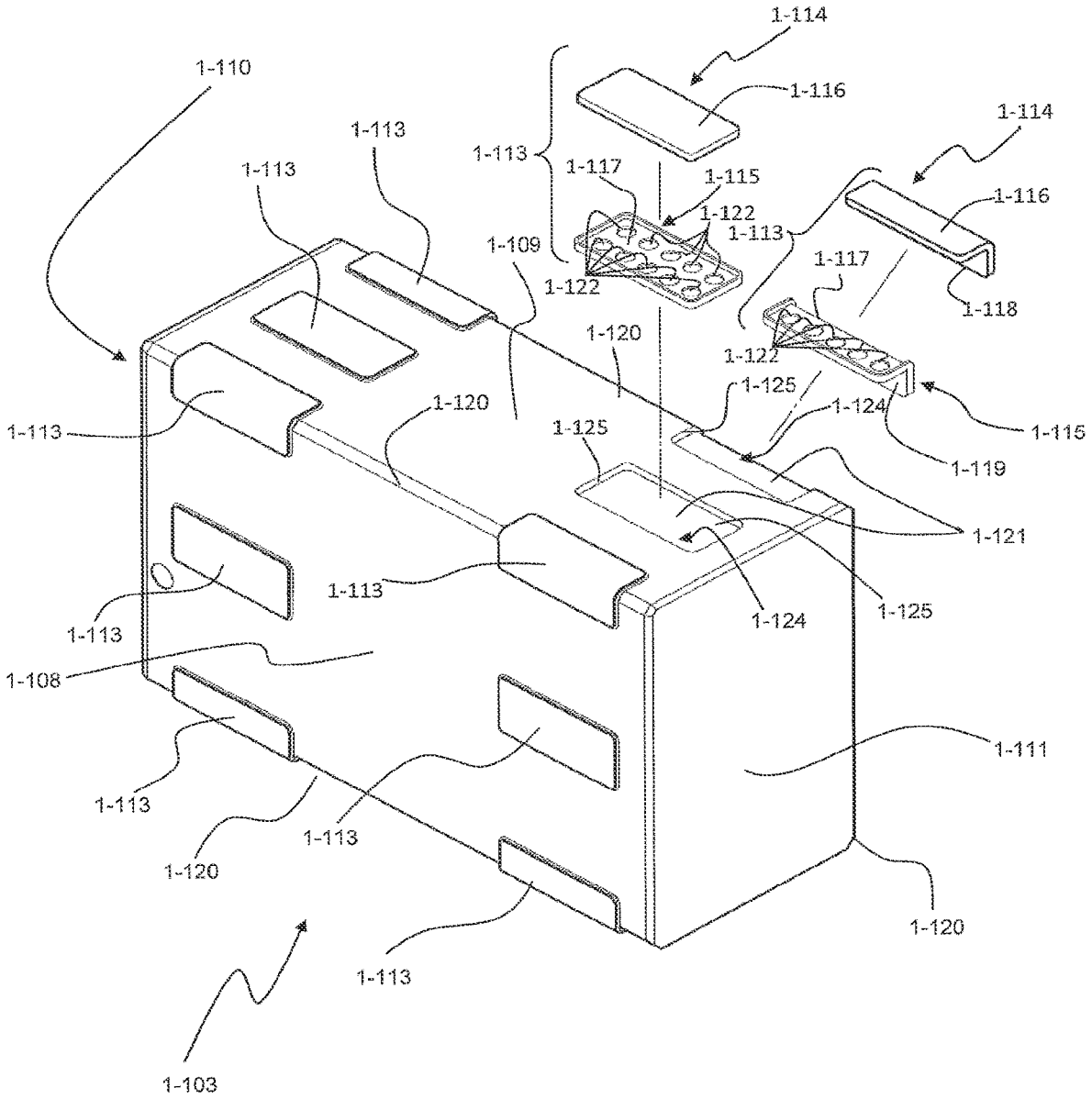
FIG. 19 shows a perspective view of a weight and cushioning slides according to the embodiment shown in FIG. 17.

In the alternative embodiment shown in FIGS. 17 and 19, the weight (1-103) differs from the embodiment of FIGS. 16 and 18*a-d* in:

size—a significantly larger mass/weight;

shape—block shaped rather than blade, and upper and lower ends—planar, not fitted with tool ends (1-4).

The hammer (1-103) may also take the form of the vacuum assisted hammer (1) described with respect to FIGS. 1-16.

As the weight (1-103) is used to impact a striker pin (1-104), there is no need for a tool end or the ability to be reversed. The weight (1-103) is a substantially cuboid block of rectangular cross section with a pair of parallel longitudinal wide side walls (1-108), joined by a pair of parallel shorter side walls (1-109), with an opposing upper and lower distal faces (1-110, 1-111).

In operation, the hammer weight (1-103) reciprocates about a linear impact axis (1-112) passing longitudinally through the geometric centre of the hammer weight (1-103). The hammer weight (1-103) is raised upwards along the impact axis (1-112) by the lifting mechanism to its maximum vertical height, prior to being released, falling under gravity and/or with a vacuum assistance along the impact axis (1-112) until impact with the striker pin (1-104). The weight (1-103) is fitted with a plurality of cushioning slides (1-113) positioned about the side walls (1-108, 1-109).

Figure 20A:
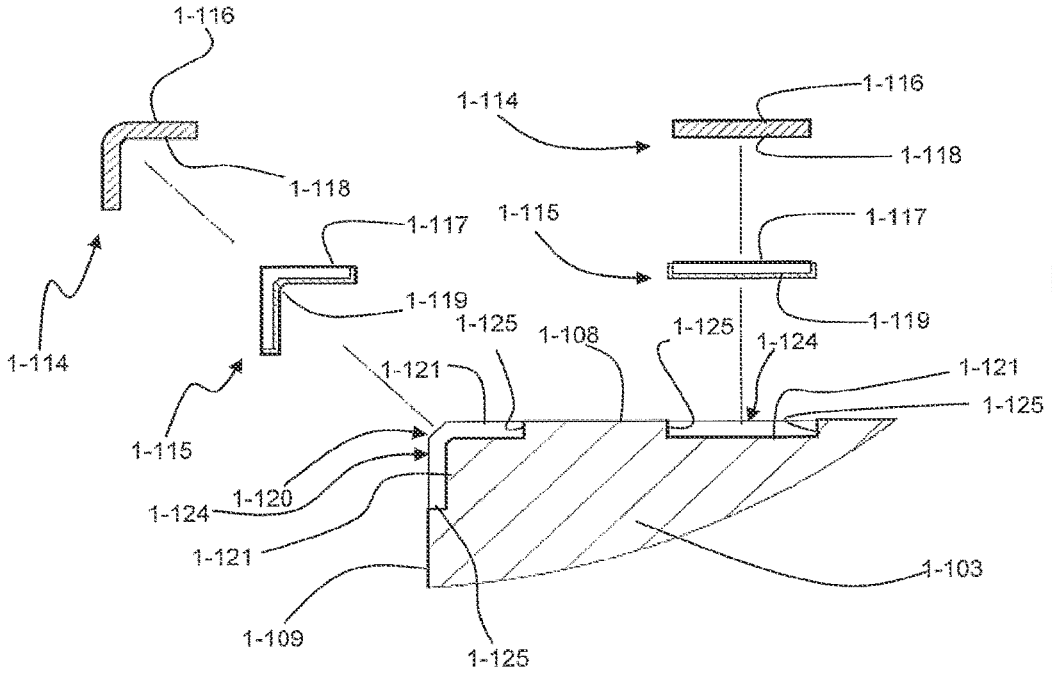
FIG. 20*a* shows an exploded enlarged plan section view of a weight and cushioning slides according to the embodiment shown in FIG. 17.

FIGS. 19 and 20*a* show an exploded view of the components of the cushioning slides (1-113), namely:

a first layer (1-114) formed from a material of predetermined low friction properties such as UHMWPE, PEEK, steel and a second layer (1-115) formed from a material of predetermined shock absorbing properties such as elastomer, e.g. polyurethane.

Figure 20B:
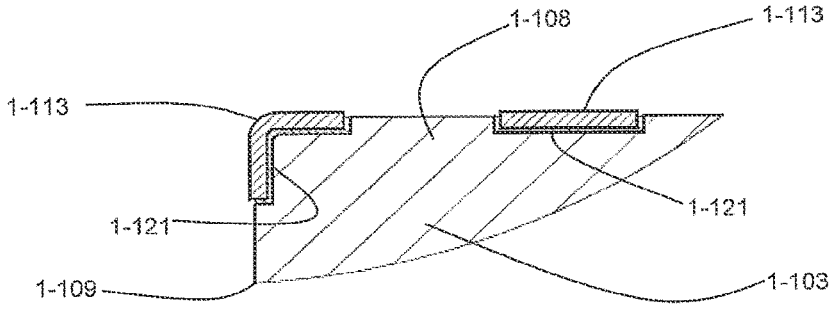
FIG. 20*b* shows an enlarged plan section view of a weight and cushioning slides shown in FIG. 20*a;*
Figure 20C:
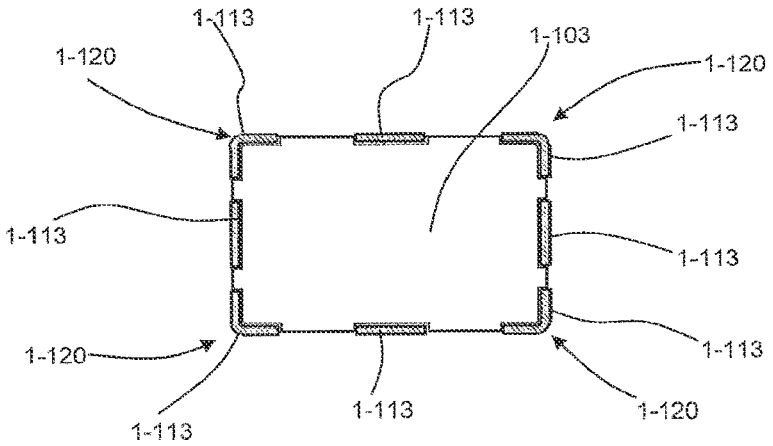
FIG. 20*c* shows a plan section view of a weight and cushioning slides in FIG. 17.

FIGS. 20*b* and 20*c* show the assembled cushioning slides (1-113) fitted to the weight (1-103) on both the planar side walls (1-108, 109) and on the four longitudinal apices (1-120) of the weight (1-103)

The first layer (1-114) is formed with an exterior surface (1-116) configured and orientated to be the first contact point between the side walls (1-108, 1-109) and the housing inner side walls (1-107). The second layer (1-115) is located between the first layer (1-114) and the weight side wall (1-108, 1-109) and formed with an outer surface (1-117) connected to the underside (1-118) of the first layer (1-114) and an interior surface (1-119) connected to the weight side walls (1-108, 1-109). The first and second layers (1-114, 1-115) are substantially parallel to each other and to the outer surface of the sidewalls (1-108, 1-109).

Figure 21:
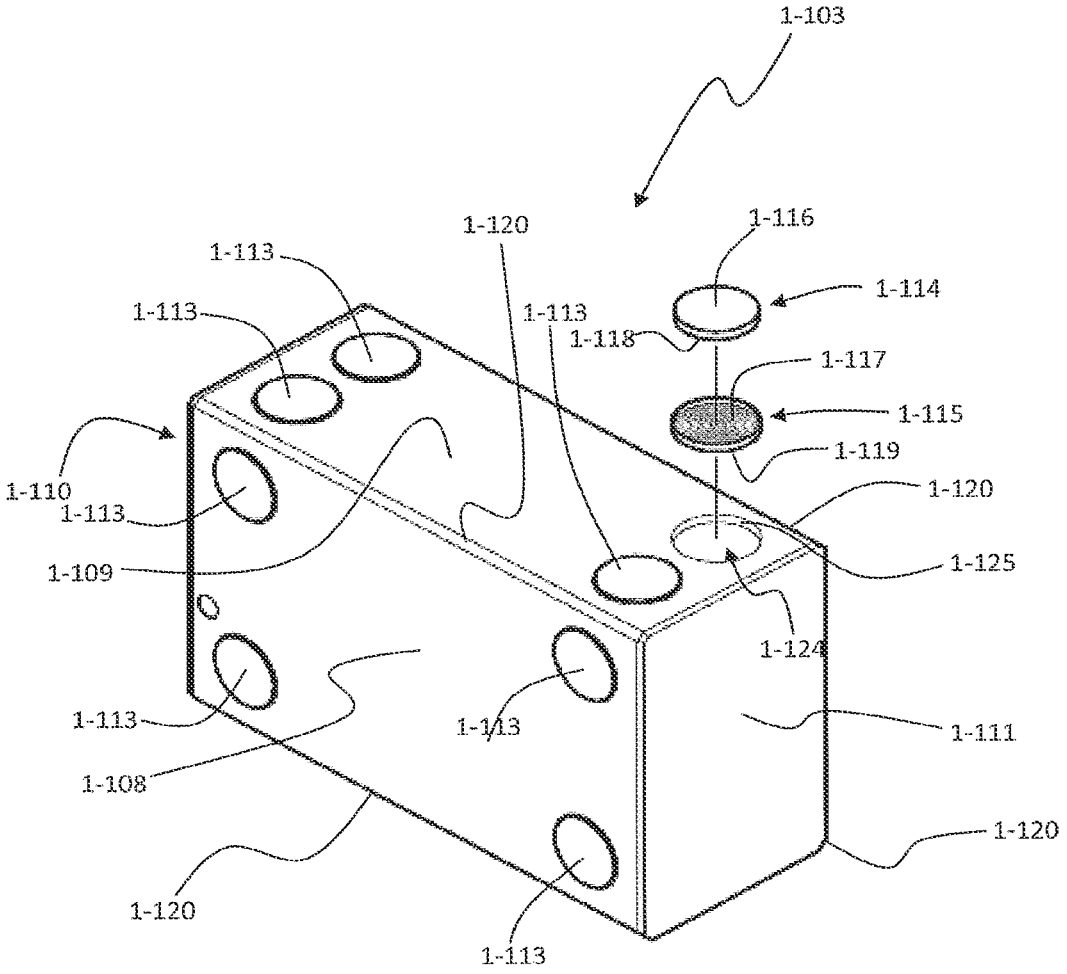
FIG. 21 shows a perspective view of a weight according to the embodiment shown in FIG. 17 with a further embodiment of cushioning slides.

The cushioning slides (1-113) placed on the sidewalls (1-108, 1-109) in the embodiment of FIGS. 17, 19, and 20*a-c* are rectangular plates in outline, however alternative shapes may be utilized such as the circular cushioning slides (1-113) shown in FIG. 21.

Figure 22A:
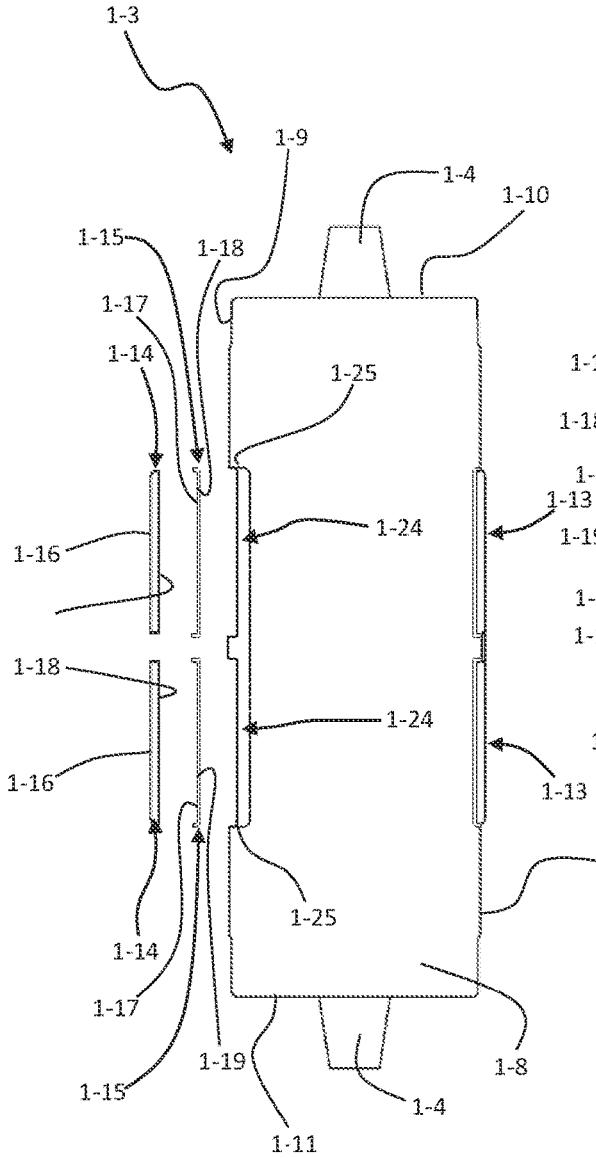
FIG. 22*a* shows a front elevation of the hammer weight and cushioning slides according to the embodiment shown in FIG. 16.
Figure 22B:
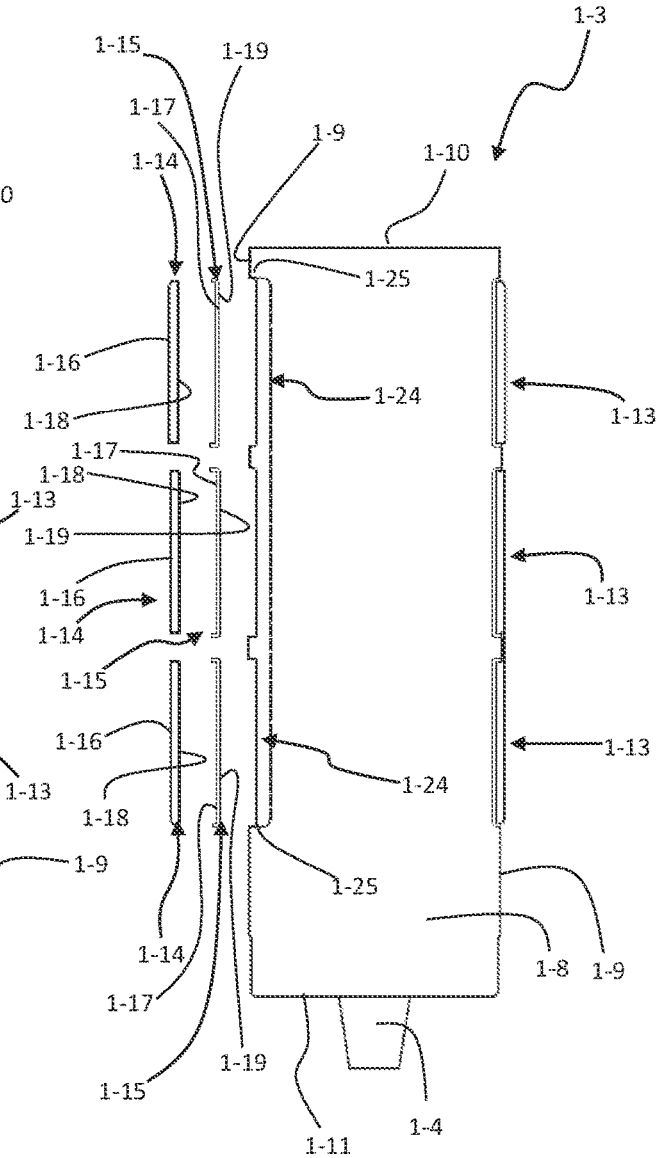
FIG. 22*b* shows a front elevation of an alternative hammer weight and cushioning slides to the embodiment shown in FIG. 22*a;*

FIGS. 22*a* and 22*b* show two further configurations of the hammer weight (1-3) shown in FIGS. 16 and 18*a-d*. FIG. 22*a* shows the bidirectional hammer weight (1-3) with twin identical tool ends (1-4), capable of being reversed when one tool end (1-4) becomes worn. The hammer weight (1-3) is also capable of being used for levering and raking rocks and the like, whereby the hammer weight (1-3) is locked from movement along the impact axis (1-12) with the side walls (1-8, 1-9) adjacent lower distal face (1-11) projecting outside beyond the housing (1-6) to perform the levering. Any cushioning slides (1-13) directly exposed to the effects of the levering and raking would be damaged. Thus, the cushioning slides (1-13) are longitudinally positioned away from both distal ends (1-10, 1-11) of the hammer weight (1-3).

FIG. 22*b* shows a unidirectional hammer weight (1-3), with only one tool end (1-4), which is also capable of levering and raking, though without being reversible. Consequently, the cushioning slides (1-13) are asymmetrically arranged longitudinally, with additional cushioning slides positioned near the upper distal surface (1-10).

Impact hammers (including the impact hammers (1, 1-1, 1-100) described above) are configured to raise and lower the weight with the minimum obstruction or resistance from the housing (6, 1-6, 1-106). The hammer weight (9, 1-3, 1-103) is only directly connected to the lifting mechanism (not shown) and not the housing inner side walls (8, 1-7, 1-107). Thus, as the weight (9, 1-3, 1-103) travels upwards or downwards, any deviation from a perfectly vertical impact axis (10, 1-12, 1-112) for the path of the weight (9, 1-3, 1-103) and/or the orientation of the housing inner side walls (8, 1-7, 1-107) can lead to mutual contact.

An initial point of impact is predominantly at one of the weight apices (1-20, 1-120) which applies a corresponding moment to the weight (1-3, 1-103), causing the weight (1-3, 1-103) to rotate until impact on the diametrically opposite apex (1-20, 1-120) unless the weight (1-3, 1-103) reaches the top or bottom of its reciprocation path first. The impact of the weight (1-3, 1-103) on the working surface (1-5, 1-105) may also generate lateral reaction forces if the working surface (1-5, 1-105) is not orthogonal to the impact axis (1-12, 1-112), and/or, if the working surface (1-5, 1-105) does not fracture on impact.

Figure 23B:
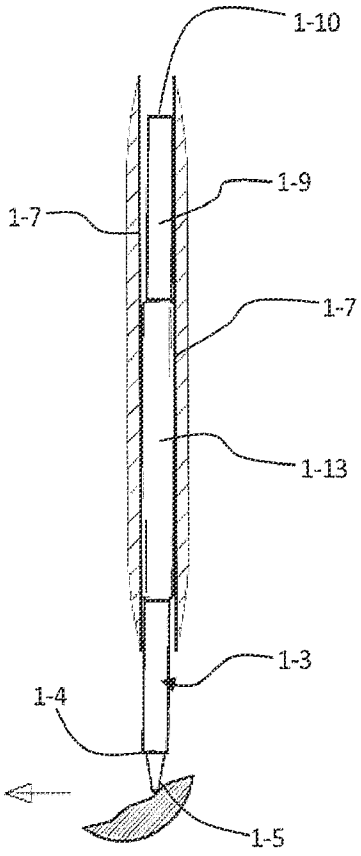
FIG. 23*b* shows a side view of the embodiment shown in FIG. 23*a;*
Figure 23A:
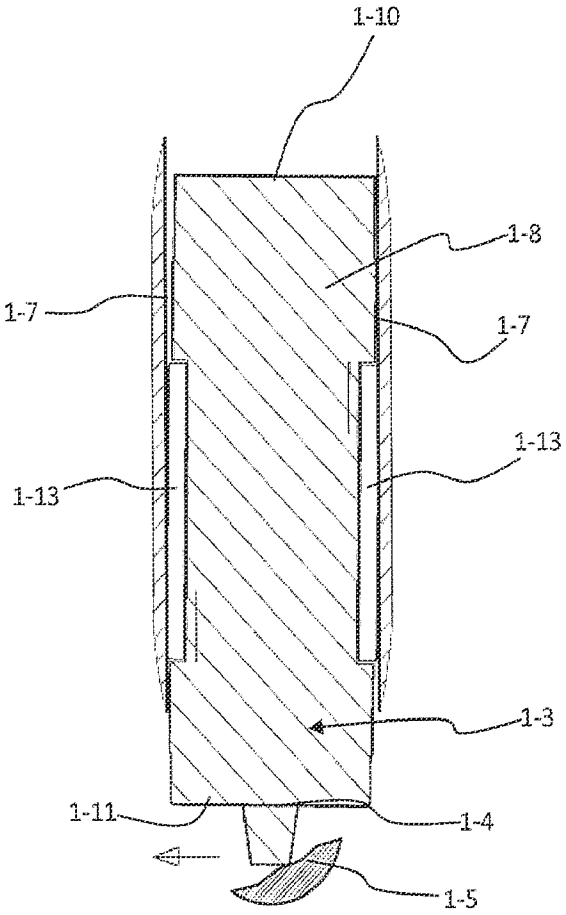
FIG. 23*a* shows a front elevation of the hammer weight of the embodiment shown in FIG. 16 impacting a working surface.

FIGS. 23*a-b* show the hammer weight (1-3) impacting an uneven working surface (1-5), which generates a commensurate lateral reaction force away from the working surface (1-5). The moment induced in the weight (1-3) by the lateral reaction force causes a rotation of the weight (1-3) away from the working surface (1-5). This rotation may be substantially parallel to the plane of the wide side walls (1-8) (as shown in FIG. 23*a*) or substantially parallel to the plane of the narrow side walls (1-9) (as shown in FIG. 23*b*) or any combination of same. The rotating effect of the contact causes diametrically opposite portions of the weight (1-3) to come into contact with the weight housing guide (1-7).

The hammer weight (1-3) shown in FIGS. 23*a-b* represents a reversible, bi-directional hammer weight (1-3) suitable for raking and levering. Consequently, the cushioning slides (1-13) are located centrally along the longitudinal side walls (1-8, 9) to avoid damage during levering/raking. However, the cushioning slide (1-13) is sufficiently dimensioned to ensure the outer surface (1-16) of the first layer (1-14) comes into contact with the surface of the housing weight guide (1-7) before the distal portion of the apices (1-20).

Figure 24:
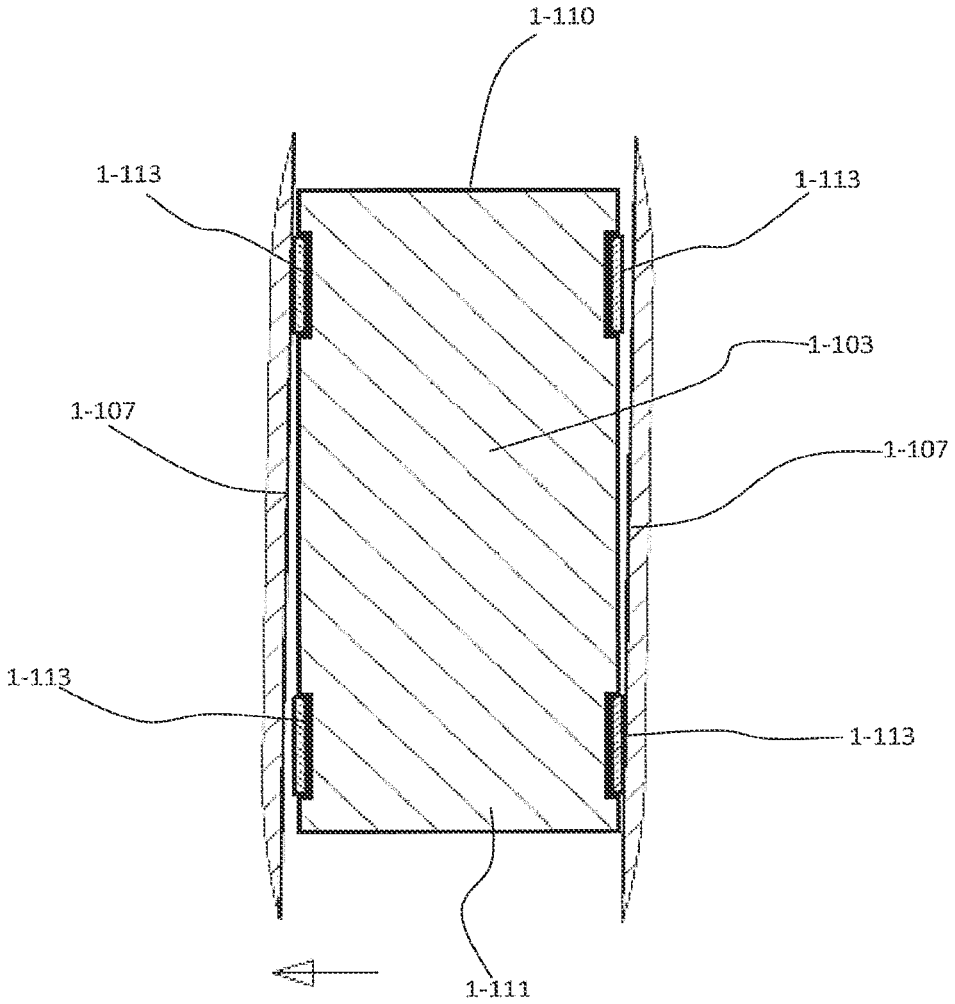
FIG. 24 shows a front elevation of the hammer weight of the embodiment shown in FIG. 17.

FIG. 24 shows a comparable situation with the weight (1-103) of the embodiment of FIGS. 17, 19, and 20*a-c* impacting the (housing inner side walls (1-107) during its downward travel. Again, the impact of the lower distal portion of the weight side wall (1-109) causes a moment-induced rotation in the weight (1-103) with a corresponding impact on the upper distal portion of the opposing side wall (1-109). The cushioning slides (1-113) on the weight (1-103) are thus positioned at these points of contact.

When the weight (1-3, 1-103) impacts the housing inner side walls (1-7, 1-107) and a compressive load is applied to the elastomer forming the second layer (1-15, 1-115), the shock is absorbed by displacement of volume of the elastomer (1-15, 1-115) away from the point of impact.

Any rigid boundaries surrounding the elastomer (1-15, 1-115) restrict the displacement of the elastomer (1-15, 1-115) to occur at any unrestrained boundaries. In the preceding embodiments where the elastomer (1-15, 1-115) is bounded by the rigid first layer underside (1-18, 1-118) and the rigid upper surface (1-21, 1-121) of the weight (1-3, 1-103) underneath the elastomer (1-15, 1-115), the elastomer (1-15, 1-115) is displaced laterally substantially parallel with the surface of the weight (1-3, 1-103) under compression.

The embodiment shown in FIGS. 16-19 provides the elastomer (1-15, 1-115) with displacement voids (1-22, 1-122) into which the displaced volume may enter under the effects of compression. As shown in FIG. 18*c*, the cushioning slide (1-13) incorporates a series of circular displacement voids (1-22) in the second layer (1-15), extending substantially uniformly along the second layer (1-15) on three sides such that the series of voids (1-22) extends over the weight surfaces (1-21) on each wide side wall (1-8) and the corresponding narrow side wall (1-9).

The embodiment in FIG. 19 also utilises a corresponding configuration of circular displacement voids (1-122) in the second layer (1-115) of the cushioning slide (1-113).

The elastomer cannot deflect laterally outwards under compression as the cushioning slides (1-13, 1-113) in both embodiments are surrounded on their exterior lateral periphery by rigid portions (1-21, 1-121) of the weight (1-3, 1-103). Therefore, under compression, the elastomer (1-15, 1-115) is only able to displace laterally inwards into the circular displacement voids (1-22, 1-122). In further embodiments (not shown), the displacement voids may be formed in the first layer underside (1-18, 1-118), and/or the rigid upper surface (1-21, 1-121) of the weight (1-3, 1-103) underneath the elastomer (1-15, 1-115), However, a variety of alternative configurations of displacement void are possible and exemplary samples are illustrated in FIGS. 25*a-d* and 26*a-d*. FIGS. 25*a-d* show four alternative second layer (1-15*a*, 15*b*, 15*c*, 15*d*) embodiments incorporating four different displacement void configurations, shown in greater detail in section view in FIGS. 26*a-d* respectively. Although each second layer (1-15*a-d*) is shaped to fit the corresponding contours of the weight surface (1-21, 1-121) to which its fitted, the portion of each second layer (1-15*a-d*) adjacent a side wall (1-8, 1-9, 1-108, 1-109) is still substantially planar.

Figures 25A, 25B, 25C, 25D:
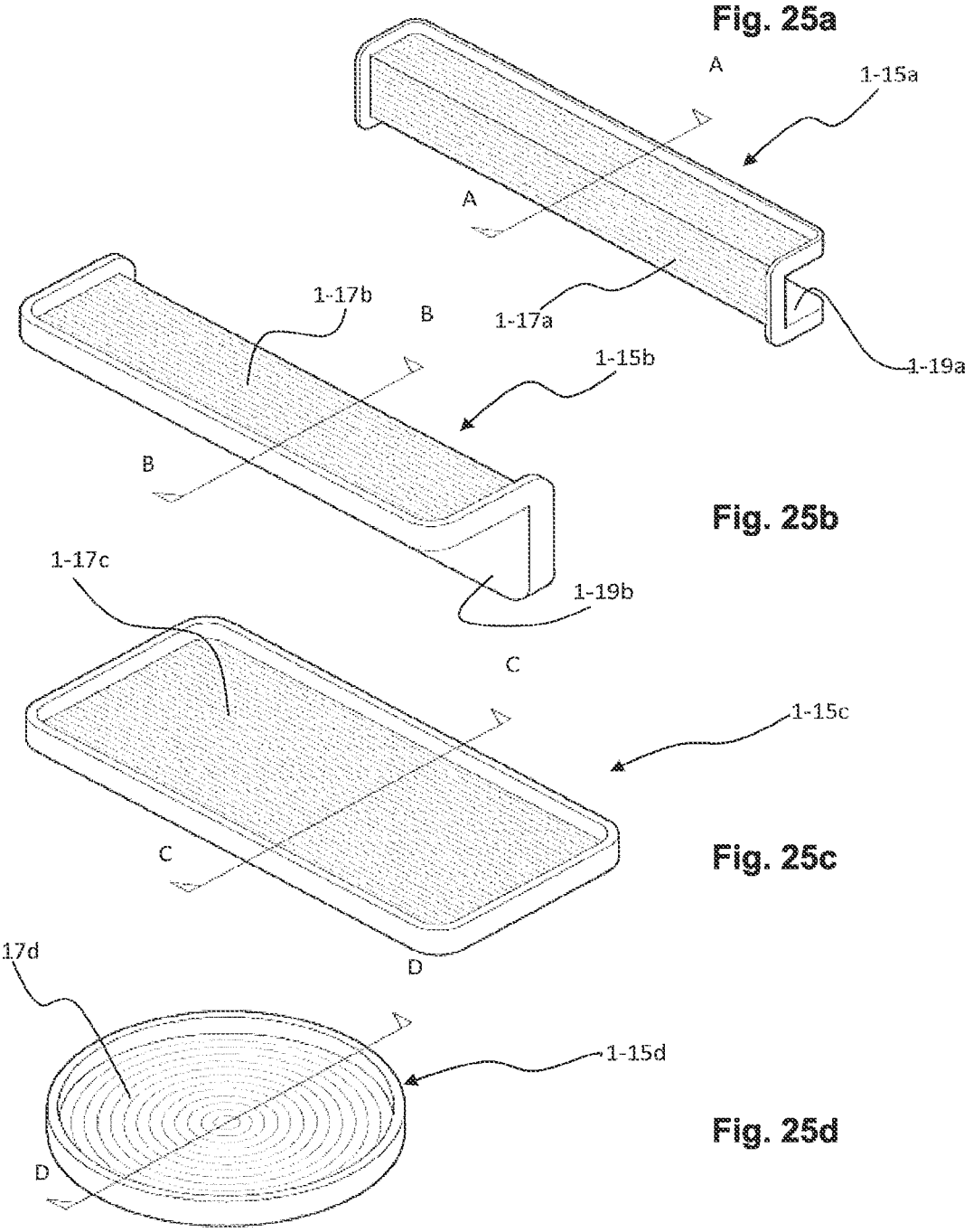
FIG. 25*a* shows an isometric view of a cushioning slide for the hammer weight shown in FIG. 16.
FIG. 25*b* shows an isometric view of a cushioning slide for an apex of the weight shown in FIG. 17.
FIG. 25*c* shows an isometric view of a rectangular cushioning slide for the side wall of the weight shown in FIG. 17.
FIG. 25*d* shows an isometric view of a circular cushioning slide for the side wall of the weight shown in FIG. 17.

FIGS. 25*a* and 25*b* respectively show cushioning slides (1-13, 1-113) configured to be fitted to a longitudinal apex (1-20, 1-120). FIGS. 25*c* and 25*d* respectively show rectangular and circular cushioning slides (1-13, 1-113) for fitment to a side wall (1-8, 1-9, 1-108, 1-109).

FIGS. 26*a-d*, show enlargements of section views through the lines AA, BB, CC and DD in FIGS. 25*a-d* respectively before (LHS) and after (RHS) the application of a compressive force in the direction of the arrows.

Figures 26A, 26B, 26C, 26D:
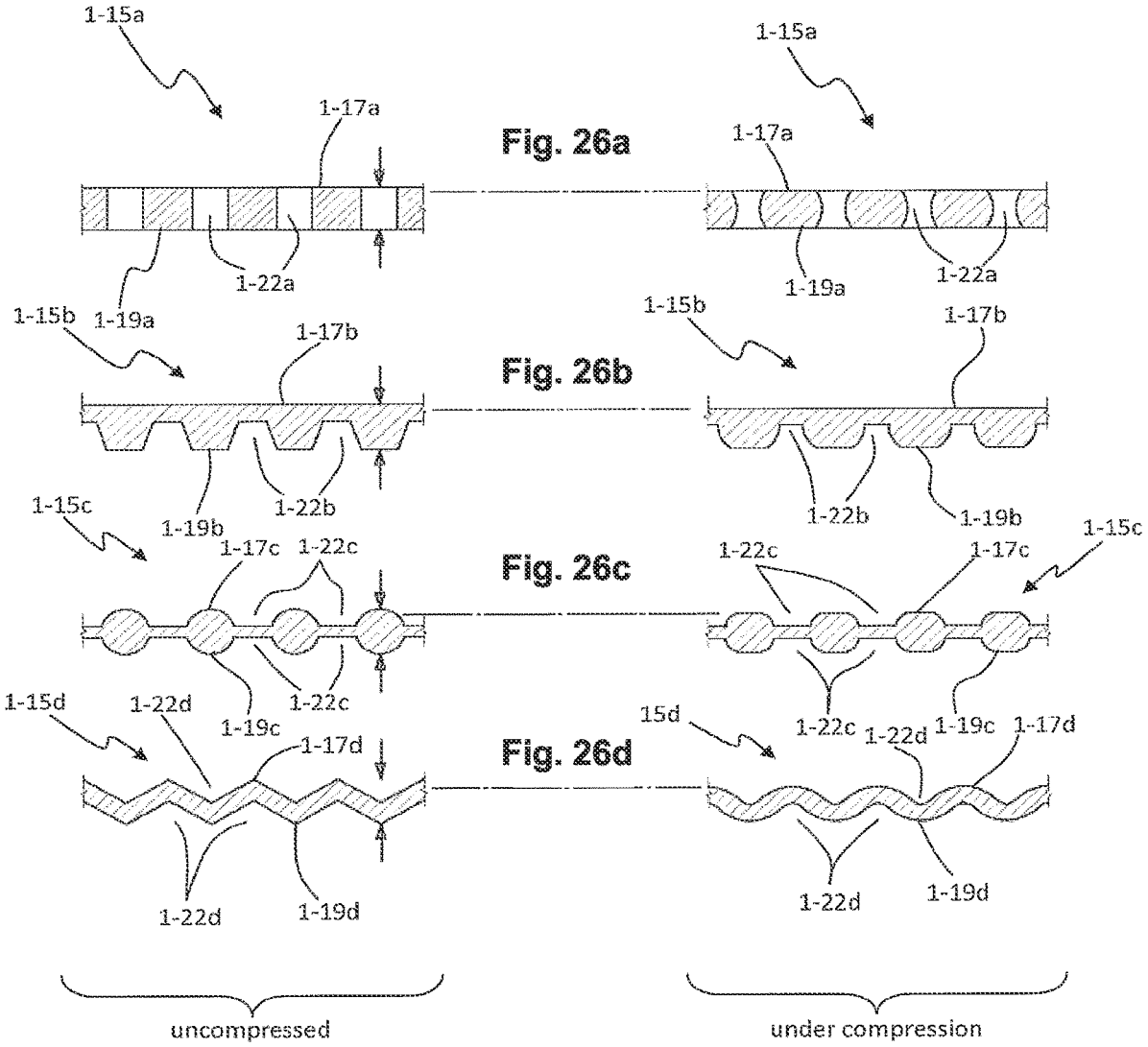
FIG. 26*a* shows a section view of the cushioning slide second layer along AA in FIG. 25*a* in uncompressed and compressed states.
FIG. 26*b* shows a section view of the cushioning slide second layer along BB in FIG. 25*b* in uncompressed and compressed states.
FIG. 26*c* shows a section view of the cushioning slide second layer along CC in FIG. 25*c* in uncompressed and compressed states.
FIG. 26*d* shows a section view of the cushioning slide second layer along DD in FIG. 25*d* in uncompressed and compressed states.

FIG. 26*a* shows a second layer (1-15*a*) with a series of displacement voids (1-22*a*) in the form of apertures extending orthogonally through the second layer (1-15*a*) from the upper surface (1-17*a*) to the lower surface (1-19*a*). The right side illustration shows the elastomer material of the second layer (1-15*a*) bulging into the adjacent displacement voids (1-22*a*).

FIG. 26*b* shows a second layer (1-15*b*) with a series of displacement voids (1-22*b*) in the form of repeated corrugated indentations in the underside (1-19*b*) of the second layer (1-15*b*). The corrugations become shorter and wider under the effects of compression and deflect into the voids (1-22*b*).

FIG. 26*c* shows a second layer (1-15*c*) with a series of displacement voids (1-22*c*) in the form of repeated indentations formed between a plurality of circular cross-section projections on both the underside (1-19*c*) and upper surface (1-17*c*) of the second layer (1-15*c*). Under compression, the projections deflect laterally into the displacement voids (1-22*c*) thereby becoming shorter and wider.

FIG. 26*d* shows a second layer (1-15*d*) formed with a saw tooth shaped underside (1-19*d*) and upper surface (1-17*d*) creating a corresponding series of saw tooth shaped displacement voids (1-22*d*). The apex of the saw tooth profile is flattened under the effects of compression thus deflecting into voids (1-22*d*). It will be readily appreciated that numerous alternative displacement void configurations are possible and that the combinations of cushioning slides (1-15*a-d*) shown in FIGS. 25*a-d* and while the displacement void (1-22*a-d*) configurations in FIGS. 26*a-d* are optimised examples they should not be seen to be limiting.

The shock absorbing elastomer forming the above described second layers (1-15, 1-115, 1-15*a*-1-15*d*) all provide a configuration to absorb the impact shock by allowing the elastomer to be deflected into the displacement voids (1-22, 1-122, 1-22*a*-1-22*d*) thereby preventing damage to the elastomer polymer. The deflection is typically less than 30% as above 30% deflection there is an increasing likelihood of damage occurring to the cushioning slides.

The shock absorbing potential capacity of the cushioning slides (1-13, 1-113) is enhanced by keeping the adjacent contact surfaces of the first (1-14, 1-114) and second (1-15, 1-115) layers unbonded or un-adhered to each other. The contact surfaces being first layer upper surface (1-17, 1-117) and the second layer lower surface (1-18, 1-118). This enables the elastomer upper surface (1-17) to move laterally across the underside (1-18) of the first layer under compression. However, the first (1-14, 1-114) and second layers (1-15, 1-115) clearly require a means to maintain their mutual contact under the violent effects of the impacting operations.

FIG. 27*a-e* shows a selection of exemplary configurations of securing features (1-23) configured to keep the first (1-14, 1-114) and second layers (1-15, 1-115) in mutual contact.

Figures 27A, 27B, 27C, 27D, 27E:
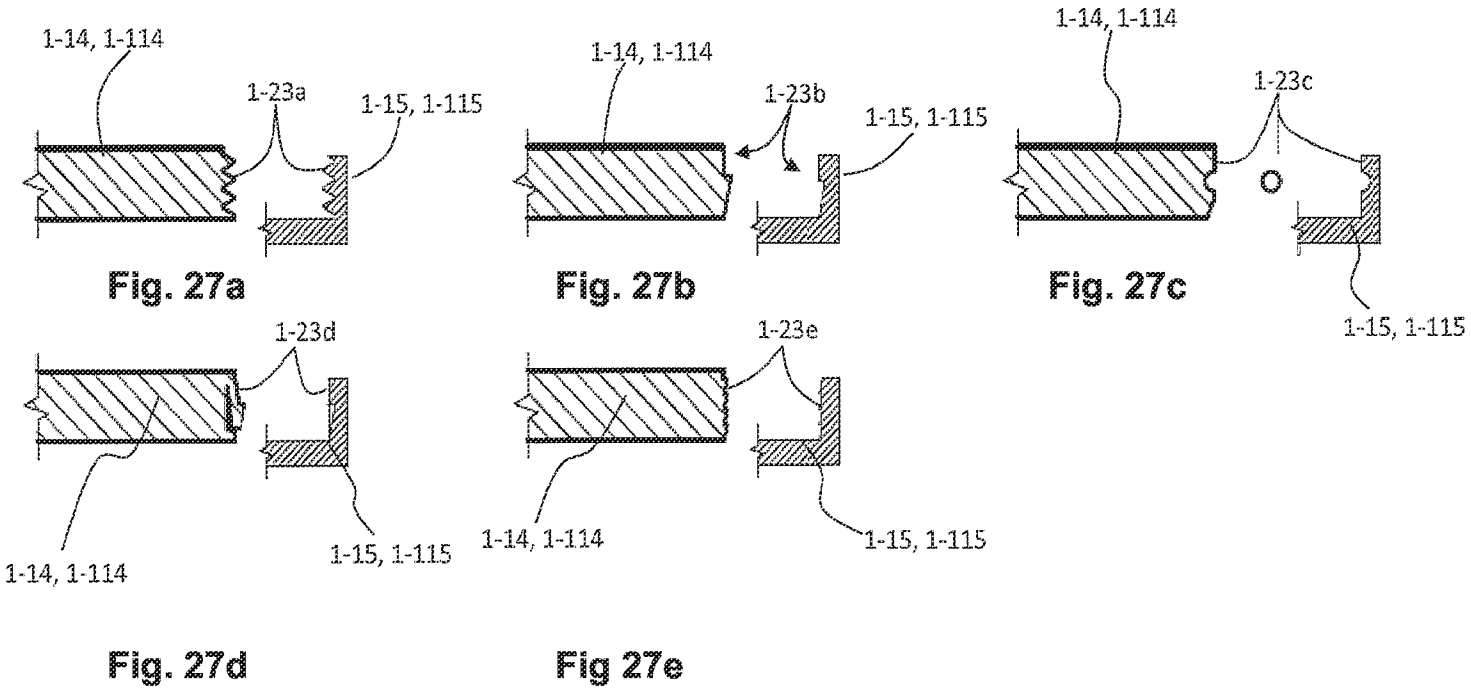
FIG. 27*a* shows an enlarged side section elevation of a peripheral portion of a cushioning slide with a first securing feature.
FIG. 27*b* shows an enlarged side section elevation of a peripheral portion of a cushioning slide with a second securing feature.
FIG. 27*c* shows an enlarged side section elevation of a peripheral portion of a cushioning slide with a third securing feature.
FIG. 27*d* shows an enlarged side section elevation of a peripheral portion of a cushioning slide with a fourth securing feature.
FIG. 27*e* shows an enlarged side section elevation of a peripheral portion of a cushioning slide with a fifth securing feature.

FIG. 27*a* shows a securing feature (1-23*a*) in the form of mating screw thread portions located at the lateral periphery of the first layer (1-14, 1-114) and the inner surface of an outer lip portion of the second layer (1-15, 1-115) substantially orthogonal to the surface of the weight (1-3, 1-103).

FIGS. 27*b-e* show securing features (1-23*b*, 1-23*c*, 1-23*d*, and 1-23*e*) in the form of:

- a tapered recess and projecting lip portion;
- O-ring seal and complementary grooves;
- an elastic clip portion and mating recess;
- serrated, interlocking portions, also located at the lateral periphery of the first layer (1-14, 1-114) and the inner surface of an outer lip portion of the second layer (1-15, 1-115) substantially orthogonal to the surface of the weight (1-3, 1-103).

The second layer (1-15, 1-115) is sufficiently flexible such that it can be pressed over the first layer and corresponding securing features (1-23) to become locked in position. Alternatively, where the cushioning slides (1-13, 1-113) are circular the second layer (1-15, 1-115) may be screwed onto the first layer (1-14, 1-114) where a suitable mating thread is provided as per FIG. 27*a*.

Yet further variations of securing features (1-23*f*-1-23*k*) are shown in FIGS. 28*a-f* to secure a cushioning slide (1-13) to the narrow side wall (1-9) of a hammer weight (1-3) in a complimentary position to that showed for the embodiment shown in FIGS. 16 and 18*a-d*.

Figures 28A, 28B, 28C:
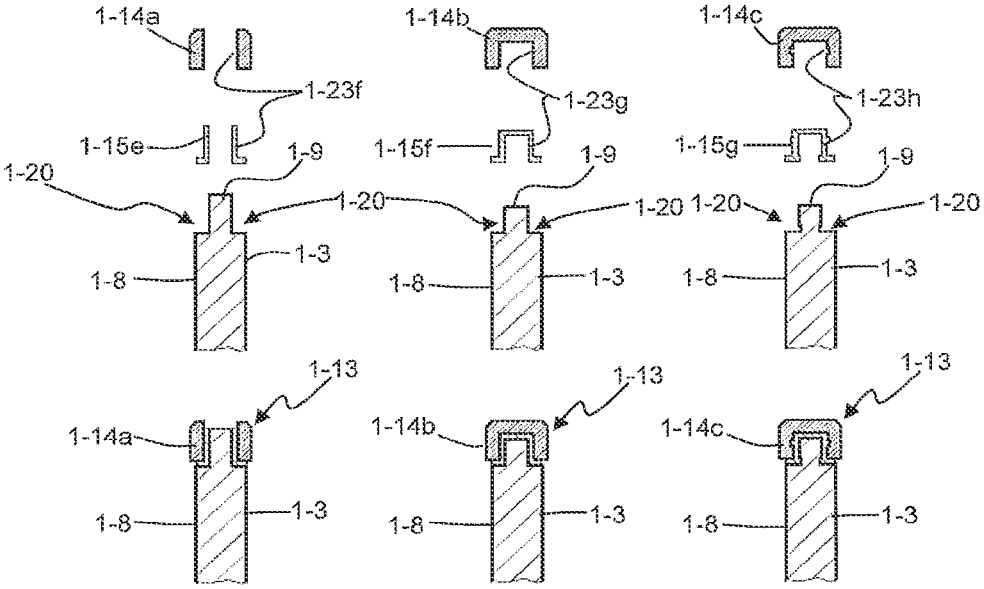
FIGS. 28*a-f* shows a partial plan section of the hammer weight of FIG. 16 with a sixth, seventh, eighth, ninth, tenth and eleventh securing features respectively.

FIG. 28*a* shows an individual first layer (1-14*a*) and a second layer (1-15*e*) located at the longitudinal apices (1-20), without any direct physical connection across the narrow side wall (1-9) between adjacent cushioning slides (1-13). The first and second layers (1-14*a*, 1-15*e*) are not directly secured to each other and instead, the securing feature (1-230 relies on the physical proximity of the housing inner side walls (1-107) to retain the cushioning slide (1-13) in position.

FIG. 28*b* shows a first layer (1-14*b*) and a second layer (1-15*f*) located at both the longitudinal apices (1-20) and extending across the width of the narrow side wall (1-9) and part of the wide side walls (1-8). The first and second layers (1-14*b*, 1-150 are not directly secured to each other and instead, the securing feature (1-23*g*) relies on the physical proximity of the housing inner side walls (1-107) to retain the cushioning slide (1-13) in position.

FIG. 28*c* shows a comparable arrangement of the first layer (1-14*b*) and a second layer (1-15*f*) as shown in FIG. 28*b*). However, the securing feature (1-23*h*) is provided as protrusions in the second layer (1-15) shaped and positioned to mate with corresponding recesses in the first layer (1-14*c*) and hammer apices (1-20). The securing feature (1-23*h*) thus secures the cushioning slide (1-13) to the weight (1-3) by a tab and complementary recess located on the mating surfaces of the first and second layers (1-14*c*, 1-15*g*) respectively.

Figures 28D, 28E, 28F:
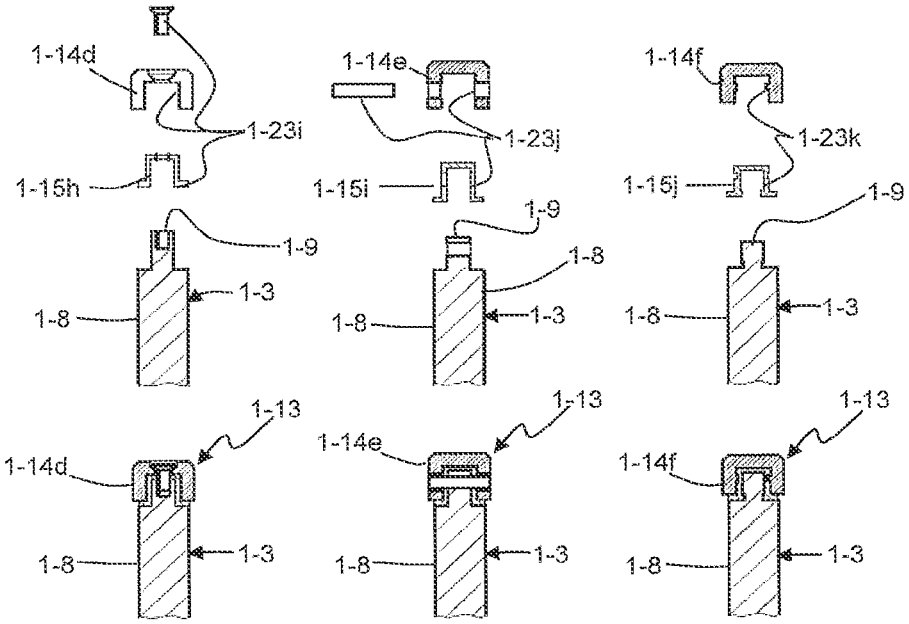

FIG. 28*d* also shows a comparable arrangement of the first layer (1-14*b*) and a second layer (1-15*f*) as shown in FIG. 28*b*. The securing feature (1-23*i*) comprises a screw, fitted through a countersunk aperture in the first layer (1-14*d*) and through an aperture in the second layer (1-15*h*) into a threaded hole in the narrow sidewall (1-9).

FIG. 28*e* shows a comparable arrangement of the first layer (1-14*c*) and a second layer (1-150) as shown in FIG. 28*b*. However, the securing feature (1-23*j*) instead comprises a cross pin, fitted through apertures in the first layer (1-14*e*) second layer (1-15*i*) and weight (1-3) from one wide side wall (1-8) to the opposing side wall (1-8).

FIG. 28*f* shows a comparable arrangement to that shown in FIG. 28*c* with a recess in the hammer weight (1-3) mating with a corresponding tab at the base of the second layer (1-15*g*, 1-15*j*). However, the securing feature (1-23*k*) secures the first layer (1-14*j*) to the second layer (1-140 in a reverse arrangement, i.e. recesses in the second layer (1-151) mating with corresponding protrusions in the first layer (1-140.

The above-described cushioning slides (1-13, 1-113) have a UHMWPE first layer (1-14, 1-14*a*-1-14*f*, 1-114) and a polyurethane elastomer second layer (1-15, 1-15*a*-1-15*j*, 1-115) to provide a relatively lightweight cushioning slide (1-13, 1-113) while providing sufficient shock-absorbing and low-friction capabilities. As discussed above, the high deceleration forces (up to one thousand G) create significant additional forces for any increase in weight of the cushioning slide (1-13, 1-113). Thus, while it is possible to use materials such as steel for the first layer (1-14, 1-114) this configuration would add greater mass by virtue of its higher density and thus have a higher inertia than a UHMEPE first layer (1-14, 1-114) during impacts.

Figure 29A:
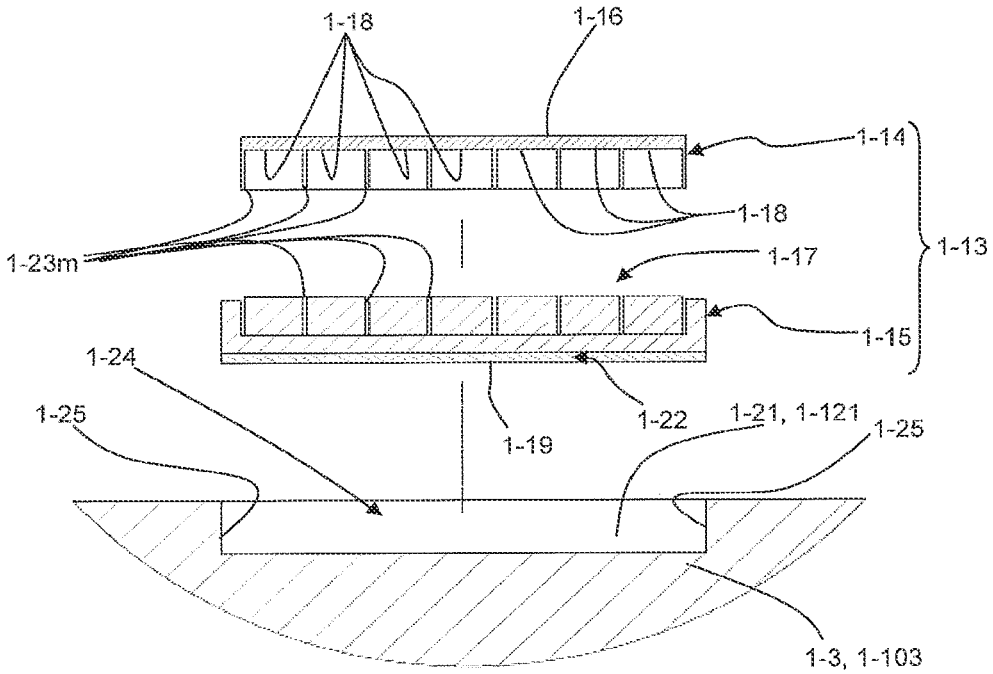
FIG. 29*a* shows an enlarged exploded section view of a cushioning slide according to a further embodiment.
Figure 29B:
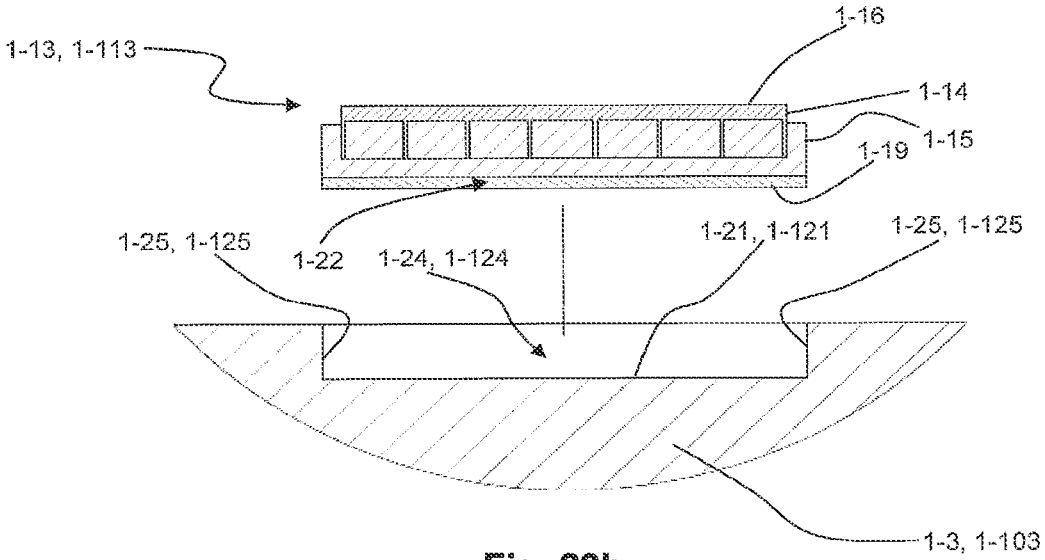
FIG. 29*b* shows an assembled view of the cushioning slide in FIG. 29*a;*

FIGS. 29*a-b* show an embodiment of a cushioning slide (1-13) that uses a steel first layer (1-14). FIGS. 29*a-b* are an exploded and part assembled view of a steel first layer (1-14) and elastomer second layer (1-15). The steel first layer (1-14) has a conventional planar upper surface (1-16) and a lower surface (1-18) formed with one part of a securing feature (1-23*m*) in the form of a cellular configuration with a plurality of subdividing wall portions projecting orthogonally away from the lower surface (1-18). The second layer (1-15) includes an upper surface (1-17) formed with the complimentary mating part of the securing feature (1-23*m*) in a cellular configuration projecting orthogonally away from the upper surface (1-17). The first and second layers (1-14, 1-15) interlock with the cellular configurations of the securing feature (1-23*m*) thereby securing to each other. The plurality of interlocked portions of the steel first layer (1-14) and the elastomer second layer (1-15) creates a strong coupling, highly resistant to separation under the effects of impact forces parallel to the plane of the weight surface (1-21, 121). It will be noted the interlocking securing feature (1-23*m*) does not extend through the full thickness of the second layer (1-15) to the underside surface (1-19). Instead, a lower portion of the second layer (1-15) positioned between the lower surface (1-19) and the securing feature (1-23*m*) is used to incorporate a form of displacement void (1-22) for accommodating deflection of the second layer (1-15) material during compression.

It will be appreciated that any impact forces acting to separate the first layer (1-14, 1-114) from the second layer (1-15, 1-115) also act to separate the whole cushioning slide (1-13, 1-113) from the weight (1-3, 1-103). It also follows that the means of securing the whole cushioning slide (1-13, 1-113) to the weight (1-3, 1-103) against the adverse effects of high acceleration forces need to be even higher than those applied solely to the first layer (1-14, 1-114). Consequently, as shown in FIGS. 18*a*-22*b*, 29*a-b*, and 30*a-b*, the weight (1-3, 1-103) is provided with a robust means to secure the cushioning slides (1-13, 1-113) to the weight (1-3, 1-103), provided in the form of sockets (1-24, 1-124) on the side walls (1-8, 1-108 and 1-9, 1-109).

As shown in FIGS. 18*a*-22*b*, 29*a-b*, and 30*a-b*, the cushioning slides (1-13, 1-113) are located on the weight (1-3, 1-103) in a socket (1-24, 1-124) formed with a retention face (1-25, 1-125) positioned at a cushioning slide perimeter. The retention face (1-25, 1-125) at the cushioning slide perimeter may be located about:

a lateral periphery of;

an inner aperture through, and/or a recess in, the cushioning slide (1-13, 1-113).

Each retention face (1-25, 1-125) may be formed as a ridge, shoulder, projection, recess, lip, protrusion or other formation presenting a rigid retention face between one of the weight distal ends (1-10, 1-110, 1-11, 1-111) and at least a portion of the cushioning slide (1-13, 1-113) located in the socket (1-25, 1-125) on a side wall (1-8, 1-9, 1-108, 1-109) of the weight (1-3, 1-103).

Figure 30A:
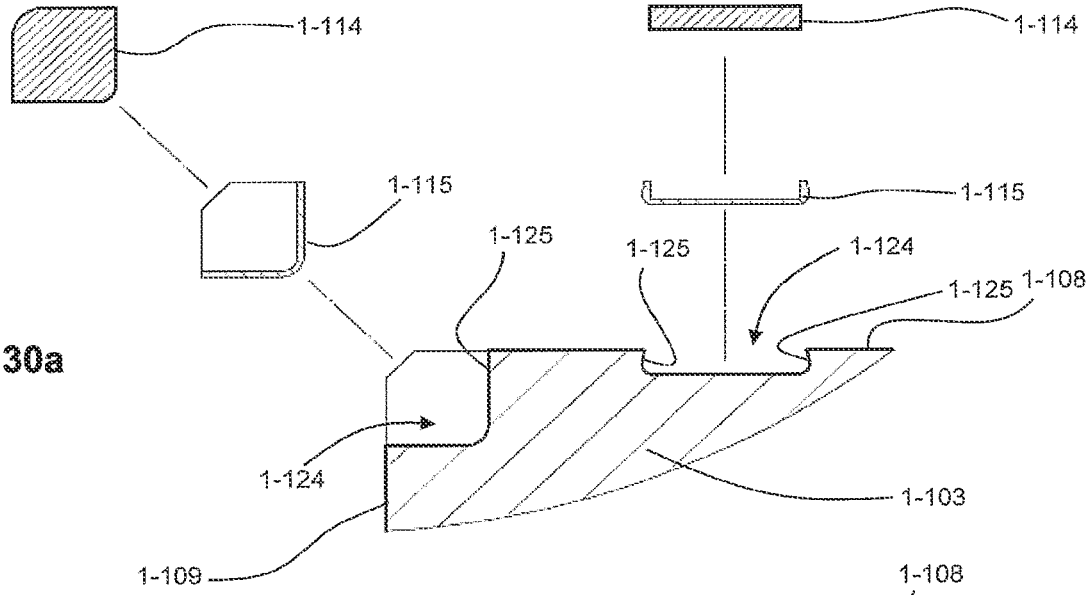
FIG. 30*a* shows an enlarged exploded plan section view of cushioning slides fitted to the weight of FIG. 17.
Figure 30B:
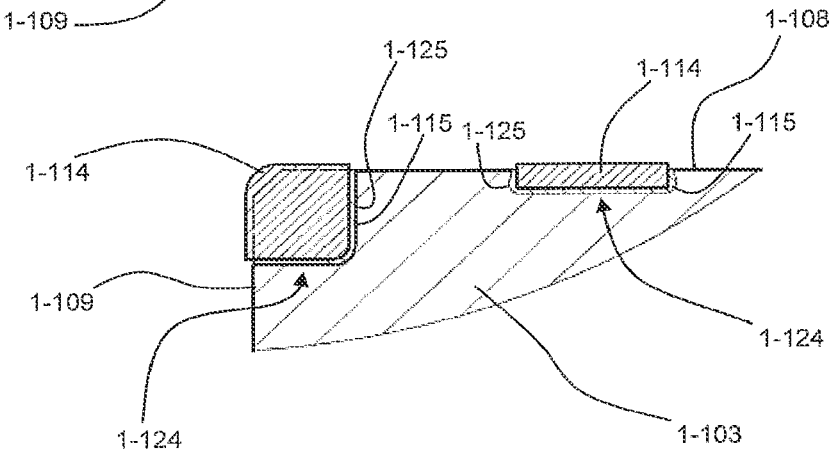
FIG. 30*b* shows an enlarged assembled view of the cushioning slides fitted to the weight of FIG. 30*a;*

The retention face (1-125) of the wide side wall socket (1-124) shown in FIG. 30*a-b* is formed as an inwardly tapered wall (1-125) of the socket (1-124) to secure the cushioning slide (1-13, 1-113) to the weight side wall (1-108,) from the component of forces substantially orthogonal to the weight side walls (1-108). Other retention features (not shown) could include a reverse taper, upper lip, O-ring groove, threads, or other inter-locking-features with the slide (1-113).

In the aforementioned embodiments, each socket retention face (1-25, 1-125) may be formed as outwardly or inwardly extending walls extending substantially orthogonal to the corresponding side walls (1-8, 1-9, 1-108, and 1-109).

Figure 31:
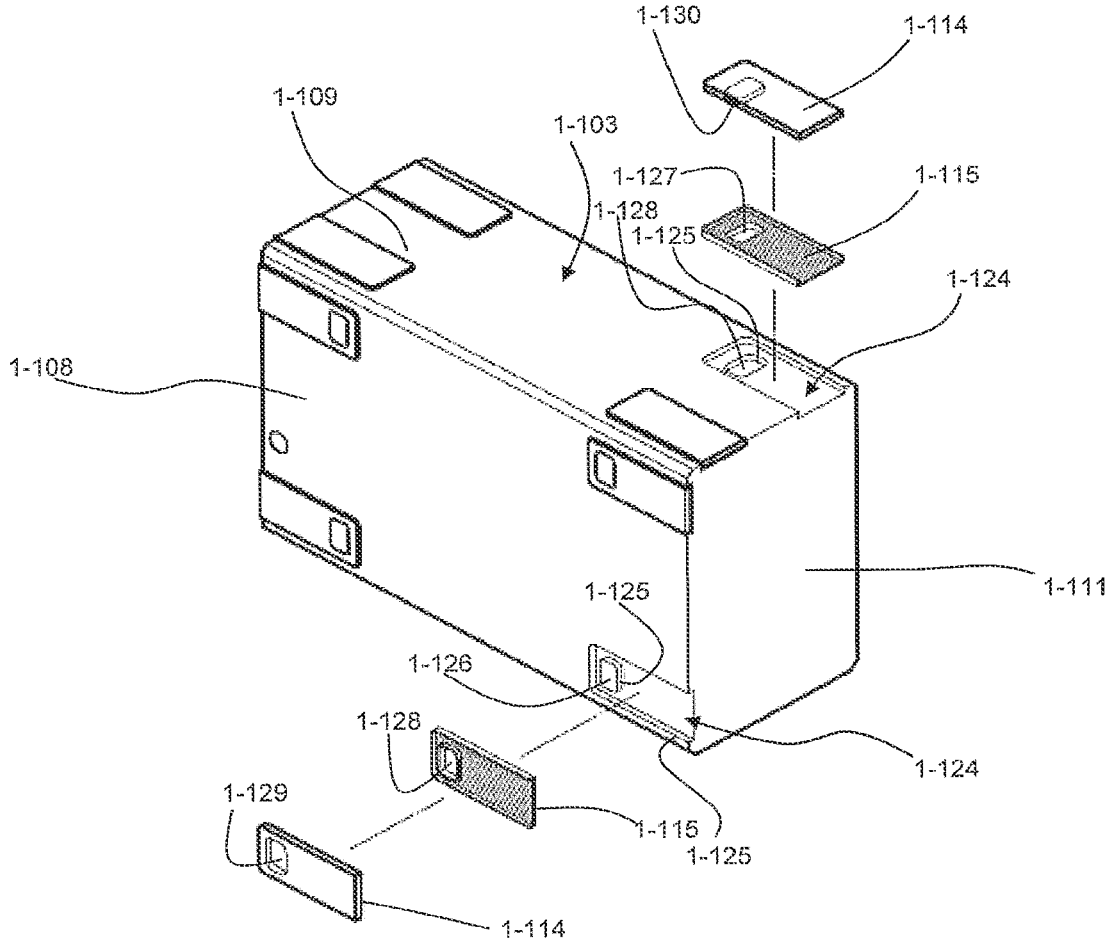
FIG. 31 shows an isometric, part-exploded view of the weight of FIG. 17 with a further cushioning slide embodiment

In the embodiment shown in FIG. 31 a retention face (1-25, 1-125) is located inside the perimeter of a socket (1-124) in the side wall (1-108) under the second layer (1-15, 1-115) and is formed as an outwardly extending wall thus forming corresponding location projections (1-126). Inwardly extending retention faces (1-125) on the narrow side walls (1-109) form location recesses (1-127) performing the same retention function as the location projections (1-126).

In the embodiment of FIG. 31, the location projection (1-126) passes through an aperture (1-128) in the second layer (1-115) and an aperture (1-129) in the first layer (1-114). Also shown in FIG. 31, the converse configuration is shown in a separate socket (1-124) where a locating portion (1-130) extends from the lower surface (1-118) of the first layer (1-114) to project though the aperture (1-128) in the second layer into locating recess (1-127).

The use of a location recess (1-127) or a location projection (1-126) enables a cushioning slide (1-13, 1-113) to be positioned directly adjacent the upper or lower distal face (1-110, 1-111) without a retention face (1-125) surrounding the entire outer periphery of the cushioning slide (1-13, 1-113) as in the embodiments shown in FIGS. 16-19 and FIGS. 21-24.

It should be appreciated that sockets (1-124) may not be necessary when using such location projections (1-126) or location recesses (1-127). Instead, the cushioning slides (1-113) may lie directly on the outer surfaces (1-108, 1-109) with only the location projections (1-126) or location recesses (1-127) respectively extending outwards or inwards from the corresponding surface (1-108, 1-109).

FIG. 18*d* shows a corresponding embodiment applied to the hammer weight (1-3) with a location projection (1-26) passing through an aperture (1-28) in the second layer (1-15) and an aperture (1-29) in the first layer (1-14).

Figure 32:
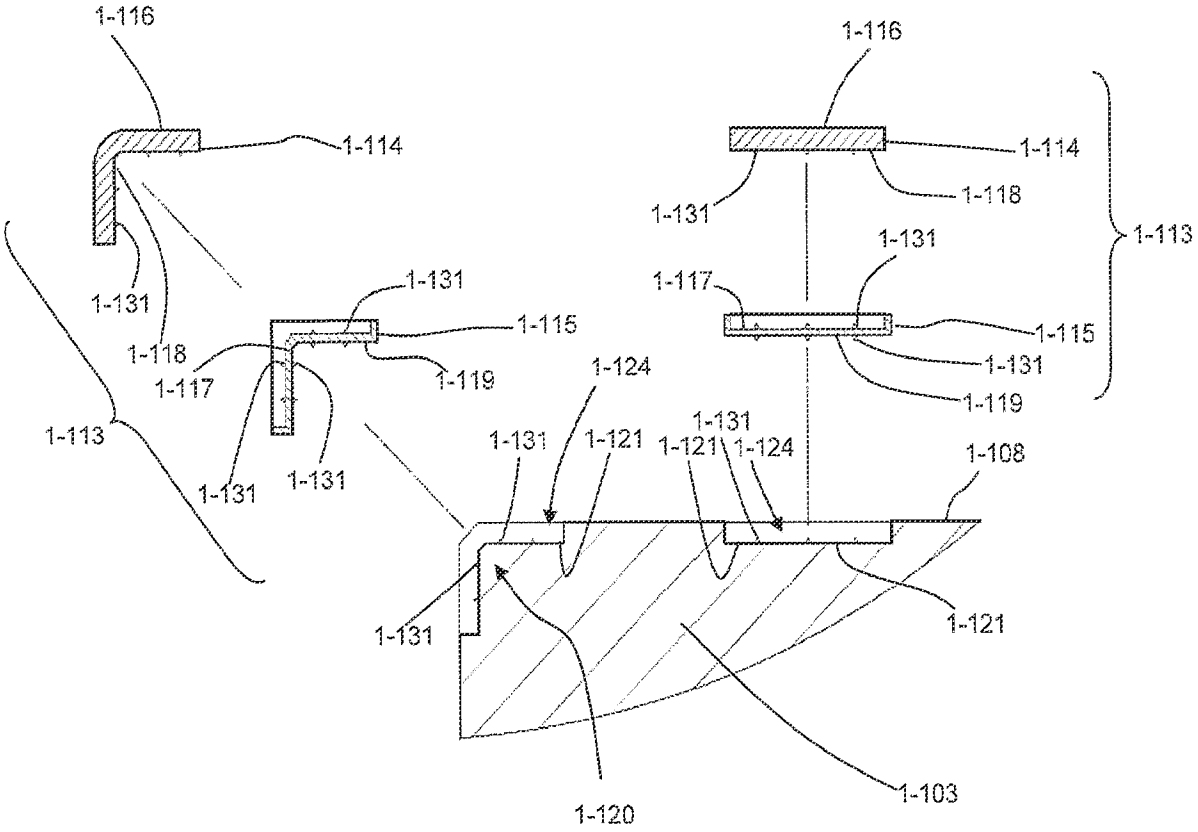
FIG. 32 shows an enlarged exploded plan section view of cushioning slides incorporating pre-tensioning features fitted to the weight of FIG. 17.

As previously identified, the greater the separation between the weight (1-3, 1-103) and the housing inner side walls (1-7, 1-107), the greater distance available for the weight to increase lateral speed under the lateral component of force (e.g. gravity), thereby increasing the resultant impact force. The embodiment shown in FIGS. 32 and 33*a-b* show a pair of cushioning slides (1-113) fitted to an apex (1-120) and a side wall (1-108) of a hammer weight (1-103). The cushioning slides (1-13) incorporate multiple pre-tensioning surface features (1-131, not all labelled) located on:

- the first layer lower surface (1-118);
- the second layer upper surface (1-117);
- the second layer lower surface (1-119), and
- the weight side wall surface (1-121) adjacent the underside of the second layer (1-119).

It will be appreciated however that the pre-tensioning surface features (1-131) need only be formed on one of the above four surfaces to function successfully. In the embodiment shown in FIGS. 32 and 33*a-b* the pre-tensioning features are small spikes, though alternatives such as fins, buttons, or the like are possible.

The pre-tensioning features (1-131) are elastic and shaped so that they are more easily compressed than the main planar portion of the second layer (1-115), The pre-tensioning surface features (1-131) also create a spacing between the first (1-114) and second (1-115) layers and between the second layer (1-115) and the corresponding side wall (1-108 or 1-109).

The pre-tensioning surface features (1-131) are formed to bias the cushioning slide's exterior surfaces (1-116) into continuous contact with the housing inner side walls (1-107) during reciprocation of the weight (1-113). In use, the pre-tensioning features (1-131) are pre-tensioned when the weight (1-103) is laterally positioned equidistantly within the housing inner side walls (1-107), as shown in FIG. 33*a*.

The exterior surface (1-116) of first layer (1-114) is thus biased into light contact with the housing inner side walls (1-107) when the housing inner side walls (1-107) is in equilibrium, (as shown in FIG. 33*a*) e.g. orientated substantially vertical. During operations, any lateral component of a force acting on the weight (1-103) acts to compress the pre-tensioning features (1-131) as shown in FIG. 33*b*. Any continued compressive force from that point onwards causes the elastomer of the second layer (1-115) to deflect as discussed with respect to the aforementioned embodiments.

FIGS. 34*a-b* shows an alternative cushioning slide (1-213) with a first layer (1-214) formed from a disc of metal or plastic with an exterior surface (1-216) and an interior surface (1-218). The interior surface (1-218) is formed by machining out a volume of the disc thickness. The cushioning slide (1-213) could also be a rectilinear or other shape and the disc is just one example. The second layer (1-215) is formed from three sub-layers including an elastomer upper layer (1-231), an intermediate rigid steel or plastic layer (1-232) and a lower elastomer layer (1-233). The second layer (1-215) has an outer surface (1-217) abutting the first layer interior surface (1-218) and a second layer interior surface (1-219) abutting a socket (1-24) in the reciprocating weight (1-3).

As per the previous embodiments, the layers (1-231, 1-232, 1-233) may be formed with displacement voids to accommodate volume displacement of the elastomer layers (1-231, 1-233) under compression.

The intermediate rigid layer (1-232) provides a rigid boundary for the elastomer layers (1-231, 1-233) and thereby ensures the elastomer layers deflect laterally under compression. A single, thicker elastomer layer may provide good shock-absorbency but is vulnerable to overheating as the amount of compression and expansion is relatively large compared with multiple thinner layers.

The upper elastomer layer (1-231) is shaped to provide a pre-tensioning feature for biasing the first layer (1-214) against the housing inner side walls (1-7, 1-107). The pre-tensioning feature is achieved in this example by forming the elastomer layer (1-231) as a bowl with a convex exterior surface (1-217). Alternatively, as in the embodiments shown in FIGS. 32 and 33*a-b*, pre-tensioning surface features may be utilised such as ridges, fins or other protrusions that push against the first layer (1-214) but compress easier than the elastomer layer (1-231, 1-233).

The lower elastomer layer (1-233) is also formed with a similar pre-tensioning shape feature and further includes a recess (1-234) for accommodating the peripheral wall (1-235) of the first layer (1-214). The recess (1-234) is sufficiently deep such that when assembled in an uncompressed state (FIG. 33*b*) the first layer wall (1-235) is not touching the base of the recess (1-234) thereby permitting travel of the first layer (1-214) when the cushioning slide (1-213) is impacted.

The cushioning slide (1-213) components may be vulnerable to relative sliding between rigid layers (1-214, 1-232) and elastomer layers (1-231, 1-233) when subjected to high accelerations along the impact axis. Any relative sliding may allow the rigid layers (1-232) to move and damage the other layers (1-233, 1-231). Thus, in the embodiment shown in FIGS. 34*a-b*, the first (1-214) and second (1-215) layers are dimensioned to provide a close-fit when assembled to prevent such problems, such as damage to the contacting edges of the rigid layers (1-232) and (1-214), particularly those resulting from high accelerations along the impact axis.

The cushioning slide (1-213) is thus formed as a layered stack which offers improved shock-absorbing characteristics over a singular second layer (1-15), (1-115) as in the previous embodiments. The cushioning slide (1-213), while more complex and costly, may be useful in applications in extremely high impact forces where the cushioning slides (1-13), (1-113) are not sufficiently robust. Accordingly, the first layer (1-214) could be formed from steel or plastic with high wear resistance which, while increasing weight offers increased robustness for high shock loads.

Figure 35:
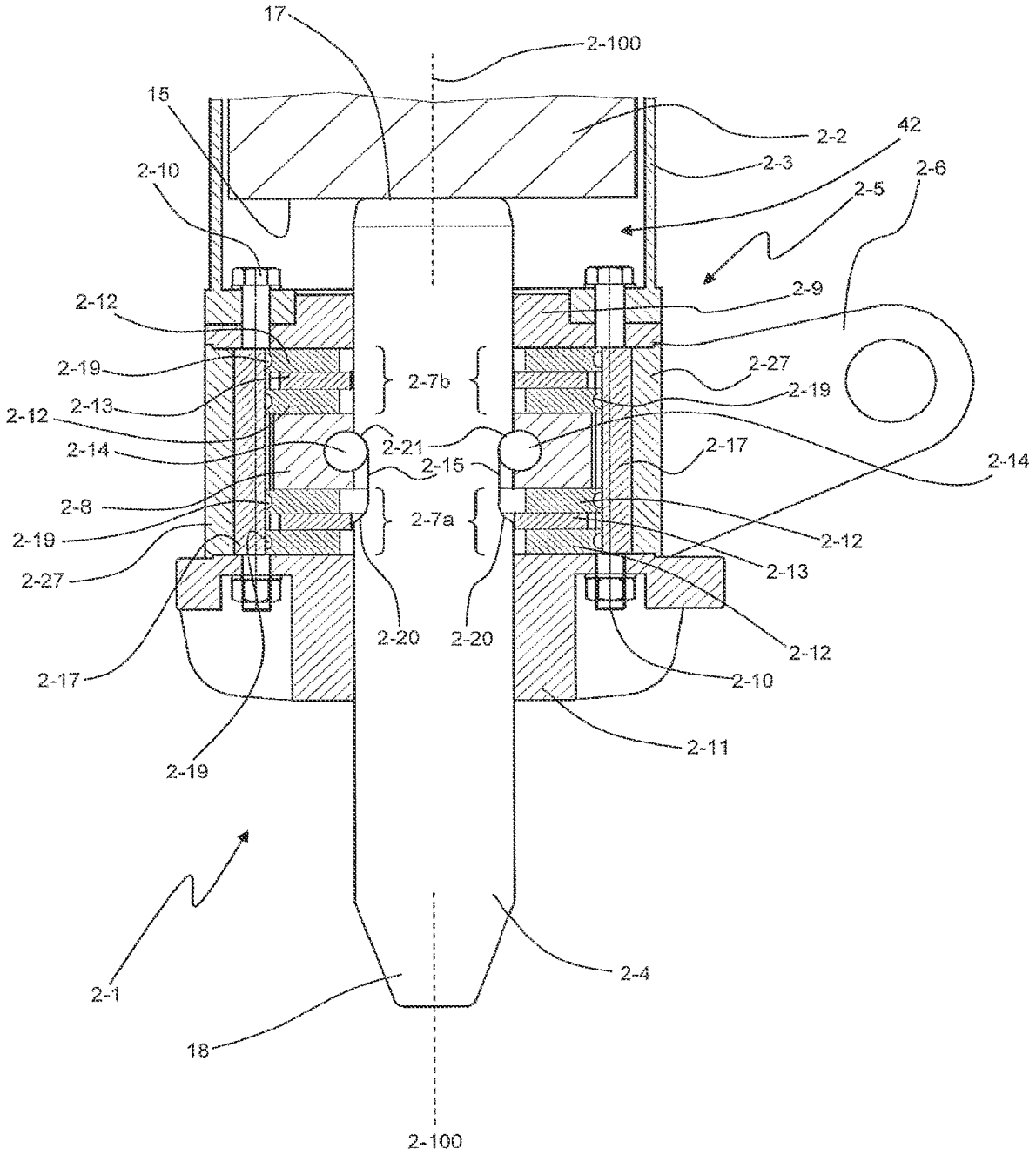
FIG. 35 shows a side elevation in section of a nose block assembly for a rock-breaking impact hammer in accordance with a preferred embodiment of the present invention.
Figure 36:
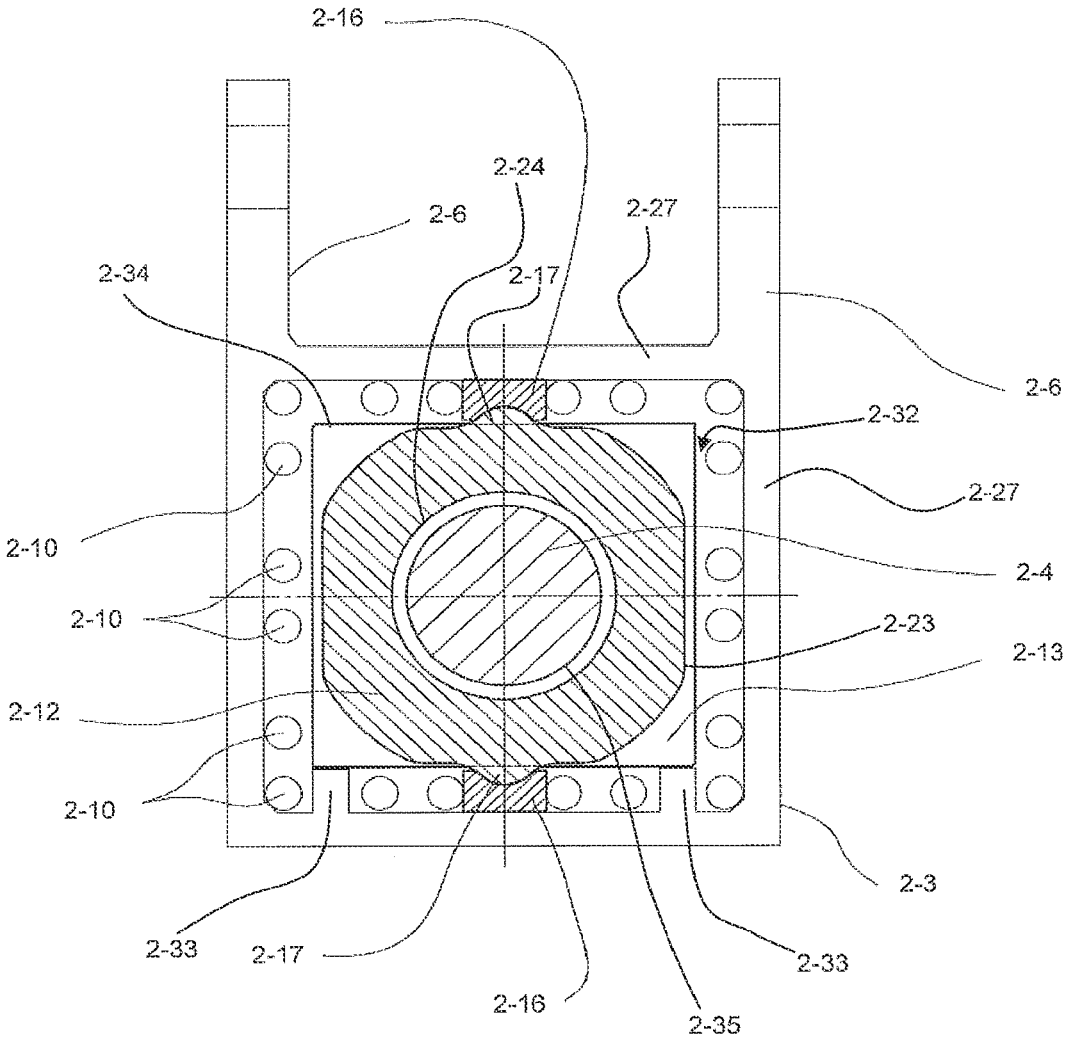
FIG. 36 shows a plan section through the nose block assembly of FIG. 35.
Figure 37:
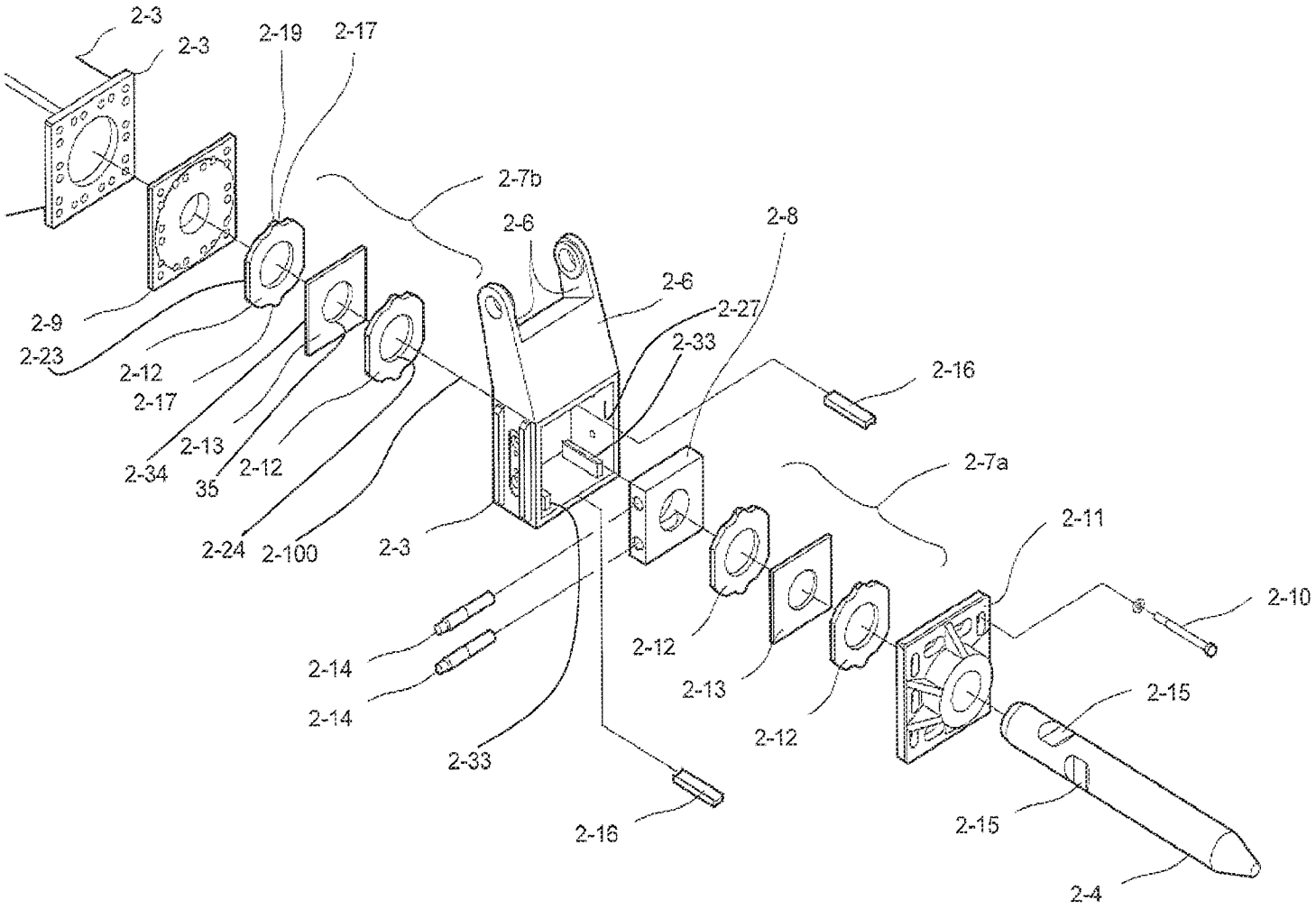
FIG. 37 shows an exploded perspective view of the nose block assembly shown in FIGS. 35-36.

One embodiment of an impact hammer is illustrated by FIGS. 35-37 in the form of a rock-breaking hammer (2-1) including a hammer weight (2-2) constrained to move linearly within a housing (2-3). A striker pin (2-4) is located in a nose cone portion of the housing (2-3) to partially protrude from the housing (2-3). The striker pin (2-4) is an elongate substantially cylindrical mass with two ends, i.e. a driven end (17) impacted by the hammer weight (2-2) and an impact end (18) protruding through the housing (2-3) to contact the rock surface being worked. The housing (2-3) is substantially elongate, with an attachment coupling (2-6) attached to a portion of the housing (2-3), referred to as the nose block (2-5), at one end of the housing (2-3). The attachment coupling (2-6) is used to attach the impact hammer (2-1) to a carrier (not shown) such as a tractor excavator or the like.

The impact hammer (2-1) also includes a shock absorber in the form of first and second shock absorbing assemblies (2-7*a*, 2-7*b*) laterally surrounding the striker pin (2-4) within the nose block (2-5) and interposed by a retainer in the form of recoil plate (2-8).

The shock-absorbing assemblies (2-7*a*, 2-7*b*) and recoil plate (2-8) are held together in the nose block (2-5) as a stack surrounding the striker pin (2-4) by an upper cap plate (2-9) fixed, via longitudinal bolts (2-10), to the nose cone (2-11) portion of the housing (2-3), located at the distal portion of the hammer (2-1), through which the striker pin (2-4) protrudes. The upper cap plate (2-9) is a rigid inelastic plate with a planar lower surface confronting the upper elastic layer (2-12) of the second shock absorbing assembly (2-7*b*). The nose cone (2-11) is also a rigid fitting with a planar upper surface confronting the lower elastic layer (2-12) of the first shock absorbing assembly (2-7*a*). The recoil plate (2-8) is formed with rigid parallel upper and lower planar surfaces confronting the lower and upper elastic layers (2-12) of the second (2-7*b*) and first (2-7*a*) shock absorbing assemblies respectively. The planar surfaces of the upper cap plate (2-9), recoil plate (2-8) and nose cone (2-11) are substantially parallel, each centrally apertured and aligned to accommodate passage of the striker pin (2-4).

As may be seen more clearly in FIG. 37, the individual shock-absorbing assemblies (2-7*a*, 2-7*b*) are composed of a plurality of individual layers. In the embodiment shown in FIGS. 35-48*c*, each shock-absorbing assembly (2-7*a*, 2-7*b*) is composed of two elastic layers in the form of polyurethane elastomer annular rings (2-12), separated by an inelastic layer in the form of apertured steel plate (2-13). The shock-absorbing assemblies (2-7*a*, 2-7*b*) are held between the cap plate (2-9) and nose cone (2-11), though are otherwise unrestrained from longitudinal movement parallel/coaxial to the longitudinal axis of the striker pin (2-4). The above described constituent elements in shock-absorbing assemblies (2-7*a*, 2-7*b*), cap plate (2-9) and nose cone (2-11) are not bonded, adhered, fixed, or in any other way connected together aside from being physically held in physical contact.

The striker pin (2-4) is attached to the impact hammer (2-1) by a slideable coupling in the form of two retaining pins (2-14) passing laterally through the recoil plate (2-8) such that a portion of each pin (2-14) partially projects inwardly into a recess (2-15) formed in the striker pin (2-4). The slideable coupling connects the striker pin (2-4) to the recoil plate (2-8) at a retaining location defined by the length of the recess (2-15) between (with respect to the driven end of the striker pin (2-4)) a distal and proximal travel stops (2-20, 2-21).

The polyurethane rings (2-12) in each shock-absorbing assembly (2-7*a*, 2-7*b*) are held in position perpendicular to the striker pin longitudinal axis by guide elements in the form of elongate slides (2-16), located on the interior walls of the nose block (2-5) and orientated substantially parallel with the striker pin longitudinal axis.

Each polyurethane ring (2-12) includes small rounded projections (2-17) extending radially outwards from the outer periphery (2-23) in the plane of the polyurethane ring (2-12). The elongate slides (2-16) are configured with an elongated groove shaped with a complementary profile to the projections (2-17) to enable the shock-absorbing assemblies (2-7*a*, 2-7*b*) to be held in lateral alignment. This allows the rings (2-12) to expand laterally whilst preventing the polyurethane rings (2-12) from impinging on the inner walls of the housing (2-3), i.e. maintaining the rings (2-12) centered co-axially to the striker pin (2-4), thus preventing any resultant abrasion/overheating damage to the polyurethane ring (2-12).

The elongate slides (2-16) are generally elongate rectangular panels formed from a similar elastic material to the elastic layer (2-12) e.g. polyurethane. However, preferably, the elongate slides (2-16) are formed from a much softer elastic material, i.e., with a lower modulus of elasticity. This provides two key benefits:

1. The elongate slides (2-16) wear more readily than the polyurethane annular rings (2-12). Consequently, maintenance costs are reduced as the elongate slides (2-16) may be easily replaced when worn and do not require the removal and dismantling of the shock absorbing assemblies (2-7*a*, 2-7*b*) in order to replace the annular rings (2-12)
2. The elongate slides (2-16) offer virtually no resistance to the lateral deflection of the annular rings (2-12) under load, thus avoiding the projections (2-17) becoming locally incompressible which may lead to failure thereof.

During a shock absorbing process, as the elastomer ring (2-12) deflects laterally, the projections (2-17) are forced outwards into increasing contact with the elongate slides (2-16) until the pressure reaches a point where the elongate slides (2-16) start to move parallel to the striker pin longitudinal axis in conjunction with the polyurethane ring (2-12).

As shown most clearly in FIG. 35, each projection (2-17) includes a substantially concave recess (2-19) at the projection apex. Each recess (2-19) is a part-cylindrical section orientated with a geometric axis of revolution in the plane of the elastic layer (2-12). Under compressive load, the vertical centre of the elastic layer (2-12) is displaced laterally outwards by the greatest extent. The recess (2-19) thereby enables the elastic layer (2-12) to expand outwards without causing the centre of the projection (2-17) to bulge beyond the perimeter of the projection (2-17).

FIGS. 38A-B, 39A-B, and 40A-B respectively show an impact hammer in the form of rock-breaking hammer (2-1) performing an effective strike, a mis-hit and an ineffective strike, both before (FIGS. 38A, 39A, and 40A) and after (FIGS. 38B, 39B, and 40B) the hammer weight (2-2) impacts the striker pin (2-4).

Figure 38A:
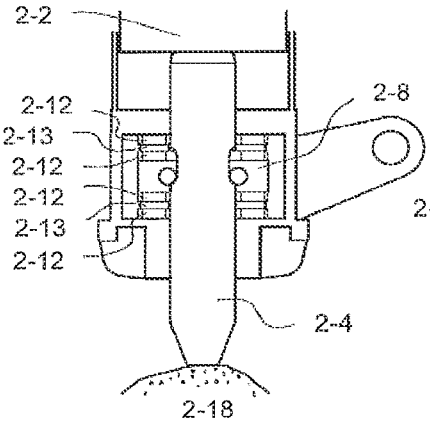
FIGS. 38A-B shows a schematic representation of the impact hammer before and after an effective strike.
Figure 38B:
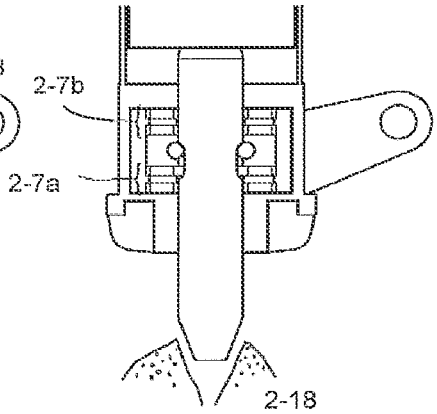

In typical use (as shown in FIG. 38A-B), the lower tip of the striker pin (2-4) is placed on a rock (2-18) and the hammer (2-1) lowered until the retaining pins (2-14) impinge on the distal travel stop (2-20) of the recess (2-15). This is termed the 'primed' position. The hammer weight (2-2) is then allowed to fall onto the upper end of the striker pin (2-4) inside the housing (2-3) and the resultant force transferred through the striker pin (2-4) to the rock (2-18). When the impact results in a successful fracture of the rock (2-18), as shown in FIG. 38B, virtually all of the impact energy from the hammer weight (2-2) may be dissipated and little, if any, force is required to be absorbed by either of the shock-absorbing assemblies (2-7*a*, 2-7*b*).

Figure 39A:
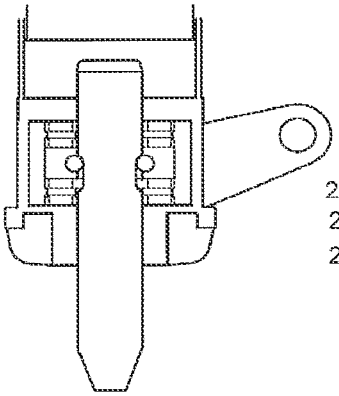
FIG. 39A-B shows a schematic representation of the impact hammer before and after a mis-hit.
Figure 39B:
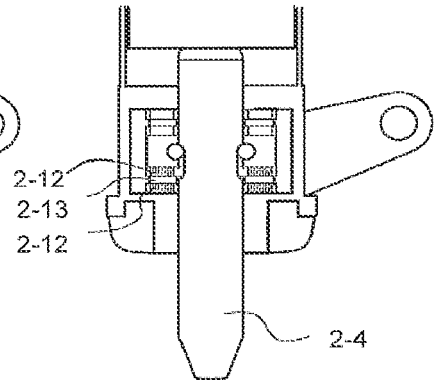

FIGS. 39A-B show the effects of a 'mis-hit' or 'dry hit', in which the hammer weight (2-2) impacts the striker pin (2-4) without being arrested by impacting a rock (2-18) or similar. Consequently, all, or a substantial portion of the impact energy of the hammer weight (2-2) is transmitted to the hammer (2-1). The downward force of the hammer weight (2-2) impacting the striker pin (2-4) forces the proximal travel stop (2-21) at the upper end of the recess (2-15) into contact with the retaining pins (2-14). Consequentially, the recoil plate (2-8) is forced downward, thus compressing the lower shock absorbing assembly (2-7*a*) between the recoil plate (2-8) and the nose cone (2-11). In the process of absorbing the impact shock, the compressive force laterally displaces the polyurethane rings (2-12), orthogonally to the striker pin longitudinal axis. The steel plates (2-13) prevent the polyurethane rings from mutual contact, thereby avoiding wear and also maximizing the combined shock-absorbing capacity of all the elastic polyurethane rings (2-12) in the shock absorbing assembly (2-7*a*) in comparison to use of a single unitary elastic member.

A significant degree of heat is generated in a 'dry hit.' However, it has been found that even several such strikes successively may avoid permanent damage to the polyurethane rings (2-12) provided a cooling period is allowed by the operator before continuing impact operations. Ideally, deformation of the polyurethane rings (2-12) is less than approximately 30% change in thickness in the direction of the applied force, though this may increase to 50% in a dry hit.

Figure 40A:
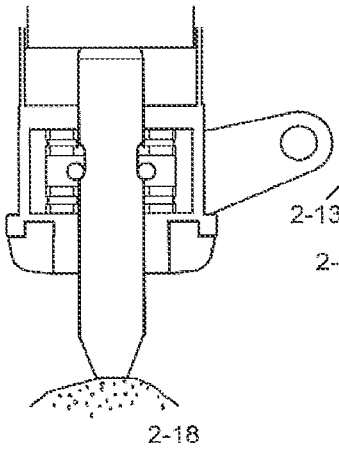
FIG. 40A-B shows a schematic representation of the impact hammer before and after an ineffective strike.
Figure 40B:
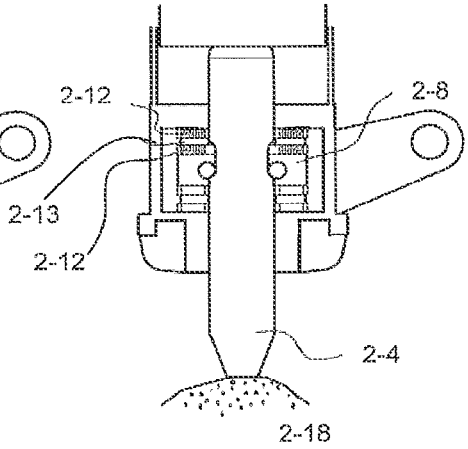
Figure 41:
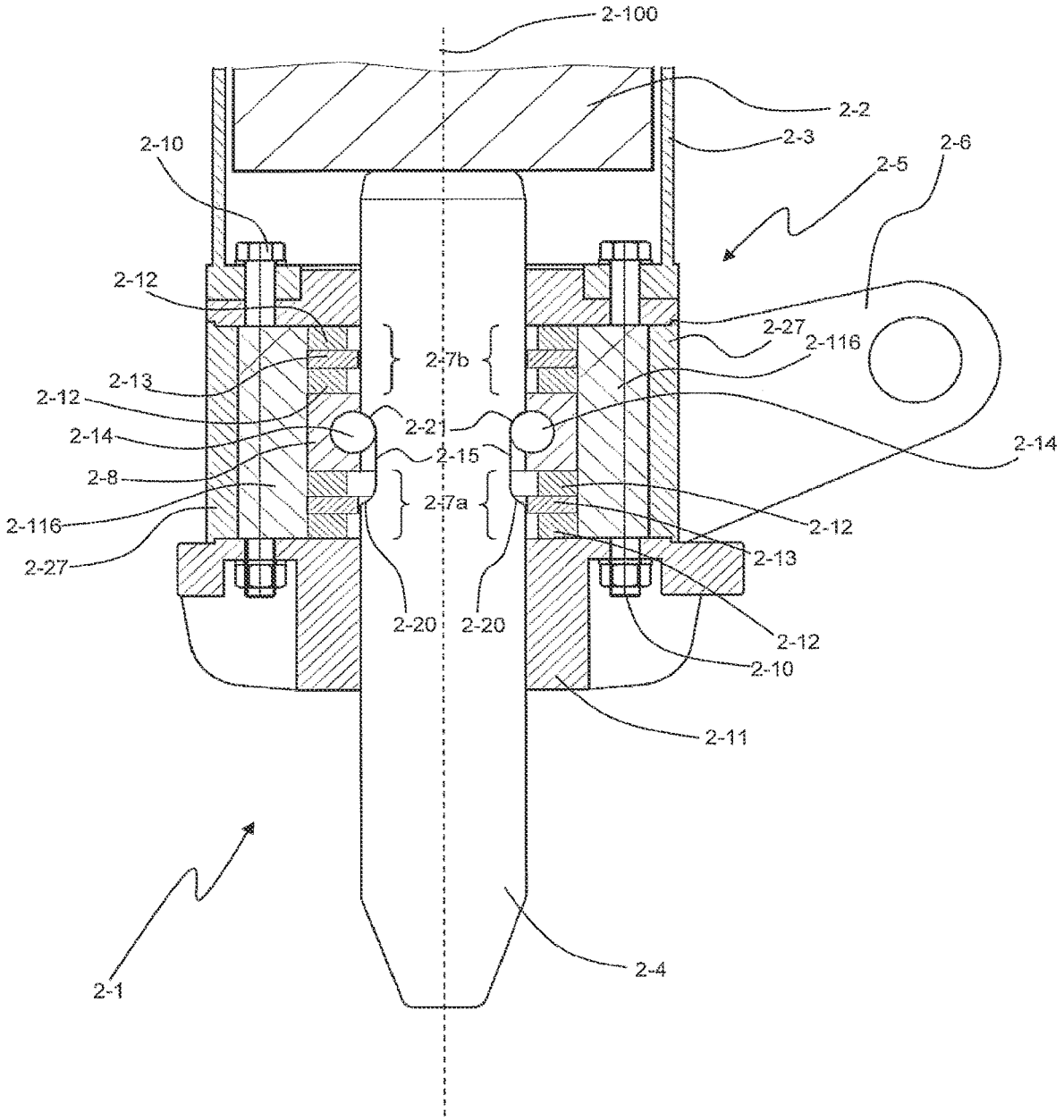
FIG. 41 shows a plan section through the nose block assembly of a rock-breaking impact hammer in accordance with a further preferred embodiment of the present invention.

FIG. 40A-B show the effects of an ineffective hit whereby the impact force of the hammer weight (2-2) on the striker pin (2-4) is insufficient to break the rock causing the striker pin (2-4) to recoil into the housing (2-3) on a reciprocal path. This forces the retaining pins (2-14) into contact with the lowermost ends of the striker pin recesses (2-15). Consequently, the upwards force is transferred via the recoil plate (2-8) to the upper shock absorbing assembly (2-7*b*) causing the elastic polyurethane rings (2-12) to deflect laterally during absorption of the applied force. Thus, the shock absorbing assembly (2-7*b*) mitigates the detrimental effects of the recoil force on the hammer (2-1) and/or carrier (not shown).

FIGS. 41-48*c* show alternative embodiments, utilizing alternative guide element configurations to that shown in FIGS. 35-37.

The embodiment as shown in FIGS. 35-37 shows the elongate slide (2-16) guide elements formed with a longitudinal recess and complimentary projections (2-17) formed on the elastic layer. The converse configuration is employed in the embodiment shown in FIGS. 41 and 42, whereby the elongate slides (2-116) are formed with a longitudinal projection (2-117) and a portion of a peripheral edge (2-23) of the elastic layer (2-12) is formed as a corresponding recess matching the profile of the projection (2-117) on the elongate slide (2-116). The elongate slides (2-16, 116) in both the first and second embodiments function identically in centring the elastic layers (2-12), as described previously.

Figure 43:
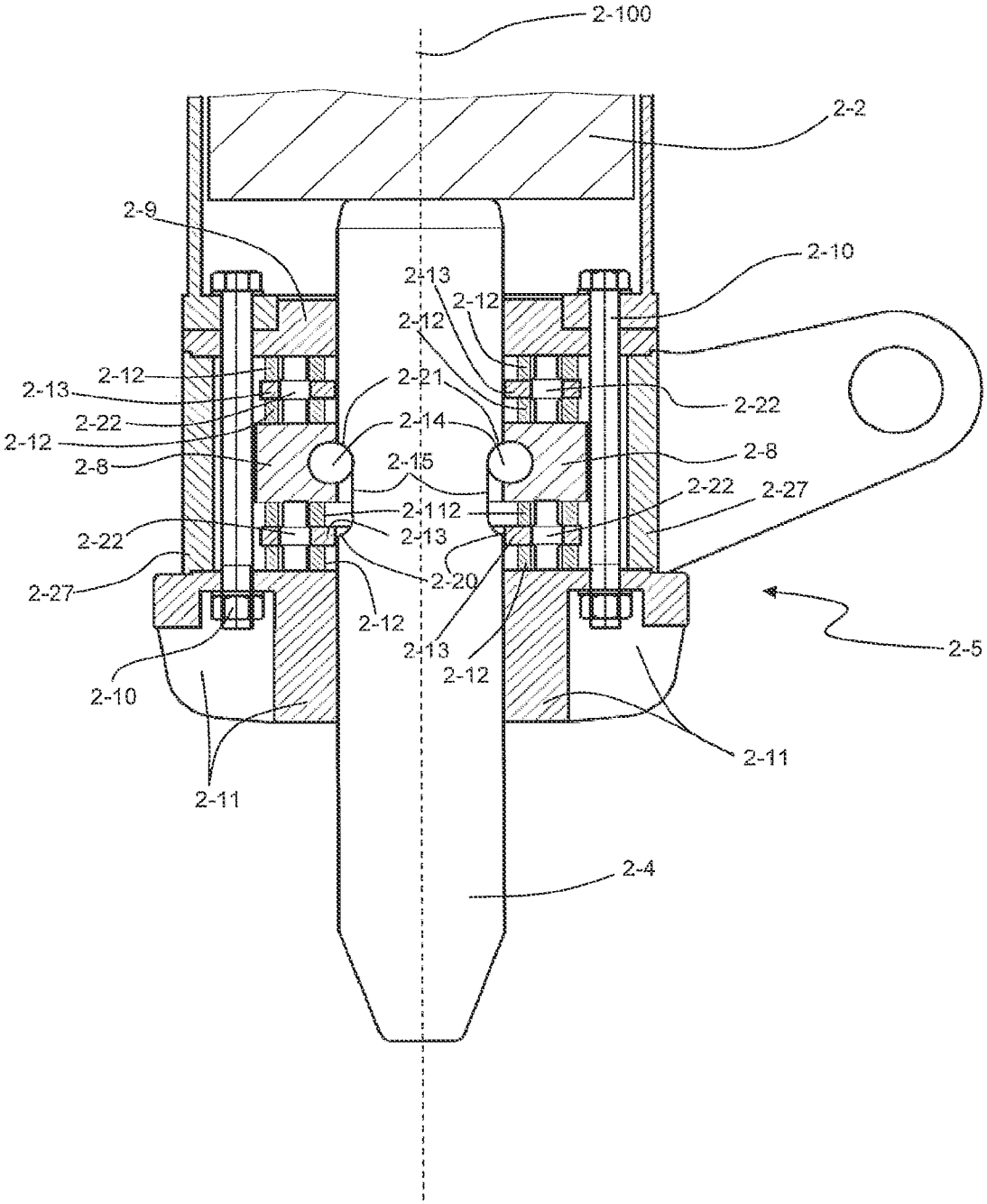
FIG. 43 shows a side elevation in section of a nose assembly for a rock-breaking impact hammer in accordance with a further preferred embodiment of the present invention.
Figure 44:
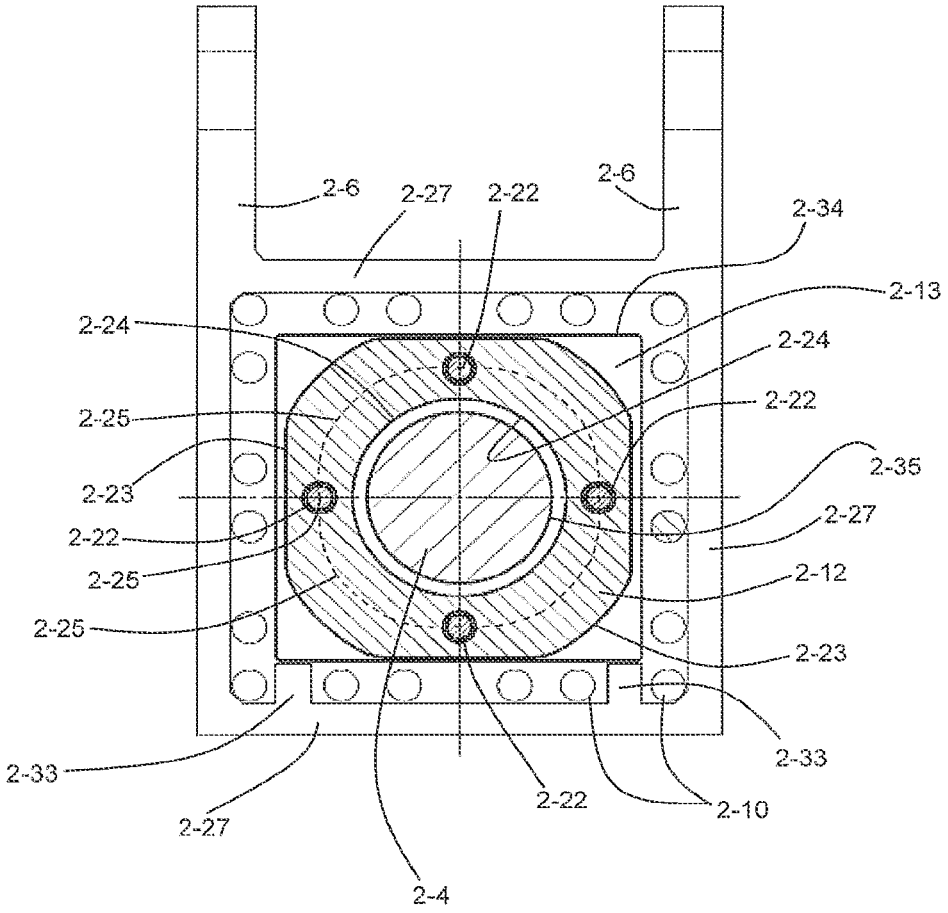
FIG. 44 shows a plan section through the nose block assembly of FIG. 43.

In an alternative embodiment (not shown), the guide elements in the form of elongate slides (2-16, 2-116) may be arranged on the exterior of the striker pin (2-4). It will also be appreciated that the slidable engagement between the elastic layer inner periphery (2-24) and the striker pin (2-4) may be formed by a recess on the elongate slide guide element and a protrusion on the elastic layer periphery (2-24) or vice versa FIGS. 43 and 44 show (in side and plan section view respectively) a further preferred embodiment incorporating guide elements in the form of locating pins (2-22). Four equidistantly spaced locating pins (2-22) are located on a planar surface of the inelastic layer (2-13) between an outer (2-23) and inner (2-24) lateral periphery of the elastic layers, orientated substantially parallel with the striker pin longitudinal axis to pass through an elastic layer (2-12).

The individual pins (2-22) may be formed in a variety of configurations including two locating pins on located on opposing sides of the inelastic layer (2-13) or as a substantially single continuous pin, fixed through the inelastic steel plate (2-13) and passing through the elastic layers (2-12) on both sides. FIG. 43 shows a configuration whereby the locating pins (2-22) are formed as two separate elements, co-axially aligned on opposing sides of the inelastic plate (2-13). It will be appreciated however, that the locating pins (2-22) on either side of the inelastic layer (2-13) do not necessarily need to be aligned, or the same in number.

The elastic layer (2-12) defects both laterally outwards towards the side walls (2-27) of the nose block (2-5) and inwards towards the striker pin (2-4) under compression. The locating pins (2-22) are positioned at a point on a null-point path (2-25) between the outer (2-23) and inner (2-24) lateral periphery. As this null point (2-25) is laterally stationary during shock absorbing, there is no relative movement between the elastomer layers (2-12) and locating pin guide element (2-22) and therefore no tension, nor compression therebetween. It will be readily appreciated by one skilled in the art that alternative configurations including two or more pins (2-22) may be employed to ensure the centring of the elastic layers (2-12). The null-point path (2-25), including the positions of locating pins (2-22) (as shown in FIG. 43) are located on a generally annular null-point path (2-25) located between the outer and inner periphery (2-23, 2-24).

Figure 45:
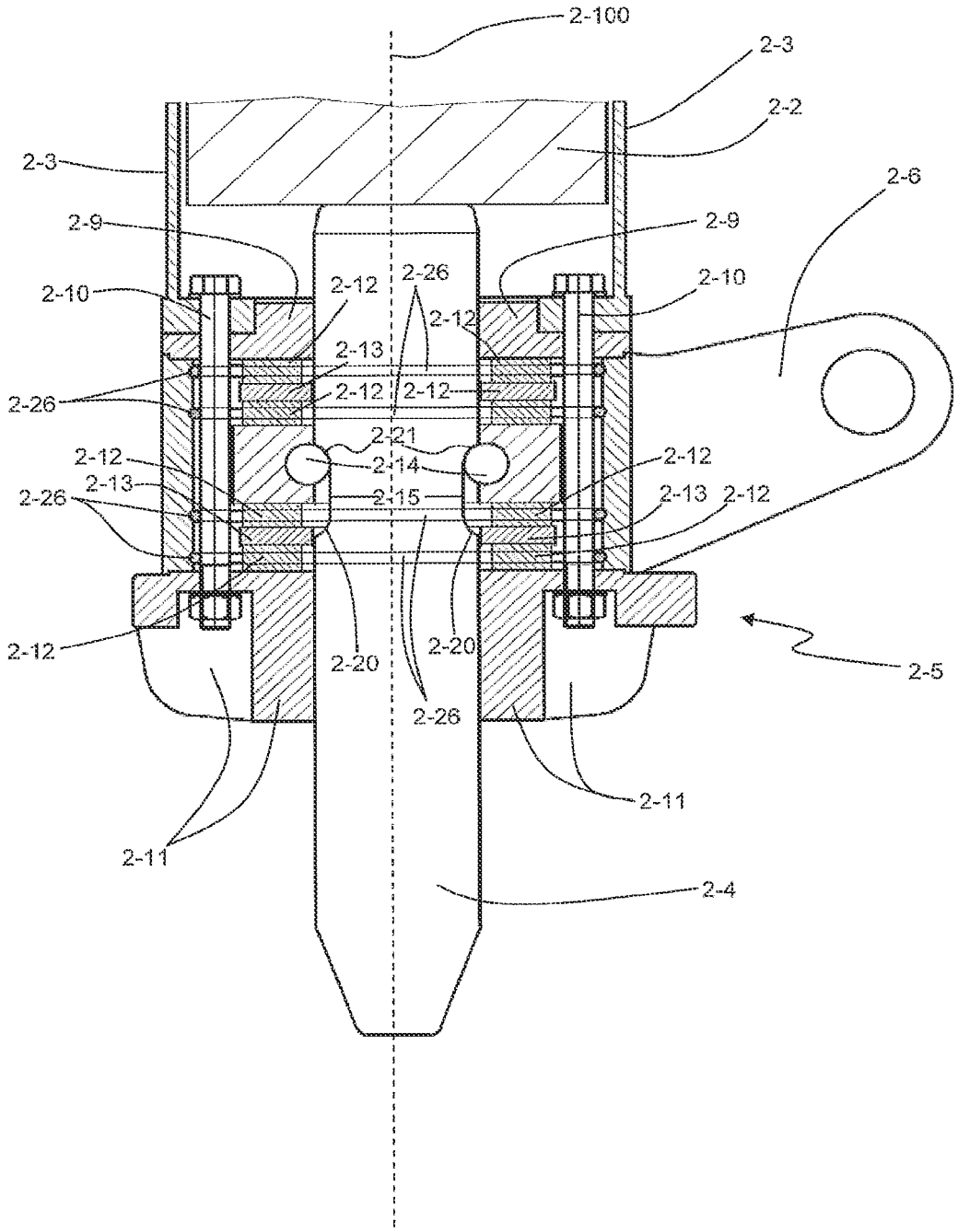
FIG. 45 shows a side elevation in section of a nose assembly for a rock-breaking impact hammer in accordance with a further preferred embodiment of the present invention.
Figure 46:
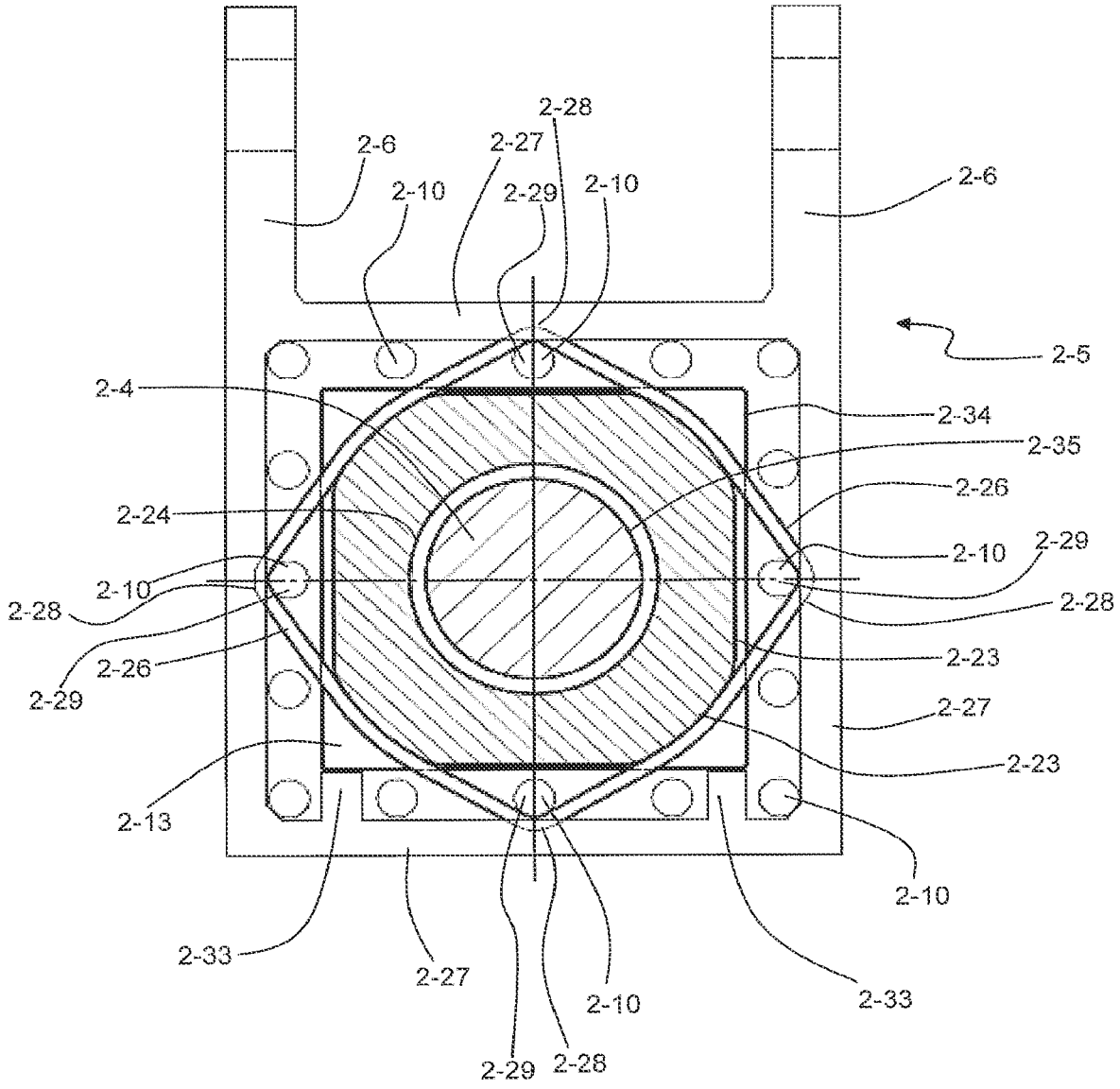
FIG. 46 shows a plan section through the nose block assembly of FIG. 44.

FIGS. 45 and 46 show a further embodiment incorporating guide elements in the form of tension bands (2-26) circumscribing each elastic layer (2-12) and four anchor points (2-29) in the form of nose block longitudinal bolts (2-10) located centrally adjacent each of the four nose block side walls (2-27). A separate tension band (2-26) is provided for each elastic layer (2-12) and applies a restorative reaction force caused by displacement of the elastic layer (2-12) from its centred position about the striker pin (2-4). It will be appreciated however that the tension bands (2-26) may be configured to pass around a differing number of anchor points (2-29) and/or other portions of, or attachments to the nose block side walls (2-27) as well as the corresponding elastic layers (2-12).

The tension band (2-26) may also be formed of an elastic material such as an elastomer. The portion of the tension band (2-26) passing behind each anchor point (2-29) passes through a shallow indent (2-28) in the adjacent nose block side wall (2-27), thereby preventing the band (2-26) from sliding or rolling up or down the nose bolts (2-10) during use.

The centering force applied by the tension bands (2-26) onto the elastic layer (2-12) is proportional to the degree the band (2-26) is displaced from the direct path between adjacent anchor points (2-29) by the outer periphery (2-23) of the elastic layer (2-23). The symmetrical arrangement of the anchor points (2-29) and the elastic layer (2-23) about the striker pin longitudinal axis produces a centering force about same.

Figure 47:
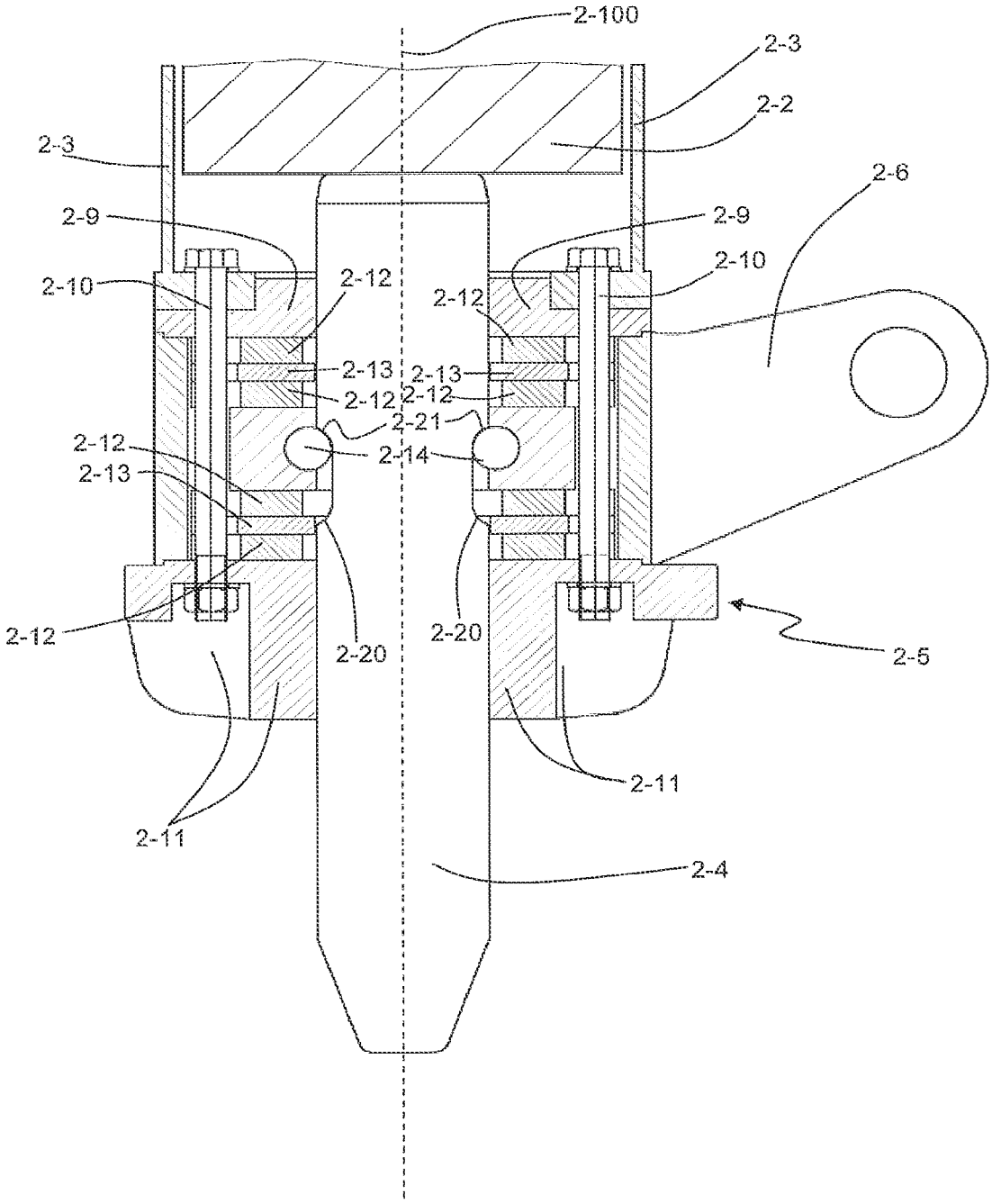
FIG. 47 shows a side elevation in section of a nose assembly for a rock-breaking impact hammer in accordance with a further preferred embodiment of the present invention.
Figure 48A:
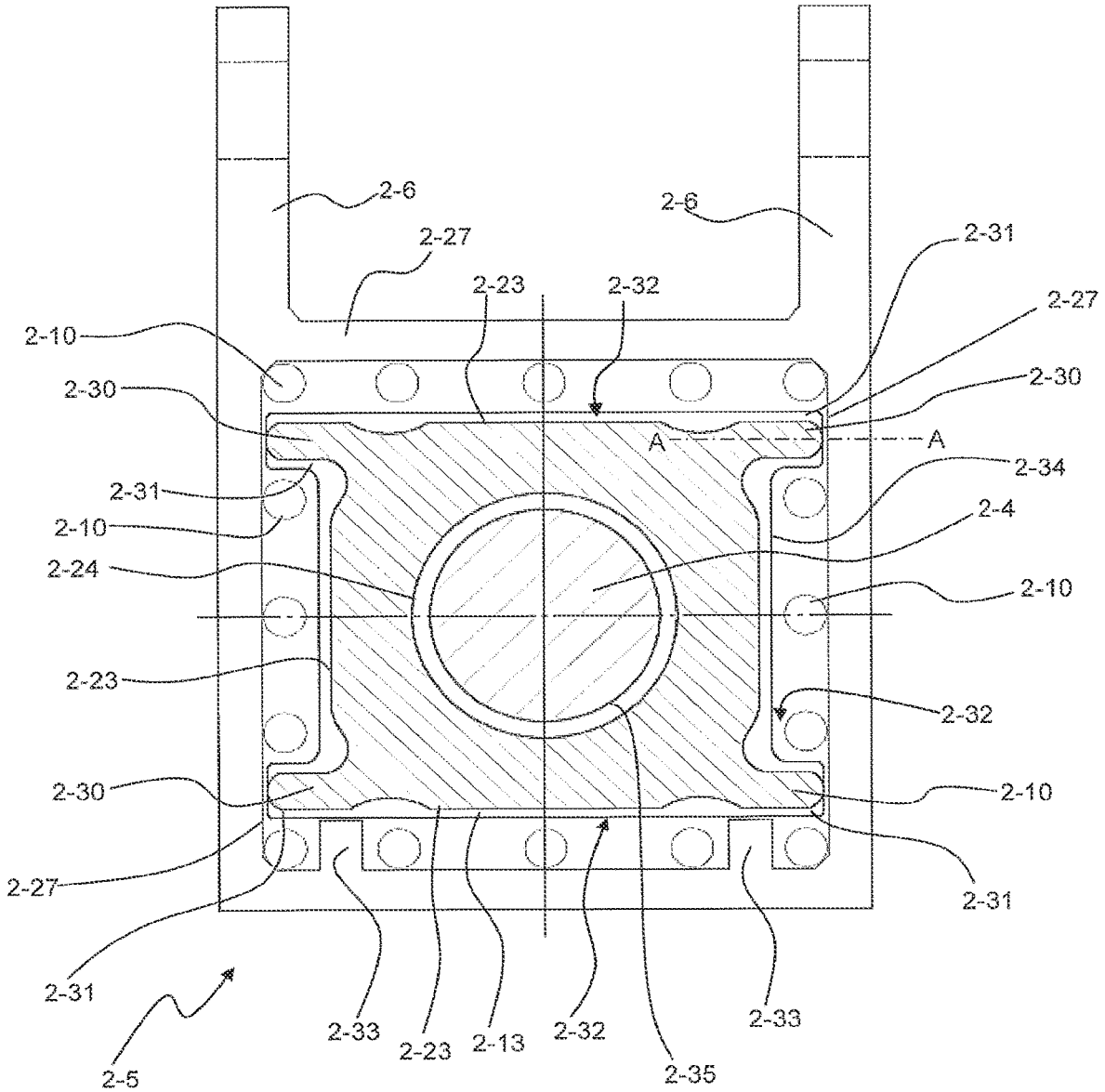
FIG. 48*a* shows a plan section through the nose block assembly of FIG. 47.

FIGS. 47 and 48*a* show a yet further embodiment incorporating guide elements in the form of supported stabilizing features (2-30) projecting directly from the elastic layer outer periphery (2-23) to contact the nose block side walls (2-27). The planar surfaces of the inelastic layer (2-13) are formed with a substantially square centre section and four tab portions (2-31) located at the four apices of the centre squares outer periphery (2-23). The tab portions (2-31) located at each apex of the inelastic layer (2-13) pass between adjacent nose bolts (2-10) to within close proximity of the nose block side wall (2-27). The stabilizing features (2-30) projecting from the outer periphery (2-23) roughly mirror the shape of the inelastic layer outer periphery (2-34) with a border to allow for lateral deflection during impacting use. Where the tab portions (2-31) are within the closest proximity to the nose block side wall (2-27), the stabilizing features (2-30) are sufficiently close to contact the sidewalls during impacting use, to provide a centering and stabilizing effect. As the remainder of the elastic layer (2-12), including the stabilizing features (2-30), are supported by the inelastic layer (2-13), the potential for damaging wear on the elastic layer (2-12) is mitigated.

Figure 48B:
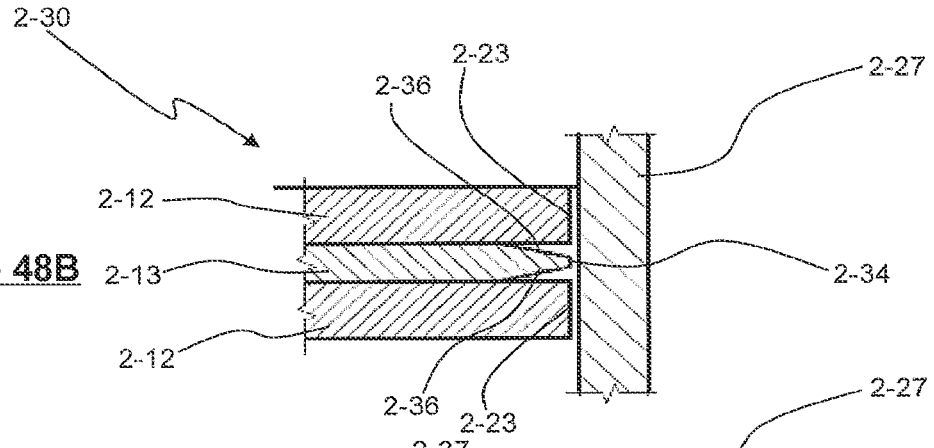
FIG. 48*b* shows an enlargement of section AA shown in the nose block assembly of FIG. 47 according to a further preferred embodiment of the present invention.
Figure 48C:
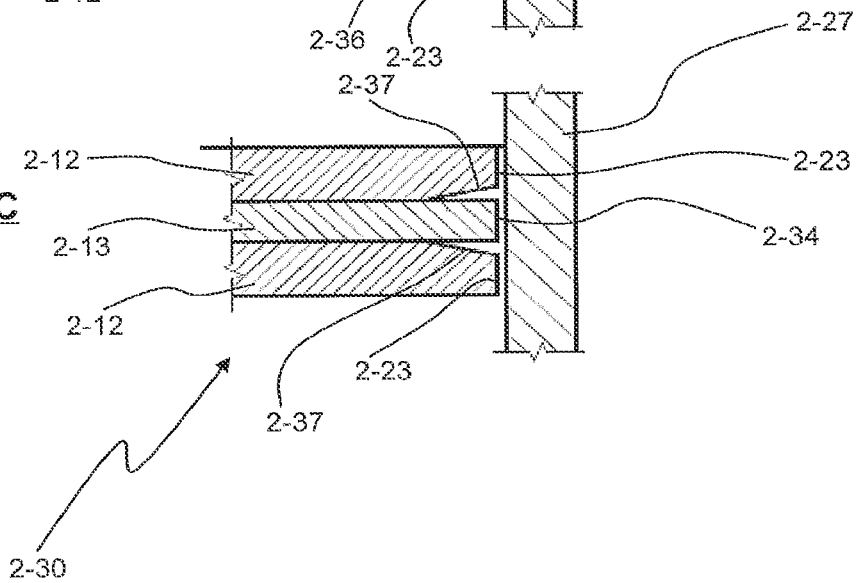
FIG. 48*c* shows an enlargement of section AA shown in the nose block assembly of FIG. 47 according to a further preferred embodiment of the present invention.

FIGS. 48*b* and 48*c* illustrate a fifth and sixth embodiments incorporating variants of the embodiment shown in FIG. 48*a* and showing an enlargement of the side elevation taken along section line AA of the supported stabilizing feature (2-30) adjacent the nose block side wall (2-27).

FIG. 48*b* shows a pair of elastic layers (2-12) interleaved by an inelastic layer (2-13) with an outer periphery tapered portion (2-36) extending to the peripheral edge (2-34) on the upper and lower surface of the inelastic layer (2-13).

FIG. 48*c* shows an inelastic layer (2-13) interleaved between a pair of elastic layers (2-12), each with outer peripheries having tapered portions (2-37) extending to the peripheral edge (2-23) on the surfaces of the elastic layers (2-12) adjacent the inelastic layer (2-13).

The embodiment of FIG. 48*b* produces a reduce pressure during compression reduction at the outer periphery tapered portions (2-37) by reducing the volume of the rigid inelastic layer (2-13) compressing the adjacent elastic layers (2-12).

The reduction in the volume of elastic layers (2-12) material caused by the tapered portions (2-37) with respect to the embodiments cause shown in FIG. 48*c* is directly comparable to the effect to that of the part-cylindrical section recess (2-19) described with respect to FIG. 35.

Figure 42:
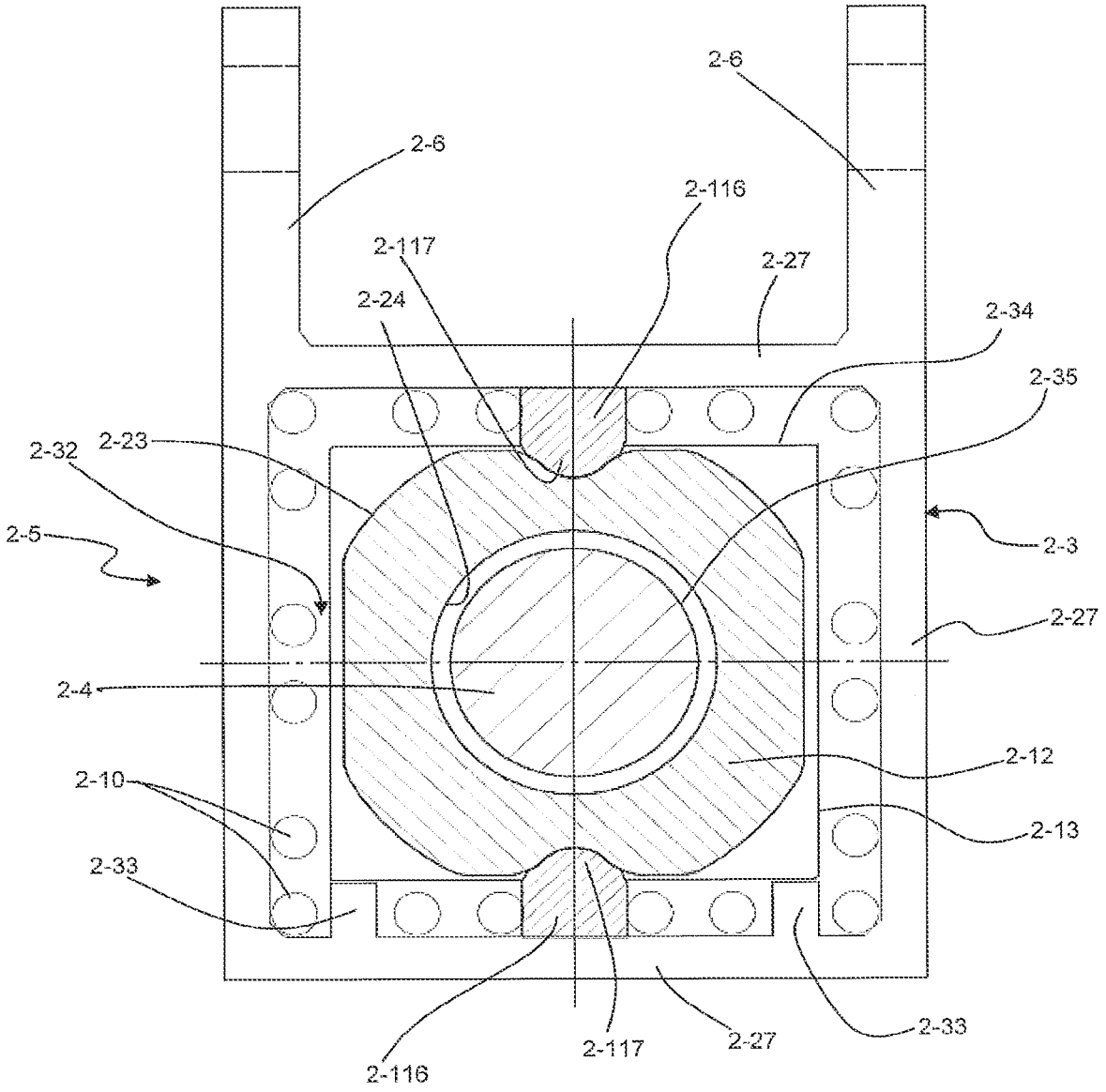
FIG. 42 shows a plan section through the nose block assembly of FIG. 41.

Over continued use, the sides of the striker pin (2-4) wear the cap plate (2-9) and nose plate (2-11) where it passes through the nose block (2-5). Consequently, the striker pin's longitudinal axis becomes misaligned from the impact axis (2-100), bringing the shock absorbing assemblies (2-7*a*, 2-7*b*) closer to the nose block walls (2-27). To prevent a detrimental contact between the shock absorbing assemblies (2-7*a*, 2-7*b*) and the nose block walls (2-27), a degree of lateral clearance (2-32) is incorporated between either the striker pin (2-4) and the inner inelastic layer periphery (2-35) or the nose block side walls (2-27) and the outer inelastic layer periphery (2-34) (as shown in FIG. 42). The impact hammer (2-1) may thus accommodate a degree of wear before maintenance is required for the cap plate (2-9) and nose plate (2-11).

Although the inelastic layer (2-13) is thus centred by its proximity to the circumference of the striker pin (2-4), the inelastic layer (2-13) may rotate about the striker pin (2-4) during use due to its uniform inner circular cross section. Thus, to prevent any detrimental interference between the inelastic layer (2-13) and the nose block side walls (2-27) and/or nose bolts (2-10), the inner nose block walls (2-27) are provided with a pair of substantially elongated cuboid restraining elements (2-33), placed between a pair of nose bolts (2-10) and extending laterally inwards toward the striker pin (2-4). The restraining elements (2-33) are positioned and dimensioned to be sufficiently close to the inelastic layer (2-13) to obstruct any rotation, whilst permitting movement parallel to the longitudinal impact axis (2-100). It should be noted that although the striker pin longitudinal axis and the impact axis (2-100) may diverge slightly due to wear, all the figures show the situation with no wear and thus the two axes are co-axial.

In an alternative embodiment (not shown), the inelastic layer (2-12) is configured with its outer periphery (2-34) positioned immediately adjacent at least a portion of the nose block walls (2-27) and/or nose bolts (2-10), with a clearance spacing between the inner inelastic layer periphery (2-24) and the striker pin (2-4).

Aspects of the present invention have been described by way of example only and it should be appreciated that modifications and additions may be made thereto without departing from the scope thereof.

It should be appreciated that the disclosure herein encompasses embodiments where any one or more of the features, components, methods or aspects, either individually, partially or collectively of any one embodiment or aspect may be combined in any way with any other feature of any other embodiment or aspect and the disclosure herein does not exclude any possible combination unless explicitly stated otherwise.

APPENDIX A

Tables 1-14.

TABLE 1

| Excavator weight class (tonnes) | Max attachment weight (6.5x multiplier) (tonnes) | Minimum attachment weight reduction to move into lighter excavator class (tonnes) | Minimum weight reduction required as percentage of lightest attachment in excavator class |
|---|---|---|---|
| 20 - 25 | 3.1 ± 3.8 | | |
| 30 - 36 | 4.6 ± 5.5 | 0.8 | 17% |

TABLE 1-continued

| Excavator weight class (tonnes) | Max attachment weight (6.5x multiplier) (tonnes) | Minimum attachment weight reduction to move into lighter excavator class (tonnes) | Minimum weight reduction required as percentage of lightest attachment in excavator class |
|---|---|---|---|
| 40 - 55 | 6.2 ± 8.5 | 0.7 | 11% |
| 65 - 80 | 10 ± 12.3 | 1.5 | 15% |
| 100 - 120 | 15.4 ± 18.5 | 3.1 | 20% |

TABLE 2

| Prior-Art gravity-only impact hammers: fixed drop height & hammer weight mass | Gravity hammer 1 DX900 | Gravity hammer 2 SS80 | Gravity hammer 3 DX1800 | Gravity hammer 4 SS150 |
|---|---|---|---|---|
| Overall hammer weight (including bracket), kg | 5500 | 9000 | 10500 | 13000 |
| Carrier weight, kg | 36,000 | 60,000 | 65,000 | 80,000 |
| Carrier cost, $ | 225,000 | 375,000 | 400,000 | 500,000 |
| Impact energy vertical, joules | 90,000 | 100,000 | 180,000 | 180,000 |
| Impact energy at 45°, joules | 52,376 | 58,196 | 104,753 | 104,753 |
| Energy/kg of carrier weight, joules per kilo | 2.5 | 1.7 | 2.8 | 2.3 |
| Work done per blow vertical (=Energy$^{1.3}$) | 2,757 | 3,162 | 6,790 | 6,790 |
| Work done per blow at 45° (=Energy$^{1.3}$) | 1,364 | 1,564 | 3,359 | 3,359 |
| Cycles per minute | 12 | 12 | 12 | 12 |
| Equivalent production tonnes per hour vertical | 65 | 75 | 161 | 161 |
| Equivalent production tonnes per hour at 45° | 32 | 37 | 80 | 80 |
| Carrier cost per tonne per hour of production, vertical | 3440 | 5000 | 2484 | 3105 |
| Carrier cost per tonne per hour of production, at 45° | 6954 | 10107 | 5021 | 6276 |

TABLE 3

| Vacuum Assisted Impact Hammers: fixed drop height & hammer weight mass | Vacuum hammer 1 XT1000 | Vacuum hammer 2 XT2000 | Vacuum hammer 3 XT4000 |
|---|---|---|---|
| Overall hammer weight (including bracket), kg | 3600 | 6000 | 11000 |
| Carrier weight, kg | 22,500 | 40,000 | 68,000 |
| Carrier cost, $ | 150,000 | 250,000 | 440,000 |
| Impact energy vertical, joules | 100,000 | 210,000 | 440,000 |
| Impact energy at 45°, joules | 95,317 | 200,165 | 419,394 |
| Energy/kg of carrier weight, joules per kilo | 4.4 | 5.3 | 6.5 |
| Work done per blow vertical (=Energy$^{1.3}$) | 3,162 | 8,296 | 21,701 |
| Work done per blow at 45° (=Energy$^{1.3}$) | 2,971 | 7,795 | 20,390 |
| Cycles per minute | 16 | 16 | 15 |
| Equivalent production tonnes per hour vertical | 100 | 262 | 643 |
| Equivalent production tonnes per hour at 45° | 94 | 246 | 604 |
| Carrier cost per tonne per hour of production, vertical | 1500 | 953 | 684 |
| Carrier cost per tonne per hour of production, at 45° | 1597 | 1014 | 728 |

TABLE 4

| Comparison: fixed impact hammer weight, vertical. | Gravity hammer 1 DX900 | Vacuum hammer 1 | Gravity hammer 2 SS80 | Vacuum hammer 2, | Gravity hammer 3, DX1800 | Vacuum hammer 3, | Gravity hammer 4 SS150 | Vacuum hammer 4, |
|---|---|---|---|---|---|---|---|---|
| Overall hammer weight incl bracket, kg | 5500 | 5500 | 9000 | 9000 | 10500 | 10500 | 13000 | 13000 |
| Carrier weight, kg | 36,000 | 36,000 | 60,000 | 60,000 | 65,000 | 65,000 | 80,000 | 80,000 |
| Carrier cost, $ | 225,000 | 225,000 | 450,000 | 450,000 | 450,000 | 450,000 | 600,000 | 600,000 |
| Impact energy vertical, joules | 90,000 | 185,000 | 100,000 | 360,000 | 180,000 | 410,000 | 180,000 | 550,000 |
| Impact energy at 45°, joules | 52,376 | 176,336 | 58,196 | 343,141 | 104,753 | 390,799 | 104,753 | 524,243 |
| Energy/kg of carrier weight, joules per kilo | 2.5 | 5.1 | 1.7 | 6.0 | 2.8 | 6.3 | 2.3 | 6.9 |
| Work done per blow vertical (Energy$^{1.3}$) | 2,757 | 7,036 | 3,162 | 16,718 | 6,790 | 19,798 | 6,790 | 29,005 |
| Work done per blow at 45° (Energy$^{1.3}$) | 1,364 | 6,611 | 1,564 | 15,708 | 3,359 | 18,601 | 3,359 | 27,252 |
| Cycles per minute | 12 | 20 | 12 | 18 | 12 | 18 | 12 | 17 |
| Equivalent production tonnes per hour vertical | 63 | 268 | 72 | 573 | 155 | 678 | 155 | 939 |

TABLE 4-continued

| Comparison: fixed impact hammer weight, vertical. | Gravity hammer 1 DX900 | Vacuum hammer 1 | Gravity hammer 2 SS80 | Vacuum hammer 2, | Gravity hammer 3, DX1800 | Vacuum hammer 3, | Gravity hammer 4 SS150 | Vacuum hammer 4, |
|---|---|---|---|---|---|---|---|---|
| Equivalent production tonnes per hour at 45° | 31 | 252 | 36 | 538 | 77 | 637 | 77 | 882 |
| Carrier cost per tonne per hour of production, vertical | 3571 | 840 | 6229 | 785 | 2901 | 663 | 3868 | 639 |
| Carrier cost per tonne per hour of production, at 45° | 7219 | 894 | 12590 | 836 | 5864 | 706 | 7818 | 680 |

TABLE 5

| Comparison: fixed impact hammer energy per blow, vertical. | Gravity hammer 1 DX900 | Vacuum hammer 5, | Gravity hammer 2 SS80 | Vacuum hammer 6, | Gravity hammer 3, DX1800 | Vacuum hammer 7, | Gravity hammer 4 SS150 | Vacuum hammer 8, |
|---|---|---|---|---|---|---|---|---|
| Overall hammer weight incl bracket, kg | 5500 | 3200 | 9000 | 3600 | 10500 | 5500 | 13000 | 5500 |
| Carrier weight, kg | 36,000 | 21,000 | 60,000 | 22,500 | 65,000 | 36,000 | 80,000 | 36,000 |
| Carrier cost, $ | 225,000 | 130,000 | 450,000 | 140,000 | 450,000 | 235,000 | 600,000 | 235,000 |
| Impact energy vertical, joules | 90,000 | 90,000 | 100,000 | 100,000 | 180,000 | 180,000 | 180,000 | 180,000 |
| Impact energy at 45° | 52,376 | 85,785 | 58,196 | 95,317 | 104,753 | 171,570 | 104,753 | 171,570 |
| Energy/kg of carrier weight, joules per kilo | 2.5 | 4.3 | 1.7 | 4.4 | 2.8 | 5.0 | 2.3 | 5.0 |
| Work done per blow vertical (energy$^{1.3}$) | 2,757 | 2,757 | 3,162 | 3,162 | 6,790 | 6,790 | 6,790 | 6,790 |
| Work done per blow at 45° (energy$^{1.3}$) | 1,364 | 2,591 | 1,564 | 2,971 | 3,359 | 6,379 | 3,359 | 6,379 |
| Cycles per minute | 12 | 20 | 12 | 20 | 12 | 20 | 12 | 20 |
| Equivalent production tonnes per hour vertical | 63 | 105 | 72 | 120 | 155 | 259 | 155 | 259 |
| Equivalent production tonnes per hour at 45° | 31 | 99 | 36 | 113 | 77 | 243 | 77 | 243 |
| Carrier cost per tonne per hour of production, vertical | 3571 | 1238 | 6229 | 1163 | 2901 | 909 | 3868 | 909 |
| Carrier cost per tonne per hour of production, at 45° | 7219 | 1318 | 12590 | 1237 | 5864 | 967 | 7818 | 967 |

TABLE 6

| Comparison: fixed productivity, vertical | Gravity hammer 1 DX900 | Vacuum hammer 9, | Gravity hammer 2 SS80 | Vacuum hammer 10, | Gravity hammer 3, DX1800 | Vacuum hammer 11, | Gravity hammer 4 SS150 | Vacuum hammer 12, |
|---|---|---|---|---|---|---|---|---|
| Overall hammer weight (inc. bracket), kg | 5500 | 2300 | 9000 | 2500 | 10500 | 3900 | 13000 | 3900 |
| Carrier weight, kg | 36,000 | 15,000 | 60,000 | 16,000 | 65,000 | 25,500 | 80,000 | 25,500 |
| Carrier cost, $ | 225,000 | 90,000 | 450,000 | 100,000 | 450,000 | 160,000 | 600,000 | 160,000 |
| Impact energy vertical, joules | 90,000 | 61,000 | 100,000 | 67,000 | 180,000 | 121,500 | 180,000 | 121,500 |
| Impact energy at 45°, joules | 52,376 | 58,143 | 58,196 | 63,862 | 104,753 | 115,810 | 104,753 | 115,810 |
| Energy/kg of carrier weight, joules per kilo | 2.5 | 4.1 | 1.7 | 4.2 | 2.8 | 4.8 | 2.3 | 4.8 |
| Work done per blow vertical (energy$^{1.3}$) | 2,757 | 1,663 | 3,162 | 1,879 | 6,790 | 4,073 | 6,790 | 4,073 |
| Work done per blow at 45° (Energy$^{1.3}$) | 1,364 | 1,563 | 1,564 | 1,765 | 3,359 | 3,827 | 3,359 | 3,827 |
| Cycles per minute | 12 | 20 | 12 | 20 | 12 | 20 | 12 | 20 |
| Equivalent production tonnes per hour vertical | 63 | 63 | 72 | 72 | 155 | 155 | 155 | 155 |
| Equivalent production tonnes per hour at 45° | 31 | 60 | 36 | 67 | 77 | 146 | 77 | 146 |
| Carrier cost per tonne per hour of production, vertical | 3571 | 1421 | 6229 | 1398 | 2901 | 1032 | 3868 | 1032 |
| Carrier cost per tonne per hour of production, at 45° | 7219 | 1513 | 12590 | 1488 | 5864 | 1098 | 7818 | 1098 |

TABLE 7

| Excavator weight | Impact Energy (Joules) Vertical impact axis | | | | |
|---|---|---|---|---|---|
| class (tonnes) | 90,000 | 100,000 | 180,000 | 210,000 | 400,000 |
| 20 - 25 | | XT 1000 (22.5T) | | | |
| 30 - 36 | DX900 (36T) | | | | |
| 40 - 55 | | | | XT2000 (40T) | |

TABLE 7-continued

| Excavator weight | Impact Energy (Joules) Vertical impact axis | | | | |
|---|---|---|---|---|---|
| class (tonnes) | 90,000 | 100,000 | 180,000 | 210,000 | 400,000 |
| 65 - 80 | | (SS80 60T) | DX1800 (65T) SS150 (80T) | | XT 4000 (80T) |
| 100 - 120 | | | | | |

TABLE 8

| | Gravity-only impact hammer | vacuum-assisted impact hammer | % difference |
|---|---|---|---|
| vertical impact axis: | | | |
| Hammer weight, kg | 1,000 | 330 | |
| drop height, m | 3 | 3 | |
| Energy from weight, Joules; kg × drop × 10 | 30,000 | 10,000 | |
| Vacuum assistance, kg | ~ | 670 | |
| Vacuum stroke length | ~ | 3 | |
| Energy from vacuum, Joules; kg × stroke × 10 | ~ | 20,000 | |
| Theoretical energy total, Joules | 30,000 | 30,000 | |
| Friction losses | 3,000 | 1,000 | |
| Air displacement losses | 1,500 | 600 | |
| Total losses Joules | 4,500 | 1,600 | |
| Net energy after losses, Joules | 25,500 | 28,400 | 111% |
| Work done, = net energy$^{1.3}$ | 535,183 | 615,622 | 115% |
| 45° impact axis | | | |
| Hammer weight, kg | 1,000 | 330 | |
| drop height, m | 2.12 | 2.12 | |
| Energy from weight, Joules; kg × drop × 10 | 21,200 | 27,070 | |
| Vacuum assistance, kg | ~ | 670 | |
| Vacuum stroke length | ~ | 3 | |
| Energy from vacuum, Joules; kg × stroke × 10 | ~ | 20,000 | |
| Theoretical energy total, Joules | 21,200 | 27,070 | |
| Friction losses | 5,300 | 1,750 | |
| Air displacement losses | 1,060 | 600 | |
| Total losses Joules | 6,360 | 2,350 | |
| Net energy after losses, Joules | 14,840 | 24,720 | 167% |
| Work done, = net energy$^{1.3}$ | 264,767 | 514,000 | 194% |

TABLE 9

| Impact Hammer type | Gravity-only | Vacuum-Assisted |
|---|---|---|
| Stopping Distance (mm) | | |
| from 1 $ms^{-1}$ | 50 | 0.02 |
| from 2 $ms^{-1}$ | 190 | 0.07 |
| from 3 $ms^{-1}$ | 420 | 0.15 |
| from 4 $ms^{-1}$ | 740 | 0.27 |
| from 5m/sec | | 0.42 |

TABLE 9-continued

| Impact Hammer type | Gravity-only | Vacuum-Assisted |
|---|---|---|
| Stopping time (s) | | |
| from 1 $ms^{-1}$ | 0.09 | 0.034 |
| from 2 $ms^{-1}$ | 0.19 | 0.068 |
| from 3 $ms^{-1}$ | 0.28 | 0.102 |
| from 4 $ms^{-1}$ | 0.37 | 0.136 |
| from 5m/sec | | 0.170 |
| Lift time for 5m stroke at 3 $ms^{-1}$ (s) | 1.53 | |
| Lift time for 5m stroke at 5 $ms^{-1}$ (s) | | 0.92 |
| Drop time for 5m stroke (s) | 1.06 | 0.59 |
| Dwell and acceleration at bottom (s) | 0.4 | 0.4 |
| Minimum practical cycle time (s) | 3.44 | 1.91 |

TABLE 10

| Excavator weight class (tonnes) | Max attachment weight (6.5x multiplier) (tonnes) | Attachment weight reduction to move into lighter excavator class (tonnes) | weight reduction as percentage of heaviest in prior excavator class |
|---|---|---|---|
| 20 - 25 | 3.07 - 3.84 | | |
| 30 - 36 | 4.62 - 5.54 | 2.47 | 44.6% |
| 40 - 55 | 6.15 - 8.46 | 3.84 | 45.4% |
| 65 - 80 | 10 - 12.31 | 6.16 | 50.0% |
| 100 - 120 | 15.38 - 18.46 | 8.46 | 45.8% |

TABLE 11

| Comparison: Similar productivity, tonnes per hour. | Vacuum hammer XT1200 | Gravity hammer DX1800 | Gravity hammer SS150 |
|---|---|---|---|
| Overall impact hammer weight including bracket | 3900 | 10500 | 13000 |
| Carrier weight | 25,500 | 65,000 | 80,000 |
| Carrier cost | 160,000 | 450,000 | 600,000 |
| Impact energy vertical joules | 120,000 | 180,000 | 180,000 |
| Impact energy at 45° joules | 114,380 | 104,753 | 104,753 |
| Energy/kg of carrier weight | 4.7 | 2.8 | 2.3 |
| Work done per blow vertical (Energy$^{1.3}$) | 4,008 | 6,790 | 6,790 |
| Work done per blow at 45° | 3,766 | 3,359 | 3,359 |
| Cycles per minute | 20 | 12 | 12 |
| Equivalent production tonnes per hour vertical | 152 | 155 | 155 |
| Equivalent production tonnes per hour at 45° | 143 | 77 | 77 |

TABLE 12

| Comparison: Fixed head-height available for working, and fixed weight of impact hammer. | Vacuum hammer 3m stroke vertical | Vacuum hammer 4.24m stroke 45° | Gravity hammer 2m stroke, vertical | Gravity hammer 2.82m stroke, 45° |
|---|---|---|---|---|
| Overall impact hammer weight including bracket | 6000 | 6000 | 6000 | 6000 |
| Carrier weight | 40,000 | 40,000 | 40,000 | 40,000 |
| Drop height of weight | 3.0 | 4.24 | 2.0 | 2.82 |
| Mass of drop weight | 1,000 | 1,000 | 2,000 | 2,000 |
| Effect of vacuum (tonnes force) | 3,000 | 3,000 | 0 | 0 |
| Effect of angle (on drop weight only, not vacuum) | 0 | 0.71 | 0 | 0.71 |
| Effect of friction and air bypass | 0.9 | 0.9 | 0.85 | 0.82 |
| Impact energy joules | 105,948 | 138,509 | 33,354 | 32,212 |

TABLE 12-continued

| Comparison: Fixed head-height available for working, and fixed weight of impact hammer. | Vacuum hammer 3m stroke vertical | Vacuum hammer 4.24m stroke 45° | Gravity hammer 2m stroke, vertical | Gravity hammer 2.82m stroke, 45° |
|---|---|---|---|---|
| Work done per blow (Energy1.3) | 3,409 | 4,830 | 759 | 725 |
| Cycles per minute | 20 | 16 | 15 | 12 |
| Equivalent production tonnes per hour | 129 | 147 | 22 | 17 |

TABLE 13

| Comparison: Similar impact hammer weight and carrier weight. | Vacuum hammer XT2000 | Gravity hammer DX900 |
|---|---|---|
| Overall impact hammer weight | 6000 | 5500 |
| Carrier weight | 40,000 | 36,000 |
| Carrier cost | 250,000 | 225,000 |
| Impact energy vertical joules | 210,000 | 90,000 |
| Impact energy at 45° joules | 200,165 | 52,376 |
| Energy/kg of carrier weight | 5.3 | 2.5 |

TABLE 13-continued

| Comparison: Similar impact hammer weight and carrier weight. | Vacuum hammer XT2000 | Gravity hammer DX900 |
|---|---|---|
| Work done per blow vertical (Energy$^{1.3}$) | 8,296 | 2,757 |
| Work done per blow at 45° | 7,795 | 1,364 |
| Cycles per minute | 20 | 12 |
| Equivalent production tonnes per hour vertical | 315 | 63 |
| Equivalent production tonnes per hour at 45° | 296 | 31 |

TABLE 14

| Accumulator performance variables | | |
|---|---|---|
| System Requirements | Accumulator configuration | comment |
| Very low pressure gain of accumulator working gas in first fluid chamber (3-8) | Large volume of accumulator relative to working volume | provides most constant power output |
| High pressure systems | Area of third piston face (3-13) is smaller than area of first piston face (3-9) | Volume of first fluid chamber (3-8) needs to be large |
| Low pressure systems | Are of third piston face (3-13) is similar to area of first piston face (3-9) | |
| Long period to charge accumulator with unutilised capacity (i.e. long scavenge period) | Large working gas volume in first fluid chamber (3-8) can be at low pressure or excess can be dumped | Typical reciprocating cylinder application where return speeds need to be constrained - produces maximum power gain |
| short period to charge accumulator with unutilised capacity (i.e. short scavenge period) | small working gas volume in first fluid chamber (3-8) at high pressure | Typical regeneration circuit for an excavator or the like |
| Large difference between scavenge pressure and pump pressure | Large working volume, can be at low pressure or excess can be dumped | Maximum power gain |
| Small additional power requirement | Second piston face (3-12) can be small relative to third piston face (3-13) with a short stroke | Accumulator is small and economical |
| Large additional power requirement | Third fluid chamber (3-11) must be large, scavenge time must be long with low pressure requirement, area of second piston face (3-12) small relative to area of third piston face (3-13) | Large power gain—high benefit from accumulator |
| Power delivered mainly as extra hydraulic fluid flow | A large third fluid chamber (3-11) and a small second piston face (3-12) area relative to area of third piston face (3-13) | Needs long scavenge time |
| Power delivered mainly as extra pressure | Area of second and third piston face as large as possible | |

The invention claimed is:

1. An impact hammer for breaking a working surface, the impact hammer comprising:

a housing with at least one inner side wall forming at least part of a containment surface;

a drive mechanism;

a reciprocating hammer weight, at least partially located within the housing, with the reciprocating hammer weight capable of reciprocating along a reciprocation axis, wherein a reciprocation cycle of the reciprocating hammer weight, when the reciprocation axis is on an approximately vertical axis, comprises:

a) an up-stroke, during which the drive mechanism moves the reciprocating hammer weight upwards along the reciprocation axis; and b) a down-stroke, during which the reciprocating hammer weight moves downwards along the reciprocation axis;

a striker pin having a driven end and a working surface impact end, the striker pin located within the housing such that the working surface impact end protrudes from the housing;

a shock-absorber coupled to the striker pin; and a variable volume vacuum chamber comprising:

a) at least a portion of the containment surface;

b) at least one upper vacuum sealing coupled to the reciprocating hammer weight;

c) at least one lower vacuum sealing; and at least one down-stroke vent, operable to permit fluid egress from the variable volume vacuum chamber during at least part of the down-stroke;

wherein the variable volume vacuum chamber is configured to have a sub-atmospheric pressure during at least part of the up-stroke such that the reciprocating hammer weight is driven toward the striker pin by a pressure differential between an atmosphere and the sub-atmospheric pressure during the down-stroke, and wherein the reciprocating hammer weight is fitted with at least one composite cushioning slide on an exterior surface of the reciprocating hammer weight, the at least one cushioning slide comprising:

an exterior first layer, formed with a first layer exterior surface configured and oriented to come into at least partial sliding contact with the containment surface during a reciprocating movement of the reciprocating hammer weight, and an interior second layer, located between the exterior first layer and the reciprocating hammer weight, the interior second layer at least partially formed from a shock-absorbing material, wherein the first layer exterior surface is a lower-friction surface than the interior second layer, the exterior first layer being formed from a material of predetermined friction and abrasion resistance properties, and wherein the at least one upper vacuum sealing is at least partially provided directly by the at least one composite cushioning slide.

2. The impact hammer of claim 1, comprising multiple composite cushioning slides, wherein the at least one upper vacuum sealing is at least partially provided directly by at least one of said multiple composite cushioning slides.

3. The impact hammer of claim 1, wherein the interior second layer forms a preload biasing the exterior first layer into contact with the containment surface.

4. The impact hammer as claimed in claim 1, wherein the upper vacuum sealing forms at least one substantially uninterrupted sealing laterally encompassing the hammer weight.

5. The impact hammer of claim 1, wherein the at least one down-stroke vent is operable to at least restrict fluid ingress into the variable volume vacuum chamber during at least part of the up-stroke.

6. The impact hammer of claim 1, wherein the at least one down-stroke vent comprises at least one aperture in the containment surface.

7. The impact hammer of claim 1, wherein the at least one down-stroke vent is formed in the containment surface.

8. The impact hammer of claim 1, further comprising multiple down-stroke vents, comprising at least one formed down-stroke vent formed in at least two of: (a) the containment surface, (b) the at least one lower vacuum sealing; (c) the reciprocating hammer weight, and (d) the at least one upper vacuum sealing.

9. The impact hammer as claimed in claim 1, wherein a vacuum pump is connected to the vent.

10. The impact hammer of claim 1, wherein the at least one down-stroke vent comprises a valve.

11. The impact hammer of claim 1, wherein the reciprocating hammer weight impacts directly on the driven end of the striker pin during at least a part of the down-stroke.

12. The impact hammer as claimed in claim 1, comprising a nose block formed from a portion of the housing and at least partially enclosing the striker pin and comprising nose block elements comprising:

a cap plate;

a upper shock absorbing assembly;

a retainer;

a lower shock absorbing assembly;

a nose cone;

positioned substantially about the striker pin between the striker pin driven end and the impact end in the preceding sequence with respect to the impact axis, and wherein the lower vacuum sealing comprises one or more seals located in the nose block.

13. The impact hammer of claim 12, wherein the one or more seals in the nose block are located between at least one of the:

cap plate and the striker pin;

upper shock absorbing assembly and the striker pin;

retainer and the striker pin;

retainer and a nose block inner side wall;

lower shock absorbing assembly and the striker pin;

nose cone and the striker pin.

14. The impact hammer of claim 13, wherein the lower vacuum sealing comprises seals located in at least one shock absorbing assembly.

15. The impact hammer of claim 14, wherein the shock-absorbers are coupled to the striker pin by the retainer, the retainer being interposed between the shock-absorbing assemblies, wherein at least the lower shock-absorbing assembly is formed from a plurality of un-bonded layers including at least two elastic layers interleaved by an inelastic layer, wherein the lower vacuum sealing comprises one or more seals located in the lower shock absorbing assembly between a said elastic layer and the striker pin.

16. The impact hammer of claim 12, wherein the at least one lower vacuum sealing comprises one or more seals formed as individual independent layers laterally encircling the striker pin.

17. The impact hammer as claimed in claim 12, wherein the lower vacuum sealing seals include an elastic or inelastic material, biased into contact with the striker pin by a preload.

18. The impact hammer of claim 1, wherein the variable volume vacuum chamber forms an atmospheric up-stroke brake applying the pressure differential to a movement of the reciprocating hammer weight over an un-driven portion of the up-stroke to decelerate the reciprocating hammer weight up-stroke movement.

19. The impact hammer of claim 1, wherein the reciprocating hammer weight comprises:

a lower impact face, at least a portion of the lower impact face forming a vacuum piston face, wherein the vacuum piston face is movable along a path parallel to, or co-axial to, the reciprocation path and the vacuum piston face comprises a hammer weight impact surface for impacting the driven end of the striker pin during at least a part of the down-stroke;

an upper face; and at least one side face, wherein at least a portion of an upper face of the reciprocating hammer weight is open to the atmosphere.

20. A method of operating an impact hammer having (a) a drive mechanism, (b) a housing, (c) a variable volume vacuum chamber, (d) a reciprocating hammer weight, at least partially located within the housing and capable of reciprocating along a reciprocation axis, (e) a striker pin having a striker pin longitudinal axis extending between a driven end of the striker pin and a working surface impact end of the striker pin, (f) a nose block formed from a portion of the housing and positioned substantially about the striker pin between the driven end and the working surface impact end with respect to an impact axis that is coaxial or parallel to the reciprocation axis, wherein the reciprocating hammer weight is fitted with at least one composite cushioning slide on an exterior surface of the reciprocating hammer weight, the at least one cushioning slide comprising:

an exterior first layer, formed with a first layer exterior surface configured and oriented to come into at least partial sliding contact with the containment surface during a reciprocating movement of the reciprocating hammer weight, and an interior second layer, located between the exterior first layer and the reciprocating hammer weight, the interior second layer at least partially formed from a shock-absorbing material, wherein the first layer exterior surface is a lower-friction surface than the interior second layer, the exterior first layer being formed from a material of predetermined friction and abrasion resistance properties, and wherein the at least one upper vacuum sealing is at least partially provided directly by the at least one composite cushioning slide, and wherein the striker pin is located within the housing such that the working surface impact end protrudes from the housing and wherein the striker pin is positioned to move substantially along a linear impact axis that is coaxial or parallel to the striker pin longitudinal axis and coaxial or parallel to the reciprocation axis, the method comprising:

a) contacting the working surface impact end of the striker pin to a working surface to be broken;

b) operating the drive mechanism to begin lifting the reciprocating hammer weight such that a volume of the variable volume vacuum chamber increases and a pressure differential between an atmosphere and the variable volume vacuum chamber is created;

c) causing an up-stroke stage, in which the reciprocating hammer weight is moved along the reciprocation axis for a distance equal to a hammer weight up-stroke length from a lower start initial position with a minimum hammer weight potential energy to an upper position at an upper distal end of the housing with a maximum hammer weight potential energy;

d) causing an upper stroke transition, in which hammer weight movement halts before reversing direction along the reciprocation axis;

e) releasing the reciprocating hammer weight, wherein the pressure differential acting on the reciprocating hammer weight drives the reciprocating hammer weight toward the driven end of the striker pin, and wherein the reciprocating hammer weight moves back along the reciprocation axis for a distance equal to a hammer weight down-stroke length from the upper position to the lower start initial position;

f) transmitting an impact force from the striker pin to the working surface to be broken; and g) repeating steps a) through f).

* * * * *